US006786070B1

(12) United States Patent
Dimig et al.

(10) Patent No.: US 6,786,070 B1
(45) Date of Patent: Sep. 7, 2004

(54) LATCH APPARATUS AND METHOD

(75) Inventors: Steven J. Dimig, Plymouth, WI (US); James Edgar, Shorewood, WI (US)

(73) Assignee: Sirattec Security Corporation, Milwaukee, WI (US)

( * ) Notice: Subject to any disclaimer, the term of this patent is extended or adjusted under 35 U.S.C. 154(b) by 0 days.

(21) Appl. No.: 09/571,340

(22) Filed: May 16, 2000

Related U.S. Application Data

(63) Continuation-in-part of application No. 09/522,158, filed on Mar. 9, 2000, now Pat. No. 6,705,140, which is a continuation-in-part of application No. 09/408,993, filed on Sep. 29, 1999, which is a continuation-in-part of application No. 09/263,415, filed on Mar. 5, 1999, now Pat. No. 6,463,773.

(51) Int. Cl.[7] ..... E05B 47/00

(52) U.S. Cl. ..... 70/277; 70/218; 292/201; 292/216; 292/DIG. 27

(58) Field of Search ..... 70/278.6, 278.7, 70/277, 237, 264; 292/201, 216, DIG. 23, DIG. 26, DIG. 27

(56) References Cited

U.S. PATENT DOCUMENTS

| | | | | |
|---|---|---|---|---|
| 1,611,838 | A | 12/1926 | Malicki | |
| 2,802,357 | A | 8/1957 | Smith | 70/283 |
| 2,910,859 | A | 11/1959 | Allen et al. | 70/135 |
| 2,955,864 | A | 10/1960 | Van Voorhes | |
| 3,121,580 | A | 2/1964 | Di Salvo et al. | |
| 3,563,589 | A | 2/1971 | Kwasiborski, Jr. | |
| 3,767,242 | A | 10/1973 | Quantz | 292/216 |
| 3,889,501 | A | 6/1975 | Fort | 70/283 |
| 4,056,276 | A | 11/1977 | Jarvis | 292/201 |
| 4,097,077 | A | 6/1978 | Gahrs | |
| 4,289,342 | A | 9/1981 | Bemm et al. | |
| 4,386,798 | A | 6/1983 | Menard | |
| 4,518,180 | A | 5/1985 | Kleefeldt et al. | 292/201 |
| 4,617,812 | A | 10/1986 | Rogers | 70/218 |
| 4,637,239 | A | 1/1987 | Kleefeldt et al. | 70/264 |
| 4,656,850 | A | 4/1987 | Tabata | 70/276 |
| 4,824,152 | A | 4/1989 | Jeavons | 292/216 |

(List continued on next page.)

FOREIGN PATENT DOCUMENTS

| | | |
|---|---|---|
| DE | 355578 | 6/1922 |
| DE | 538812 | 11/1929 |
| DE | 685943 | 12/1939 |
| DE | 4129706 | 3/1993 |
| DE | 19527565 | 1/1997 |

(List continued on next page.)

*Primary Examiner*—Lloyd A. Gall
(74) *Attorney, Agent, or Firm*—Michael Best & Friedrich LLP

(57) ABSTRACT

A latch assembly having at least one control element having a first path of motion in which a ratchet is moved to an unlatched position and a second path of motion in which the ratchet is not so moved, the path of motion taken by the control element dependent upon whether an engagement element is engaged with the control element or disengaged therefrom. Preferably, the control element moves the ratchet by contact with a pawl which itself can be engaged with the ratchet. In a preferred embodiment of the present invention, the control element can be partially or fully actuated through its second path of motion while still being engagable with its engagement element. If already partially or fully actuated through its second path of motion, the engagement element is preferably movable into contact with the control element and can move the control element to its first path of motion. The latch assembly can have a second control element also having first and second paths of motion determined at least partially upon whether an engagement element is engaged with the second control element or disengaged therefrom. The second control element can be connected to the first engagement element to move the first engagement element into and out of engagement with the first control element when the second control element is actuated in its engaged state.

14 Claims, 59 Drawing Sheets

U.S. PATENT DOCUMENTS

| | | | | | |
|---|---|---|---|---|---|
| 4,887,390 | A | | 12/1989 | Boyko et al. | 49/214 |
| 4,948,183 | A | | 8/1990 | Yamada | 292/199 |
| 4,986,098 | A | | 1/1991 | Fisher | 70/262 |
| 4,995,248 | A | | 2/1991 | Liu | 70/107 |
| 5,029,915 | A | | 7/1991 | Wilkes | 292/336.3 |
| 5,037,145 | A | | 8/1991 | Wilkes | 292/201 |
| 5,046,377 | A | | 9/1991 | Wilkes et al. | 74/431 |
| 5,074,603 | A | | 12/1991 | Brackmann | 292/216 |
| 5,142,890 | A | | 9/1992 | Uyeda et al. | 70/277 |
| 5,236,234 | A | | 8/1993 | Norman | 292/201 |
| 5,307,656 | A | | 5/1994 | Gartner et al. | 70/277 |
| 5,308,128 | A | | 5/1994 | Portelli et al. | |
| 5,350,206 | A | | 9/1994 | Akahori et al. | 292/336.3 |
| 5,423,582 | A | | 6/1995 | Kleefeldt | 292/201 |
| 5,531,488 | A | | 7/1996 | Yoshikuwa et al. | 292/216 |
| 5,538,298 | A | * | 7/1996 | Ikeda | 292/DIG. 23 X |
| 5,547,208 | A | | 8/1996 | Chappell et al. | 180/281 |
| 5,561,997 | A | | 10/1996 | Milman | 70/283 |
| 5,577,782 | A | | 11/1996 | Johnson et al. | 292/216 |
| 5,603,539 | A | | 2/1997 | Gruhn et al. | 292/216 |
| 5,636,880 | A | | 6/1997 | Miller et al. | 292/144 |
| 5,667,260 | A | * | 9/1997 | Weyerstall | 292/201 |
| 5,676,003 | A | | 10/1997 | Ursel et al. | |
| 5,697,236 | A | | 12/1997 | Kleefeldt et al. | |
| 5,722,272 | A | | 3/1998 | Bridgeman et al. | 70/264 |
| 5,727,825 | A | | 3/1998 | Spurr | 292/341.12 |
| 5,732,988 | A | | 3/1998 | Mizuki | 292/201 |
| 5,758,912 | A | | 6/1998 | Hamada | 292/216 |
| 5,765,884 | A | | 6/1998 | Armbruster | |
| 5,769,468 | A | | 6/1998 | Armbruster | 292/201 |
| 5,785,364 | A | | 7/1998 | Kleefeldt et al. | 292/201 |
| 5,803,515 | A | | 9/1998 | Arabia, Jr. et al. | |
| 5,844,470 | A | | 12/1998 | Garnault et al. | |
| 5,881,589 | A | | 3/1999 | Clark et al. | |
| 5,887,466 | A | * | 3/1999 | Yoshizawa | 292/201 X |
| 5,901,991 | A | | 5/1999 | Hugel et al. | 292/201 |
| 5,921,594 | A | | 7/1999 | Bendel | 292/216 |
| 5,921,595 | A | | 7/1999 | Brackmann et al. | 292/216 |
| 5,931,034 | A | | 8/1999 | Fisher | |
| 5,992,194 | A | * | 11/1999 | Baukholt et al. | 292/201 X |
| 6,050,620 | A | | 4/2000 | Rogers, Jr. et al. | |
| 6,062,613 | A | | 5/2000 | Jung et al. | |
| 6,079,237 | A | | 6/2000 | Hochart | |
| 6,112,564 | A | * | 9/2000 | Rathmann et al. | 70/279.1 |
| 6,126,212 | A | | 10/2000 | Fujihara | |
| 6,148,651 | A | | 11/2000 | Roncin | |
| 6,168,215 | B1 | | 1/2001 | Kodama et al. | |
| 6,254,148 | B1 | * | 7/2001 | Cetnar | 292/201 |
| 6,279,361 | B1 | * | 8/2001 | Baukholt et al. | 292/201 X |
| 6,286,878 | B1 | | 9/2001 | Hochart et al. | |
| 6,338,508 | B1 | | 1/2002 | Kleefeldt | |

FOREIGN PATENT DOCUMENTS

| | | | |
|---|---|---|---|
| DE | 19547727 | * | 6/1997 |
| DE | 29701390 | | 11/1997 |
| EP | 0169644 | | 1/1986 |
| EP | 285412 | | 5/1988 |
| EP | 0694665 | | 1/1996 |
| EP | 0743413 | | 11/1996 |
| FR | 2746840 | | 10/1997 |
| GB | 5427 | | 3/1911 |
| GB | 1563368 | | 3/1980 |
| GB | 2034801 | | 6/1980 |
| IT | 413637 | | 5/1946 |
| WO | WO90/05822 | | 5/1990 |
| WO | WO00/20710 | | 4/2000 |

* cited by examiner

LATCH APPARATUS AND METHOD

FIELD OF THE INVENTION

This is a continuation-in-part of U.S. patent application Ser. No. 09/522,158, filed on Mar. 9, 2000 now U.S. Pat. No. 6,705,140, which is a continuation-in-part of U.S. patent application Ser. No. 09/408,993, filed on Sep. 29, 1999, which is a continuation-in-part of U.S. patent application Ser. No. 09/263,415, filed on Mar. 5, 1999 now U.S. Pat. No. 6,463,773.

BACKGROUND OF THE INVENTION

Conventional latches are used to restrain the movement of one member or element with respect to another. For example, conventional door latches restrain the movement of a door with respect to a surrounding door frame. The function of such latches is to hold the door secure within the frame until the latch is released and the door is free to open. Existing latches typically have mechanical connections linking the latch to actuation elements such as handles which can be actuated by a user to release the latch. Movement of the actuation elements is transferred through the mechanical connections and will cause the latch to release, The mechanical connections can be one or more rods, cables, or other suitable elements or devices. Although the following discussion is with reference to door latches (e.g., especially for vehicle doors) for purposes of example and discussion only, the background information provided applies equally to a wide variety of latches used in other applications.

Most current vehicle door latches contain a restraint mechanism for preventing the release of the latch without proper authorization. When in a locked state, the restraint mechanism blocks or impedes the mechanical connection between a user-operable handle (or other door opening device) and a latch release mechanism, thereby locking the door. Many conventional door latches also have two or more lock states, such as unlocked, locked, child locked, and dead locked states. Inputs to the latch for controlling the lock states of the latch can be mechanical, electrical, or parallel mechanical and electrical inputs. For example, by the turn of a user's key, a cylinder lock can mechanically move the restraint mechanism, thereby unlocking the latch. As another example, cable or rod elements connecting a door handle to the latch release mechanism can be controlled by one or more electrical power actuators. These actuators, sometimes called "power locks" can use electrical motors or solenoids as the force generator to change between locked and unlocked states.

A number of problems exist, however, in the conventional door latches described above. For example, conventional restraint mechanisms in such latches are typically quite complex, with numerous parts often having relatively complicated movements. Such latches are thus more expensive to manufacture, assemble, maintain, and repair. This problem is compounded in latches having multiple lock states as mentioned above. These latches often require separate sets of elements corresponding to and controlling each lock state of the latch.

In addition, because conventional door latches are typically relatively complex (especially latches having multiple lock states), the ability of a latch design to be used in diverse applications suffers significantly. For example, many conventional door latches are suitable for installation in a particular door, but cannot readily be installed in other door designs. As another At example, door latch applications in which only limited latching functions are needed generally call for a different door latch than door latch applications in which full latching functions are needed. Conventional door latches are far from being "universal" (capable of installation in a number of different applications and easily adaptable to applications varying in functionality). Therefore, it is often necessary for a manufacturer, installer, or servicer of door latches to keep a wide variety of different door latches in inventory—an expensive and inefficient practice.

Space and location constraints for door latches varies significantly from application to application. In some applications for example, connecting rods are used to mechanically link door handles or user-operable lock buttons to the latch, while in other applications bowden cables are more suitable. As used herein and in the appended claims, the terms "user-operable", "user-actuatable", and the like include direct and indirect user operation and actuation. Therefore, devices or elements described in such manner include those that are operated upon or actuated indirectly by a user in some manner (e.g., via electronic actuation, mechanical linkage, and the like), and are not necessarily limited to devices or elements intended for direct contact and manipulation by a user in normal operations of the latch.

The latch space and location constraints mentioned above can also require latch connections to be made only from certain sides or the latch or only at certain angles with respect to portions of the latch. Conventional latch manufacturers address such problems by providing specialized latches for specific applications or groups of applications. Once again, this solution requires a manufacturer, installer, or servicer of door latches to incur the expense of keeping a wide variety of different door latches in inventory.

For obvious reasons, increased latch complexity also has a significant impact upon assembly and repair cost. Conventional door latches are generally difficult to assemble and require a significant amount of assembly time. An assembler must often orient the latch assembly in several directions during the assembly process (i.e., flip the latch over or turn the latch repeatedly). Also, the large number of small and intricate parts typically used in conventional door latches adds to assembly cost. Particularly in light of the specialized nature, function, and redundancy of many door latch parts, conventional door latches designs are far from being optimized.

Problems of latch weight and size are related to the problem of latch complexity. The inclusion of more elements and more complex mechanisms within the latch generally undesirably increases the size and weight of the latch. In virtually all vehicle applications, weight and size of any component is a concern. Additionally, increased weight and size of elements and assemblies within the latch necessarily requires more power and greater force to operate the latch. Because power is also at a premium in many applications (especially in vehicular applications), numerous elements and complex assemblies within conventional door latches are an inefficiency that is often wrongly ignored. Not only are larger and more complex latches a power drain, but such latches are typically unnecessarily slow.

Latch operating speed continues to be important to the latch design viability, particularly with the increasingly common use of electromechanical assemblies in many latch applications. The time required to perform each latch operation has been reduced to well under one second in vehicular applications, and significant advantages exist for reducing such time even further. Specifically, it is most desirable to reduce the amount of time to change the state of a latch, such as from a locked state to an unlocked state, from a child-locked state to an unlocked state, etc. Although numerous conventional mechanisms exist for accelerating latch state changes, the speed at which such changes are performed remains far from optimal. This is due at least in part to the incremental improvement of conventional mechanical assemblies in lieu of using significantly different mechanisms and devices for changing latch states. Also, compact actuation devices capable of very rapidly and significantly changing the state of a mechanical assembly are not common. Such actuation devices that do exist are often not suitable for use in mechanical devices having moving and inertial forces that are significantly larger than the actuation device itself (as is the case with many types of latches).

Another problem with conventional door latches relates to their operation. Particularly where a latch has multiple lock states, the ability of a user to easily and fully control the latch in its various lock states is quite limited. For example, many latches having a child locked state (i.e., the inside door handle is disabled but the outside door handle is not) require a user to manually set the child locked state by manipulating a lever or other device on the latch. Other latches do not permit the door to enter a dead locked state (i.e., both the inside and outside door handles being disabled). Also, conventional door latches generally do not permit a user to place the door latch in all lock states remotely, such as by a button or buttons on a key fob. These examples are only some of the shortcomings in existing door latch operability.

Still another problem of conventional door latches is related to power locks. The design of existing power lock systems has until now significantly limited the safety of the latch. Latch design limitations exist in conventional latches to ensure, for example, that dead locked latches operated by powered devices or systems will reliably unlock in the event of power interruption or failure. Such limitations have resulted in latch designs which permit less than optimal user operability. Although manual overrides for conventional door latches do exist, these overrides typically add a significant amount of complexity to the door latch and are difficult to install and assemble. Therefore, a reliable design having a failure mode and a simple manual override for an electrically powered latch which is electrically actuatable in all locked states remains an elusive goal.

In conventional door latches, yet another problem is caused by the fact that an unauthorized user can often manipulate the restraint mechanism within the latch and/or the connections of the latch to the door locks to unlock the latch. Because conventional door latches typically have at least some type of mechanical linkage from the user-operable elements (e.g., lock cylinders) to the restraint mechanism in the latch, the ability of an unauthorized user to unlock the latch as just described has been a persistent problem. Many existing door latches have multiple paths through which force is transmitted from a user-operable device to the restraint mechanism in the latch. For example, where the restraint mechanism is a ratchet selectively held in a locked position by a movable pawl, conventional door latches have multiple direct and/or indirect connections to the pawl from multiple user-operable devices. Each such connection added to a latch assembly provides another latch input that is subject to manipulation by an unauthorized user to unlock the latch. Although multiple connections are necessary to full latch functionality, many existing latch designs employ separate and independent connections without regard for the ability to reduce the number of force transmitting paths into the latch.

As described above, inputs to latch assemblies typically include one or more user-operable devices such as handles, buttons, levers, and the like for releasing the latch restraint mechanism and one or more user-operable devices such as lock cylinders, sill buttons, and the like for changing the lock state of the latch. The conventional practice of employing separate connections to the latch for such inputs increases latch complexity, weight, and expense, and increases the design difficulty in selectively disabling or isolating any particular input as desired.

Another shortcoming of conventional latch assemblies involves the inability of conventional door locks to correctly respond to more than one latch assembly input at one time. In a well-recognized example, conventional vehicle door latches having a power unlock feature typically require one or more electrical signals to trigger a change of state in the latch (e.g., from a locked state to an unlocked state) before actuation of a handle or other user-manipulatable device will unlatch the latch. If a user actuates the handle before the latch has changed states, this actuation can require the user to release and re-actuate the handle, and can even prevent the latch from changing between its locked and unlocked states. At best, either result is an annoying attribute that remains unaddressed in conventional latch assembly designs. In this and other examples, a conventional latch assembly is unable to respond to actuation of more than one input at a time, or is only responsive to one of two inputs actuated simultaneously or closely in time.

A number of existing latch assembly designs provide for elements or devices that can be powered to change the locked or unlocked state of the latch assembly. Some latch assemblies even have elements or devices that can be powered to drive the latch assembly into a latched state. However, due at least in part to safety issues, conventional latch assemblies do not have elements or devices that are powered for unlatching the latch assembly. Such latch assemblies are not designed with protection against inadvertent or accidental latch release in mind, and do not provide any mechanism by which powered unlatching can be reliably employed. As such, full functionality of conventional latch assemblies is significantly limited.

In light of the problems and limitations of the prior art described above, a need exists for a latch assembly which can be used in many applications, is modular and which therefore has easily adaptable functionality to meet the needs of a large number of applications (i.e., from limited to full functionality), has the fewest elements and assemblies possible, is smaller, faster, and lighter than existing latches, consumes less power in operation, is less expensive and easier to manufacture, assemble, maintain, and repair, provides a high degree of flexibility in user operation to control the lock states of the latch, is capable of properly responding to concurrent or nearly concurrent actuation of multiple latch assembly inputs, can be powered to an unlatched state responsive to actuation of more than one input to the latch assembly actuated concurrently or nearly concurrently, has a simple and reliable design for manual override in the event of power interruption or failure, offers improved security against unlocking by an unauthorized user, has as few inputs as possible for unlatching the latch while still retaining full latch functionality, and provides the ability to quickly isolate desired combinations of latch inputs. A need also exists for an actuation device that is compact, fast, capable of rapidly changing the states of a mechanical device (such as a latch), and is operable significantly independent of the size of device input and inertial forces. Each preferred embodiment of the present invention achieves one or more of these results.

SUMMARY OF THE INVENTION

The present invention employs at least one control element movable in at least two different manners defining locked and unlocked states of the latch assembly. Movement of the control element in each manner is preferably defined by engagement and disengagement with another element. Specifically, the control element is movable in a first manner through a first path when engaged by the engagement element and is movable in a second manner through a second path when disengaged from the engagement element. Preferably, movement of the control element through the first path either directly or indirectly imparts motion to a latch element or mechanism (e.g., a ratchet). Such motion moves the latch element or mechanism to move to its unlatched position to unlatch the door. In contrast, when the control element moves through the second path, the control element does not impart motion (or sufficient motion) to the latch element or mechanism for unlatching the door. Therefore, whether movement or actuation of the control element by a user will unlatch the latch depends upon whether the control element moves in the first or the second manner. Preferably, the control element can be moved from the second path to the first path even if already partially or fully actuated through the second path (and preferably, vice versa). In highly preferred embodiments of the present invention, the control element can be moved from the first to the second path and from the second to the first path regardless of control element position in either path. Unlike conventional latch assemblies, this flexibility permits the state of the latch assembly to be changed even if an input to the latch assembly is already partially or fully actuated.

The ability to change a latch assembly input between its locked and unlocked states in a range of latch assembly input positions significantly increases the latch functionality in numerous applications. For example, where a user attempting to unlatch the latch has already partially or fully actuated the latch assembly input in its locked state, the latch assembly input can still be placed in its unlocked state without requiring the user to release and re-actuate the latch assembly input. As such, at least two inputs (e.g., a first input coupled to the control element for unlatching the latch and a second input for placing the first input in its locked and unlocked states) are preferably used to cause the latch to unlatch. In a common vehicle door application where the control element is placed in its locked and unlocked states by a powered latch assembly input, the user can therefore actuate an outside door handle prior to being unlocked, during or after which time the powered latch assembly input can be actuated to unlock the door handle input and well as to unlatch the latch assembly. This arrangement serves as a power unlatching feature requiring user actuation during unlatching, and therefore addresses the shortcomings of power unlatching described-above.

As just illustrated, the latch assembly of the present invention is preferably capable of receiving a number of external inputs used to control the operation and state of the latch. Preferably, these inputs are connected to one or more user-operable devices for releasing the latch and to one or more user-operable devices for changing the state of the latch (e.g., to and between latch states such as unlocked, locked, child locked, and dead locked, states).

In some highly preferred embodiments of the present invention, preferably only a limited number of paths exist through the latch for releasing the latch. In one preferred embodiment of the invention, the element or mechanism directly generating release of the latch (e.g., a fork bolt or a ratchet releasably engaged with a striker bar) is acted upon through one path shared by two or more inputs to the latch. In other words, where conventional latch assemblies typically employ multiple inputs connected "in parallel" to the element or mechanism directly generating release of the latch, the inputs of this embodiment of the present invention are preferably connected to this element or mechanism "in series". Fewer separate and independent latch releasing paths through the latch assembly result in a latch that is more resistant to unauthorized release, less complex, requires fewer elements and components, and is less expensive to manufacture, assemble, service, and maintain than its conventional counterparts.

The latch assembly of the present invention operates to quickly change the manner of control element motion by preferably moving (e.g., extending or retracting, shifting back and forth, etc.) one or more elements that guide or limit the motion of the control element. These elements can be pins which are quickly extended and retracted by one or more actuators, levers movable into pressing, camming, or other force-transmitting contact with the control element, members movable to at least partially define the bounds of control element motion, and the like, although still other elements can be used effectively.

One highly preferred embodiment of the present invention has two control elements, pins, and actuators. Each control element, pin, and actuator set is preferably connected to and corresponds to at least one input to the latch assembly, such as to a user-operable handle, lever, lock cylinder, sill button, etc. Most preferably, each control element, pin, and actuator set is coupled to a respective door handle. In each control element, pin, and actuator set, the actuator can be extended to insert the pin into an aperture in the control element and can also be retracted to retract the pin from the aperture. When the actuator and pin are extended and thereby engage the control element, the control element preferably pivots through a first path about a first pivot point. However, when the actuator and pin are retracted and are thereby disengaged from the control element, the control element preferably pivots through a second path about a second pivot point. Movement of the control element through the first path preferably brings the control element into contact with a pawl that is coupled to the latch element or mechanism. This contact causes the latch element or mechanism to release, thereby unlatching the door. The control element in the first path is therefore is in an unlocked state. In contrast, movement of the control element through the second path preferably does not bring the control element into such contact, or at least into contact sufficient to release the latch element or mechanism. The control element in the second path therefore is in a locked state.

In some embodiments of the present invention, each control element is connected to a respective user-operable input and is movable in its unlocked state to contact the pawl and to release the ratchet. In these embodiments, each control element does not rely upon another control element for latch release. The user-operable inputs connected to the control elements in these embodiments are therefore "in parallel" as described above because each can separately and independently generate latch release. However, the user-operable inputs in other embodiments of the present invention are connected "in series" as also described above. Where two control element, pin, and actuator sets are used with respective user-operable inputs, actuation of a first control element in its unlocked state preferably releases the ratchet without substantial interaction with the second control element. Actuation of the second control element in its unlocked state preferably releases the ratchet only via contact and force transmission through the first control element in its unlocked state. In another similar embodiment, the second control element is always in its unlocked state, and depends upon the state of the first control element to transmit ratchet-releasing force therethrough. Still other embodiments of the present invention employing multiple latch inputs connected "in series" via two or more control elements are possible. In each such embodiment, the latch assembly preferably has more latch-releasing inputs (e.g., door handles, levers, and the like) than control elements capable of releasing the ratchet without required actuation of another control element.

In some highly preferred embodiments of the present invention, the actuators are electromechanical solenoids that perform quick retraction and extension operations to engage and disengage pins with the control elements in their different lock states. The control elements in such embodiments preferably pivot about an aperture in each control element that is engaged by the pin in the extended position and about another pivot point or about a post, peg, or other element extending from each control element when the pin is not engaged therewith.

In referring herein to "retraction" and "extension" operations of solenoids and to "retracted" and "extended" positions of the solenoids, it should be understood that this is with reference to well known operation of conventional solenoids. Specifically, solenoids typically have one or more elements (such as an armature) which are controllable to extend and retract from the remainder of the solenoid in a well known manner. Terms such as retraction, retracted, extension and extended used herein in connection with a solenoid refers to such conventional solenoid operations. It will be apparent that modified solenoids or other actuators, or even other actuating devices such as mini-motors, devices made of shape memory alloys (such as muscle wires), vacuum cylinders, etc. can be used without departing from the present invention.

In other highly preferred embodiments, the actuators are coupled to levers or other members movable to pivot, translate, push, pull, slide, or otherwise move the control elements into their different lock states.

Other advantages of the present invention can be provided by using an actuator employing magnetic force to engage and restrain one or more elements. This actuator is a solenoid having at least one coil that can be energized to extend or retract an armature of the actuator (to engage or disengage from one or more elements, respectively). The armature can be biased in an opposite direction by a conventional spring or other bias element, but most preferably is moved in an opposite direction by energization of a second coil. To increase the speed at which the actuator engages an element, the actuator includes a holding element at an end thereof. The holding element is at least partially made of a ferrous material, ferromagnetic material, and/or any material otherwise attracted or repelled by a magnetic field (hereinafter and in the appended claims referred to as "magnetic" material). The holding element has at least an engaged state in which holding element movement is impeded by magnetic force from the energized first coil and a disengaged state in which the holding element can move more freely because the first coil is less energized or is not energized.

By energizing the first coil as described above, movement of the holding element can be impeded, and is most preferably restrained. Specifically, the holding element can be attracted or repelled by the first coil's magnetic force against the latch housing, against the coil itself, or against another element in the latch, thereby impeding further holding element movement. The movement of any element engaged with or connected to the holding element is therefore also impeded. To this end, the holding element most preferably has a pin that is engaged with a connected element (e.g., a control element in the latch assembly of the present invention).

The holding element preferably has a receptacle or aperture therein for receiving the armature of the actuator. Most preferably, energization of the first coil holds the holding element in place at least until the armature has been drawn by the magnetic force into engagement with the holding element. If desired, the first coil can then be de-energized to release the holding element (and whatever other element is connected thereto), the holding element now being engaged by the armature. Alternatively, the first coil can remain energized as desired.

The time necessary to energize the first coil, generate magnetic force thereby, and exert such force upon a holding element to hold the holding element in place is significantly faster than conventional armature engagement speeds. As such, the first coil can be used to quickly hold a connected element in place via magnetic force while a slower armature is moved into engagement with the holding element or directly into engagement with the connected element. A compressible or spring-loaded armature is preferably used to help ensure reliable engagement with the holding element and/or the connected element. In most preferred embodiments of the present invention, the holding element is held by the energized first coil for a sufficient time to engage the holding element with the armature, after which time the first coil is de-energized.

Preferably, the holding element is movable through one or more tracks, guides, and the like when not restrained by the first coil. In some highly preferred embodiments of the present invention, the track is provided with a recess, seat, or depression receiving the holding element when energized by the first coil in order to help keep the holding element from moving while the armature is being drawn by the first coil. Alternatively or in addition, the track can have one or more raised portions also shaped to impede holding element movement when the first coil is energized. Preferably, the armature is thereafter held in its engaged state by an over-center spring coupled to the armature.

To disengage the holding element (and whatever element is attached thereto as desired), the first coil is preferably de-energized and the second coil is energized to draw the armature out of engagement with the holding element. The holding element and any element attached thereto is thereby able to move with respect to the coil and armature, whether in a holding element track or otherwise.

Although significant advantages are realized by using this actuator in conjunction with latch assemblies such as those described and illustrated herein, this actuator can be employed in any device and environment for selectively engaging any desired element.

Various embodiments of the latch assembly of the present invention can employ actuators having no mechanical inputs to either extend or retract. However, in some preferred embodiments, the latch assembly can be provided with such inputs to supplement or replace actuator capabilities described above. Specifically, it can be desirable in some applications to supplement one or more powered actuators with mechanical inputs, whereby the actuators can be engaged and/or disengaged (e.g., armatures extended or retracted) by mechanical linkages to the actuators. By manually actuating a latch input to either place an actuator in its locked or unlocked state or to unlatch the latch, these mechanical linkages can transfer some of the manual force to the actuators to manually perform the engagement or disengagement operations. Where the actuators are capable of performing engagement and disengagement operations without mechanical assistance, these mechanical linkages can act as a backup feature for the actuators. Instead, these mechanical linkages permit the use of actuators requiring some degree of mechanical input (i.e., to move to one or both of the engaged or disengaged states, to move partially to an engaged state or partially from a disengaged state, and the like).

In a preferred embodiment of the present invention, a latch assembly is provided with two control elements each having a respective actuator and pin set. This latch assembly has two latch inputs for changing the state of the latch, such as between a locked to an unlocked state or between a child locked and an unlocked state. A set of levers is connected to the these inputs and is movable to mechanically attract or repel armatures of the actuators. When not otherwise disabled, actuation of the inputs causes the levers to move and to push the armatures into engagement with control elements, thereby changing the state of the latch. This motion can serve as "backup" for the force provided by solenoid coils in the actuator, can supplement such force, or can even replace such force in some embodiments of the present invention. In preferred embodiments of the present invention, the connection between at least one of the inputs and the levers can be disabled to prevent the manual actuation just described.

When the latch assembly of the present invention is used on a vehicle door, a first control element is preferably coupled via a linking member to an inside door handle and a second control element is preferably coupled to an outside door handle. When the engagement element (e.g., pin, lever, or the like) corresponding to each control element is actuated to engage the first and second control elements, respectively, actuation of the control elements by either handle causes the actuated control element to directly or indirectly move a ratchet to unlatch the door. This is the unlocked state of the latch assembly. When the engagement element corresponding to each control element is actuated to disengage from the first and second control elements, actuation of the control elements by either handle does not move the ratchet or does so insufficiently to unlatch the door. This is the dead locked state of the latch assembly. When the engagement element corresponding to the first control element is actuated to engage the first control element and when the engagement element corresponding to the second control element is actuated to disengage from the second control element, actuation of the inside door handle will directly or indirectly move a ratchet to unlatch the door, but actuation of the outside door handle will not do so. This is the locked state of the latch assembly. When the engagement element corresponding to the first control element is actuated to disengage from the first control element and the engagement element corresponding to the second control element is actuated to engage the second control element, actuation of the outside door handle will move the pawl and unlatch the door, but actuation of the inside door handle will not do so. This is the child locked state of the latch assembly. Of course, in other embodiments of the present invention, one, three, or even more control element, engagement element, and actuator sets can be used as desired.

Latch assembly operations for placing the control elements in their locked and unlocked states are therefore preferably quickly performed via actuators, and most preferably, by electromagnetic solenoids. Also, the relatively small number of elements (e.g., an actuator, engagement element, control element, and, if desired, a pawl as described in more detail below) employed to place the latch assembly in its various lock states is a significant advantage over prior art latches. Preferred embodiments of the present invention are therefore lighter, smaller, can be operated using less power, and can be manufactured, maintained, and repaired at less expense.

In addition, the use of actuators such as electromagnetic solenoids to place the control elements in their various states provides greater flexibility for controlling the various latch assembly lock states.

The latch assembly of the present invention also preferably has a control circuit for controlling the actuators. Most preferably, the control circuit is electrical and uses a sensing device to detect changes in the primary power supply (e.g., power loss, power interruption, etc.) supplying power to the latch assembly and to the actuators. At least as a safety feature, certain changes detected in the power supply preferably cause the actuators to automatically engage the pins with the control elements and to thereby unlock the latch assembly. Because the mechanism for placing the latch assembly in its various lock states is preferably actuated electronically rather than by conventional mechanical means, the latch assembly is also more secure against unauthorized operation.

In addition to the above-noted advantages of the present invention, a number of preferred embodiments are also highly adaptable for installation in a number of different applications and in a number of different configurations, thereby providing a latch which can easily be changed from a latch having minimal functionality to a latch with full functionality, and to a number of different states in between. First, the latch assembly preferably provides linking access to the control elements therein (e.g., capability to connect the control elements to actuation elements external to the latch assembly via cables, rods, or other "input" or "linking" elements) either by ports for interior linking or by housing apertures permitting control elements to extend outside of the latch assembly for exterior linking. Second, the input elements linked to the latch assembly for actuation thereof are preferably fully interchangeable with multiple control elements and with the pawl. The control elements and the pawl can therefore be connected in a number of different ways to the actuation elements, thereby providing a large amount of flexibility to install the latch for operation in a variety of different ways. Third, the latch assembly preferably has a sufficient number of control element and actuator positions so that an assembler can selectively install one or more control elements and actuators in desired locations to create a latch assembly best suited for a particular application. By selecting how many control elements and associated actuators are to be installed (and where) in each particular latch, the assembler is able to easily modify each latch for a specific application without requiring any modification to the latch assembly.

The latch assemblies of the present invention preferably also have at least one manual override which permits a user to manually shift an engagement element into engagement with a control element to establish an unlocked state of the control element. Such a manual override can also or instead permit a user to manually shift an engagement element out of engagement with a control element to establish a locked state of the control element. In a highly preferred embodiment, the manual override is also capable of shifting an engagement element in such manner in response to movement of another control element in its unlocked state or in response to movement of the pawl to its unlocked state.

Another feature of the present invention is related to its assembly. Specifically, highly preferred latch assembly embodiments are assembled in layers of elements. Most preferably, a majority of elements are positioned and installed within the latch layer upon layer without requiring numerous re-orientations of the latch assembly by the assembler and without requiring access to more than one side of the latch assembly. This saves considerable assembly, service, and maintenance time, thereby lowering the cost to manufacture, service, and maintain the latch.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
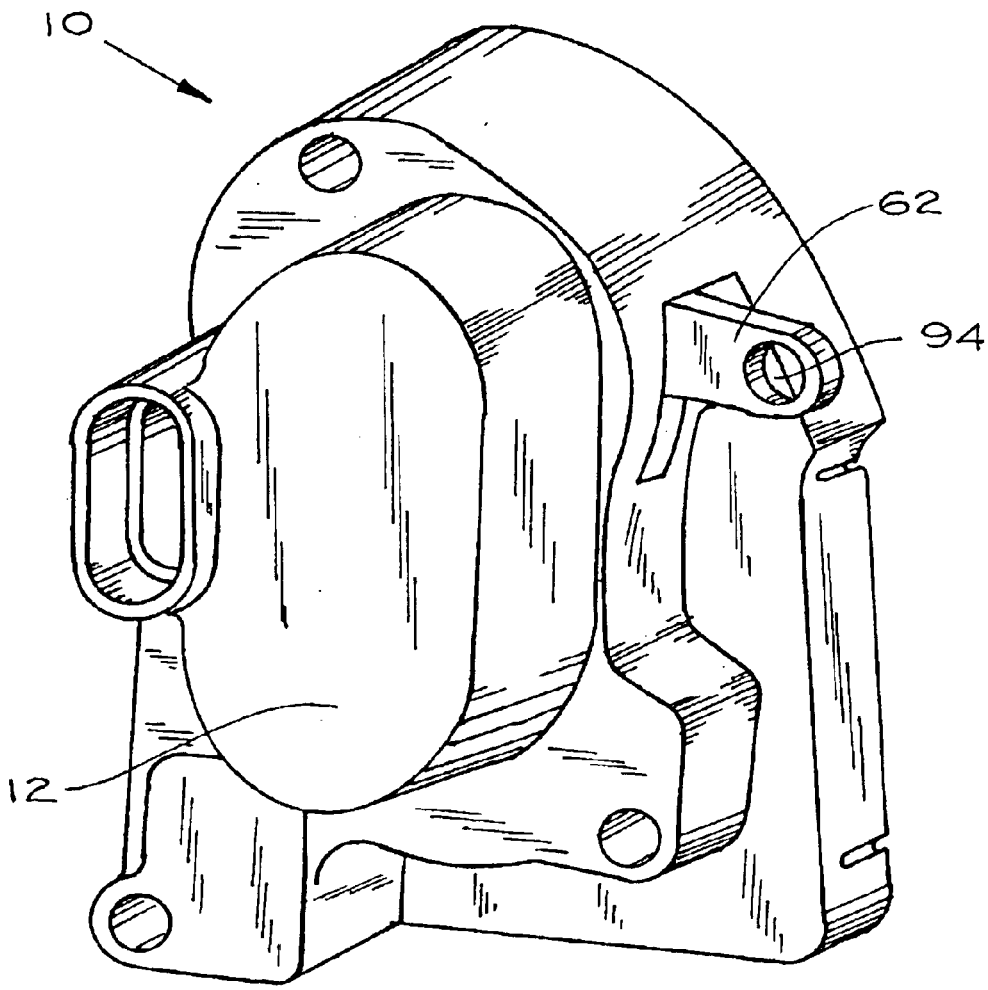
FIG. 1 is a front perspective view, looking down, of a latch mechanism according to a first preferred embodiment of the present invention.
Figure 2:
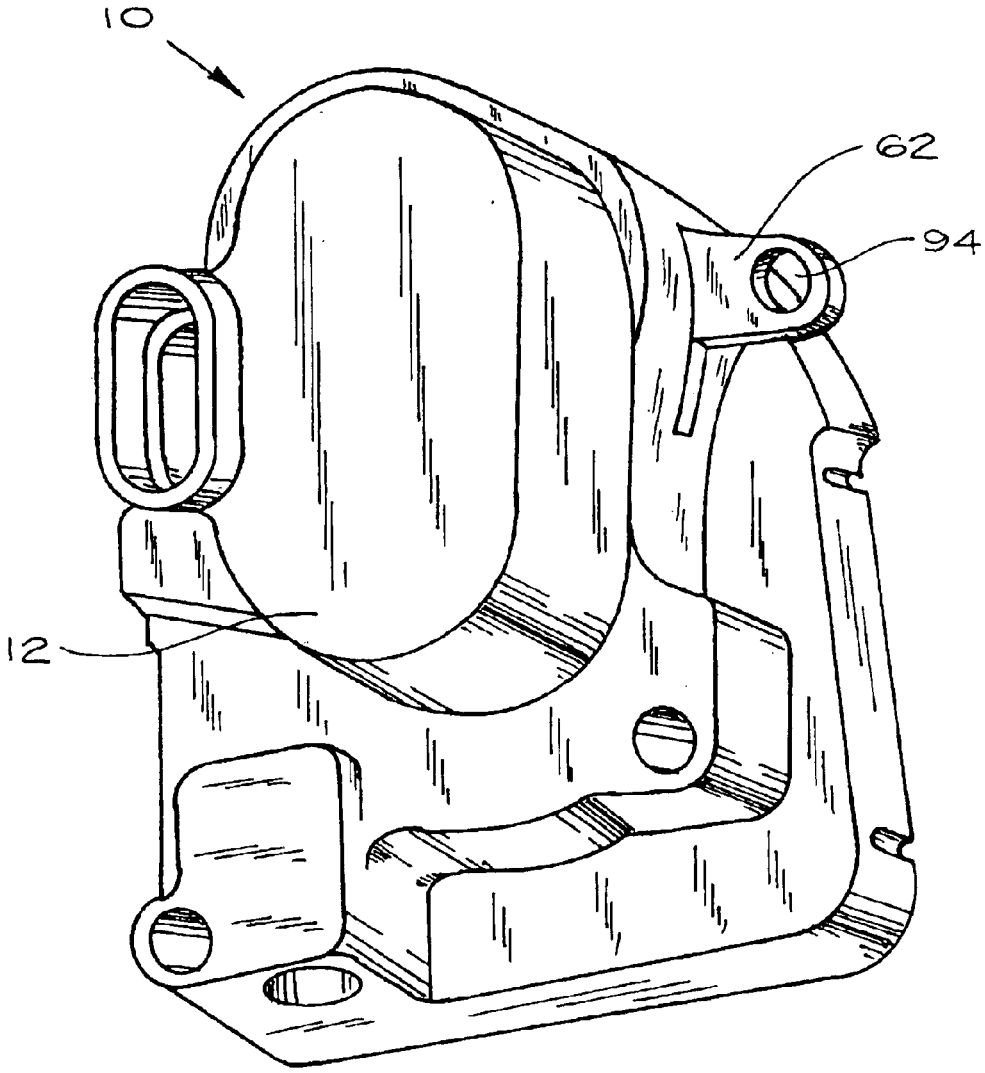
FIG. 2 is a front perspective view, looking up, of the latch mechanism shown in FIG. 1.
Figure 3:
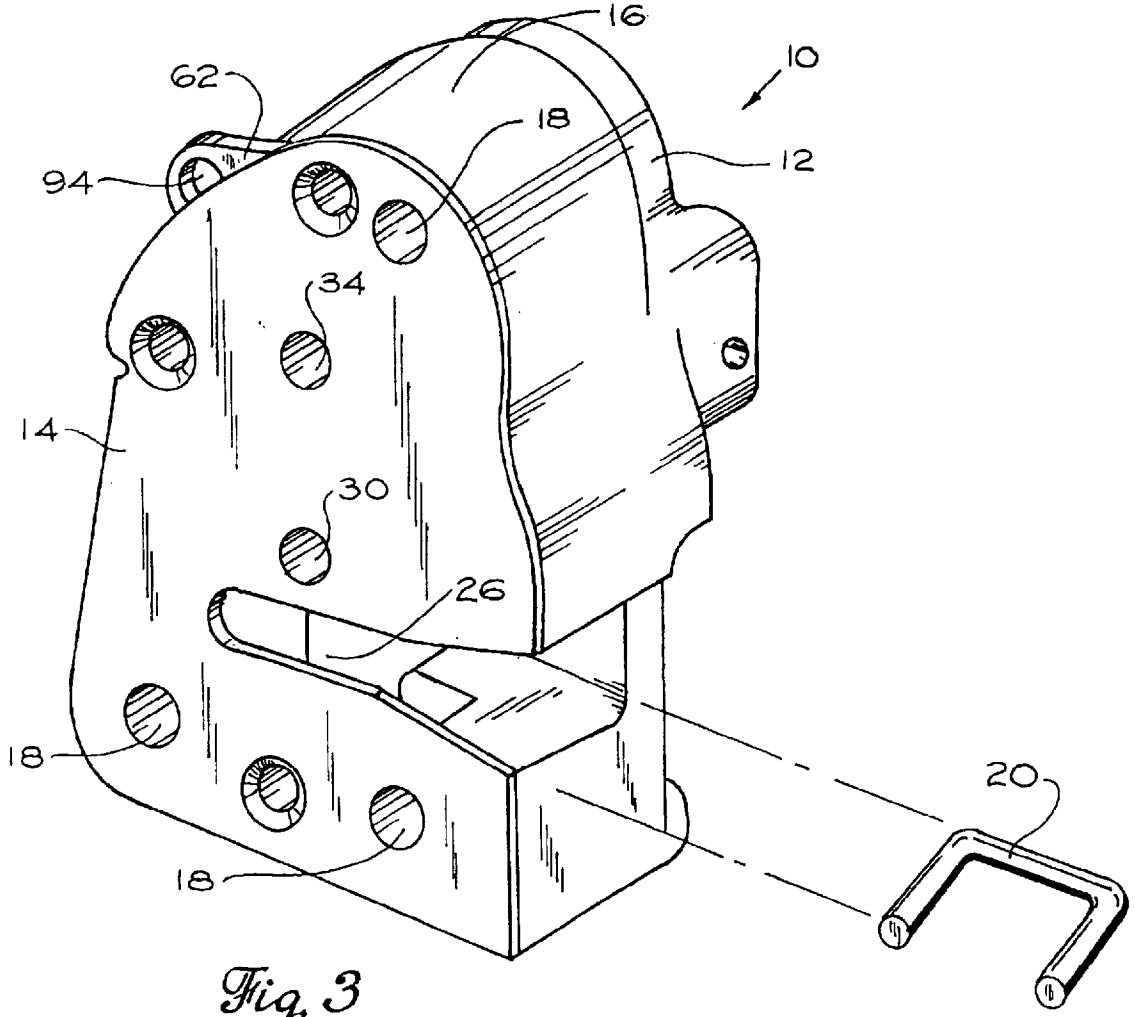
FIG. 3 is a rear perspective view, looking down, of the latch mechanism shown in FIGS. 1 and 2.

While the latch assembly 10 of the present invention is useful in a variety of applications, it is particularly useful in vehicle applications such as for automotive and truck doors. In such applications, the latch assembly 10 preferably has a front cover 12, a rear mounting plate 14 and a housing 16 which collectively enclose the internal elements and mechanisms of the latch assembly 10. A highly preferred embodiment of the latch assembly 10 is shown in FIGS. 1–3. It should be noted that although the following description is with reference to the latch assembly 10 used in vehicle door applications (where application of the latch assembly 10 can be employed with excellent results), the latch assembly 10 can instead be used in many other applications. In fact, the present invention can be used in any application in which it is desirable to releasably secure one body to another. Such applications can be non-automotive and even in applications not involving doors.

The terms of orientation and direction are used herein for ease of description only and do not indicate or imply any required limitation of the present invention. For example, terms such as front, rear, left, right, clockwise, counterclockwise, upper, lower, top, bottom, first, and second as used herein do not indicate or imply that the elements or operations thus described must be oriented or directed in a particular way in the practice of the present invention. One having ordinary skill in the art will recognize that opposite or different orientations and directions are generally possible without departing from the spirit and scope of the present invention. Also, it should be noted that throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical communication with another element. Examples include directly securing one element to another (e.g., via welding, bolting, gluing, frictionally engaging, mating, etc.), elements which can act upon one another (e.g., via camming, pushing, or other interaction) and one element imparting motion directly or through one or more other elements to another element.

Where the latch assembly 10 secures a vehicle door to a door frame or vehicle body, the latch assembly 10 is preferably mounted in a conventional manner to the vehicle door. For example; the rear mounting plate 14 can be provided with fastener apertures 18 through which threaded or other conventional fasteners (not shown) are passed and secured to the door. The latch assembly 10 can be secured to the door or to the vehicle body in a number of manners, such as by welding, screwing, bolting, riveting, and the like, all of which are well known to those skilled in the art. Further discussion of securement methods and elements is therefore not provided herein.

Similar to conventional latch assemblies, the latch assembly 10 is designed to releasably capture a striker 20 (see FIG. 3) mounted on the vehicle body (or on the door if the latch assembly 10 is instead mounted on the vehicle body). For this purpose, the latch assembly 10 preferably has a ratchet or fork bolt 22 (see FIGS. 4, 5, 13, and 14) rotatably mounted therein for releasably capturing the striker 20. The ratchet 22, the rear mounting plate 14, and the housing 16 each have a groove 24, 26, 27, respectively, for receiving and capturing the striker 20 to latch the door shut. Specifically, the ratchet 22 is rotatable between a fully open position in which the grooves 24, 26, 27 align with one another to receive the striker 20, and a range of closed positions in which the ratchet 22 is rotated to reposition the groove 24 of the ratchet 22 out of alignment with the grooves 26, 27 of the rear mounting plate 14 and the housing 16 (thereby capturing the striker 20 within the grooves 24, 26, 27). It should be noted that a number of different striker and ratchet designs exist which operate in well known manners to releasably secure a striker (or like element) to a ratchet (or like element). The preferred embodiments of the present invention are useful with these other conventional striker and ratchet designs as well. Such other striker and ratchet designs fall within the spirit and scope of the present invention.

Figure 4:
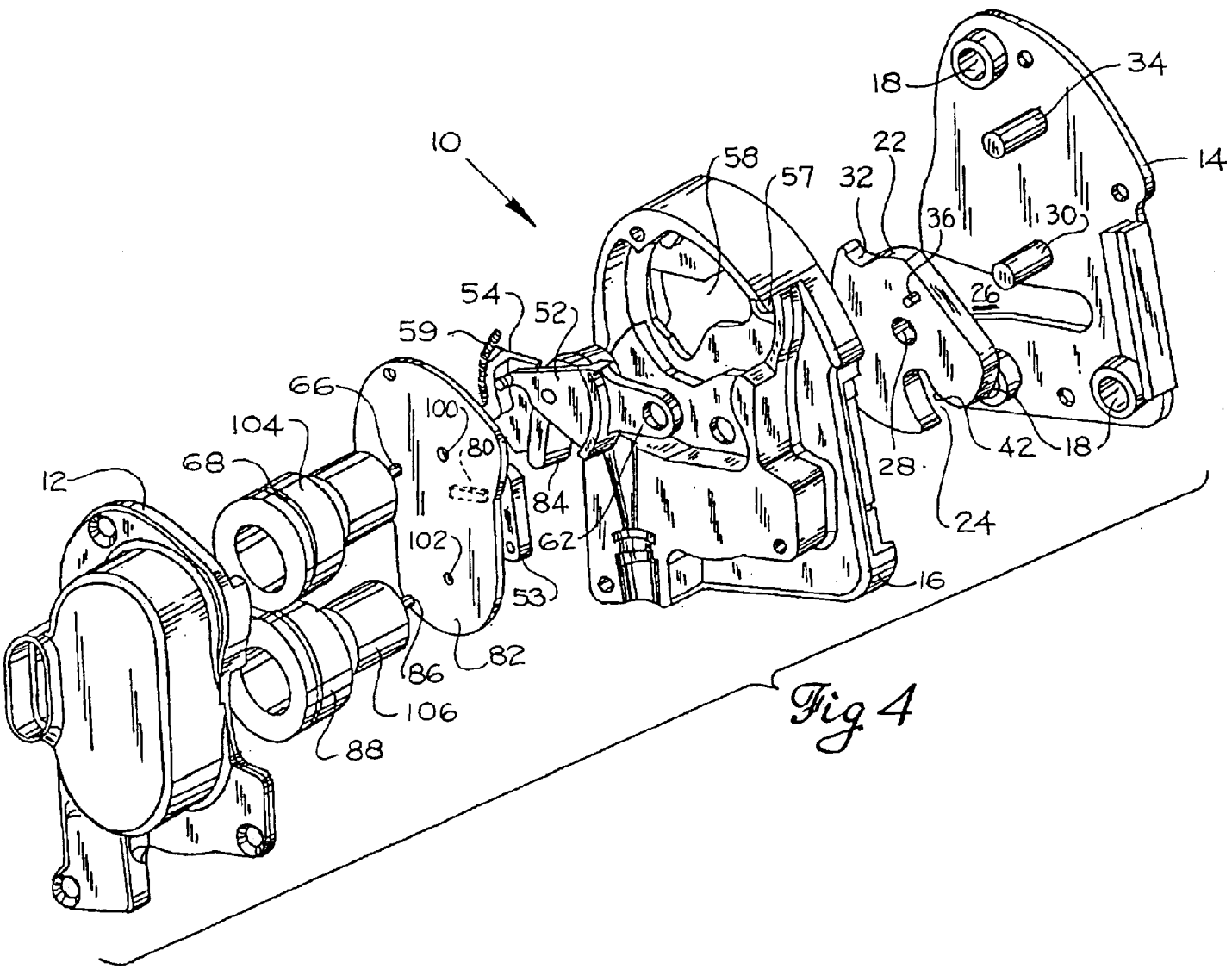
FIG. 4 is an exploded view of the latch mechanism shown in FIGS. 1–3, viewed from the front.
Figure 5:
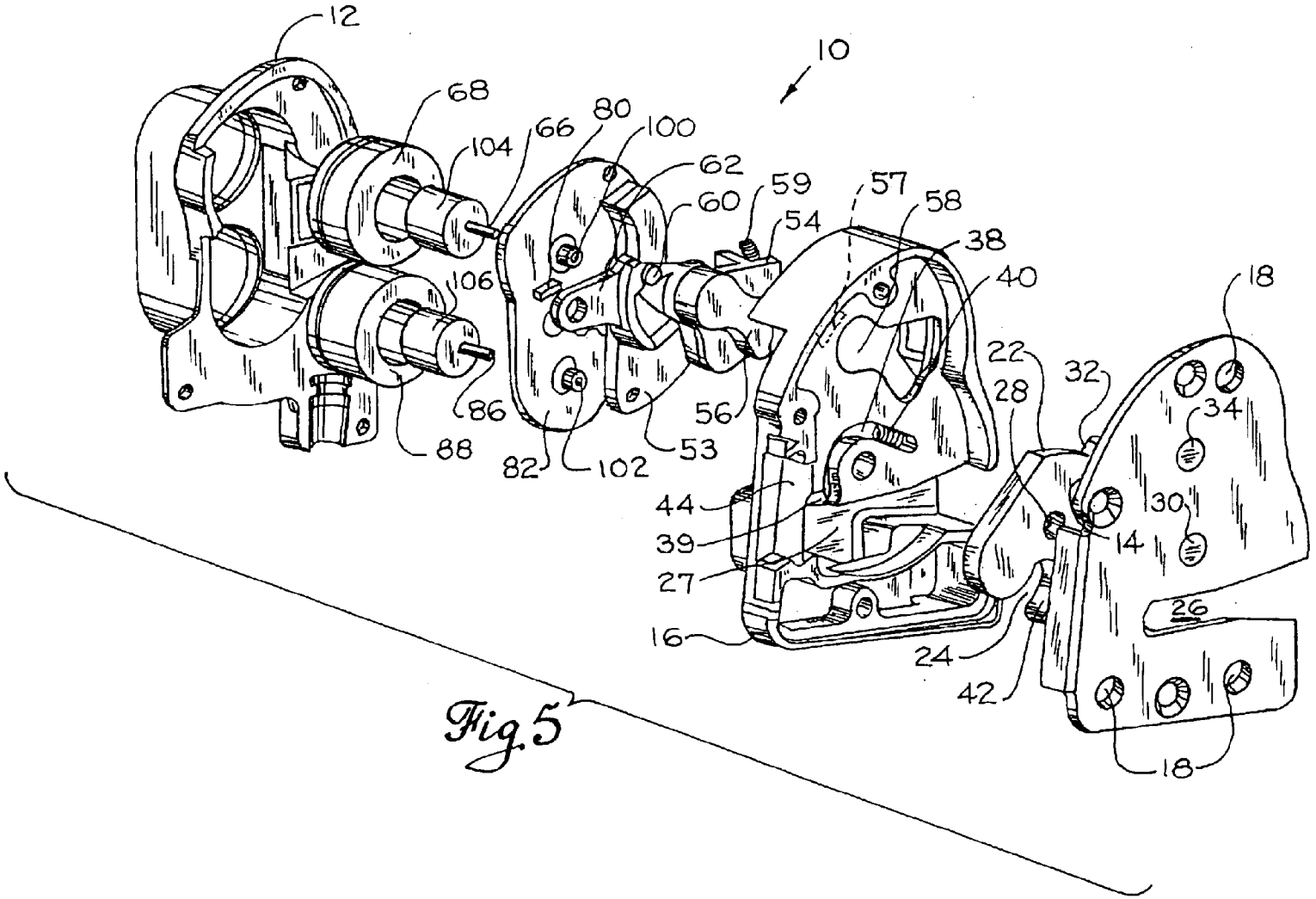
FIG. 5 is an exploded view of the latch mechanism shown in FIGS. 1–4, viewed from the rear.
Figure 6:
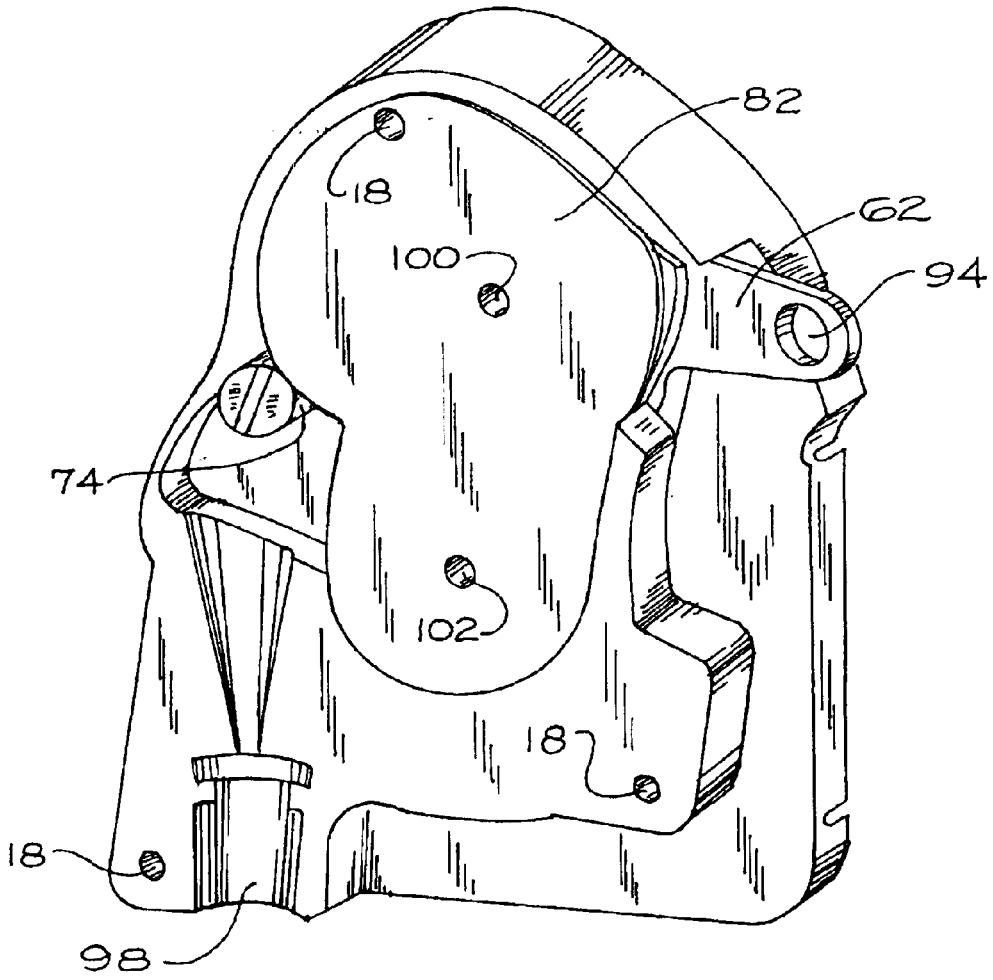
FIG. 6 is a front perspective view of the latch mechanism shown in FIGS. 1–5, with the front cover and actuators removed.
Figure 7:
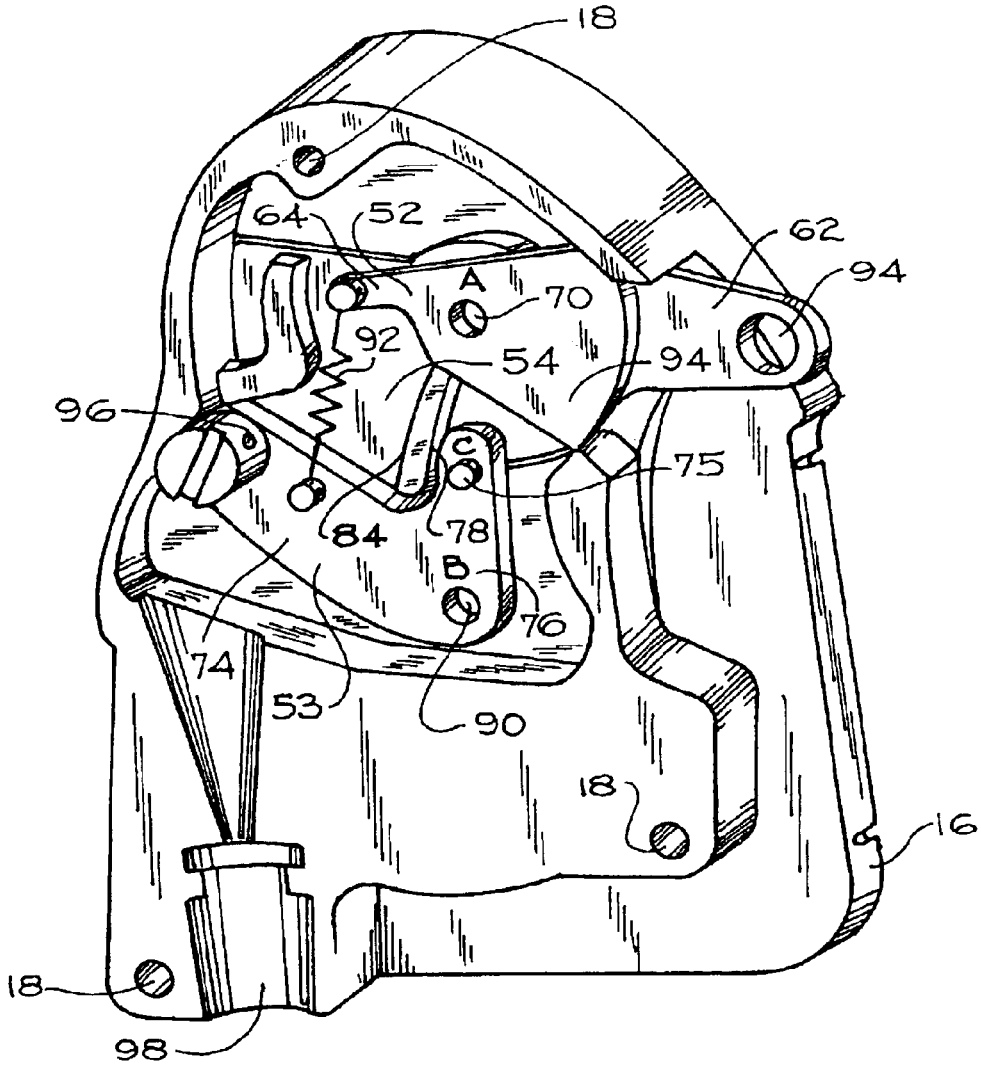
FIG. 7 is a front perspective view of the latch mechanism shown in FIGS. 1–6, with the front cover, actuators, and the cover plate removed, and showing the control elements and the pawl of the latch mechanism.
Figure 8:
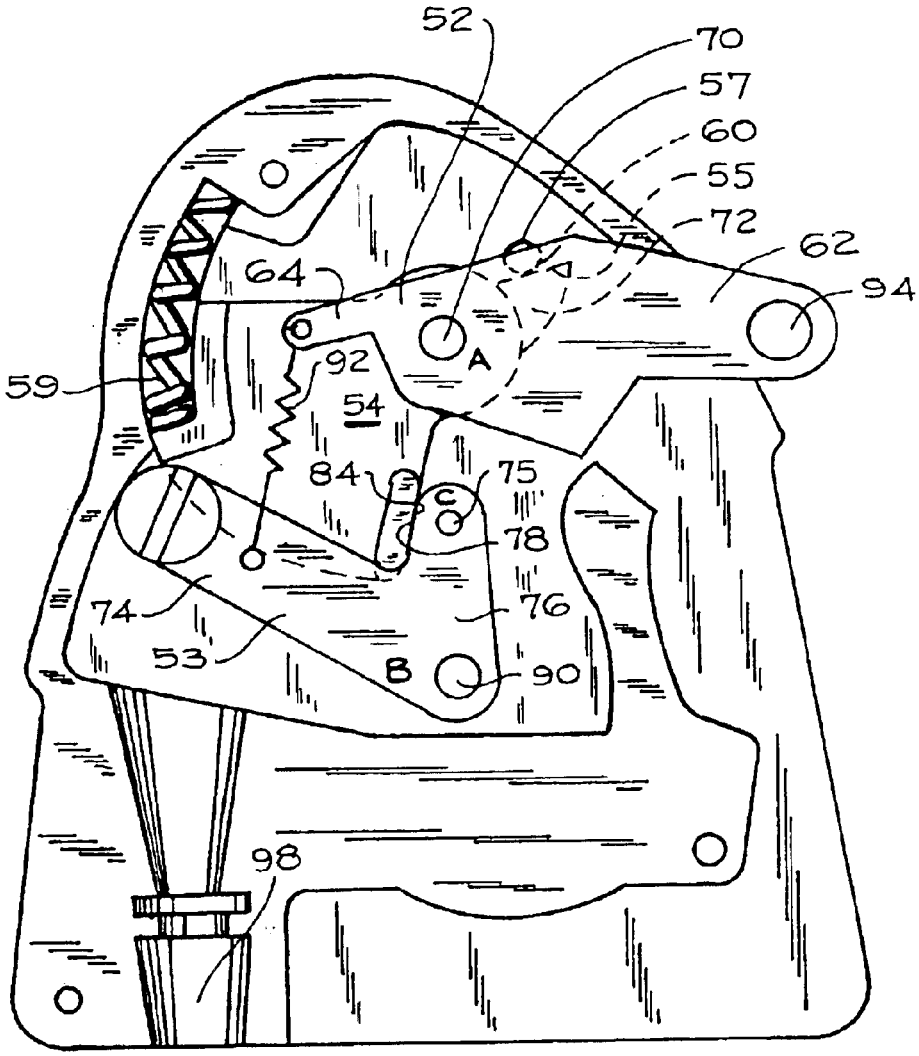
FIG. 8 is a front elevational view of the latch mechanism shown in FIG. 7, with both the right and left control elements in their unactuated positions.

With particular reference to FIGS. 4 and 5, the operation of the ratchet 22 in capturing and securing the striker 20 within the latch assembly 10 will now be further described. As indicated above, the use of a ratchet in a latch mechanism is well known to those skilled in the art. In the latch assembly 10 of the present invention, the ratchet 22 is preferably provided with an aperture 28 for mounting the ratchet 22 to the rear mounting plate 14. The aperture 28 is sized and shaped to rotatably receive a lower pivot post 30 extending from the rear mounting plate 14. The lower pivot post 30 is preferably fastened to the rear mounting plate 14 in a conventional manner, such as by a riveting, screwing, bolting, or other conventional fastening techniques. The lower pivot post 30 can instead be made integral with the rear mounting plate 14. Sufficient clearance is provided between the lower pivot post 30 and the aperture 28 of the ratchet 22 so that the ratchet 22 can rotate substantially freely about the lower pivot post 30.

In order to control the movement of the ratchet 22 within the latch assembly 10, rotation of the ratchet 22 is preferably limited at two locations as follows. First, the ratchet 22 is prevented from rotation beyond the point where the grooves 24, 26, 27 of the ratchet 22, the rear mounting plate 14, and the housing 16 are aligned for receiving the striker 20 as described above. This limitation exists due primarily to the manner in which the striker 20 moves through the grooves 24, 26, 27 as it enters the latch assembly 10. When the striker 20 has rotated the ratchet 22 to the position shown in FIGS. 4 and 5, the striker 20 is preferably stopped by an elastomeric element 44 (described in more detail below) located between the rear mounting plate 14 and the housing 16. Because the striker 20 is trapped between the grooves 24, 26, 27 of the ratchet 22, the rear mounting plate 14, and the housing 16 in this position, the ratchet 22 cannot rotate further in the counterclockwise direction as viewed in FIG. 4. In addition, the ratchet 22 is preferably provided with a stop pin 36 which fits into a stop pin groove 38 in the housing 16 (see FIG. 5). As best viewed in FIG. 5, a ratchet spring 40 is also preferably fitted within the stop pin groove 38 and exerts a reactive force against the stop pin 36 when compressed by rotation of the ratchet 22 in the counterclockwise direction as viewed in FIG. 4. Therefore, when the ratchet 22 is rotated in the counterclockwise direction as viewed in FIG. 4, the ratchet spring 40 and the termination of the stop pin groove 38 in the housing 16 prevents further rotation of the ratchet 22 in the same direction.

To limit movement of the ratchet 22 in the clockwise direction as viewed in FIG. 4, the stop pin groove 38 has a terminal section 39 (see FIG. 5) within which the stop pin 36 is stopped when the ratchet 22 is rotated under force of the ratchet spring 40 in the clockwise direction as viewed in FIG. 4. As such, the ratchet 22 is effectively limited in movement in one direction by the stop pin 36 against the ratchet spring 40 and by the striker 20 stopped by the elastomeric element 44 and trapped within the grooves 24, 26, 27, and limited in movement in the opposite direction by the stop pin 36 within the terminal section 39 of the stop pin groove 38.

It should be noted that the ratchet 22 is preferably biased into its unlatched position (clockwise as viewed in FIG. 4) by the ratchet spring 40. The latch assembly 10 therefore returns to an unlatched state unless movement of the ratchet 22 is interfered with as will be discussed in more detail below. When the striker 20 is inserted into the grooves 24, 26, 27 of the ratchet 22, the rear mounting plate 14, and the housing 16 in this unlatched position, the striker 20 presses against the lower wall 42 of the groove 24 in the ratchet 22 (see FIG. 14) and thereby causes the ratchet 22 to rotate about the lower pivot post 30 against the compressive force of the ratchet spring 40 in the stop pin groove 38. Further insertion of the striker 20 rotates the ratchet 22 until the striker 20 contacts and is stopped by the elastomeric element 44 (described below) and/or until the reactive force of the ratchet spring 40 stops the ratchet 22.

Due to the high impact forces commonly experienced by the latch assembly 10 as the ad striker 20 enters and is stopped by the latch assembly 10, it is desirable to cushion the impact of the striker 20 upon the latch assembly 10 as the striker 20 is stopped. To this end, one well known element preferably used in the present invention is an elastomeric element 44 located behind the termination of the groove 26 in the rear mounting plate 14. The elastomeric element 44, secured in a conventional manner to the rear mounting plate 14 and/or to the housing 16, is an impact absorbing article preferably made of an elastomeric material such as rubber, urethane, plastic, or other resilient material having a low deformation memory.

The elastomeric element 44 not only performs the function of absorbing potentially damaging forces experienced by the latch assembly 10 during striker capture, but also acts to reduce the operational noise emitted by the latch assembly 10. One having ordinary skill in the art will appreciate that a number of other conventional damper and impact absorbing elements and devices can be used in the latch assembly 10 of the present invention to protect the latch assembly 10 from high impact forces and to reduce latch noise. These other damper and impact absorbing elements fall within the spirit and scope of the present invention.

The ratchet 22, the rear mounting plate 14, the elastomeric element 44, and their operational relationship with respect to the striker 20 as described above is generally conventional and well known to those skilled in the art. In operation, prior art latch mechanisms employ one or more elements which interact or interfere with the ratchet 22 at particular positions in its rotation to prevent rotation of the ratchet 22 to its unlatched position once the striker 20 is inserted sufficiently within the latch assembly 10. For example, such elements can be brought into contact with a stop surface 32 of the ratchet 22 when the ratchet 22 is in its latched position (i.e., rotated to a counterclockwise position as viewed in FIG. 4). When it is desired to release the striker 20 in an unlatching procedure, the elements are removed from interference with the ratchet 22 and the ratchet 22 is returned to its unlatched position (e.g., by the ratchet spring 40). As described above in the Background of the Invention, the prior art mechanisms and elements used to selectively insert and remove such elements from the ratchet 22 are virtually always complex, expensive to manufacture, inefficient, and relatively slow.

In one preferred embodiment of the present invention, the latch assembly 10 has a pawl 54 as best seen in FIGS. 4–12. The pawl 54 is rotatably mounted upon an upper pivot post 34 extending from the rear mounting plate 14. The upper pivot post 34, like the lower pivot post 30, is preferably attached to the rear mounting plate 14 by fastening, riveting, screwing, bolting, or other conventional fastening methods. The upper pivot post 34 can instead be made integral with the rear mounting plate 14, if desired.

Figure 13:
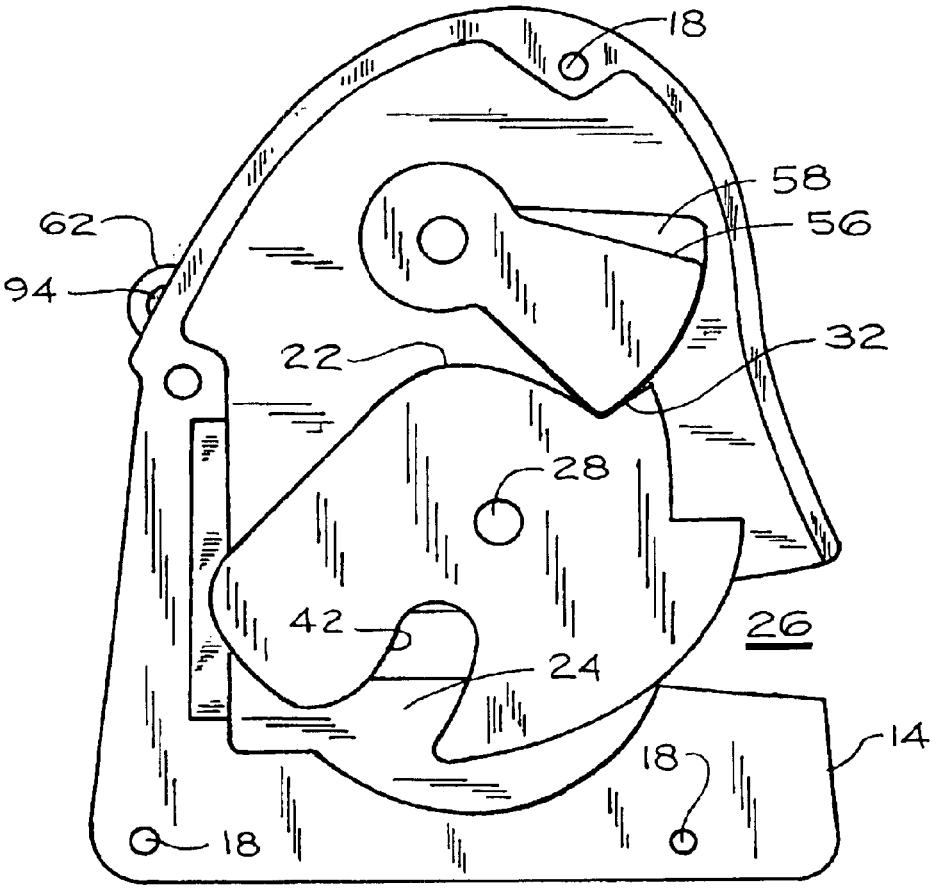
FIG. 13 is a rear elevational view of the latch mechanism shown in FIGS. 1–12, with the rear mounting plate removed and with the pawl engaged with the ratchet.
Figure 14:
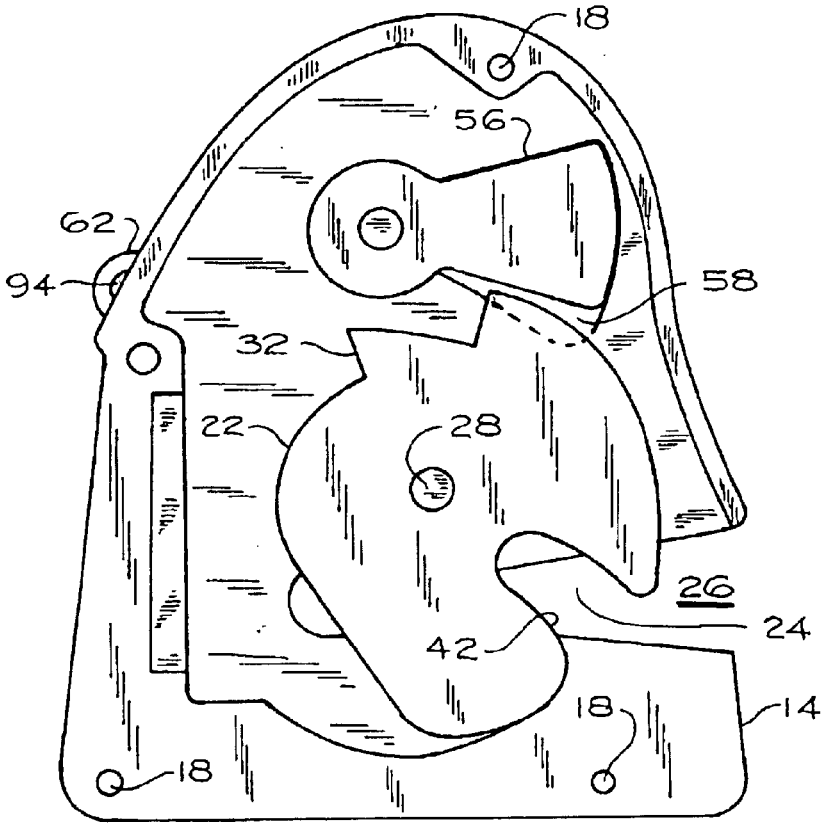
FIG. 14 is a rear elevational view of the latch mechanism shown in FIGS. 1–13, with the rear mounting plate removed and with the pawl disengaged from the ratchet.

The pawl 54 preferably includes a cam 56 (see FIGS. 5, 13, and 14). The body of the pawl 54 is preferably located on a side of the housing 16 opposite the ratchet 22. However, the cam 56 of the pawl 54 preferably extends through an aperture 58 within the housing 16 to place the cam 56 in selective engagement with the ratchet 22. Specifically, the pawl's fit within the aperture 58 of the housing 16 is loose enough to permit an amount of movement of the cam 56 relative to the ratchet 22. It should be noted that although the housing shape illustrated in the figures is preferred in the present invention, other housing shapes can be used (e.g., having a different aperture type for accepting different pawls 54, cams 56, and different pawl and cam motions, different housing interior shapes and sizes for accepting different control elements and control element motions, etc.). As best shown in FIGS. 13 and 14, the pawl 54 and the cam 56 can preferably be placed in one position (FIG. 13) in which the cam 56 engages with the stop surface 32 of the ratchet 22 when the ratchet 22 is in its latched position and in another position (FIG. 14) in which the cam 56 is retracted from and does not interfere with rotation of the ratchet 22. In the retracted pawl position, the ratchet spring 40 causes the ratchet 22 to automatically rotate to its unlatched position shown in FIG. 14 as described above.

The pawl 54 is preferably biased into its ratchet interfering position by a pawl spring 59. Referring to FIGS. 7–12, it can be seen that the pawl spring 59 is preferably a compression spring contained between walls of the pawl 54 and the housing 16. The pawl spring 59 biases the pawl 54 in a counterclockwise direction as viewed in FIGS. 7–12, thereby pressing the cam 56 toward the ratchet 22 on the opposite side of the housing 16. It will be appreciated that although the pawl spring 59 is shown secured between walls of the pawl 54 and the housing 16, such an arrangement and position is not required to perform the function of biasing the pawl 54 in the counterclockwise direction as viewed in FIGS. 7–12. Indeed, the pawl spring 59 can instead be rigidly attached at one end to a part of the pawl 54, can be rigidly attached to an inside wall of the housing 16, can be contained within walls solely in the pawl 54 or solely in the housing 16 (still permitting, of course, an end of the pawl spring 59 to exert force against the pawl 54 and another end to exert force against the housing 16), and the like. Any such configuration in which the pawl spring 59 is positioned to exert a force against the pawl 54 in a counterclockwise direction as viewed in FIGS. 7–12 can instead be used in the present invention. Such alternative configurations are well known to those skilled in the art and are therefore encompassed within the spirit and scope of the present invention.

The preferred embodiment of the present invention just described also has at least one control element 52. By moving the pawl 54 (e.g., rotating the pawl 54 in the preferred embodiment), the latch assembly 10 can be placed in its unlatched state or can be secured in its latched state by virtue of the pawl's relationship with the ratchet 22. With proper positioning and control of the control element 52, movement of the control element 52 to press and/or ride against the pawl 54 therefore moves the pawl 54 to release the ratchet 22 and thereby to release the striker 20. With different positioning and control of the control element 52, movement of the control element 52 does not impart movement to the pawl 54 and therefore does not release the ratchet 22 to release the striker 20. As will now be described, the control element 52 of the present invention can be positioned and controlled in either manner to define an unlatched state of the latch assembly 10 and a latched state of the latch assembly 10.

Turning to FIGS. 7–12, a highly preferred embodiment of the present invention has a right and a left control element 52, 53, respectively. Once again, the terms "right" and "left" are used only for ease of description, and do not imply that these elements necessarily be in a right and left position with respect to each other or to other elements in the latch assembly 10. Other orientations are possible and fall within the scope of the present invention. The control elements 52, 53 preferably act as levers in the latch assembly 10, and are externally actuatable by a user. However, and as described below in greater detail, the control elements 52, 53 need not necessarily pivot (an inherent part of a lever's operation), but can instead translate and/or translate and rotate in alternate embodiments of the present invention. Therefore, the term "lever" as used herein does not necessarily require that the control elements 52, 53 pivot or exclusively pivot.

Figure 9:
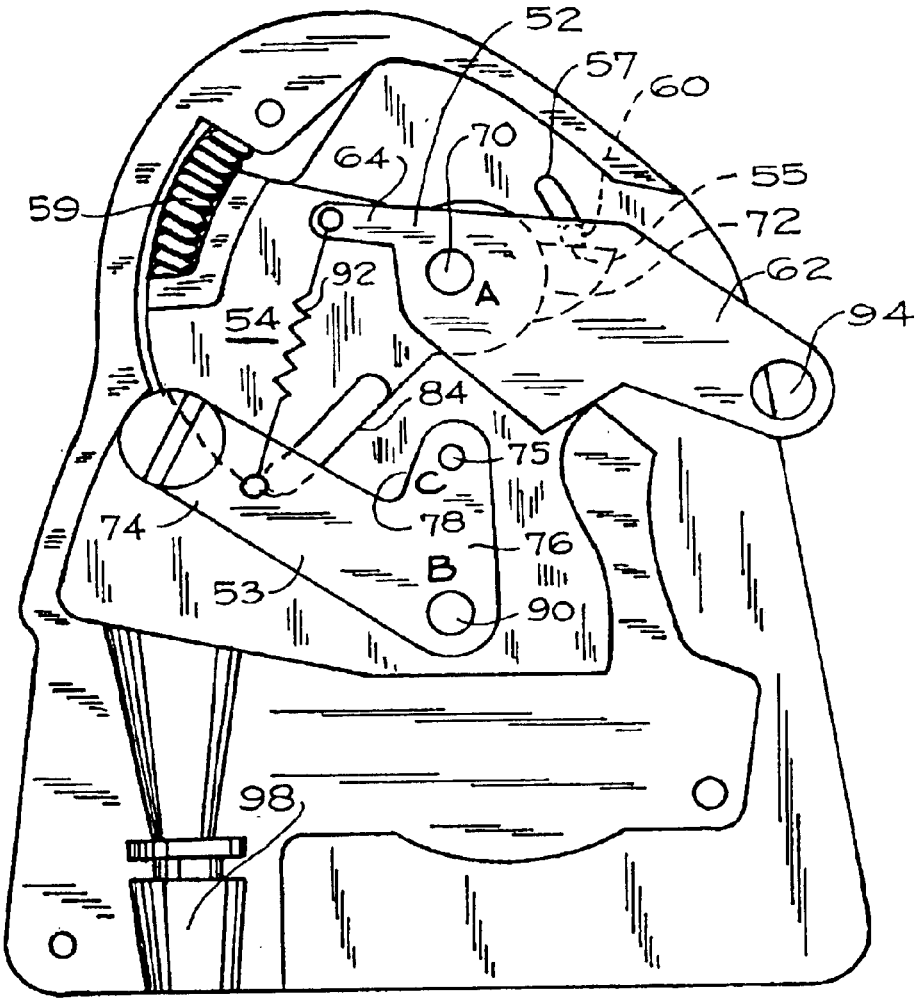
FIG. 9 is a front elevational view of the latch mechanism shown in FIG. 7, with the latch mechanism unlocked and with the right control element actuated.
Figure 10:
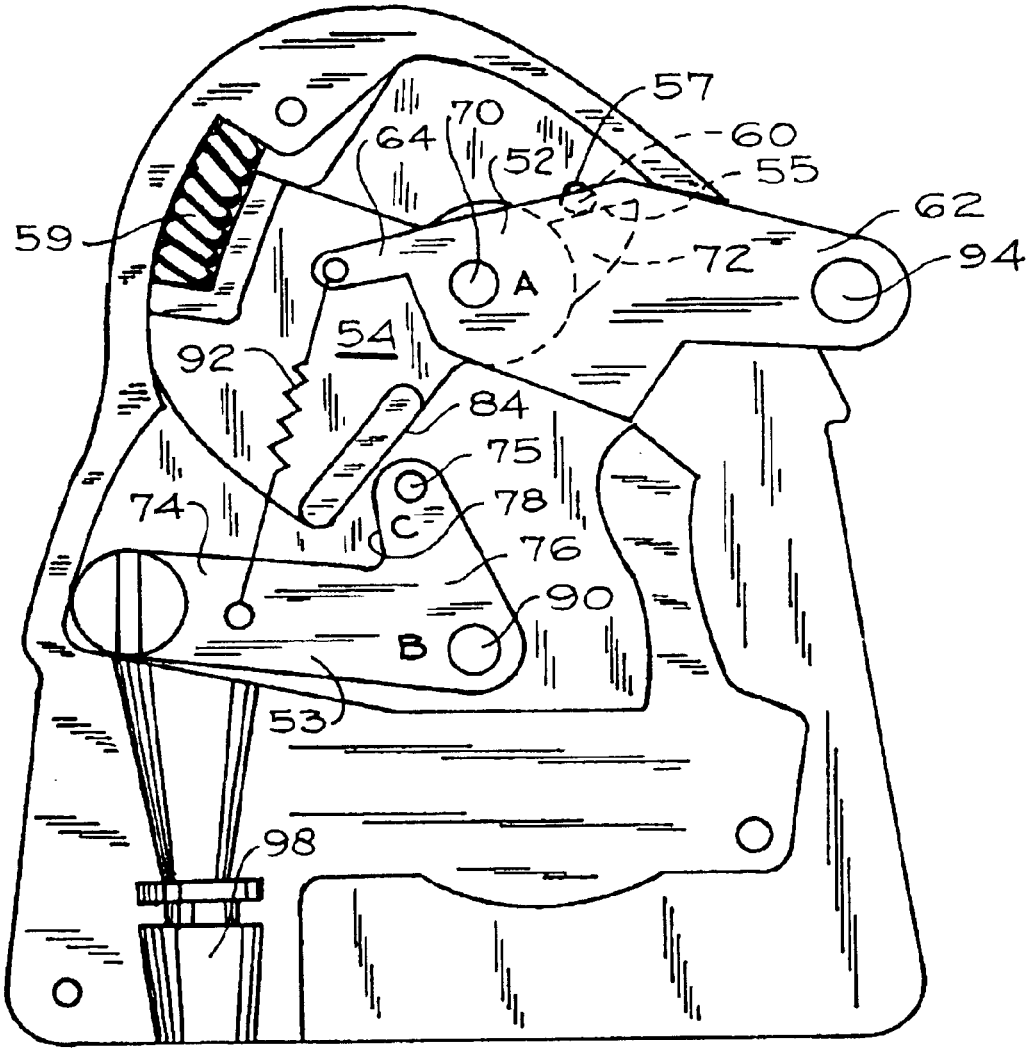
FIG. 10 is a front elevational view of the latch mechanism shown in FIG. 7, with the latch mechanism unlocked and with the left control element actuated.
Figure 11:
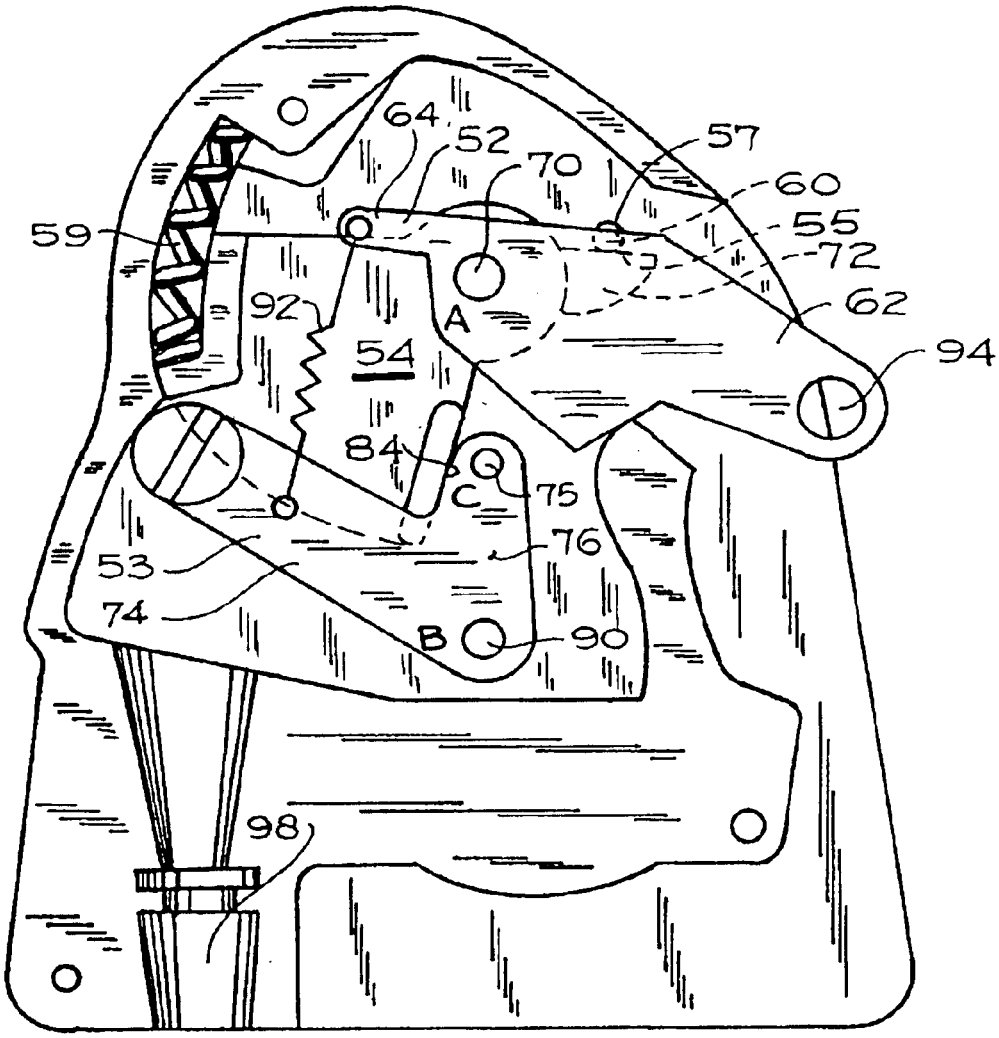
FIG. 11 is a front elevational view of the latch mechanism shown in FIG. 7, with the latch mechanism locked and with the right control element actuated.

Referring to FIGS. 4 and 7–12, it can be seen that the right control element 52 preferably has a first pivot point A (see FIGS. 8–12), an abutment post 60, a linkage end 62, and a lever end 64 opposite the linkage end 62. The abutment post 60 is preferably in abutting relationship with a ledge 72 of the pawl 54 at a bearing surface 55 of the pawl 54. Therefore, as shown in FIG. 11, when an actuating force is exerted (downwardly) against the linkage end 62 of the right control element 52, the right control element 52 rotates in a clockwise direction about the abutment post 60 which acts as a fulcrum for the right control element 52 and as a bearing surface against the bearing surface 55 of the pawl 54. However, if the right control element 52 is also engaged for rotation about pivot point A, the same actuation force against the linkage end 62 of the right control element 52 rotates the right control element 52 and the pawl 54 together about pivot point A (rather than rotating the right control element 52 about the abutment post 60). In this latter case, the abutment post 60 acts as a bearing surface against the bearing surface 55 of the pawl 54 as the pawl bearing surface 55 is pushed downward. It can thus be seen that by engaging and disengaging the right control element 52 for pivotal movement about pivot point A, actuation of the right control element 52 will either rotate the pawl 54 or not rotate the pawl 54, respectively. FIG. 9 thus defines an unlocked state of the latch assembly 10 (with the right control element 52 engaged for rotation about pivot point A) because rotation of the pawl 54 will cause release of the ratchet 22 and the striker 20 (see FIG. 14). Also, FIG. 11 thus defines a locked state of the latch assembly 10 (with the right control element 52 disengaged from rotation about pivot point A) because the pawl 54 does not rotate with the right control element 52 to release the ratchet 22 and the striker 20 (see FIG. 13). To better control the movement of the right control element 52 either in its locked state or in its unlocked state, highly preferred embodiments of the present invention have a groove 57 in the housing 16 within which the abutment post 60 of the right control element 52 is received (see FIGS. 4 and 5). When the right control element 52 pivots about the abutment post 60, the abutment post 60 rotates in place at the top of the groove 57, held there by the bearing surface 55 of the pawl 54. When the right control element 52 is instead engaged for pivotal movement about pivot point A, the abutment post 60 travels down the groove 57 while it pushes the pawl 54 in a clockwise direction.

With the above relationship between the right control element 52 and the pawl 54 in mind, switching between the locked and unlocked states of the right control element 52 is therefore ultimately dependent upon disengagement and engagement operations, respectively, of the right control element 52 for rotation about pivot point A. Such operations can be performed in a number of ways. The most highly preferred method in the present invention is via a pin 66 (see FIG. 5) selectively retracted and extended by a high-speed actuator 68. When the actuator 68 is placed in its extended position, the pin 66 is preferably inserted into an aperture 70 (see FIGS. 7–12) in the right control element 52 at pivot point A, thereby controlling the right control element 52 to rotate about pivot point A when actuated by a user. When the actuator 68 is placed in its retracted position, the pin 66 is preferably retracted from the aperture 70, thereby permitting the right control element 52 to pivot about the abutment post 60. The arrangement just described therefore reduces the time for placing the control element 52 in its locked and unlocked positions to the time required for disengaging and engaging the right control element 52 with the pin 66. This time can be quite short depending upon the type of actuator 68 used. In contrast to prior art devices which require engagement elements which operate parallel to the plane of motion of the control elements, the engagement elements of the present invention operate perpendicular to the plane of motion of the control elements. This arrangement also reduces the forces required to move the engagement elements. Accordingly, an actuator with a relatively short stroke can be used to place the control elements 52, 53 in their locked and unlocked states, which generally results in a faster motion. In fact, in highly preferred embodiments of the present invention, actuator extension and retraction operations can be completed in under 10 milliseconds. Prior art devices require significantly more time to perform comparable latch assembly operations. Of course, one or more manual actuators can instead be used in the present invention to manually insert the pin 66 or move any other engagement element into engagement with the control elements 52, 53. The actuators described herein and the other major components of the latch assembly 10 are preferably constructed as modules, enabling ready replacement or substitution.

Figure 12:
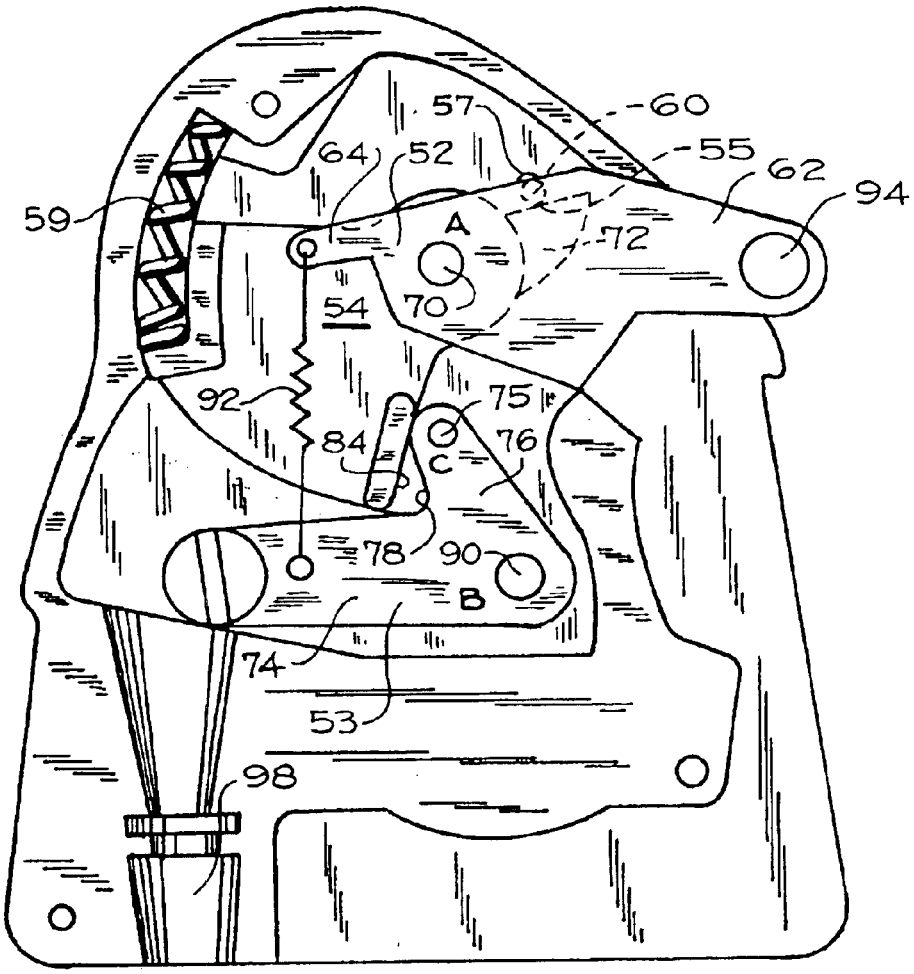
FIG. 12 is a front elevational view of the latch mechanism shown in FIG. 7, with the latch mechanism locked and with the left control element actuated.

Following along very similar structural and operational principles as the right control element 52, the left control element 53 also has a first pivot point B, a linkage end 74, a lever end 76 opposite the linkage end 74, and a rotation peg 75 defining a second pivot point C. Although the left control element 53 is also preferably a lever, in the preferred embodiment of the present invention shown in the figures, the left control element 53 is L-shaped and preferably has a cam surface 78 located adjacent the pawl 54. Therefore, and as shown in FIG. 12, when an actuating force is exerted (downwardly) against the linkage end 74 of the left control element 53, the left control element 53 preferably rotates in a counterclockwise direction about the rotation peg 75. Accordingly, the left control element 53 does not act upon the pawl 54 during rotation of the left control element 53 about the rotation peg 75 as shown in FIG. 12. To prevent unwanted translational movement of the rotation peg 75 during the counterclockwise rotation of the left control element 53, the rotation peg 75 preferably rests in a groove 80 of the cover plate 82 (see FIGS. 4 and 5). Of course, other well known elements can be used to prevent this translation, such as a ledge or rib extending from the rear surface of the cover plate 82.

However, if the left control element 53 is engaged for rotation about pivot point B, the same actuation force against the linkage end 74 of the left control element 53 rotates the left control element 53 to press the cam surface 78 of the left control element 53 into a cam surface 84 of the pawl 54, thereby rotating the pawl 54 about the upper pivot post 34. It can thus be seen that by engaging and disengaging the left control element 53 for pivotal movement about pivot point B, actuation of the left control element 53 will either rotate the pawl 54 or not rotate the pawl 54, respectively. FIG. 10 thus defines an unlocked state of the latch assembly 10 (with the left control element 53 engaged for rotation about pivot point B), because rotation of the pawl 54 will cause release of the ratchet 22 and the striker 20. Also, FIG. 12 thus defines a locked state of the latch assembly 10 (with the left control element 53 disengaged from rotation about pivot point B) because the pawl 54 does not rotate under camming force exerted by the left control element 53 to release the ratchet 22 and the striker 20.

As with the right control element 52, switching between the locked and unlocked states of the left control element 53 is therefore ultimately dependent upon disengagement and engagement operations, respectively, of the left control element 53 for rotation about pivot point B. Also as with the right control element 52, the preferred method of performing such operations in the present invention is via a pin 86 (see FIG. 5) selectively retracted and extended by a high-speed actuator 88. When the actuator 88 is placed in its extended position, the pin 86 is preferably inserted into an aperture 90 (see FIGS. 7–12) in the left control element 53 at pivot point B, thereby controlling the left control element 53 to rotate about pivot point B when actuated by a user. When the actuator 88 is placed in its retracted position, the pin 86 is retracted from the aperture 90, thereby controlling the left control element 53 to pivot about its rotation peg 75 when actuated by a user. The arrangement just described therefore reduces the time for placing the left control element 53 in its locked and unlocked positions to the time required for disengaging and engaging the left control element 53 with the pin 86. This time can be quite short depending upon the type of actuator 88 used).

For proper positioning of the right and left control elements 52, 53 within the latch assembly 10, the latch assembly 10 preferably has at least one control element spring 92 (see FIGS. 7–12). In the most preferred embodiment of the present invention, one control element spring 92 is connected in a conventional manner between the ends 64, 74 of the right and left control elements 52, 53, respectively. Preferably, the control element spring 92 is connected to each end 64, 74 by being hooked onto posts formed near the ends 64, 74. However, the control element spring 92 can be fastened to the ends 64, 74 in a number of other well known manners (e.g., via a fastener securing the ends of the spring 92 in place upon the ends 64, 74, via welding, glue, epoxy, etc.). The control element spring 92 acts to bias the control elements 52, 53 toward one another and into their unactuated positions shown in FIG. 8.

One having ordinary skill in the art will recognize that the particular control element spring 92 and its location within the latch assembly 10 shown in the figures is only one of a number of different control element spring types and locations serving this biasing function. For example, two or more control element springs can instead be used to bias the control elements 52, 53 into their unactuated positions. In such a case, the control element springs can be attached between the ends 64, 74 and the housing 16. Alternatively, the control element springs can be of a different form than the extension spring shown in the figures. For example, the control element springs can be coil, torsion, or leaf springs arranged in the latch assembly 10 to bias the control elements 52, 53 as described above. Such alternate biasing elements and arrangements fall within the sprint and scope of the present invention.

Prior to describing the actuators 68, 88 and their operation in more detail, the mechanical actuation of the control elements 52, 53 will now be described. Each control element 52, 53 is provided with a linkage end 62, 74 upon which external forces are preferably exerted to actuate the control elements 52, 53. In the case of the right control element 52, the linkage end 62 is preferably an arm of the right control element 52 having an aperture 94 therethrough at its terminal portion. In the case of the left control element 53, the linkage end 74 is preferably a post having an aperture 96 therethrough. When the latch assembly 10 is installed, an external linking element (not shown) is connected via the aperture 94 to the right control element 52 and an external linking element (also not shown) is connected via the aperture 96 to the left control element 53. Herein and in the appended claims, the terms "linking element" and "input element" are used interchangeably. Because the left control element 53 is preferably located fully within the latch assembly 10, the linking element is passed through a port 98 within the housing 16 and the cover 12 of the latch assembly 10. Of course, the port 98 can take any number of shapes and locations within the housing 16 and/or the cover 12 to permit the external linking element to be connected inside the latch assembly 10 to the left control element 53.

In the highly preferred embodiment of the present invention shown in the figures, the linking element connected in a conventional fashion to the right control element 52 is preferably a bar or member connected and directly actuated by, e.g., a door handle, while the linking element connected to the left control element 53 is preferably a cable which is secured in a conventional fashion to the linkage end 74. The linking element connected to the left control element 53 is preferably passed out of the latch assembly 10 through the port 98. It should be noted that although cables are preferred, other types of linking elements can be used, such as rods, bars, chains, string, rope, etc. In fact, the linking elements can even be made integral to or extensions of the control elements 52, 53 themselves. The particular type of linking element used is dependent at least in part upon the shape, size, and position of opening(s) in the cover 12 and/or the housing 16 to permit the control elements 52, 53 to be connected to the external linking elements. The particular type of linking element used can also depend upon whether attachment of the control elements 52, 53 to the linking elements is accomplished externally of the cover 12 and/or the housing 16 (such as in the case of the right control element 52 shown in the figures) or internally (such as in the case of the left control element).

The latch assembly 10 described above and illustrated in the figures finds particular application for doors having two handles, such as an internal handle and an external handle. In this application, one handle is connected to the right control element 52 and the other handle is connected to the left control element 53 via the linking elements described above. Therefore, actuation of one handle actuates one control element while actuation of the another handle actuates the other control element. The manner of connection of the linking elements to the handles is well known to those skilled in the art and is therefore not described further herein. It should also be noted that the linking elements need not necessarily be attached to door handles. Especially where the latch assembly 10 is used in applications not involving vehicle doors (or indeed, any type of door), the control elements 52, 53 can be actuated either indirectly via linking elements or directly to operate the latch assembly 10. Any number of conventional elements and mechanisms can be linked to the control elements 52, 53 to effect their actuation as desired. As described above, the type of movement of the control elements 52, 53 (when actuated) is dependent upon whether the pins 66, 86 are extended or retracted to engage with the control elements 52, 53. When the pins 66, 86 are extended by the actuators 68, 88 to engage the control elements 52, 53, the control elements 52, 53 preferably pivot about pivot points A and B, respectively, which permits the control elements 52, 53 to exert motive force to the pawl 54. The term "motive force" as used herein and in the appended claims means that force is transferred that is sufficient to generate motion of an element, and is not limited to any manner in which such force is transferred (e.g., by physical contact, magnetic repulsion or attraction, etc.). When the pins 66, 86 are retracted by the actuators 68, 88 to disengage from the control elements 52, 53, the control elements 52, 53 preferably pivot instead about abutment post 60 and rotation peg 75, respectively, which prevents the control elements 52, 53 from exerting force upon the pawl 54 sufficient to move (rotate) the pawl 54. Because the speed in which the control elements 52, 53 are placed in their locked and unlocked states is thus dependent upon the speed of the actuators 68, 88 to move the pins 66, 86, it is desirable to use the fastest actuator type economically reasonable for the actuators 68, 88. In the most preferred embodiment of the present invention, the actuators 68, 88 are each a two-position residual magnetic latching electromagnetic solenoid such as those commercially available from and sold by TLX Technologies of Waukesha, Wis. However, other conventional actuator types are possible, including other types of solenoids, conventional hydraulic or vacuum actuators, small motors, and even elements or assemblies which are manually operated to push and retract the pins 66, 86 to place the control elements 52, 53 into their locked and unlocked positions. Though not as preferred as two-position electromagnetic solenoids, these alternative actuators fall within the spirit and scope of the present invention.

The actuators 68, 88 are preferably connected to an electronic control circuit which is controllable by a user for placing the actuators 68, 88 in their engaged and disengaged states, thereby placing the latch assembly 10 in its unlocked and locked states, respectively. Upon command by the user, the electronic control circuit preferably generates electronic pulses to the actuators 68, 88 for controlling their movement. To secure against accidental or unauthorized actuation, a coded signal can be sent to the electronic control circuit. Coding of electronic signals is well known to those skilled in the art and is not therefore discussed further herein. The electronic control circuit can be powered in a conventional manner, such as by a battery, an alternator, a generator, a capacitor, a vehicle electrical system or other conventional power source.

With reference to the preferred embodiment of the present invention, the actuators 68, 88 are electromagnetic solenoids which can retain residual magnetism to hold the actuators 68, 88 in their retracted positions once they are moved thereto. When the actuators 68, 88 are moved to their extended positions, conventional springs (not shown) are preferably used to maintain their positions in the extended states. Therefore, when the actuators 68, 88 are in their retracted positions and held therein via the residual magnetism, a power pulse from the electronic control circuit is used to break the residual magnetism and to thereby extend the actuators 68, 88 via the springs into their extended positions. Conversely, when the actuators 68, 88 are in their extended positions and held therein by the springs, a power pulse from the electronic control circuit is used to force the actuators 68, 88 into their retracted positions against the force of the springs, and residual magnetism is used to keep the actuators 68, 88 in these positions.

In a highly preferred embodiment of the present invention, the electronic control circuit just described contains at least two power sources for the actuators 68, 88 in the latch assembly 10. These power sources can comprise any conventional power sources including, without limitation, capacitors, batteries, alternators, generators and vehicle electrical systems. For illustrative purposes only, a first power source is described herein as a battery and a second power source is described as a capacitor. During normal operation when the latch assembly 10 is powered continuously by the battery 120, each capacitor 124 is continuously charged. Each capacitor 124 stores sufficient energy to break the residual magnetism of the electromagnetic solenoids 68, 88. In the event of total power failure, the control circuit can automatically discharge the capacitors 124 to cause the actuators 68, 88 to unlock the latch assembly 10. The latch assembly 10 can be completely unlocked or partially unlocked upon power failure. When the latch assembly 10 is used on a vehicle door, only the portion of the latch assembly 10 actuated by an inside door handle will be unlocked. This configuration enables the vehicle occupant to exit the vehicle while maintaining security against unauthorized entry. Alternatively, the user can unlock the latch assembly 10 manually (e.g., using a switch) using energy stored by the capacitors. Further, it may instead be desirable to have one capacitor for each actuator 68, 88 with enough charge to place the solenoids 68, 88 in their retracted positions. Therefore, even with power disconnected from the latch assembly 10, there exists sufficient charge in the control circuit to lock the latch assembly 10 (either under command of the user or automatically by the control circuit). With multiple capacitors for each actuator 68, 88, a preferred embodiment of the present invention has one capacitor for each actuator 68, 88 with sufficient energy to place the actuator 68, 88 in its locked position and another capacitor for each actuator 68, 88 with sufficient energy to place the actuator 68, 88 in its unlocked position.

The electronic control circuit is preferably also provided with a conventional electrical characteristic sensing circuit for detecting the power supplied to the electronic control circuit. Such sensing circuits (e.g., voltage or current sensing circuits) are well known to those skilled in the art and are therefore not described further herein except for the generalized example shown in FIG. 15. When the sensing circuit detects a change in an electrical characteristic beyond a predetermined level such as low voltage or current level, or loss of power such as due to a disconnected or failed power source, the control circuit preferably generates a signal to the actuators to place them in their unlocked positions to unlock the latch assembly 10. Alternately, (though not preferred) when the sensing circuit detects the change, the control circuit can instead enable a control or button that can be actuated by the user to unlock the latch.

Figure 15:
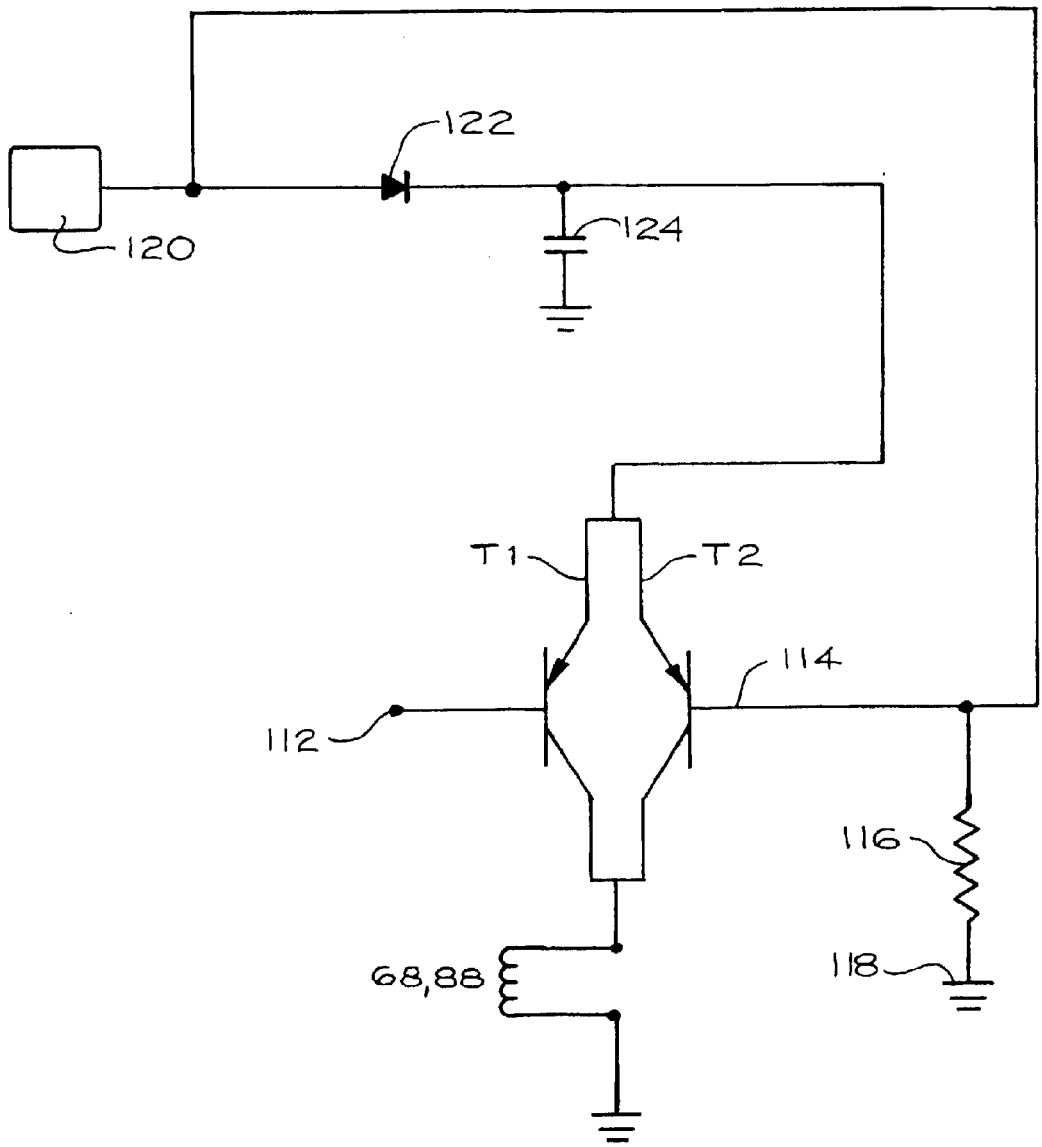
FIG. 15 is a schematic diagram of a control circuit for the latch assembly of the present invention according to a preferred embodiment of the present invention.

An exemplary automatic unlocking circuit 110 for unlocking the latch assembly 10 is shown in FIG. 15. It will be apparent to one of ordinary skill in the art that a wide variety of circuits and components different than that illustrated in FIG. 15 and described below can be used equivalently. T1 and T2 are two PNP-type transistors connected in parallel. During typical operation, a delatching pulse applied at node 112 activates transistor T1 and preferably comprises a conventional controlled voltage pulse sufficient to delatch the solenoid 68, 88.

Transistor T2's base 114 is preferably connected to a resistor 116 connected to ground 118, and is also preferably connected to a 12 volt battery or other voltage source 120 such as in a conventional vehicle electrical system.

When 12 volts D.C. from the battery 120 is present, T2 is non-conducting and T1 is non-conducting unless pulsed to ground 118. The diode 122 keeps the capacitor 124 from discharging back to the rest of the system.

Accordingly, the capacitor 124 only discharges when one of the battery's electrical characteristics such as voltage level falls below a predetermined level. When this occurs, the base of T2 approaches ground 118. Therefore, T2 turns on fully and the capacitor 124 can discharge through T2 and send a release pulse through the solenoid 68, 88 thereby delatching the solenoid 68, 88 and unlocking the latch assembly 10.

In addition to all of the preferred embodiments previously described, it will be appreciated by one having ordinary skill in the art that the particular arrangement and operation of the actuators 68, 88 described above for the most preferred embodiment of the present invention can take a number of other forms within the spirit and scope of the present invention. For example, the residual magnetism exerted upon the actuators 68, 88 to keep them in their retracted positions can instead be exerted upon the actuators 68, 88 to keep them in their extended positions, and the springs keeping the actuators 68, 88 in their extended positions can instead be used to keep the actuators 68, 88 in their retracted positions (i.e., the opposite solenoid arrangement as that described above). In such an arrangement, the latch assembly can operate in a similar manner as described above, with a dual power source (e.g., battery and capacitor), with a sensing circuit, and/or with similar electronic circuitry. Such an arrangement can be particularly useful in applications where it is desirable to place or keep the latch assembly 10 in its locked state in the event of power loss. When power is lost, interrupted, or otherwise changed in a predetermined manner, the sensing circuit preferably triggers the actuators to retract using the dual power source arrangement described above, thereby placing the latch assembly in its locked state.

Other embodiments of the present invention employ conventional solenoids using permanent magnets. These magnets retain the solenoid's armatures in both extended and retracted positions as is well known in the art. Other well known systems and elements can be used to achieve the function of the capacitors described above, and well known mechanical and electrical systems and elements can be used as alternatives to the springs and residual magnetism employed to control the positions of the actuators 68, 88.

As indicated above, many alternatives to the use of electromagnetic solenoids for the actuators 68, 88 exist and are well known to those skilled in the art. For example, the actuators can each be a rack and pinion assembly. As another example, the actuators can each be a motor turning a worm gear that meshes with an element (e.g., a threaded pin) to push and pull the element toward and away from the control elements 52, 53. The element can instead be a wheel having teeth meshing with the worm gear. In such an arrangement, rotation of the worm gear causes rotation of the wheel. A pin or rod attached to the circumference of the wheel can then be moved toward or away from the control elements 52, 53 via rotation of the wheel. All other well known mechanisms for quickly extending and retracting a pin or other engagement element are useful with and fall within the spirit and scope of the present invention.

Figure 46:
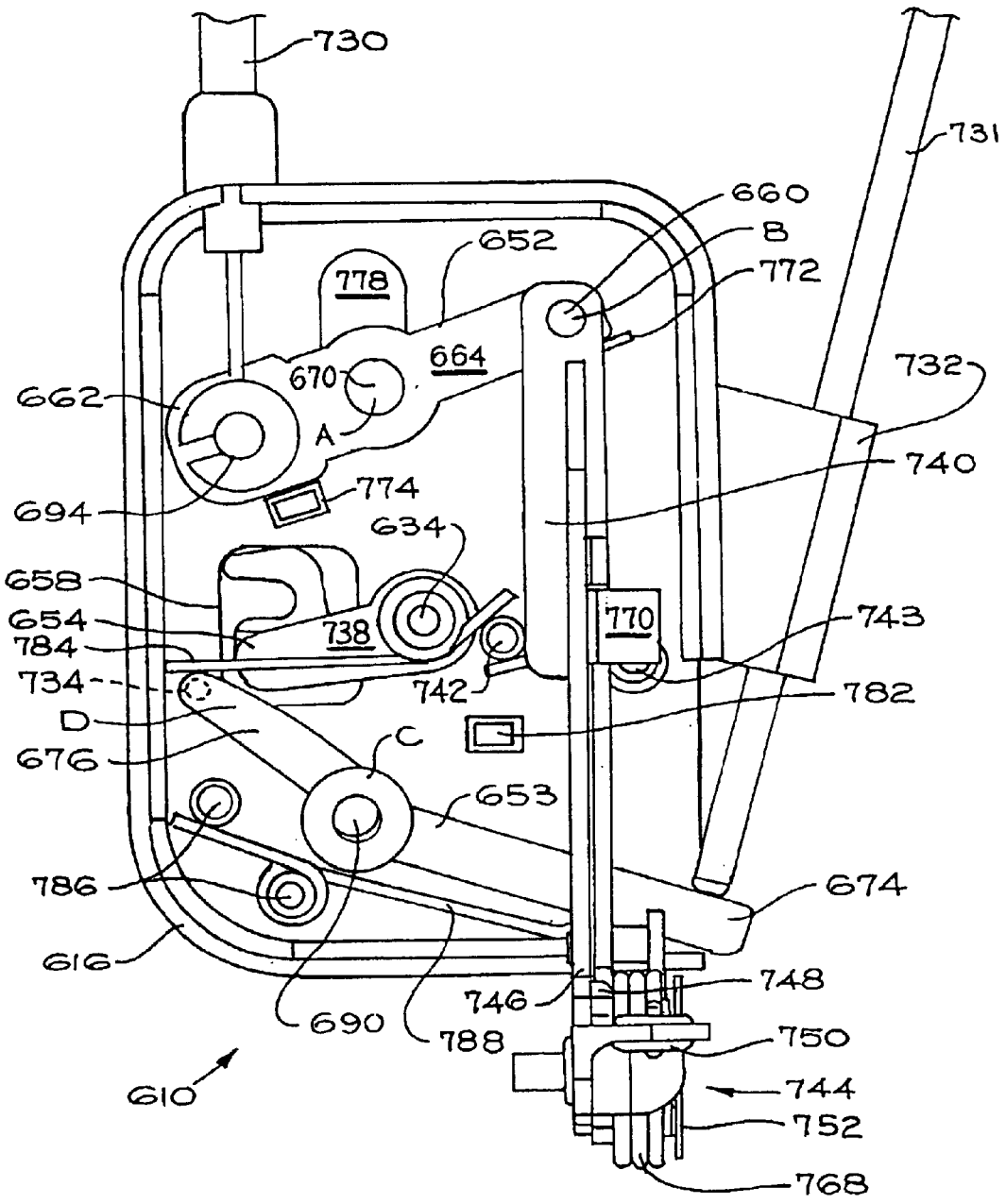
FIG. 46 is a front elevational view of the latch mechanism shown in FIGS. 35–45, with the latch mechanism deadlocked and with the lower control element actuated.

The actuators 68, 88 in the preferred embodiment of the present invention are preferably contained and substantially enclosed in the cover 12 and are preferably encapsulated therein by the cover plate 82 as best shown in FIGS. 46. The cover plate 82 is preferably provided with apertures 100, 102 for receiving the pins 66, 86, respectively, which extend beyond the cover plate 82 when in their extended positions to interact with the control elements 52, 53. The cover plate 82 also helps to protect the actuators 68, 88 from debris, dirt, etc., managing to enter the latch assembly 10 between the cover plate 82 and the housing 16, and helps to control movement of the pins 66, 86.

The pins 66, 86 are preferably mounted to or integral with the armatures of the actuators 68, 88. It will be apparent to one of ordinary skill in the art that the pins 66, 86 need not necessarily be mounted to or be part of the armatures. Instead, the pins can be mounted to pin plates 104, 106 as shown in the figures. Further, depending largely upon the type of actuator used, the pins 66, 86 can extend within the actuators 68, 88 which directly control the movement of the pins 66, 86 into and out of the apertures 100, 102 in the cover plate 82. Other pin arrangements will be recognized by those skilled in the art and are encompassed by the present invention.

In operation, the user of the preferred embodiment of the present invention described above has the ability to select from four locking modes of the latch assembly 10: unlocked, locked, child locked, and dead locked. In the unlocked mode, the electronic control circuit described above preferably sends a signal or signals to both actuators 68, 88 to place them in their extended positions in which the pins 66, 86 are also in their extended positions. The pins 66, 86 thus interact with the control elements 52, 53 to control the control elements 52, 53 to pivot about pivot points A and B. By pivoting about pivot points A and B, the control elements 52, 53 are able to move the pawl 54 and release the ratchet 22 to unlatch the latch assembly 10 when the control elements 52, 53 are actuated by a user. In this unlocked state, actuation of either control element 52, 53 (e.g., via the inside door handle or the outside door handle of a vehicle door) will therefore unlatch the latch assembly 10.

In the locked mode, the electronic control circuit preferably sends a signal or signals to one of the two actuators 68, 88 to place it in its retracted position and a signal or signals to the other actuator 88, 68 to place it in its extended position. In the case of the latch assembly 10 illustrated in the figures, the upper actuator 68 controls the position of the upper pin 66 which is either engaged or disengaged with the right control element 52, while the lower actuator 88 controls the position of the lower pin 86 which is either engaged or disengaged with the left control element 53. While the control elements 52, 53 can be connected directly to door handles, the right control element 52 is preferably coupled by a linking element to the outside door handle while the left control element 53 is preferably coupled by a linking element to the inside door handle. The linking elements can comprise conventional linkages, rods, cables, linear actuators, rotary actuators and the like for transmitting torque, tensile forces and/or compressive forces. Thus, for the arrangement just described, the upper actuator 68 controls the locked and unlocked states of the outside door handle, and the lower actuator 88 controls the locked and unlocked states of the inside door handle.

Prior to describing the child locked mode of the latch assembly 10, it should be noted that the term "child locked" is used herein for mode identification purposes only. The term itself is not intended to explicitly or implicitly define the arrangement and operation of the latch assembly 10. In general use of the term, "child locked" typically means that the inside door handle of a vehicle door is not operable to unlatch the door, and does not provide any information about the operability of the outside door handle. However, for mode identification purposes herein, the term "child locked" means that the inside door handle is inoperable and the outside door handle is operable.

In the child locked mode for the particular arrangement of the latch assembly 10 described above, the upper actuator 68 is preferably in an extended position (controlled by the electronic control circuit) and the upper pin 66 is engaged with the right control element 52. The right control element 52 is therefore in its unlocked state. The lower actuator 88 is preferably in a retracted position (also controlled by the electronic control circuit) and the lower pin 86 is disengaged from the left control element 53. The left control element 53 is therefore in its locked state. Actuation of the inside door handle then causes the left control element 53 to move, but not in a manner imparting motive force to the pawl 54 to unlatch the latch assembly 10. Actuation of the outside door handle causes the right control element 52 to pivot about pivot point A (engaged via the upper pin 66), thereby moving the pawl 54 to unlatch the latch assembly 10. Therefore, in the child locked mode, the latch assembly 10 can be unlatched by the outside door handle but not by the inside door handle. It should be noted, however, that the outside door handle can be put into a locked state independent of the child locked mode.

In the dead locked mode, the electronic control circuit preferably sends a signal or signals to both actuators 68, 88 to place them in their retracted positions in which the pins 66, 86 are also in their retracted positions. The pins 66, 86 thus do not interact with the control elements 52, 53, leaving the control elements 52, 53 to pivot about the abutment post 60 and the rotation peg 75, respectively. By pivoting about the abutment post 60 and the rotation peg 75, the control elements 52, 53 are unable to move the pawl 54 and release the ratchet 22 to unlatch the latch assembly 10 when the control elements 52, 53 are actuated by a user. In this dead locked state, actuation of either control element 52, 53 (e.g., via the inside door handle or the outside door handle of a vehicle door) will therefore not unlatch the latch assembly 10.

It will be appreciated by one having ordinary skill in the art that the principles of the present invention can be practiced with latch assemblies which are arranged in a significantly different manner than the preferred embodiment of the latch assembly 10 described above and illustrated in the drawings. Specifically, the connection of the upper actuator 68, upper pin 66, and right control element 52 to an outside door handle and the connection of the lower actuator 88, lower pin 86, and left control element 53 to an inside door handle can be reversed (i.e., the upper actuator 68 controlling the locked and unlocked states for the inside door handle and the lower actuator 88 controlling the locked and unlocked states for the outside door handle). In fact, the use of two actuators 68, 88, two pins 66, 86, and two control elements 52, 53 is only a preferred embodiment. More or fewer actuator, pin, and control element sets can be used depending upon the number of handles (or other user-actuated elements) desired to control the various locking modes of the latch assembly 10. For example, one set can be used if the door only has one handle for latching and unlatching the latch assembly 10. Also, multiple handles (or other user-actuated elements) can be coupled to the same control element, if desired. In such a case, an inside and an outside handle can operate always in the same mode: locked or unlocked.

The cover 12, housing 16, and cover plate 82 of the latch assembly 10 are preferably made of plastic. However, the cover 12, the housing 16, and the cover plate 82 can be made from any number of other materials, such as steel, aluminum, iron, or other metals, urethane, fiberglass or other synthetic materials, composites, refractory materials such as glass, ceramic, etc., and even relatively unusual materials such as wood or stone. Depending upon the type of material used, the cover 12 can be made in a number of manners, such as via a heat and/or pressure sintering process, casting, injection or other molding, curing, extruding, stamping, pressing, firing, welding, etc. The materials and methods just described are well known to those skilled in the art and are encompassed by the present invention.

The rear mounting plate 14, ratchet 22, and pawl 54 are preferably made of steel, and the right and left control elements 52, 53 are preferably made of a castable or moldable material such as zinc or plastic. However, these elements can also be made from a variety of other materials including those noted by way of example in the preceding paragraph. Preferably, the ratchet spring 40, the pawl spring 59, the control element spring 92, and the actuator springs (not shown) are each helical springs made of spring steel. However, one having ordinary skill in the art will recognize that any type of bias member capable of exerting motive force against the relevant elements can instead be used. Such other bias members include, without limitation, an elastomeric material such as rubber, urethane, etc. capable of storing and releasing an amount of force under pressure, magnets, fluid or gas-actuated diaphragms pressing against or pulling the device to be moved, vacuum or suction devices acting upon the element desired to be moved, electromagnets, electrical circuits or elements capable of generating a biasing force, etc. Of course, other spring types (such as conventional coil, torsion, or leaf springs) made from different spring materials can be used in lieu of the helical springs to accomplish the same functions. Although the manners in which the other types of bias members are fastened within the latch assembly can be quite different to create the same or similar biasing force described above, such other types of bias members fall within the spirit and scope of the present invention.

A second preferred embodiment of the present invention is illustrated in FIGS. 17–31. The latch assembly illustrated in FIGS. 17–31 operates on very similar principles to the latch assembly of the first preferred embodiment described above and illustrated in FIGS. 1–15. Elements of the second preferred embodiment which are comparable or which perform functions similar to those in the first preferred embodiment are therefore numbered in like manner in the 200 and 300 series. While the structure and operation of the latch assemblies in the first and second embodiments are substantially the same in many ways, the important structural and operational differences are described in detail below.

The latch assembly of the second preferred embodiment is designed for increased application flexibility and improved modularity. As will be described in greater detail below, the latch assembly 210 is well-suited for installation in a wide number of different door applications and can be used in applications where only limited latch functions are needed as well as in applications where full latch functionality is desired.

Figure 17:
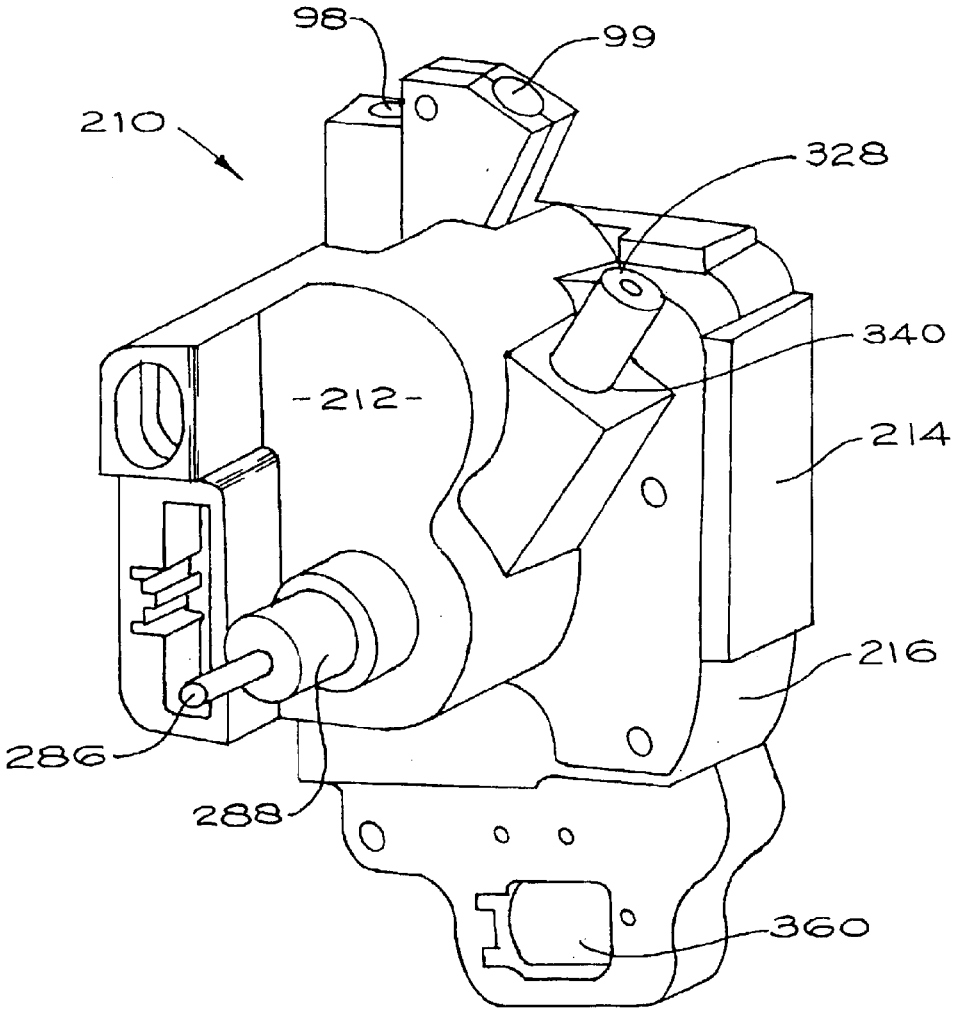
FIG. 17 is a front perspective view, looking down, of a latch mechanism according to a second preferred embodiment of the present invention.
Figure 18:
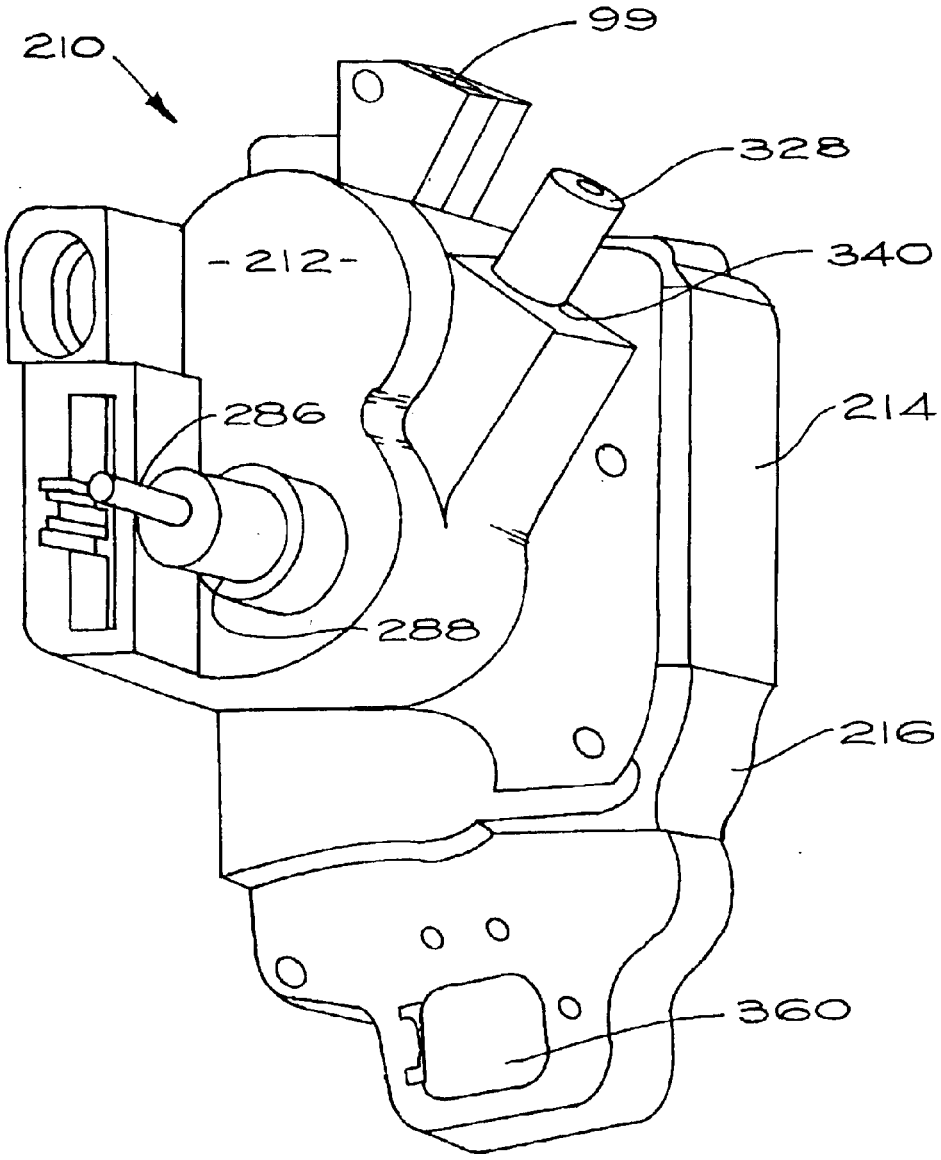
FIG. 18 is a front perspective view, looking up, of the latch mechanism shown in FIG. 17.
Figure 19:
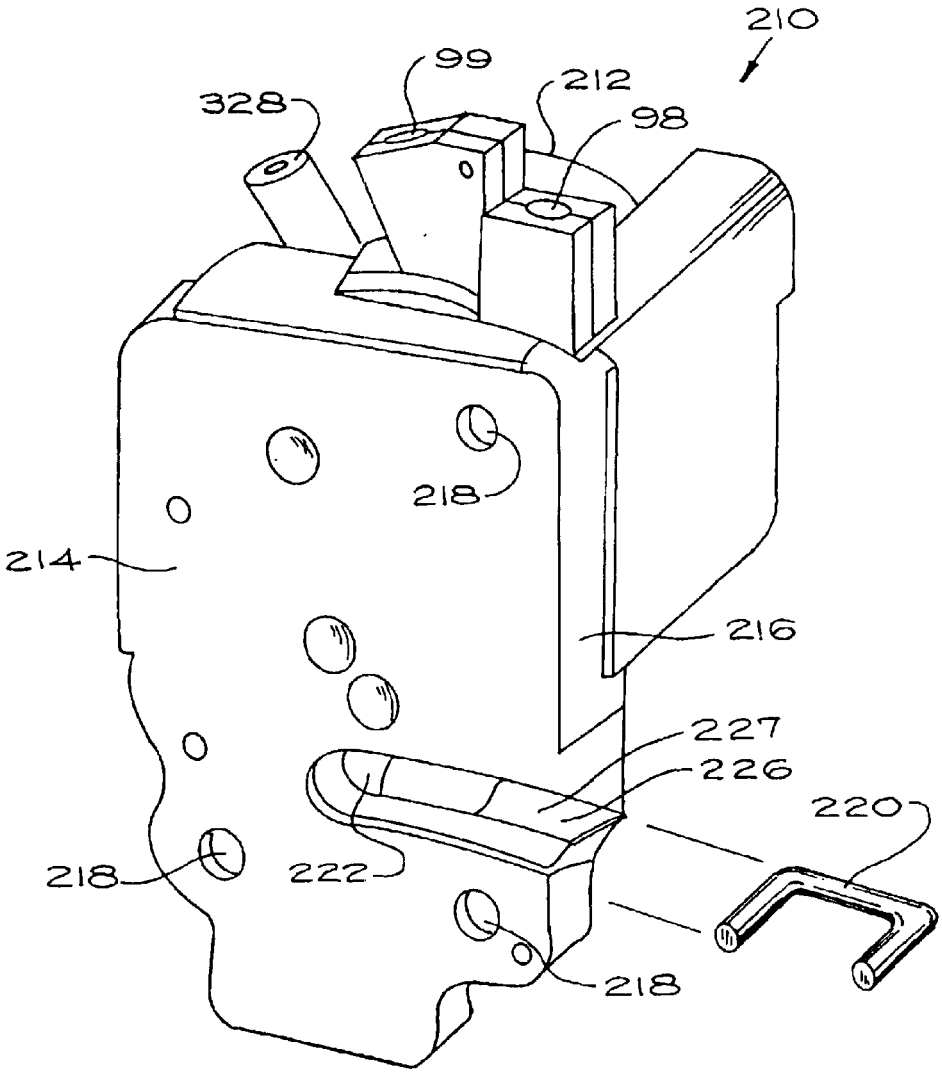
FIG. 19 is a rear perspective view, looking down, of the latch mechanism shown in FIGS. 17 and 18.
Figure 20:
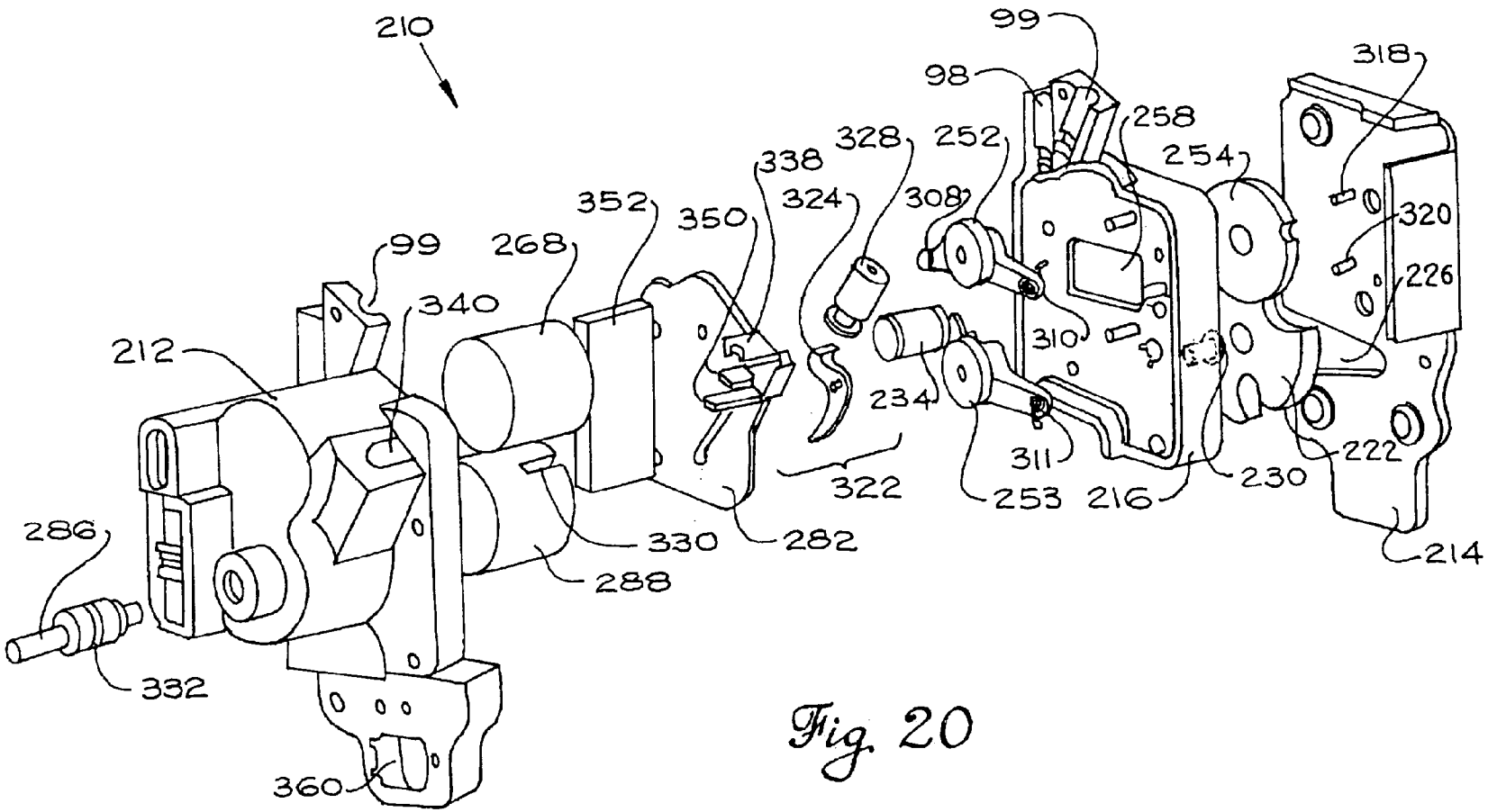
FIG. 20 is an exploded view of the latch mechanism shown in FIGS. 17–19, viewed from the front.
Figure 21:
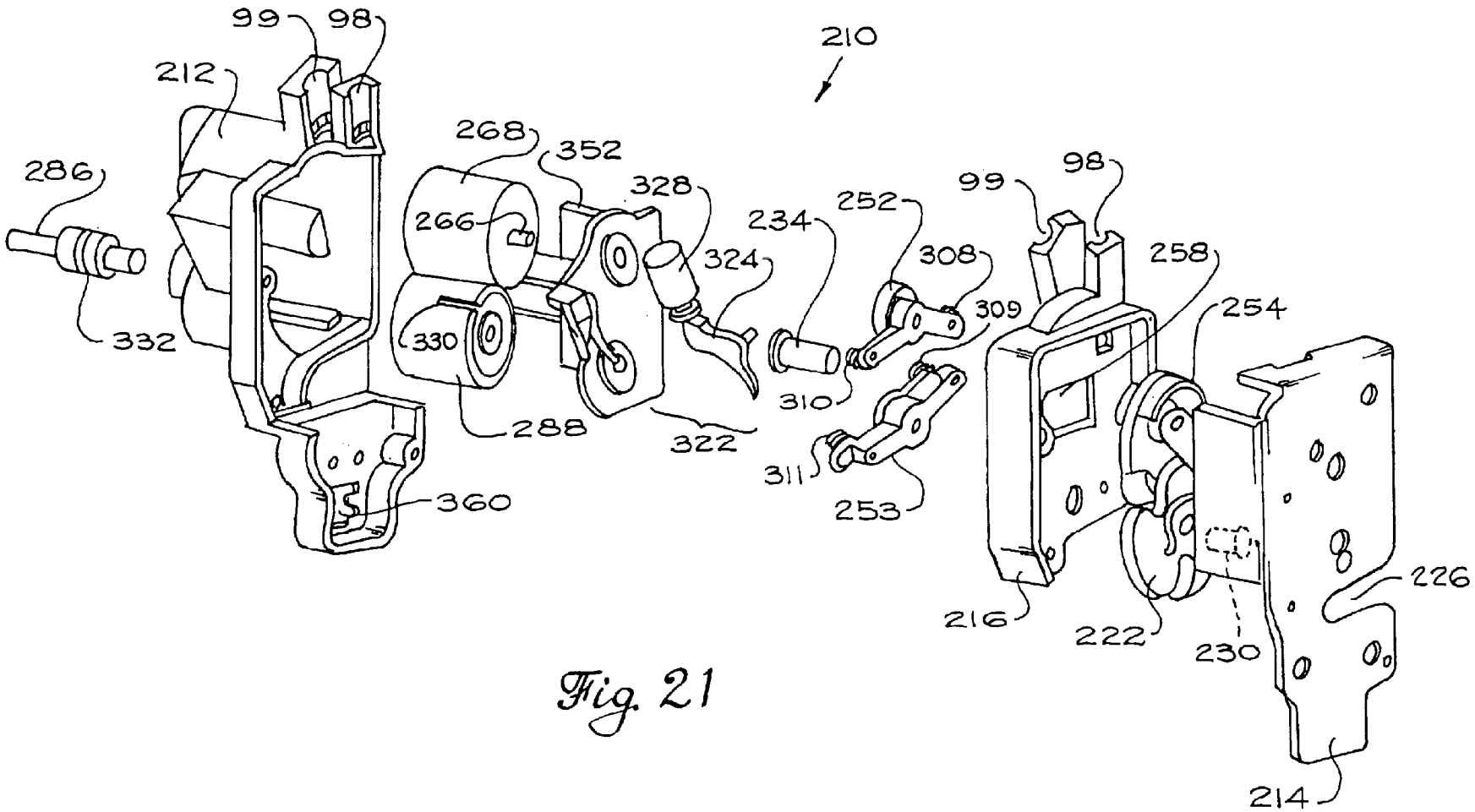
FIG. 21 is an exploded view of the latch mechanism shown in FIGS. 17–20, viewed from the rear.

With reference first to FIGS. 17–21, the latch assembly 210 preferably has a housing 216 sandwiched between a rear mounting plate 214 and a front cover 212 in much the same way as the latch assembly 10 of the first preferred embodiment. As can be seen in FIGS. 20–23, a circuit board 352 powered and capable of controlling the actuators 268, 288 in a conventional manner is preferably mounted upon the latch assembly 10, and is more preferably mounted to the front cover 212. With reference also to FIGS. 17 and 18, the latch assembly 210 can also have an aperture 360 for receiving a door ajar switch module (not shown), if desired. The aperture 360 is preferably located in the front cover 212 of the latch assembly 210, but can be located in another area of the latch assembly 210. The latch assembly 210 also preferably has two control elements 252, 253 movable within the housing 216 in two states (one in which actuators 268, 288 drive pins 266, 286 into apertures 270, 290 for control element rotation therearound and one in which the pins 266, 286 are not in the apertures 270, 290 and in which the control elements 252, 253 rotate in a different manner).

The control elements 252, 253 of the second preferred embodiment are shaped differently than those of the first preferred embodiment. However, each control element 252, 253 preferably still has a linkage end 262, 274, a lever end 264, 276, and an aperture 270, 290 for removably receiving a pin 266, 286 of an actuator 268, 288 therein. Each control element 252, 253 is preferably connected to the housing 216 by at least one torsion spring as shown in FIGS. 24–29. More preferably, the linkage ends 262, 274 and the lever ends 264, 276 of the control elements 252, 253 are each connected to the housing 216 by torsion springs 308, 309, 310, and 311, respectively. Most preferably, each torsion spring 308, 309, 310, 311 has an arm which is received within an groove, aperture, slot, or other aperture in the respective linkage end or lever end of the control elements 252, 253, and an arm which is received within a groove, aperture, slot, or other aperture in the housing 216. The torsion springs 308, 309, 310, 311 function to connect the control elements 252, 253 to the housing 216 and also to resiliently retain the rotational positions of the control elements 252, 253 as will now be discussed.

Figure 25:
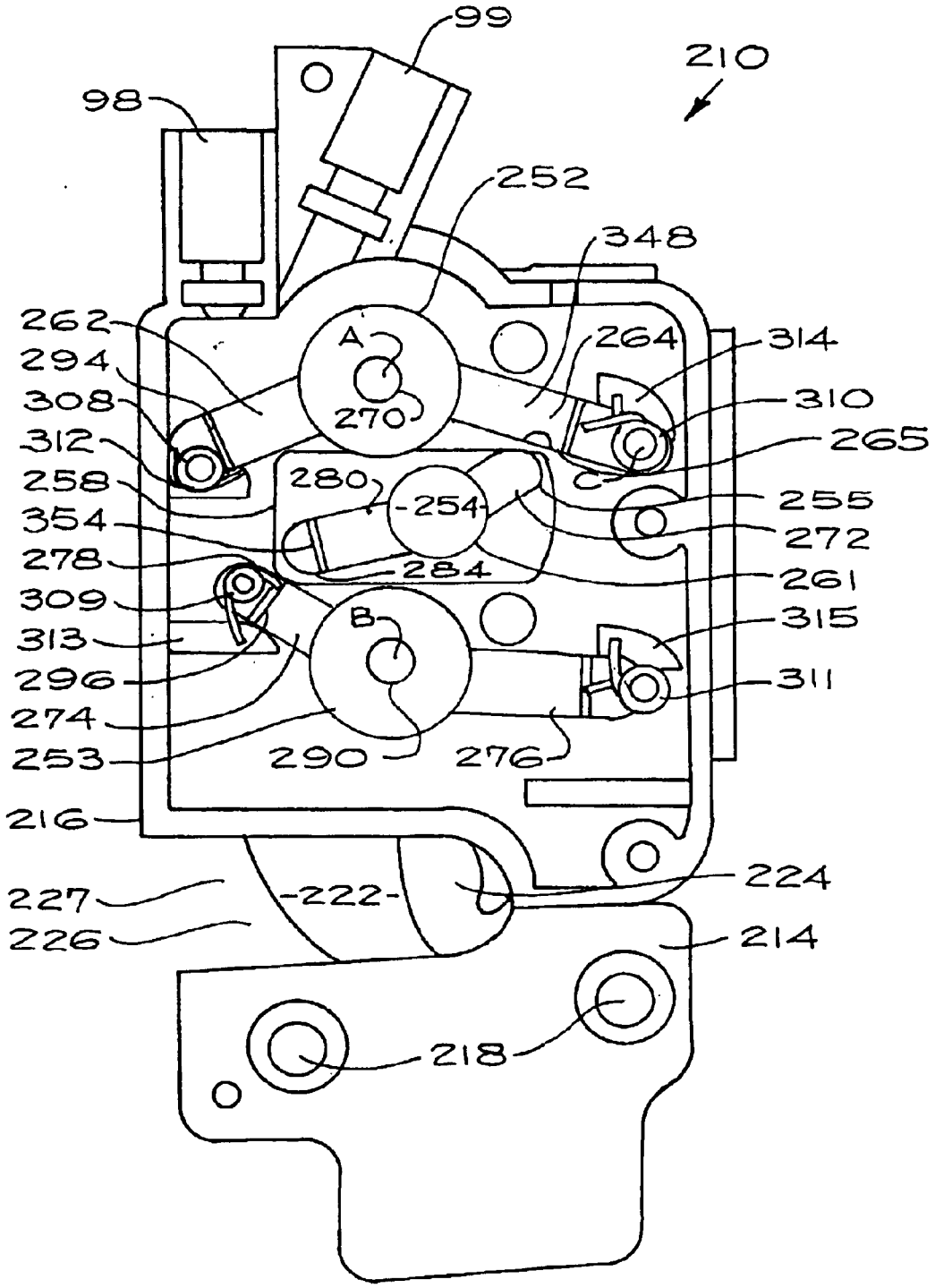
FIG. 25 is a front elevational view of the latch mechanism shown in FIG. 24, with both the upper and lower control elements in their unactuated positions.

FIG. 25 of the second preferred embodiment shows both control elements 252, 253 in their at-rest positions (not actuated). To assist in locating the control elements 252, 253 in these positions, the housing 216 is preferably provided with a number of stops 312, 313, 314, 315 which abut the ends 262, 274, 264, 276 of the control elements 252, 253 when the control elements 252, 253 are drawn to their at-rest positions by their torsion springs 308, 309, 310, 311. The stops 312, 313, 314, 315 are preferably curved walls shaped to match the curved ends of the control elements 252, 253, but can instead be any element (whether integral to the housing 216 or attached thereto in any conventional manner) or elements of sufficient size and strength to stop movement of the control elements 252, 253 under spring force by the torsion springs 308, 309, 310, 311. For example, such elements can instead be studs, posts, blocks, pins, and the like extending from the surface of the housing 216, laterally from the sides of the housing 216, from the rear side of the cover plate 282, etc.

One having ordinary skill in the art will appreciate that many other biasing elements can be used in place of torsion springs 308, 309, 310, 311 to bias the control elements 252, 253 to their at-rest positions. For example, extension, compression, leaf, or other types of springs in the latch assembly can bias the control elements 252, 253 into their at-rest positions. With reference to the discussion above regarding alternative bias elements in the first preferred embodiment of the present invention, still other bias elements can be used in place of the torsion springs 308, 309, 310, 311.

The bias elements (i.e., torsion springs) used to bias the control elements 252, 253 into their at-rest positions can be connected in a number of different manners well known to those skilled in the art. For example, each bias element can be connected at one end to an end of a control elements 252, 253 and to another end at a stop 312, 313, 314, 315 as shown in the figures, to the face of the housing 216, to the rear face of the cover plate 282, and the like. As another example, torsion springs can be fitted about the central portion of the control elements 252, 253 and be attached at one end to the housing 216 or to the cover plate 282 to resist clockwise motion of the control elements 252, 253. Although it is preferable to insert the ends of the springs into apertures, grooves, slots or other apertures as shown in the figures, several well-known spring arrangements do not require any spring-receiving element in which to insert the spring ends. For example, the spring ends can wrap around posts or studs on the housing 216 and control elements 252, 253, can be attached to the housing 216 and control elements 252, 253 in any conventional manner (e.g., via welding, gluing, riveting, bolting, and the like), etc.

Figure 28:
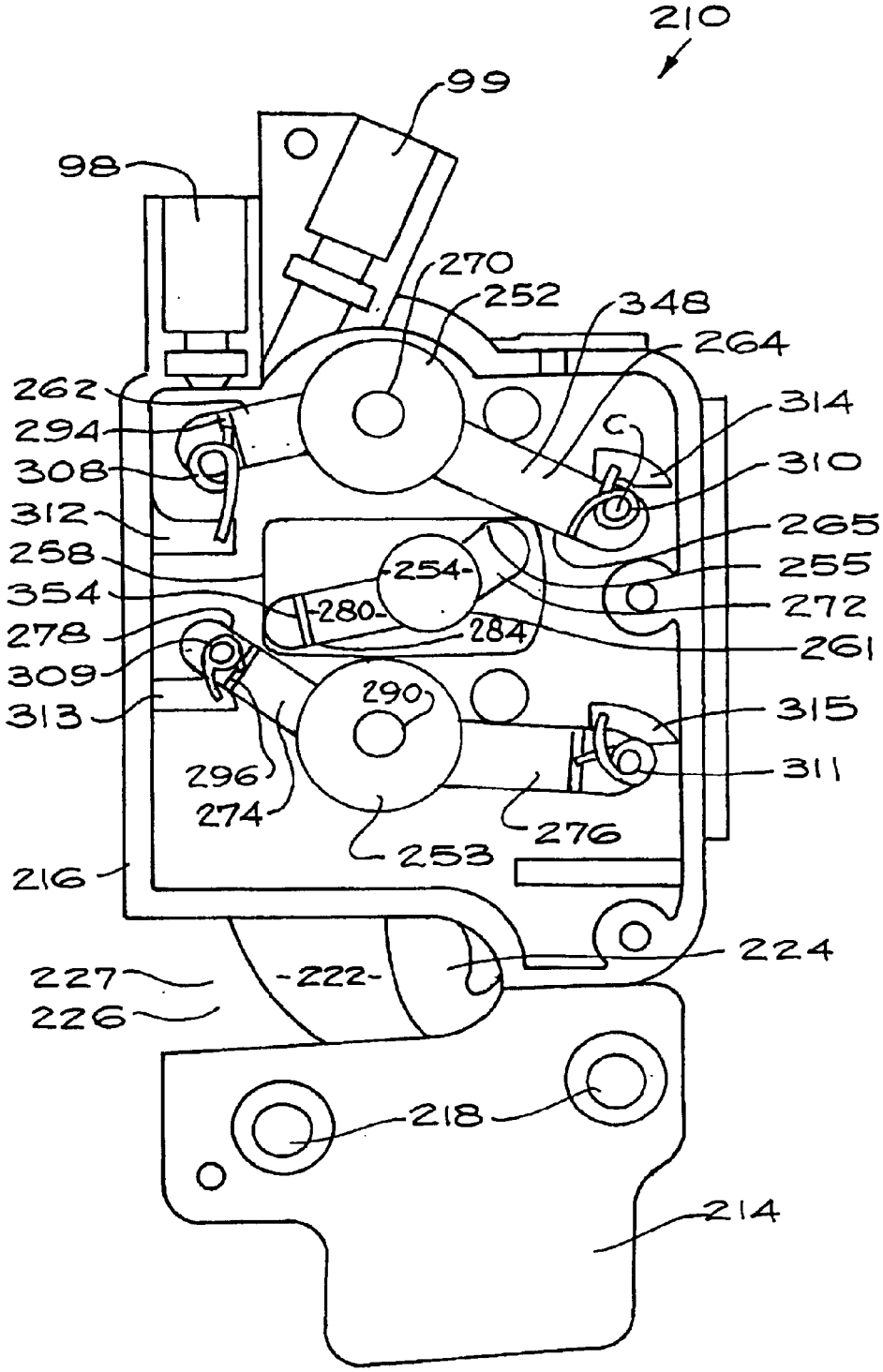
FIG. 28 is a front elevational view of the latch mechanism shown in FIG. 24, with the latch mechanism locked and with the upper control element actuated.
Figure 29:
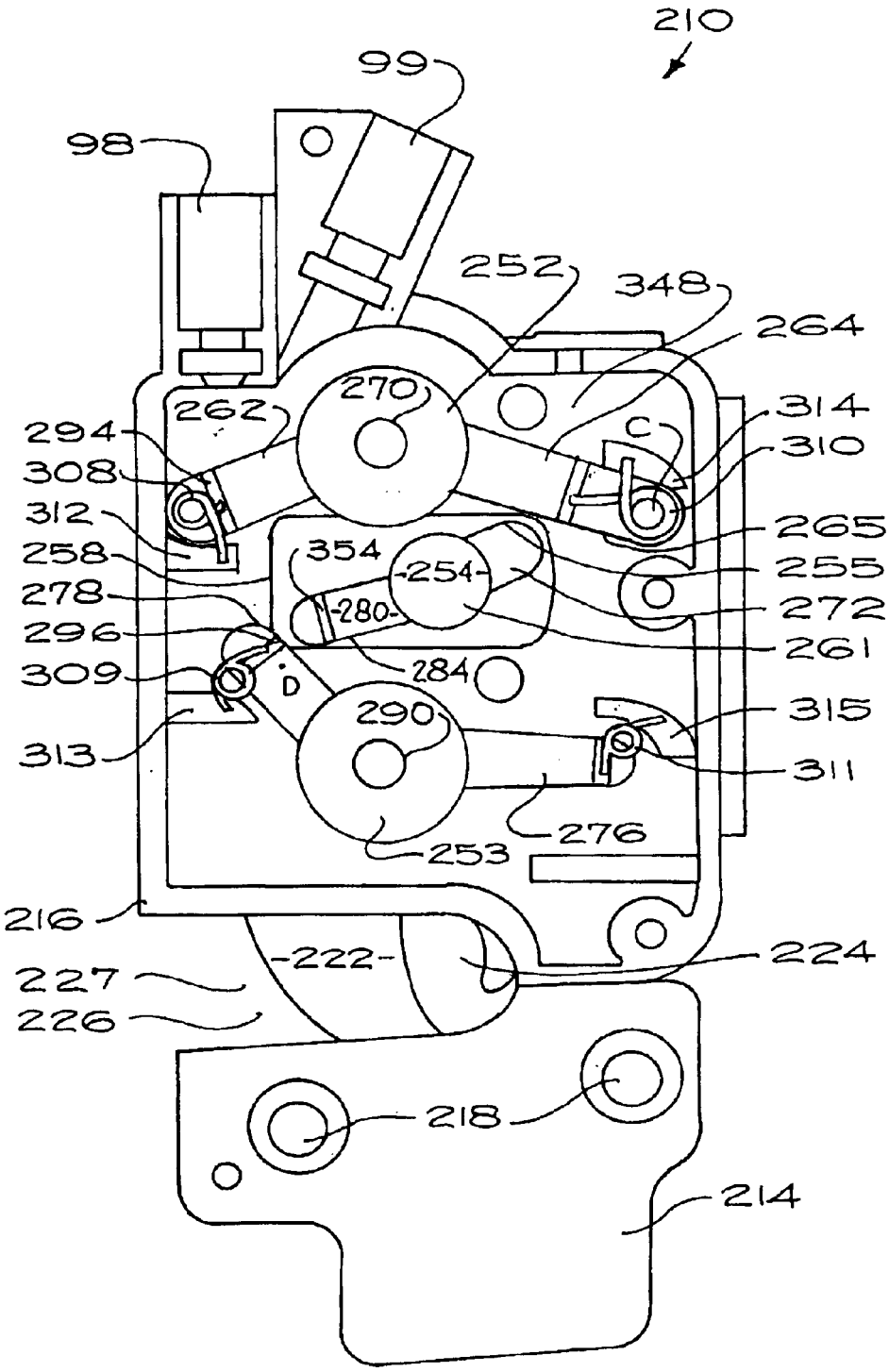
FIG. 29 is a front elevational view of the latch mechanism shown in FIG. 24, with the latch mechanism locked and with the lower control element actuated.
Figure 30:
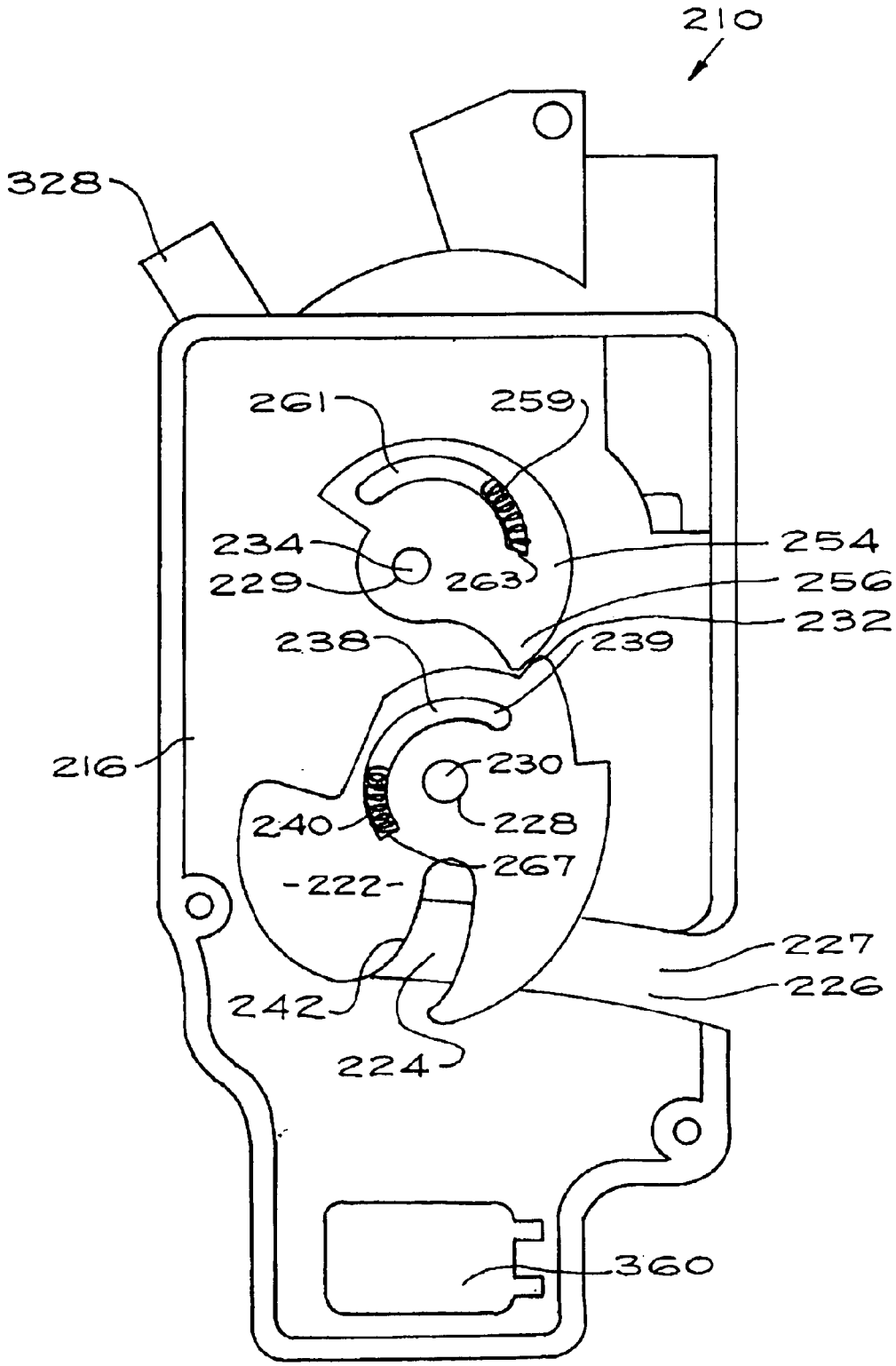
FIG. 30 is a rear elevational view of the latch mechanism shown in FIGS. 17–29, with the rear mounting plate removed and with the pawl engaged with the ratchet.
Figure 31:
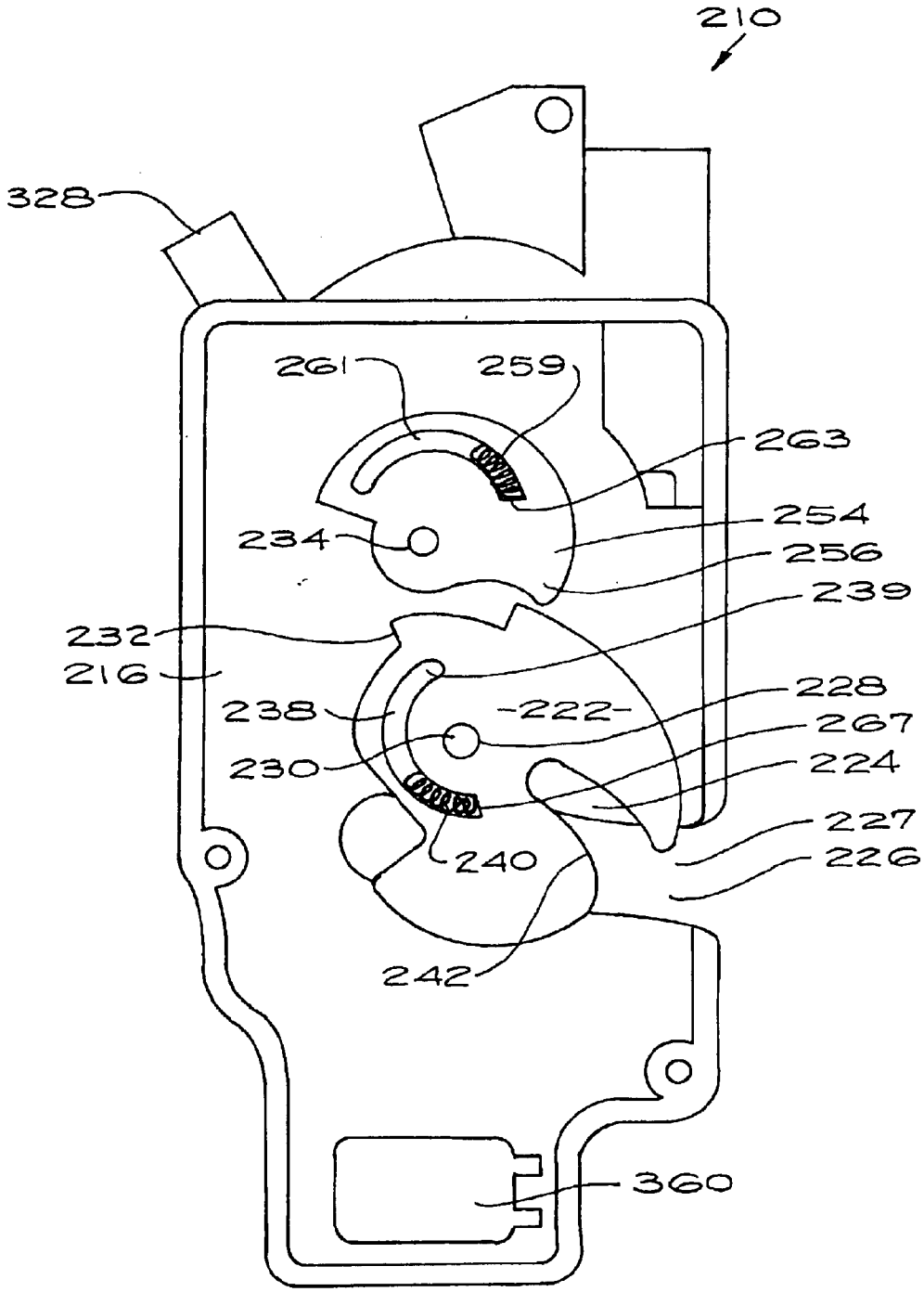
FIG. 31 is a rear elevational view of the latch mechanism shown in FIGS. 17–30, with the rear mounting plate removed and with the pawl disengaged from the ratchet.

The pawl 254 of the second preferred embodiment also differs from the first preferred embodiment in a number of ways which will now be described. With the exception of the differences described below and illustrated in the drawings, however, additional information regarding the material, operation, and structure of the pawl 254 is set forth above in the description of the first preferred embodiment. As best seen in FIGS. 24–31, the portion of the pawl 254 located on the same side of the housing 216 as the control elements 252, 253 (the "actuation portion" of the pawl 254) preferably has an elongated shape with a lever arm 272 and a linkage arm 280 extending from a central portion 261. The pawl 254 is preferably rotatably mounted upon the upper pivot post 234 which preferably passes through an aperture 229 in the central portion 316 of the pawl 254. The pawl 254 preferably extends through to the opposite side of the housing 216 as best seen in FIGS. 30 and 31. The rear portion of the pawl 254 (the "locking portion" of the pawl 254) shown in FIGS. 30 and 31 is very similar to the rear portion of the pawl 54 in the first preferred embodiment described above and illustrated in FIGS. 13 and 14. However, the pawl 254 has a groove 261 therein in which is retained a pawl spring 259 for biasing the pawl 254 in a clockwise direction into engagement with the ratchet 222 as best shown in FIG. 30. Preferably, a pawl spring pin 318 (see also FIG. 20) or like element extends from the rear mounting plate 214 and into the groove 261 to act against the pawl spring 259. Under compression between the end 263 of the groove 261 and the pawl spring pin 318, the pawl spring 259 acts to bias the pawl 254 in a clockwise direction as noted above. It should be noted that the groove 261, pawl spring 259, and the pawl spring pin 318 can be located on the side of the pawl 254 opposite that shown in the figures, if desired (i.e., the groove 261 and pawl spring 259 facing the housing 216, and the pawl spring pin 259 extending into the groove 261 from the housing 216). As mentioned in the description of the first preferred embodiment, numerous other biasing elements can be used and located in a number of different locations to achieve the pawl biasing function of the pawl spring 259 in the pawl groove 261. Such other elements and locations fall within the spirit and scope of the present invention.

With continued reference to FIGS. 30 and 31, the ratchet 222 of the second preferred embodiment is very similar to the ratchet 22 of the first preferred embodiment. Therefore, with the exception of the differences described below, additional information regarding the material, operation, and structure of the ratchet 222 is set forth above in the description of the first preferred embodiment. Like the ratchet 22 of the first preferred embodiment, the ratchet 222 is rotatably mounted to the lower pivot post 230 (which can be integral or connected to either the rear face of the housing 216 or to the rear mounting plate 214). However, the ratchet 222 is biased in the counter-clockwise direction as viewed in FIGS. 30 and 31 by a ratchet spring 240 seated within a groove 238 in substantially the same manner as the pawl 254 biased by the pawl spring 259. Preferably, a ratchet spring pin 320 (see also FIG. 20) or like element extends from the rear mounting plate 214 into the groove 238 to act against the ratchet spring 240. Under compression between the end 267 of the groove 238 and the ratchet spring pin 320, the ratchet spring 240 acts to bias the ratchet 222 in a counter-clockwise direction as noted above. It should be noted that the groove 238, ratchet spring 240, and the ratchet spring pin 320 can be located on the side of the ratchet 222 opposite that shown in the figures, if desired (i.e., the groove 238 and ratchet spring 240 facing the housing 216, and the ratchet spring pin 320 extending into the groove 238 from the housing 216). As mentioned in the description of the first preferred embodiment, numerous other biasing elements can be used and located in a number of different locations to achieve the ratchet biasing function of the ratchet spring 240 in the ratchet groove 238. Such other elements and locations fall within the spirit and scope of the present invention.

With the above-described differences in the structure and operation of the pawl 254 and the ratchet 222 noted, the general operation of the pawl 254 and the ratchet 222 is preferably substantially the same as that described above with reference to the first preferred embodiment of the present invention. Specifically, and with additional reference to FIG. 19, when the striker 220 is trapped in the ratchet groove 224 in the position shown in FIG. 30, the ratchet spring 240 biases the ratchet 222 in a counter-clockwise direction to release the striker 220. However, the pawl spring 259 biases the pawl 254 into a clockwise direction to engage the cam 256 of the pawl 254 with the stop surface 232 of the ratchet 222, thereby preventing the ratchet 222 from rotating. The pawl and ratchet positions shown in FIG. 30 are therefore their respective locked positions. When the pawl 254 is caused to rotate counter-clockwise by a control element 252, 253 as described in more detail below, the pawl 254 releases the ratchet 222 to rotate counter-clockwise and to release the striker 220. The positions of the pawl 254 and the ratchet 222 in their respective unlatched states (in which the striker 220 is released) are shown in FIG. 31.

Another significant difference between the latch assemblies of the first and second preferred embodiments is the location and arrangement of the linking elements to the control elements 252, 253 (see FIG. 25). As noted in the discussion of the first preferred embodiment above, it is possible to connect external linking elements to the control elements in a number of different ways. The first preferred embodiment illustrated one control element 52 which is connectable to a linking element (not shown) via an aperture 94 at its linkage end 62, and a second control element 53 connectable to a linking element (also not shown) via a post with an aperture 96 therethrough dimensioned to receive an end of the linking element. Rather than have one connection point for a linking element outside of the housing 216 and one connection point for a linking element inside the housing 216 as in the first preferred embodiment, the second preferred embodiment has linkage ends 262, 274 of the control elements 252, 253 both inside the latch housing 216. Preferably, the linkage elements connected thereto are bowden cables (not shown) passed through ports 98, 99 respectively. The linkage elements are preferably received within grooves 294, 296 in the linkage ends 262, 274, but can instead be attached to the linkage ends in any conventional manner.

Unlike the first preferred embodiment, the upper control element 252 of the preferred embodiment is preferably associated with the inside handle of a door, while the lower control element 253 is preferably associated with the outside handle. Therefore, the linking element (e.g., a bowden cable) coupled to the linkage end 262 of the upper control element 252 preferably extends to and is actuatable by an inside door handle, and the linking element (e.g., also a bowden cable) coupled to the linkage end 274 of the lower control element 253 preferably extends to and is actuatable by an outside door handle. In operation of the preferred illustrated embodiment, the upper control element 252 is actuated by pulling upward on the linking element passing through port 98, and the lower control element 253 is actuated by pulling upward on the linking element passing through port 99. The reaction by the control elements 252, 253 to such actuation will now be discussed in detail.

As mentioned above, each control element 252, 253 preferably has two states of operation: a first state in which the control element 252, 253 is engaged with a pin 266, 286 by an actuator 268, 288, and a second state in which the control element 252, 253 is not engaged. The motion of the control elements 252, 253 when actuated differs between the first and second states. Preferably, the control elements 252, 253 pivot about the respective pins 266, 286 when actuated in the first state, but pivot about different pivot points when actuated in the second state.

Figure 26:
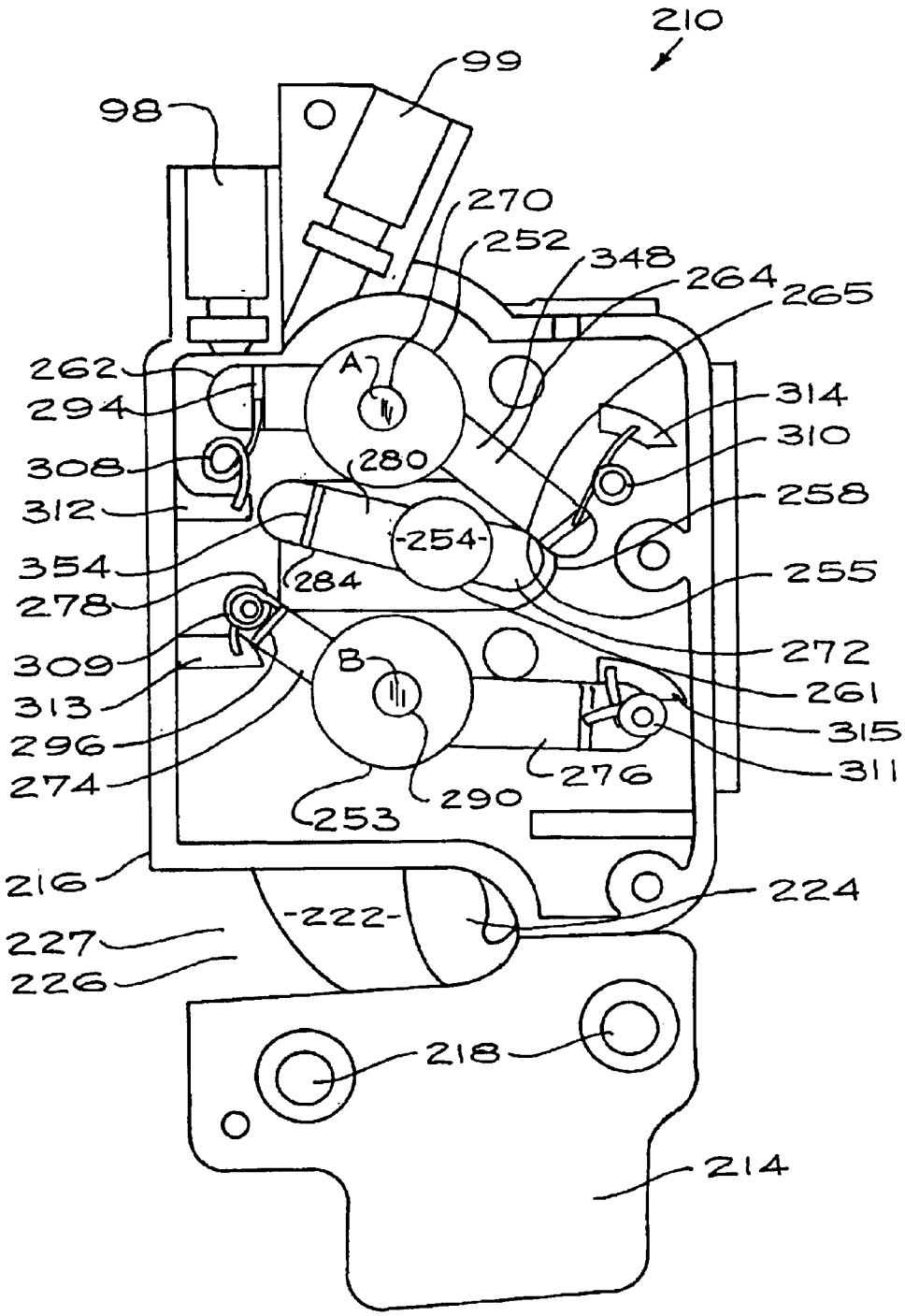
FIG. 26 is a front elevational view of the latch mechanism shown in FIG. 24, with the latch mechanism unlocked and with the upper control element actuated.
Figure 27:
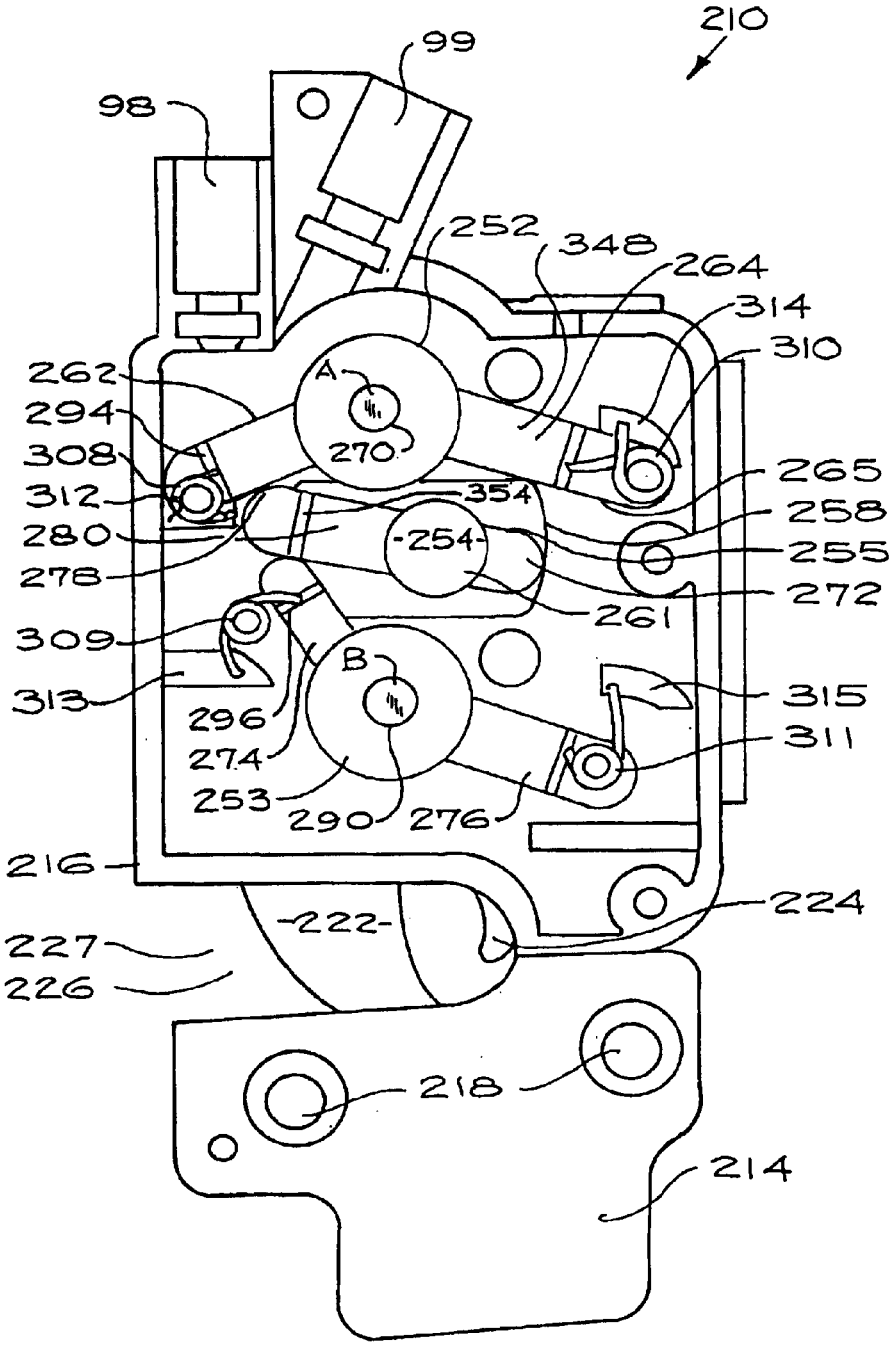
FIG. 27 is a front elevational view of the latch mechanism shown in FIG. 24, with the latch mechanism unlocked and with the lower control element actuated.

In the first state of the upper control element 252, the pin 266 is driven into the aperture 270 in the upper control element 252 so that actuation of the upper control element 252 will create rotational movement of the upper control element 252 about the pin 266. With reference to FIG. 26, such rotational movement (e.g., via upward actuation of a bowden cable passing through port 98 and connected to the linkage end 262 of the upper control element 252) causes the lever arm 264 of the upper control element 252 to move through a first path of motion in a downward direction until the cam surface 265 of the upper control element 252 contacts and moves in camming contact against the cam surface 255 of the pawl 254. This action pushes the lever arm 272 of the pawl 254 in a downward direction, causing the pawl 254 to rotate in a clockwise direction as shown in FIG. 26 which in turn releases the pawl 254 from the ratchet 222 and unlatches the latch. Therefore, this is the unlocked state of the upper control element 252. Similarly, in the first state of the lower control element 253, the pin 286 is driven into the aperture 290 in the lower control element 253 so that actuation of the lower control element 253 will create rotational movement of the lower control element 253 about the pin 286. With reference to FIG. 27, such rotational movement (e.g., via upward actuation of a bowden cable passing through port 99 and connected to the linkage end 274 of the lower control element 253) causes the linkage end 274 of the pawl 254 to move through a first path of motion an upward direction until the cam surface 278 of the lower control element 253 contacts and moves in camming contact against the cam surface 284 of the pawl 254. This action pushes the linkage arm 280 of the pawl 254 in an upward direction, causing the pawl 254 to rotate in a clockwise direction as shown in FIG. 27 which in turn releases the pawl 254 from the ratchet 222 and unlatches the latch. Therefore, this is the unlocked state of the lower control element 253.

In the second state of the upper control element 252, the pin 266 is released from engagement in the aperture 270 of the upper control element 252. With reference to FIG. 28, actuation of the upper control element 252 (e.g., via upward actuation of a bowden cable passing through port 98 and connected to the linkage end 262 of the upper control element 252) causes the upper control element 252 to rotate about point C near the torsion spring 310 biasing the lever end 264 of the upper control element 252 against its associated stop 314. The upper control element 252 therefore passes through a second path of motion different from the first path described above. In this second path of motion, the upper control element 252 does not move the pawl sufficiently to release the ratchet 222 and to unlatch the latch. Therefore, this is the locked state of the upper control element 252. Most preferably, and as shown in FIG. 28, the upper control element 252 does not contact the pawl 254 in the second path of motion. In the second state of the lower control element 253, the pin 286 is released from engagement in the aperture 290 of the lower control element 253. With reference to FIG. 29, actuation of the lower control element 253 (e.g., via upward actuation of a bowden cable passing through port 99 and connected to the linkage end 274 of the lower control element 253) causes the lower control element 253 to rotate about point D near the cam surface 278 of the lower control element 253 (see FIG. 29). The lower control element 253 therefore passes through a second path of motion different from its first path described above. The lower control element 253 in this second path of motion does not move the pawl 254 sufficiently to release the ratchet 222 and to unlatch the latch. Therefore, this is the locked state of the lower control element 253. Most preferably, and as shown in FIG. 29, the lower control element 253 does not contact the pawl 254 in the second path of motion.

The above-described control element and pawl movement is one manner in which the control elements 252, 253 can be positioned beside a pawl 254 so that their movement in one state causes sufficient movement of the pawl 254 to release the ratchet 222, while their movement in another state causes no movement (or at least insufficient movement) of the pawl 254. This movement has been described above and illustrated as camming movement against the pawl 254. However, it should be noted that a camming relationship between the control elements 252, 253 and the pawl 254 is only one manner in which to transfer motion from the control elements 252, 253 to the pawl 254. Such motion can be transferred in many different ways well-known to those skilled in the art. For example, this motion can be transferred by camming, riding, pushing, or otherwise exerting motive force upon a third element which reacts by moving the pawl 254, by repelling magnetic force between magnets located at or near the locations of the cam surfaces 255, 284, 265, 278 of the pawl 254 and the control elements 252, 253, by directly or indirectly linking the control elements 252, 253 to the pawl 254, and the like. These other manners in which to transmit motive force from the control elements 252, 253 to the pawl 254 (when engaged by the engagement elements 266, 286) fall within the spirit and scope of the present invention.

Figure 32:
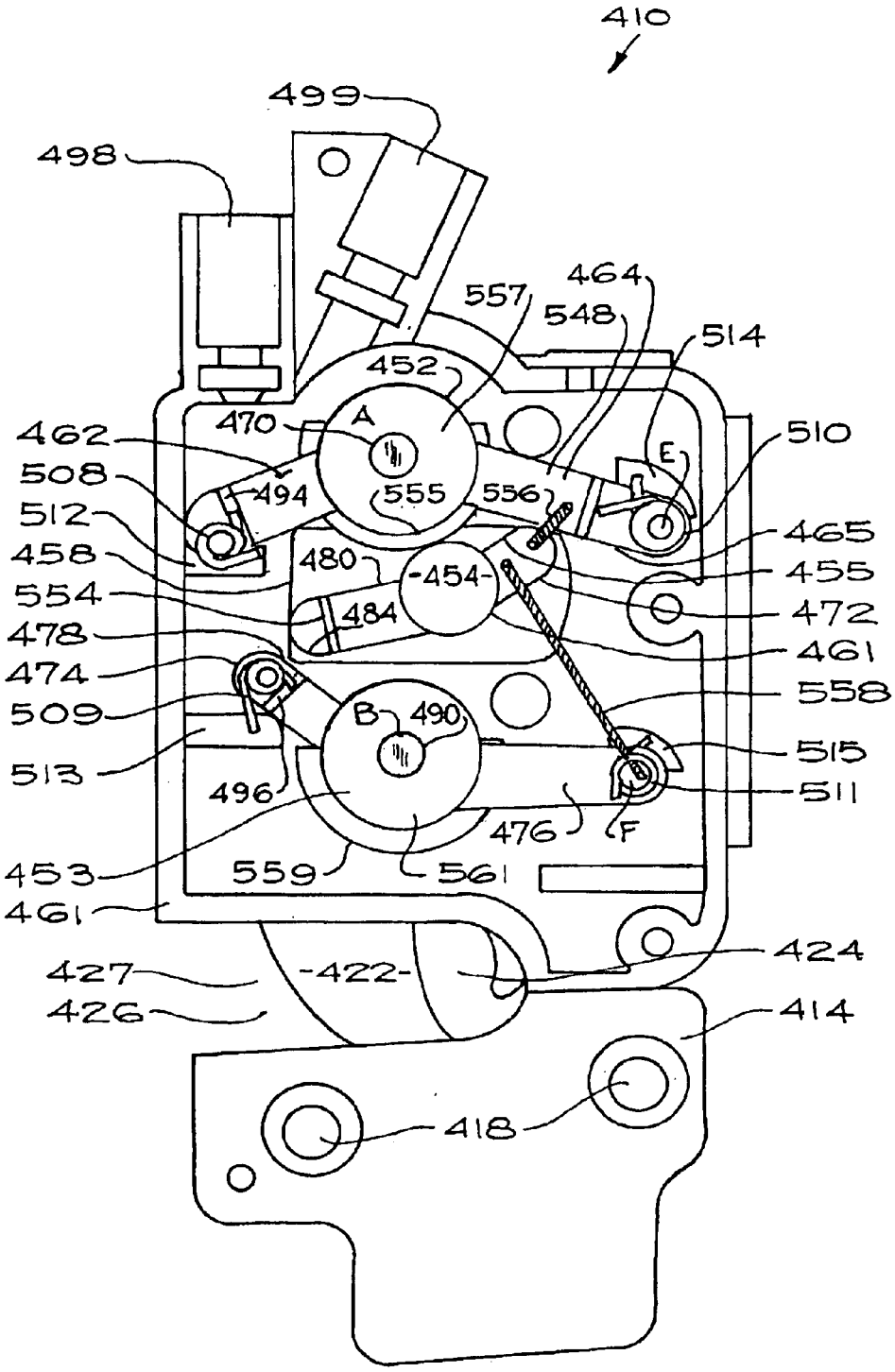
FIG. 32 is a front elevational view of a latch mechanism according to a third preferred embodiment of the present invention, with the front cover, actuators, cover plate, and circuit board removed and with the control elements in their unactuated positions.
Figure 33:
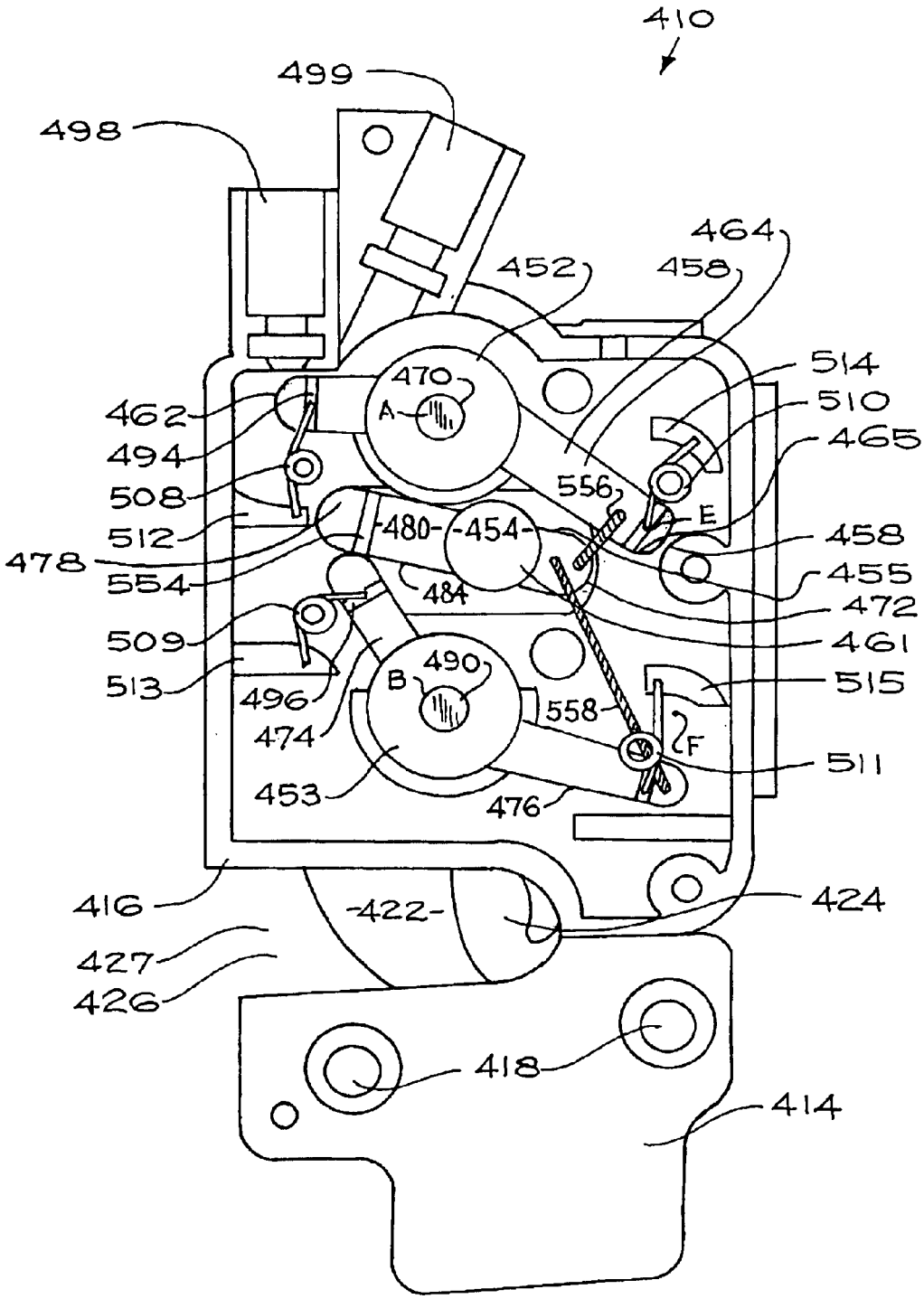
FIG. 33 is a front elevational view of the latch mechanism shown in FIG. 32, with the latch mechanism unlocked and with the lower control element actuated.
Figure 34:
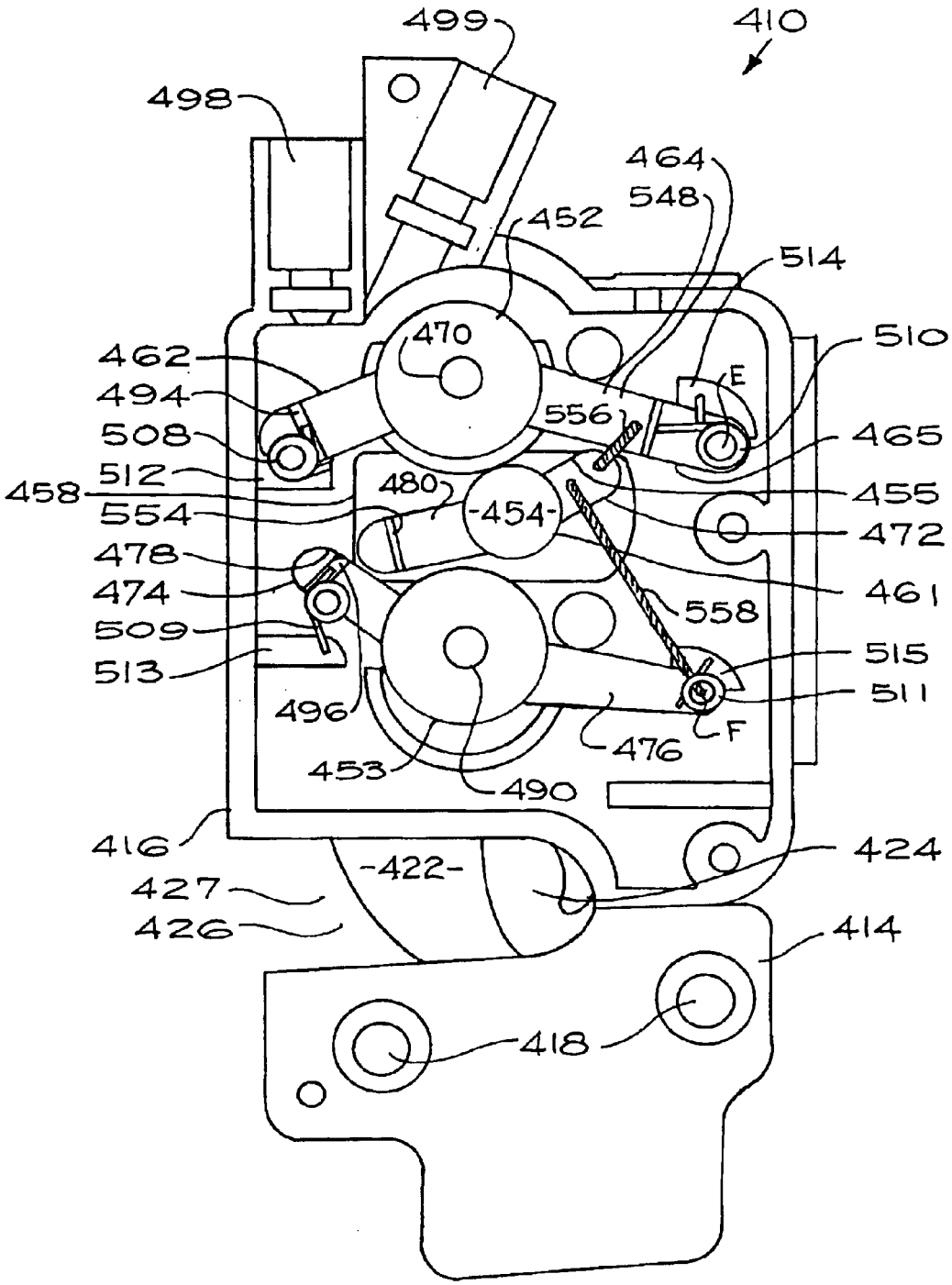
FIG. 34 is a front elevational view of the latch mechanism shown in FIG. 32, with the latch mechanism locked and with the lower control element actuated.
Figure 35:
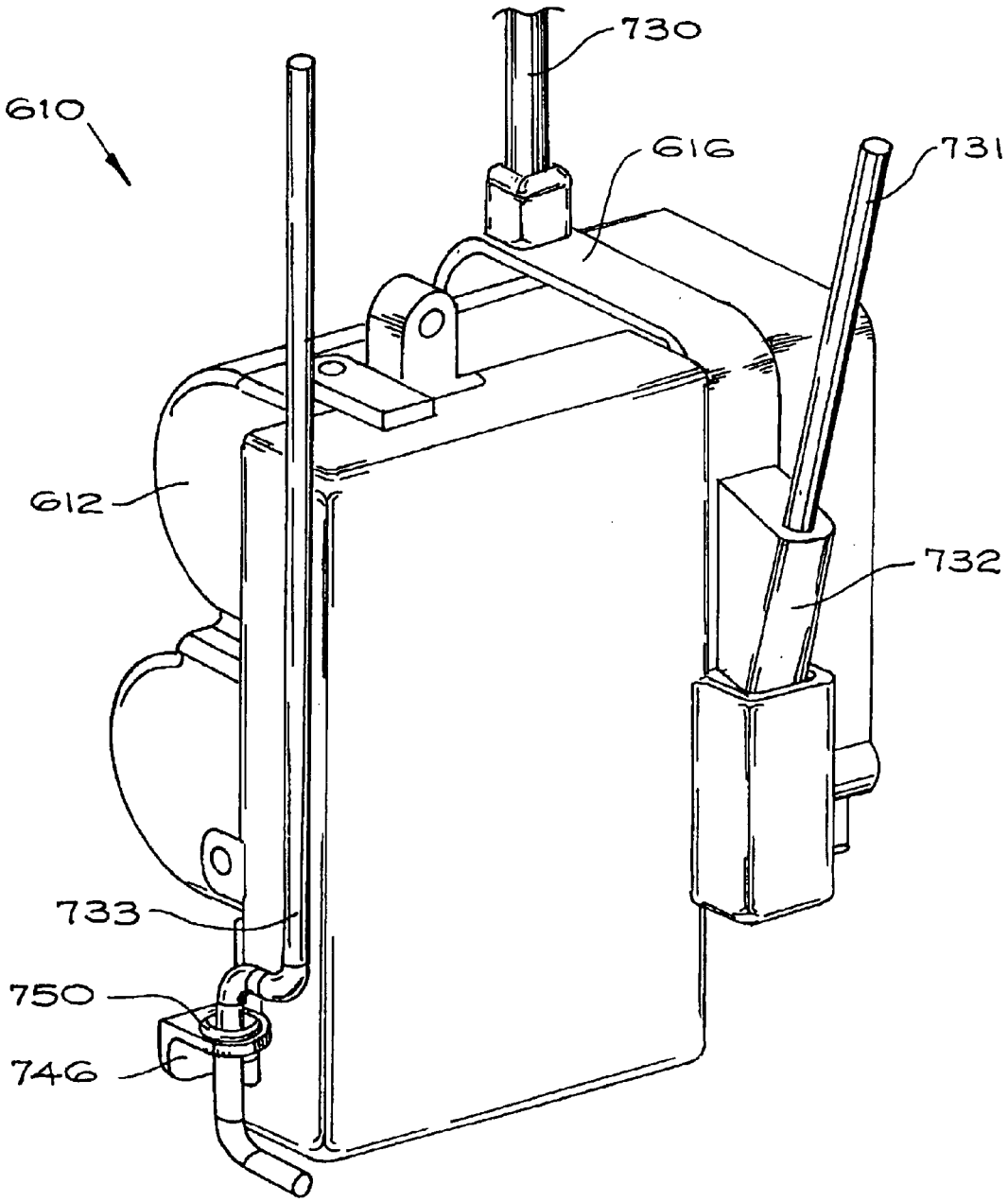
FIG. 35 is a front perspective view of a latch mechanism according to a fourth preferred embodiment of the present invention.
Figure 36:
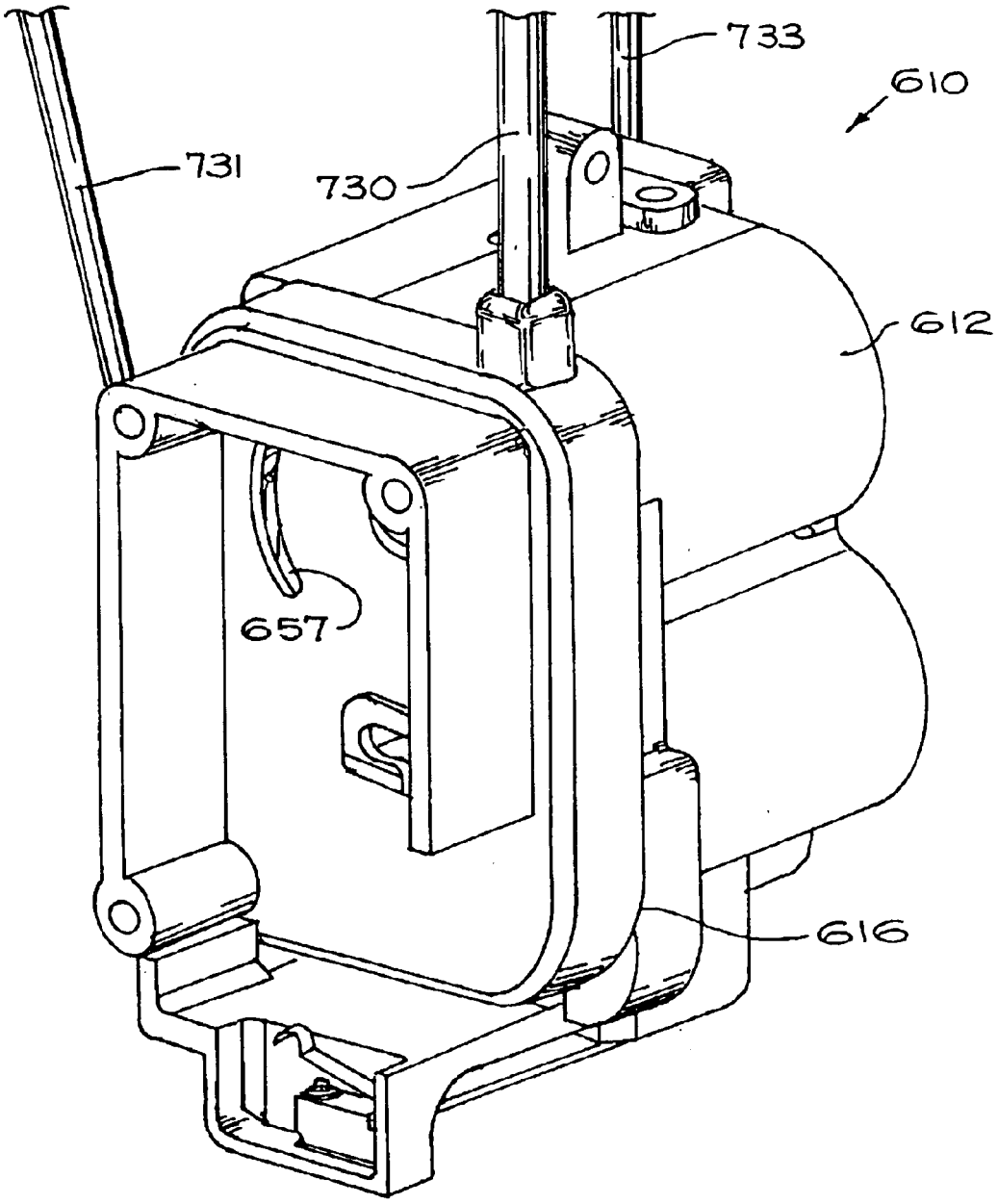
FIG. 36 is a rear perspective view of the latch mechanism shown in FIG. 35.

By way of example only, one such alternative arrangement is illustrated in FIGS. 32–34. The latch assembly shown in FIGS. 32–34 is substantially the same as that shown in FIGS. 17–31, but with the exceptions described hereinafter. Reference numerals in this third embodiment are increased with respect to those in the second preferred embodiment to the 400 and 500 number series.

As can be seen in FIG. 32, the upper control element 452 and the lower control element 453 are each connected to the pawl 454 by a respective link 556, 558. The links 556, 558 can take virtually any shape and can be connected to the control elements 452, 453 and to the pawl 454 in any conventional manner which allows relative movement of the control elements 452, 453 and the pawl 454 (i.e., by welding, brazing, gluing, fastening with fasteners, and the like). Preferably however, the links 556, 558 are U-shaped wires or rods bent to fit within suitably sized apertures in the control elements 452, 453 and the pawl 454. As such, the links 556, 558 are easy to install in a layered fashion with the other elements as will be discussed in more detail below.

In the latch assembly 410 illustrated in FIG. 32, actuation of the upper and lower control elements 452, 453 when they are engaged with the engagement elements 466, 486 does cause the pawl 454 to move sufficiently to release the ratchet 422, but not via canning contact of the control elements 452, 453 against the pawl 454. Instead, when the upper control element 452 is rotated clockwise about point A (when the upper engagement element 466 is extended within aperture 470), the lever end 464 of the upper control element 452 moves downward as in the second preferred embodiment discussed above. The upper link 556 thereby transfers motive force to the lever end 472 of the pawl 454 to rotate the pawl 454 and to release the ratchet 422. However, when the upper control element 452 is actuated without being engaged by the upper engagement element 466, the upper control element 452 rotates about point E (see FIG. 32), thereby generating insufficient movement to push the lever end 472 of the pawl 454 downward to release the ratchet 422. The difference in movement between the upper control element 452 in an engaged and a disengaged state is similar to the difference shown in FIGS. 26 and 28 of the second preferred embodiment. In FIG. 26, the lever end 264 of the upper control element 252 moves a significant amount because point A represents the fulcrum of the upper control element 252. In FIG. 28, the lever end 264 of the upper control element 252 moves relatively little because point C is the fulcrum of the upper control element 252. By connecting a link 556 at the lever end 464 of the upper control element 452 in the third preferred embodiment shown in FIG. 32, similar motion characteristics are used to either transfer or not transfer motive force to the pawl 454. To help guide the upper control element 452 in its actuation movement when not engaged by upper engagement element 466, a wall 555 is preferably located beside a portion of the central section 557 of the upper control element 452. The wall 555 is preferably integral with the housing 416, but can instead be attached thereto or extend from the cover plate 482 or other portion of the latch assembly 410 as desired. As shown in FIGS. 32–34, the wall 555 is preferably U-shaped to guide the upper control element 452 in its upward movement when actuated in its latched state. When actuated in its unlatched state, the upper control element 452 preferably remains in place in the U-shaped wall 555. One having ordinary skill in the art will recognize that other wall shapes can be employed to guide control elements moving in different manners in their unlatched states as necessary.

Similarly, and with reference to FIG. 33, when the lower control element 453 is rotated clockwise about point B (when the lower engagement element 486 is extended within aperture 490), the lever end 476 of the lower control element 453 moves downward as in the second preferred embodiment discussed above. The lower link 558 thereby transfers motive force to the lever end 472 of the pawl 454 to rotate the pawl 454 and to release the ratchet 422. However, when the lower control element 453 is actuated without being engaged by the lower engagement element 486, the lower control element 453 rotates about point F as shown in FIG. 34, thereby generating insufficient movement to pull the lever end 472 of the pawl downward to release the ratchet 422. The difference in movement between the lower control element 453 in an engaged and a disengaged state can be seen by comparing FIGS. 33 and 34. In FIG. 33, the lever end 476 of the lower control element 453 moves a significant amount because point B represents the fulcrum of the lower control element 453. In FIG. 34, the lever end 476 of the lower control element 453 moves relatively little because point F at the lower end of the link 558 is the fulcrum of the lower control element 453. By connecting a link 558 at the lever end 476 of the lower control element 453, these motion characteristics are used to either transfer or not transfer motive force to the pawl 454. Preferably, and as with the upper control element 452 described above, a wall 559 is located beside a portion of the central section 561 of the lower control element 453 to help guide the lower control element 453 in its actuation movement when not engaged by the lower engagement element 486. The wall 559 is preferably integral with the housing 416, but can instead be attached thereto or extend from the cover plate 482 or other portion of the latch assembly 410 as desired. Like the wall 555 for the upper control element 452, the wall 559 is preferably U-shaped to guide the lower control element 453 in its upward movement when actuated in its latched state (see FIG. 34). When actuated in its unlatched state, the lower control element 453 preferably remains in place in the U-shaped wall 559.

It will be appreciated by one having ordinary skill in the art that the links 556, 558 can each be connected to at least one of a number of different locations along the lengths of the control elements 452, 453 to create motion characteristics similar to those just described. Also, the links 556, 558 can have different lengths than those shown in the figures to accommodate different spacings existing between the pawl 454 and the control element 452, 453 and to permit linking along different locations of the control elements 452, 453 and the pawl 454 as desired. These different connection arrangements and link lengths fall within the spirit and scope of the present invention.

Figure 23:
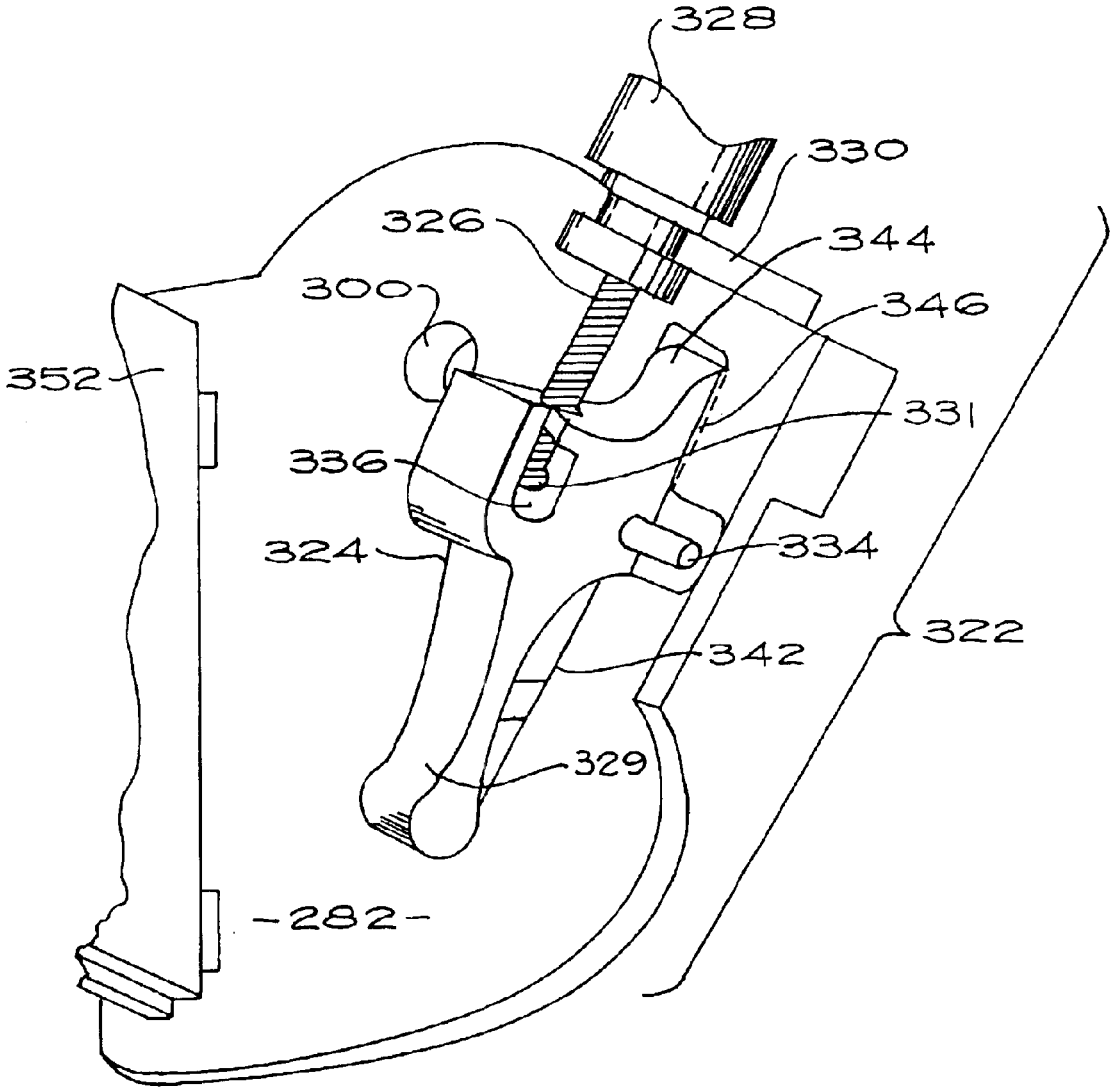
FIG. 23 is a perspective detail view of FIG. 22, showing the manual override device.

With reference back to the latch assembly of the second preferred embodiment of the present invention, the latch assembly 210 operates upon some of the same basic principles of the present invention as described in the first preferred embodiment (i.e., quick change between locked and unlocked states of the control elements 252, 253 by efficient and fast actuator motion to drive engagement elements 266, 286 into and out of engagement with the control elements 252, 253). As is best seen in FIG. 23, the second preferred embodiment of the present invention also preferably has a manual override device 322 which permits a user to manually move at least one of the pins 266, 286 (or other engagement element type used) between its locked and unlocked states. The ability to perform this function is useful, for example, where it is desirable to link a user-operable device such as a lock cylinder to the latch assembly 210, allowing a user to unlock the latch assembly 210 even during power interrupt.

Figure 22:
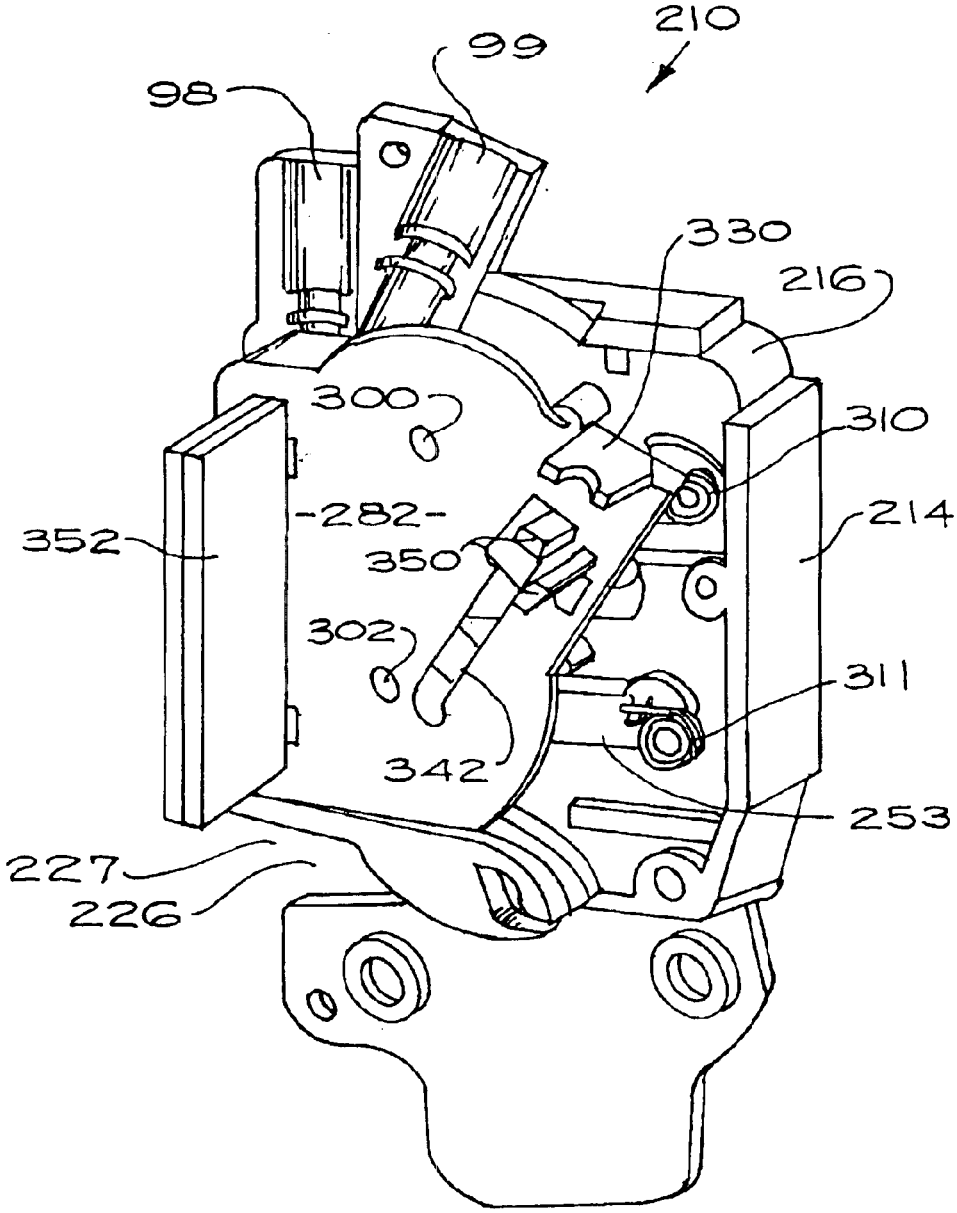
FIG. 22 is a front perspective view of the latch mechanism shown in FIGS. 17–21, with the front cover, actuators, and manual override device removed.

With reference to FIGS. 22 and 23, a preferred embodiment of a manual override device 322 will now be described. The manual override device 322 preferably has a bell crank 324 connected to an end 331 of a cable 326 via a cable end clip 328. The bell crank 324 preferably operates as described below to manually move the armature of the lower actuator 288 into engagement with the lower control element 253 (corresponding to an outside car door handle in a preferred application). To do so, the bell crank 324 preferably has a tail 329 extending therefrom which is preferably directly or indirectly connected in a conventional manner to the armature of the lower actuator 288. In the preferred embodiment of the present invention illustrated in the figures, the tail 329 preferably extends through an elongated aperture 330 (see FIGS. 20 and 21) in the side of the lower actuator 288 and into a receiving groove 332 of the armature therein. The bell crank 324 also preferably has a pivot 334 about which the bell crank 324 is pivotable by actuation of the cable 326. Also, the bell crank 324 preferably has an aperture 336 into which the end of the cable 326 is fitted. Preferably, the aperture 336 has a dogleg extension (see FIG. 23) permitting the end 331 of the cable 326 to be fitted into the aperture 336 but preventing the end 331 of the cable 326 from being pulled out of the aperture 336 when the cable 326 is pulled. The end 331 of the cable 326 also preferably is enlarged (most preferably in a ball shape as shown in FIG. 23) to prevent the cable 326 from being pulled out when the cable 326 is pulled. With additional reference to FIG. 20, the cable clip 328 properly positions the cable 326 with respect to the housing 216 and preferably has a conventional groove therein for seating within a cable seat 338. The cable clip 328 preferably fits within an aperture 340 in the housing 216 and/or front cover 212 as shown in the figures. To assist the bell crank 324 in its movement as described below, one or more blocks, walls, posts, pins, or other elements 350 can be located around or beside the bell crank 324 as shown in FIG. 22 (removed from FIG. 23 for clarity). These elements 350 can be integral with or attached to the cover plate 282 as shown in FIG. 22, or can extend from the housing 216 or front cover 212 as desired.

When the above-described manual override device 322 is actuated (i.e., when the cable 326 is pushed), the cable end trapped in the bell crank aperture 336 pushes the bell crank 324 about its pivot 334, thereby pushing the tail 329 and the connected armature of the lower actuator 288 toward the lower control element 253 to engage the lower pin 286 with the lower control element 253. As described above, this action places the lower control element 253 into an unlocked state. Preferably, when the cable 326 is pulled rather than pushed, the bell crank 324 pivots in an opposite direction to pull the lower pin 286 out of engagement with the lower control element 253 and to thereby place the lower control element 253 in a locked state. In alternative embodiments to the preferred embodiment shown in the figures, the connection between the bell crank 324 and the cable 326 (or rod, lever, chain, or other linking device connected to the bell crank 324 for actuation thereof permits only one-directional actuation. In other words, the connection permits the cable 326 or other such linking device only to pull the bell crank or only to push the bell crank. These alternative embodiments can employ lost motion connections for this purpose or linking devices that are capable of transmitting pulling force but not pushing force.

If desired, the cover plate 282 can be shaped to receive the bell crank 324 in a recessed manner. Specifically, the cover plate 282 can have a recess 342 as best shown in FIG. 22, in which is pivotably received the bell crank pivot 334 and the bell crank tail 329.

One having ordinary skill in the art will appreciate that the particular manual override device 322 illustrated in the figures is only one of a large number of well-known manual overrides which can be used to manually manipulate the position of an actuator armature or pin 266, 286 in the latch assembly 210. For example, a similar bell crank assembly can be used as described above, but with the tail 329 of the bell crank 324 coupled to a pin 286 for moving the pin 286 into and out of engagement with the lower control element 253 rather than moving the armature connected (directly or indirectly) thereto. Also, a bell crank assembly can be adapted in a well-known manner to push the armature or pin 286 into engagement with the lower control element 253 when the cable 326 is pulled and to pull the armature or pin 286 out of engagement with the lower control element 253 when the cable 326 is pushed. Such a change can be made, for example, simply by changing the location of the tail 329 on the bell crank 324 and repositioning the bell crank 324 in the latch assembly 210. As another example, the bell crank 324 need not necessarily be in camming contact with a control element to be pivoted about its pivot 334. Instead, motive force can be exerted upon the bell crank 324 by movement of a control element in any conventional manner, including those described above with reference to the third preferred embodiment of the present invention (e.g., by a link connecting the bell crank 324 to a control element, via repulsive magnetic force of magnets on the bell crank 324 and on a control element, by a control element exerting force upon a third element which in turn exerts force upon the bell crank 324, and the like).

A manual override device for the lower control element 253 is preferred as shown in the figures, because in the preferred embodiment of the present invention a user can manually unlock the outside door handle as needed. However, it will be appreciated by one having ordinary skill in the art that a manual override device such as that described above and illustrated in the figures can be used for the upper control element 252 or for both the upper and lower control elements 252, 253. Either or both of the inside and outside door handles can therefore be manually unlocked by a user. Where a manual override device exists for both control elements 252, 253, such a device can be shaped to actuate the armatures or pins 266, 286 simultaneously (e.g., two cables connected to the same bell crank 324 having a tail running to each armature or pin 266, 286). Otherwise, a separate bell crank 324, cable 326, and cable end clip 328 assembly can be used to selectively actuate either armature or pin 266, 286 independently of the other. It should also be noted that although the lower control element 253 is connected to the outside door handle and the upper control element 252 is connected to the inside door handle in the preferred application of the present invention, these associations can be reversed as discussed below. Also, the particular locations of the control elements 252, 253 (i.e., upper, lower, left, right, etc.) are largely irrelevant to the number and operation of manual overrides used. None, one, two, more, or all of the control elements in any particular latch design according to the present invention can have a manual override associated therewith as desired, regardless of which user-operable handle or other such device is used to actuate the control elements (i.e., inside door handle, outside door handle, and the like).

Although a bell crank 324 is preferably used to accomplish the manual override function of moving the armatures or pins 266, 286 with respect to the control elements 252, 253, other well-known devices and assemblies can instead be used to accomplish this function. By way of example only, one alternative assembly is a lever having a forked end engaged with an actuator 268, 288, pin 266, 286, or pin plate and an opposite end movable by a separate actuator, cylinder, magnet, or other conventional device to actuate the lever between at least two positions. In another alternative assembly, a lever or bell crank can be attached directly to a control element 252, 253 which itself is permitted limited axial movement (limited by the axial movement of the torsion springs 308, 309, 310, 311) toward or away from the associated actuator 268, 288 for engagement therewith. In yet another alternative assembly, a lever or bell crank can have its own pin insertable by actuation directly into the control element aperture 270, 290. In such a design, the shapes of the bell crank pin and the actuator pin would preferably be complementary (i.e., two semi-circular extruded shapes facing one another and together having a round pin shape) to allow movement of one independently of the other into and out of the control element apertures 270, 290. Still other manual overrides are possible and fall within the spirit and scope of the present invention.

Figure 24:
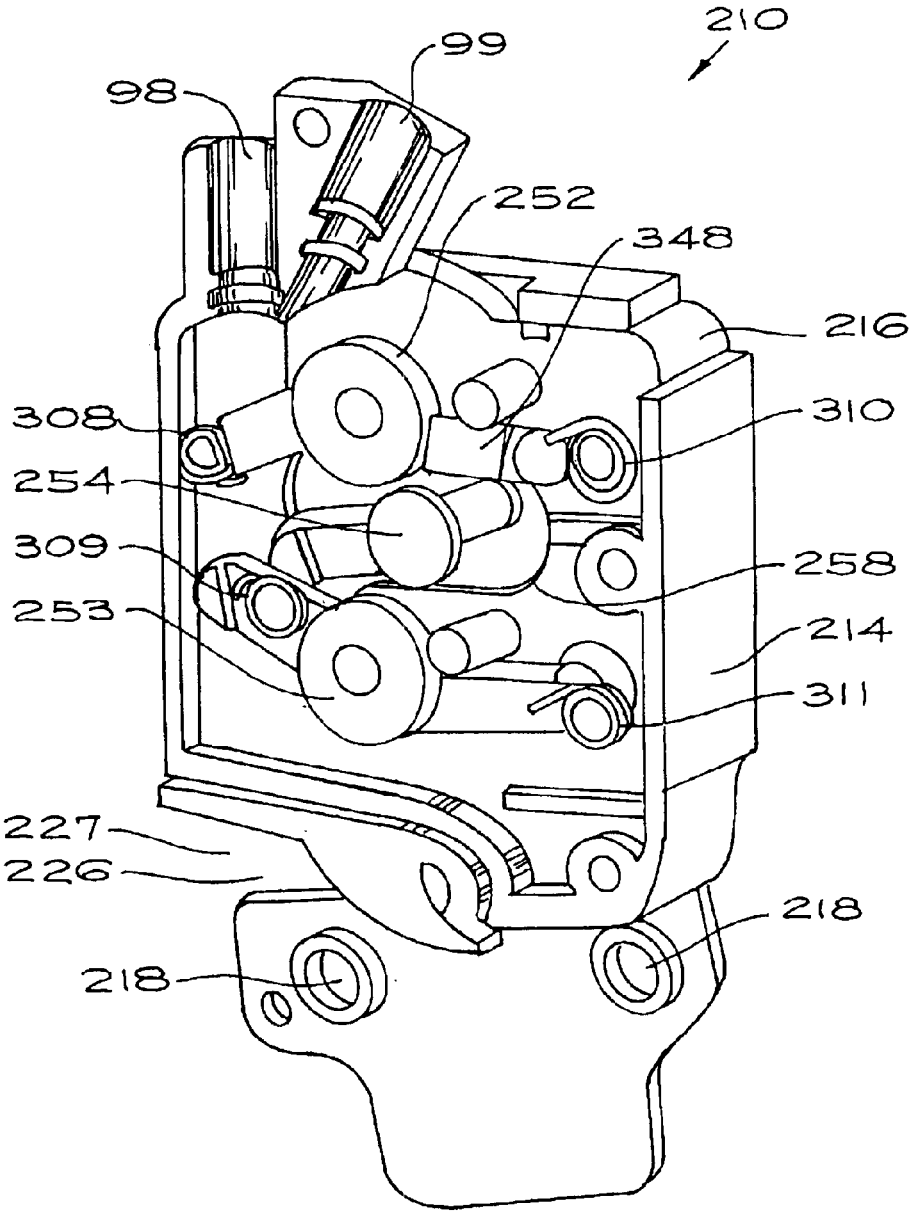
FIG. 24 is a front perspective view of the latch mechanism shown in FIGS. 17–23, with the front cover, actuators, circuit board and the cover plate removed, and showing the control elements and the pawl of the latch mechanism.

With reference again to FIG. 23, it can be seen that the bell crank 324 preferably has an extension 344 extending from the pivot 334. The extension 344 has a cam surface 346 which is located on the side of the cover plate 282 opposite the cable 326 and bell crank aperture 336. The cam surface 346 is preferably located in the latch assembly 210 adjacent to the lever end 264 of the upper control element 252. As best seen in FIG. 24, the lever end 264 of the upper control element 252 preferably has a ramped cam portion 348 (hereinafter referred to only as the ramped portion 348). When the upper control element 252 is engaged by the upper pin 266 (i.e., in the unlocked state as described above), the lever end 264 moves in a downward direction when the upper control element 252 is actuated. As also described above, this action turns the pawl 254 to release the ratchet 222. In the preferred embodiment of the present invention illustrated in the figures, this motion also causes the cam surface 346 of the bell crank 324 to ride up upon the ramped portion 348 of the upper control element 252. This motion pivots the bell crank 324 about its pivot 334 and pushes the pin 286 into the aperture 290 of the lower control element 253, thereby placing the lower control element 252 in its unlocked state in a manner as described above. This feature is useful in applications where actuation of one control element in its unlocked state causes another control element to switch states. For example, in car doors applications where a user opens the door from the inside, it is often desirable to automatically unlock the door for access from the outside (i.e., unlock the outside door handle).

The above-described arrangement can be applied in substantially the same manner so that actuation of the lower control element 253 in its unlocked state causes pivoting of the bell crank 324 to unlock the upper control element 252. Such an arrangement can even be used so that actuation of either control element 252, 253 in its unlocked state causes the other control element 253, 252 to be shifted to its unlocked state. It should also be noted that the ramped portion of the control elements in each of the above cases can be reversed to cause locking of one control element when the other is actuated in its unlocked state. In still other embodiments employing the same ramped portion and bell crank cam surface design, it is even possible to generate the camming motion when a control element is actuated in its locked state, or regardless of the state of the control element. Because the control elements 252, 253 move in different manners in their locked and unlocked states, the desired camming motion can be achieved in each case by positioning the bell crank 324 so that the ramped portion of the control element moves to cam against the cam surface 346 of the bell crank 324 only in the selected motion of the control element (i.e., in its locked state or its unlocked state).

In yet another alternative embodiment of the ramped portion and bell crank cam surface design just described, it is possible to located the ramped portion 348 upon the pawl rather than upon a control element. Therefore, the bell crank 324 or other such device as described above would preferably shift the state of a control element only when the pawl 254 is rotated between its latched and unlatched positions. The ramped surface 348 can be located on any portion of the pawl 254 or upper pivot post 234 facing the bell crank 324, which itself would be positioned adjacent the ramped surface 348 in the same manner as described above.

In the second preferred embodiment of the present invention described above and illustrated in FIGS. 17–31, the manual override device 322 is capable of performing at least two functions: manual override in response to actuation of a cable 326, linkage, rod, or other such element of the manual override device 322, and manual override in response to movement of a control element. Both of these functions need not necessarily be performed by a manual override device 322. Specifically, a manual override device can have just a connection point for an external cable 326, linkage, rod, and the like (without a cam surface 346) or can have a cam surface 346 without such a connection point. Different manual override devices 322 in the same latch assembly can take either form as desired for the functionality of the latch assembly.

A fourth preferred embodiment of the present invention is illustrated in FIGS. 35–46. The latch assembly illustrated in FIGS. 35–46 operates on very similar principles to the latch assembly of the first preferred embodiment described above and illustrated in FIGS. 1–15. Elements of the fourth preferred embodiment which are comparable or which perform functions similar to those in the first preferred embodiment are therefore numbered in like manner in the 600 and 700 series. While the structure and operation of the latch assemblies in the first and fourth embodiments are substantially the same in many ways, the important structural and operational differences between these embodiments are described in detail below. For ease of description and illustration, the elements located behind the latch housing 616 are not shown in FIGS. 35–46, including the rear portion of the pawl, the ratchet, and the rear mounting plate. These elements are preferably substantially the same and operate in substantially the same manner as those described above with reference to the second preferred embodiment of the present invention. However, the elements located behind the latch housing 616 can be substantially the same and operate in substantially the same manner as those of the first preferred embodiment of the present invention. Also, any conventional ratchet and pawl assembly can also be used in conjunction with the latch assembly 610 described below and illustrated in FIGS. 35–46.

The preferred embodiment of the latch assembly 610 illustrated in FIGS. 35–46 and described below provides a number of advantages over conventional latches, including a latch input arrangement that employs reduced unlatching paths through the latch assembly 610, a mechanical actuation assembly that can be used as a supplement to or in place of electronic actuation as described above, and a one or two-stage magnetic holding actuator capable of engaging elements with speeds well beyond those of conventional actuation devices.

The latch assembly 610 has an upper control element 652 and a lower control element 653 for actuation by respective linking elements 730, 731. The control elements 652, 653 are preferably elongated in shape, and can be substantially straight (such as the upper control element 652) or can have virtually any other shape desired (such as the angled lower control element 653). The linking elements 730, 731 are preferably attached in conventional manners to respective user-operable devices (not shown) for actuating the control elements 652, 653. Specifically, the linking elements 730, 731 are preferably attached in any conventional manner to respective handles, levers, buttons, or other devices accessible for manipulation by a user to actuate the control elements 652, 653. As described above, the linking elements 730, 731 can be any element capable of transferring motive force from the user-operable devices to the control elements 652, 653, and can even be extensions of the control elements 652, 653 themselves, if desired. In the preferred embodiment illustrated in FIGS. 35–46 however, the linking element 730 for the upper control element 652 is a bowden cable, while the linking element 731 for the lower control element 653 is a rod.

The linking elements 730, 731 need not be attached to their respective control elements 652, 653 as is clear from the relationship between the lower control element 653 and its linking element 731. The linking elements 730, 731 need only be movable to impart movement to the control elements 652, 653. The upper control element 652 is preferably connected to its linking element 730 by a conventional pin and aperture connection in which a pin, bulb, bearing, or other element is located at the end of the linking element 730 and is received within a mating aperture 694 in the upper control element 652. This connection preferably permits relative rotation between the upper control element 652 and the end of its linking element 730 in a conventional manner. The linking element 731 is preferably not connected to the lower control element 653, but instead is positioned to be moveable into and out of pressing contact against the lower control element 653. Specifically, the linking element 731 for the lower control element 653 is preferably extendible to press against the lower control element 653 when actuation of the lower control element 653 is desired by a user. To this end, the linking element 731 is preferably sufficiently rigid to transfer pushing pressure to the lower control element 653. The linking element 731 preferably passes through a boss 732 connected to or integral with the housing 616 as shown in FIGS. 35–46. The boss 732 can take any form capable of slidably receiving the linking element 731, such as one or more hooks, tubes, lugs, apertures in an extension of the housing 616, and the like. The boss 732 can also be connected to different locations of the latch assembly 610, including without limitation to the front cover 612, cover plate 682, rear mounting plate (not shown), etc. Although not required, the boss 732 is preferably employed to add stability to the linking element 731 and its operation.

It should be noted that both control elements 652, 653 can be connected to the linking elements 730, 731 in any conventional manner, or can be positioned relative to the linking elements 730, 731 to be acted upon by the linking elements 730, 731 even though not connected thereto. In those embodiments where the linking elements are connected to their control elements, many different types of connections are possible, including without limitation ball and socket connections, connections employing conventional fasteners, clamps, adhesive or cohesive, welding, and the like, hinge connections, etc. Preferably however, these connections permit relative movement between the control element and the linking element for smoother operation. In those embodiments where the linking elements are not connected to their control elements, the linking elements can be pushed, swung, pulled, or otherwise moved to exert motive force upon the control elements. Such motive force is most preferably transmitted by direct or indirect contact of the control elements with their respective linking elements, but can instead be transmitted without such contact (e.g., via magnetic force from magnets on the linking elements and their respective control elements).

As described above, the control elements 652, 653 can be connected to linking elements (or be positioned to be moved by linking elements) in various locations on the control elements 652, 653. However, because the control elements 652, 653 are preferably mounted for pivotal movement as described in more detail below, the control elements 652, 653 are more preferably connected to or contacted by the linking elements at their ends, and most preferably at their linkage ends 662, 674. In the case of the preferred illustrated embodiment described above and shown in FIGS. 35–46, the control elements 652, 653 are elongated levers such as those of the first, second, and third preferred embodiments described above. The linking and control element connection for the upper control element 652 is preferably at an end of the upper control element 652, while the lower control element 653 is positioned to be contacted and moved by its respective linking element 731 at an end of the lower control element 653.

The control elements 652, 653 of the preferred embodiment shown in FIGS. 35–46 operate under the same general principles described above with regard to the other embodiments of the present invention. Specifically, each control element 652, 653 preferably has a corresponding actuator 668, 688 which, when actuated in one position, places the control element 652, 653 in a first state movable in a first manner and when actuated in another position places the control element 652, 653 in a second state movable in a second manner different from the first. Most preferably, each control element 652, 653 is releasably engagable with a pin 666, 686 via its actuator 668, 688, respectively. Preferably, the control element 652, 653 is pivotable about a first pivot point when engaged with the pin 666, 686 of its respective actuator 668, 688, and about a second pivot point when disengaged therefrom (although non-pivotal or partly-pivotal movement in either state is possible via pin extension and retraction as described below). When the control element 652, 653 is engaged with its respective pin 666, 686, the control element 652, 653 is preferably movable to move the pawl 654 and to thereby release the ratchet (not shown). When the control element 652, 653 is disengaged from its respective pin 666, 686, the control element 652, 653 is movable in a different manner not imparting motive force (or sufficient motive force) to the pawl 654 to release the ratchet. Alternatively, the engaged and disengaged states of either or both control elements 652, 653 can correspond to the non-ratchet releasing and ratchet releasing states of the control elements 652, 653, respectively. Only the front portion of pawl 654 is visible in FIGS. 35–46, the rear portion preferably being substantially the same and operating in substantially the same manner as that shown in FIGS. 30 and 31 of the second preferred embodiment (but which can be substantially the same and operate in substantially the same manner as the pawl 54 of the first preferred embodiment or as any conventional pawl).

As will now be described, the preferred embodiment of the present invention shown in FIGS. 35–46 has the advantage of being able to receive multiple latch inputs while still having one ultimate force-transmitting path through the latch assembly 610 for unlatching the latch assembly 610. The latch assembly 610 preferably has four primary mechanical inputs (although any number and type of inputs are possible): two inputs for changing the latch state and two inputs for unlatching the latch 610. Again with reference to a vehicle door environment by way of example only, the linking element 730 connected to the upper control element 652 preferably runs to an inside door handle, lever, or other user-operable device (not shown) and to an inside lock button, sill button, or other user-operable device (not shown). The linking element 731 actuatable to move the lower control element 653 preferably runs to an outside door handle, lever, or other user-operable device (not shown). Finally, the latch assembly 610 is also preferably connected to an outside cylinder lock or other conventional locking device via another linking element 733. This linking element 733 can take any form described above for the linking elements of the first preferred embodiment, but is most preferably a rod.

Figure 42:
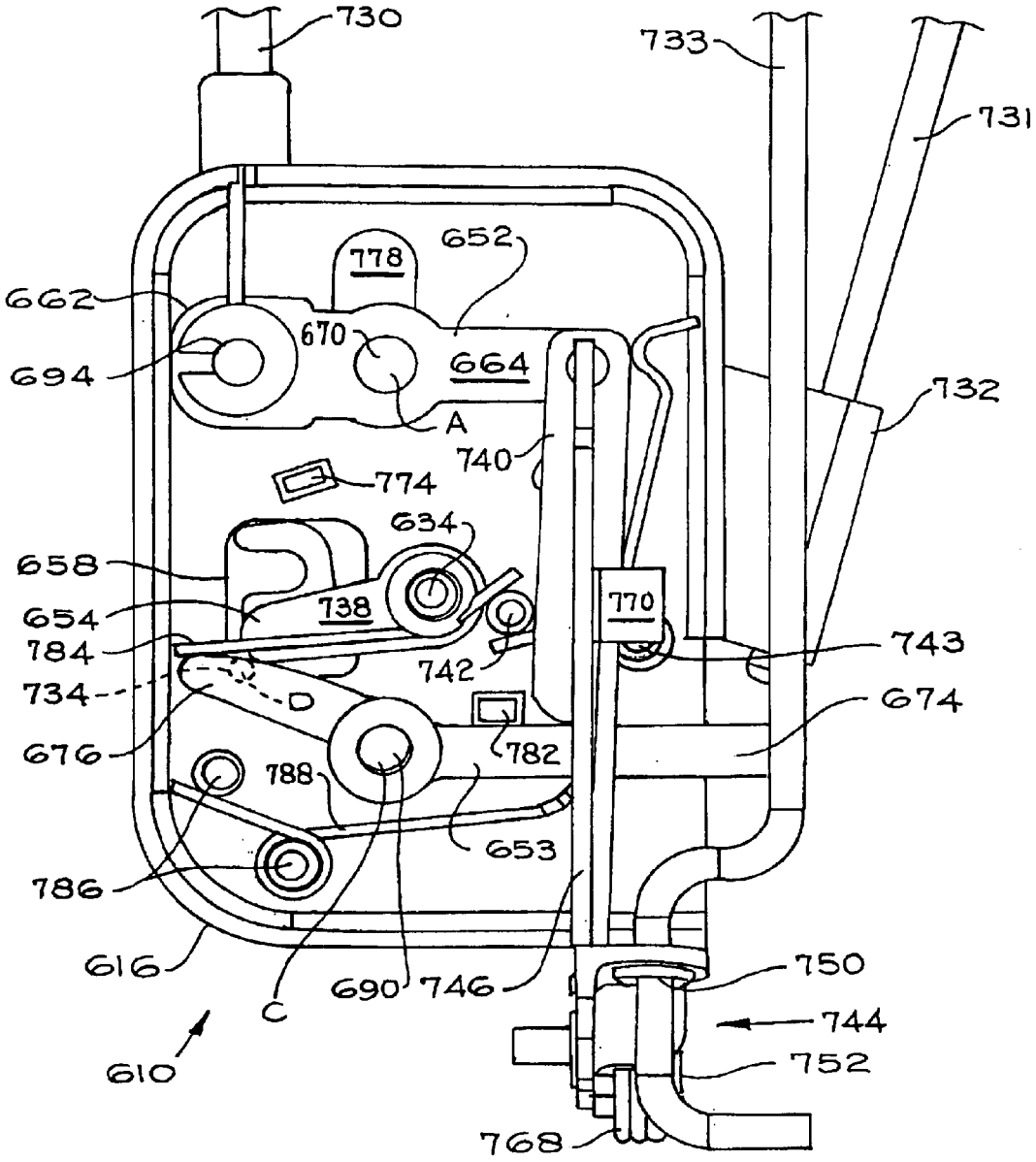
FIG. 42 is a front elevational view of the latch mechanism shown in FIGS. 35–41, with the latch mechanism fully unlocked and with the upper control element partially actuated.
Figure 43:
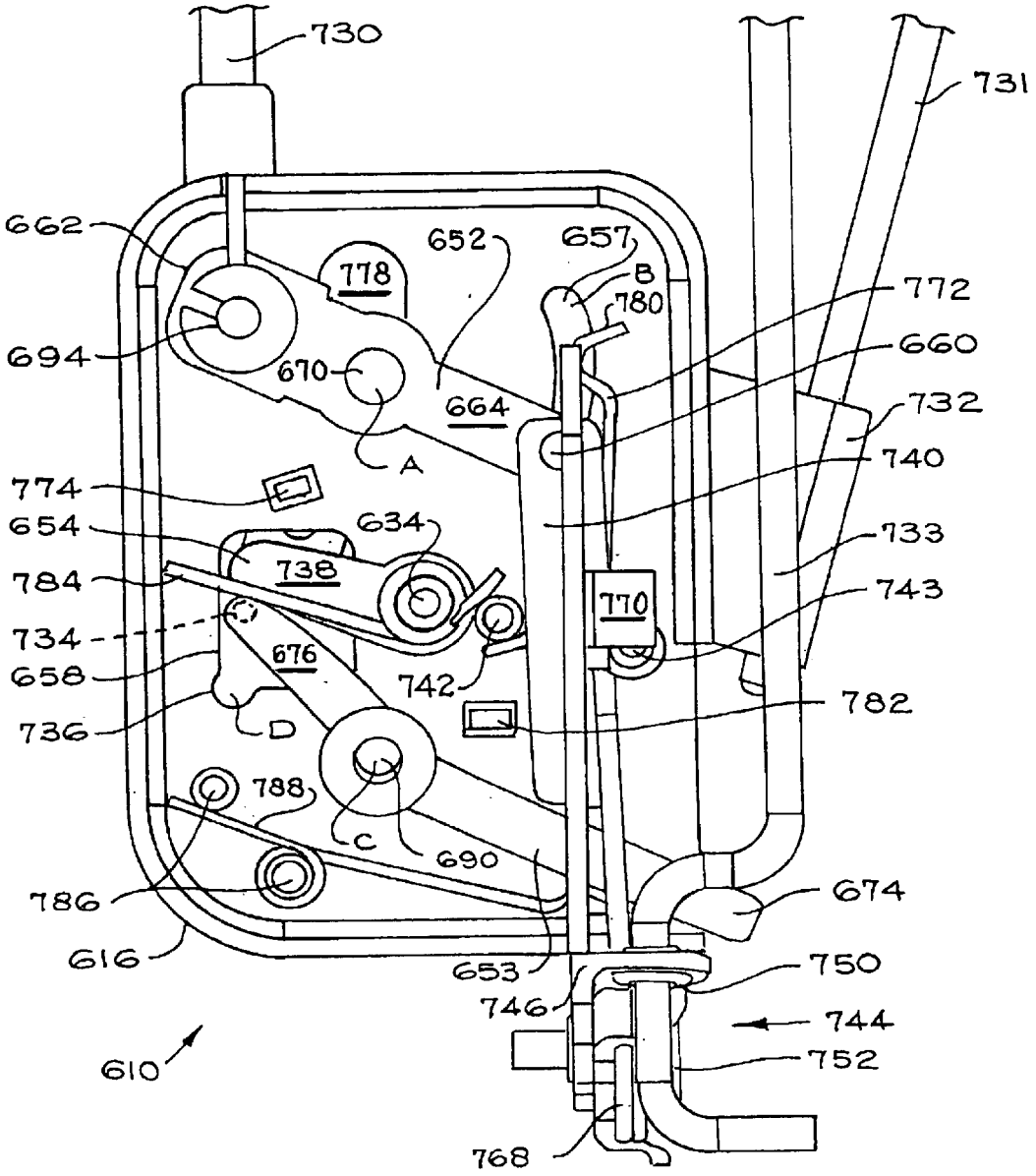
FIG. 43 is a front elevational view of the latch mechanism shown in FIGS. 35–42, with the latch mechanism fully unlocked and with the upper control element fully actuated.
Figure 44:
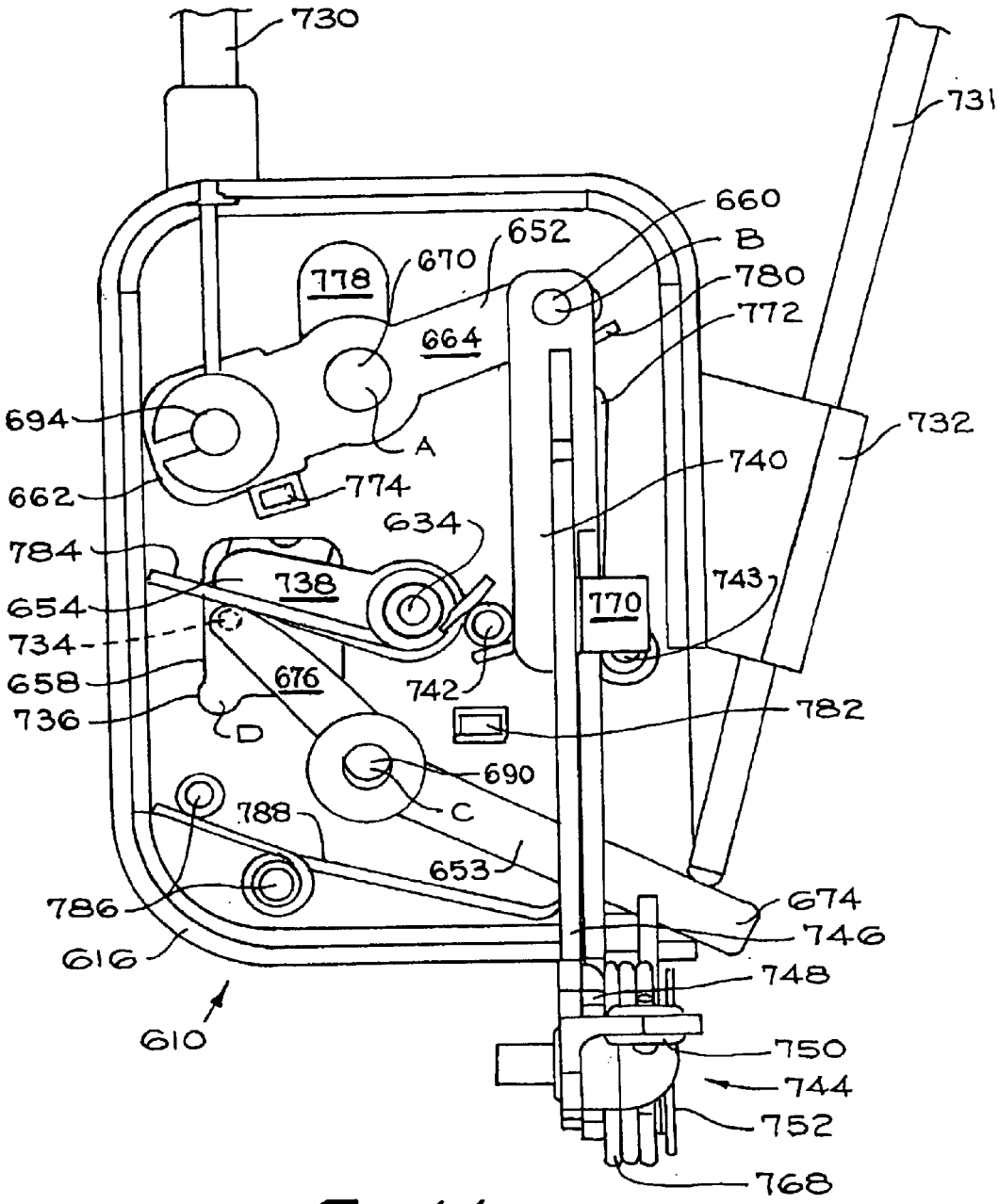
FIG. 44 is a front elevational view of the latch mechanism shown in FIGS. 35–43, with the latch mechanism fully unlocked and with the lower control element actuated.
Figure 45:
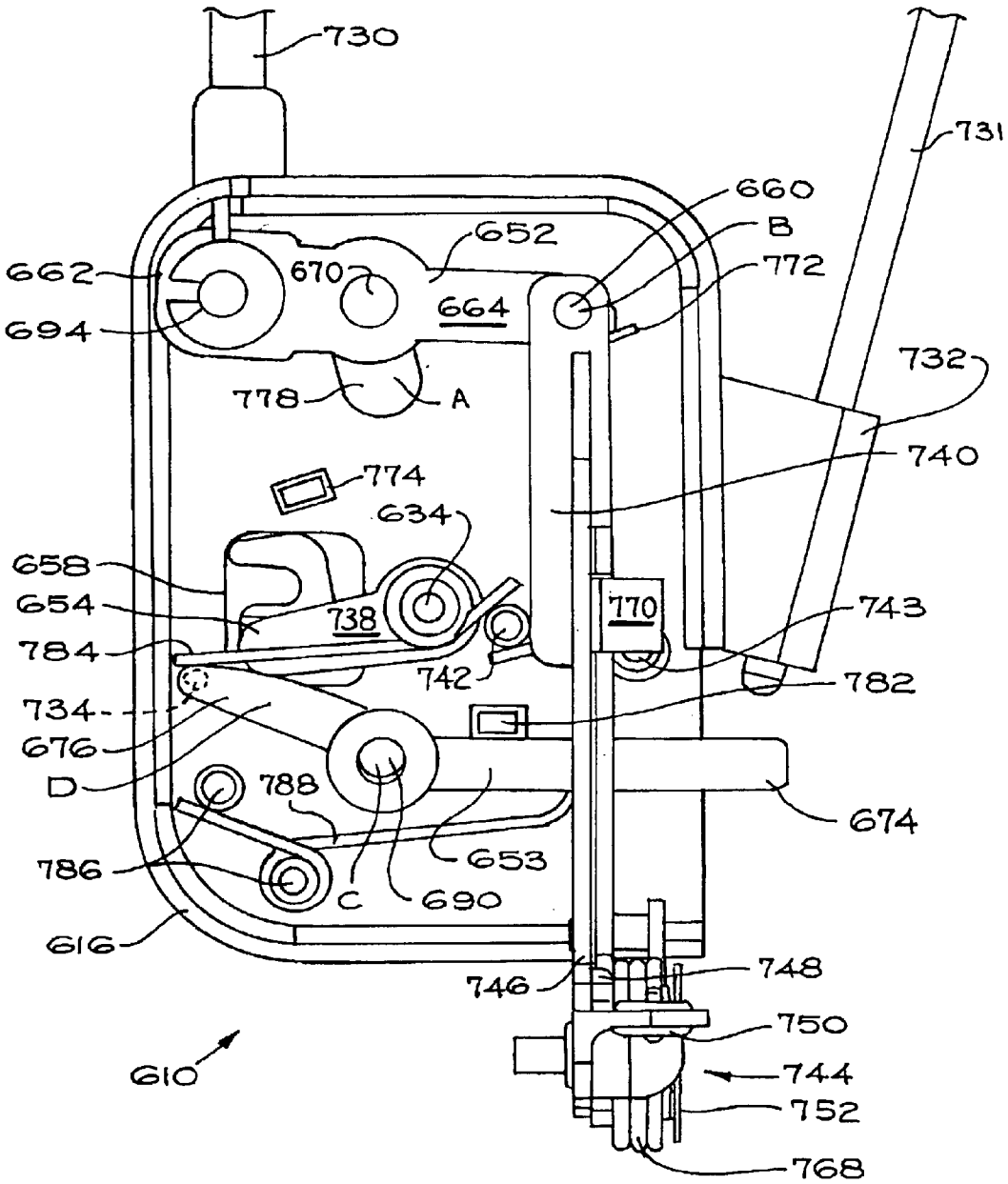
FIG. 45 is a front elevational view of the latch mechanism shown in FIGS. 35–44, with the latch mechanism deadlocked and with the upper control element actuated.

As can be seen with reference to FIGS. 40–46, the lower control element 653 is preferably mounted within the latch assembly 610 adjacent to the pawl 654. The lower control element 653 is pivotable about a first pivot point C when engaged with the lower pin 686 by the lower actuator 688, and is pivotable about a second pivot point D when disengaged from the lower pin 686. Specifically, the lower control element 653 preferably has an aperture 690 suitably sized and shaped to removably receive the lower pin 686 as described above with regard to the first, second, and third embodiments. Also, the lower control element 653 preferably has a post 734 thereon preferably received within a notch 736 or other suitable receptacle in the housing 616 (best shown in FIGS. 43 and 44) when the lower control element 653 is not actuated. This notch 736 is preferably a portion of the housing aperture 658 through which the pawl 654 is received as in the above-described embodiments of the present invention. When the lower control element 653 is actuated while engaged with the lower pin 686, the lower control element 653 preferably pivots about pivot point C as shown in FIG. 44. In this movement, the lower control element post 734 moves from the notch 736 into the housing aperture 658 as the lever end 676 of the lower control element 653 moves the pawl 654 to release the ratchet. Alternatively, when the lower element 653 is not engaged with the lower pin 686, the lower control element 653 preferably pivots in the notch 736 about pivot point D as shown in FIG. 46, imparting little to no movement to the pawl 654 (and at least insufficient pawl movement to release the ratchet).

It should be noted that the notch 736 for the lower control element post 734 can be a groove, recess, elongated aperture, or any other receptacle capable of receiving the lower control element post 734 and of permitting its movement when the lower control element 653 is actuated. Also, the post 734 need not necessarily be on the lower control element 653. Specifically, the lower control element 653 can have a groove, recess, slot, or similar feature within which is received a post, pin, or similar element extending from the front cover 612, latch housing 616, cover plate 682, or rear mounting plate (not shown). In such case, the motion of the lower control element 653 is similar to that described immediately above.

The pawl 654 is preferably an elongated element pivotably mounted upon a pivot post 634 extending from or attached to the latch housing 616 in any conventional manner. Alternatively, the pivot post 634 can extend from or be attached to other latch assembly elements capable of providing sufficient strength and rigidity to permit pawl rotation thereabout, including without limitation the front cover 612 and the cover plate 682. Instead, the pawl 654 can be provided with its own pivot post pivotably received within an aperture in the front cover 612, cover plate 682, or latch housing 616; Although the pawl 654 can take virtually any shape, the pawl 654 most preferably has an elongated lobe 738 extending from the pawl's point of connection to the pivot post 634.

From the above description, it can be seen that actuation of the outside door handle and the linking element 731 connected thereto causes movement of the lower control element 653 which moves the pawl 654 to release the ratchet when the lower control element 653 is engaged by the lower pin 686, but which does not move the pawl 654 (or does so insufficiently) to release the ratchet when the lower control element 653 is not engaged. The upper control element 652 operates in a similar manner, but is mechanically isolated from the pawl 654 as will now be described.

The upper control element 652 preferably has an isolation element 740 connected thereto in any conventional manner. The isolation element 740 can take any shape desired and capable of transferring motive force from the upper control element 652 to the lower control element 653, but most preferably is an elongated element depending from the upper control element 652. Most preferably, the isolation element 740 is pivotably connected to the lever end 664 of the upper control element 652. This connection can be via any pivotable joint, such as a ball and socket joint, a hinge joint, and the like, but is preferably a conventional post and aperture connection. The post 660 can be integral with or rigidly attached to the upper control element 652 or to the isolation element 740, and is sized and shaped to pivotably mate with an aperture in the corresponding element.

To help control movement of the isolation element 740, guidance posts 742, 743 are preferably provided flanking the isolation element 740. The guidance posts 742, 743 are preferably integral with the latch housing 616 or connected thereto in any conventional manner, but can instead be integral with or connected to the front cover 612 or the cover plate 682 as desired. The guidance posts 742, 743 are spaced apart sufficiently to permit the isolation element 740 to readily slide therebetween in a controlled manner. As an alternative to guidance posts, one or more walls, dimples, protuberances, and the like can be located beside the isolation element 740 to help ensure its movement along the desired path as described below. It should be noted that any number of guidance posts 742, 743 (even none) can be used to perform this function, and can be located in positions different from those shown in the figures. However, two guidance posts 742, 743 flanking an end of the isolation element 740 opposite the upper control element 652 when in its unactuated position is most preferred.

Preferably, the post 660 on the upper control element 652 is slidably received within an elongated aperture 657 in the latch housing 616 to farther assist in controlled motion of the upper control element 652 and the isolation element 740. The aperture 657 is preferably curved to follow movement of the lever end 664 when the upper control element 652 is actuated in its engaged state. The aperture 657 can be located in the latch housing 616 or can be located in the cover plate 682 or front cover 612 as desired. Although the post 660 and aperture 657 can control the motion of the upper control element 652 and the isolation element 740, a separate post integral with or attached to the upper control element 652 or to the isolation element 740 and riding within the aperture 657 can instead be used. The post and aperture arrangement can even be replaced by any conventional device used to control element motion, including without limitation a track, rail, slot, groove, or aperture within which a bearing, slide, post, carriage, pin, or other element can ride.

The upper control element 652 is preferably pivotable about a first pivot point A when engaged with the upper pin 666 by the upper actuator 668, and is pivotable about a second pivot point B when disengaged from the upper pin 666. Specifically, the upper control element 652 preferably has an aperture 670 suitably sized and shaped to removably receive the upper pin 666 as described above with regard to the first, second, and third embodiments. When the upper control element 652 is actuated while engaged with the upper pin 666, the upper control element 652 preferably pivots about pivot point A as shown in FIGS. 42 and 43. In this movement, the upper control element post 660 moves through the elongated aperture 657 as the lever end 664 of the upper control element 652 moves the isolation element 740 between the guidance posts 742, 743 toward the lower control element 653. Eventually, the isolation element 740 preferably contacts the lower control element 653. Further movement of the isolation element 740 causes the lower control element 653 to move under pressure from the isolation element 740. Although the isolation element 740 can be positioned by the guidance posts 742, 743 (and by the place at which it is connected to the upper control element 652) to contact and push virtually any part of the lower control element 653, this contact and pushing force is most preferably on the linkage end 674 of the lower control element 653. How the lower control element 653 moves in response to the isolation element 740 is dependent upon whether or not it is engaged with the lower engagement pin 686. Actuation of the lower control element 653 in its engaged and disengaged states by the upper control element 652 is preferably essentially the same as actuation of the lower control element 653 by its linking element 731 (described above).

When the upper control element 652 is not engaged with the upper pin 666, the upper control element 652 preferably pivots about pivot point B without moving the isolation element 740. Although in less preferred embodiments of the present invention actuation of the upper control element 652 may transmit some motive force to the isolation element 740, the force transmitted is preferably insufficient to move the isolation element 740 into contact with the lower control element 653 or at least is insufficient to move the lower control element 653 enough to generate release of the ratchet as described above. To help guide the upper control element 652 in its movement when not engaged with the upper pin 666, the upper control element 652 is preferably provided with a hub 776 (see FIG. 38), post, pin, or other extension shaped to ride within an aperture 778 in the latch housing 716. The aperture 778 is preferably arc-shaped to match the movement of the upper control element 652 as it pivots about pivot point B. It should be noted that the hub and aperture set just described can be replaced by any number of well known guidance assemblies and elements capable of guiding the upper control element 652 as it pivots about pivot point B. These elements include without limitation a pin and slot connection, mating arc-shaped walls in the upper control element 652 and latch housing 616, a bearing in the upper control element 652 or latch housing 616 riding within a groove or track in the latch housing 616 or upper control element 652, respectively, etc. One having ordinary skill in the art will recognize that the particular location of these guidance elements need not necessarily be as described above and illustrated in the figures. For example, the hub 776 can be located on the opposite side of the upper control element 652 to mate in an aperture, groove, or other element in the cover plate 682 or front cover 612, or the upper control element 652 can be shaped to have a groove or aperture therein through which a post extending from the latch housing 616, cover plate 682, or front cover 612 is slidably received. Still other arrangements for guiding the disengaged upper control element 652 in its travel path are possible and fall within the spirit and scope of the present invention.

By virtue of the above-described control element arrangement, the lower control element 653 is actuatable by its linking element 731, and will unlatch the latch assembly 610 if the lower control element 653 is in its engaged state. The upper control element 652 is actuatable by its linking element 730, but will unlatch the latch assembly 610 if both the upper and lower control elements 652, 653 are in their engaged states. As such, the upper control element 652 is dependent upon the state of the lower control element 653 to unlatch the latch 610. Even though the pawl 654 can be moved to release the ratchet via actuation of a number of different latch inputs (in the illustrated preferred embodiment, two inputs: linking elements 730, 731), preferably only a limited number of motion-transmitting paths exist to the pawl 654 to release the ratchet (in the illustrated preferred embodiment, only one: lower control element 653). In other words, rather than have multiple "parallel" paths through which motive force can be transmitted from user-operable devices to the element retaining the latch in its latched condition, the present invention according to the fourth preferred embodiment employs control elements in 0"series" to transmit such forces. Although more than one path can exist to the element holding the latch in its latched state (e.g., the pawl 654 in the preferred embodiment), the number of such paths is preferably less than the number of user-operable devices and corresponding inputs.

By combining motion-transmitting paths in this manner, the ability of an unauthorized user to unlatch the latch is more difficult because fewer paths exist to the element holding the latch in its latched state. Also, it is easier to disable two or more inputs by "disconnecting" one path rather than two or more paths. In the illustrated preferred embodiment for example, a first motion transmitting path extends from the inside door handle, through the linking element 730, upper control element 652, isolation element 740, lower control element 653, and to the pawl 654 to release the ratchet, and a second motion transmitting path extends from the outside door handle, through the linking element 731, lower control element 653 and to the pawl 654 to release the ratchet. The motion transmitting paths are therefore merged at the lower control element 653, which thereafter is the only path to unlatch the latch. Both paths can be quickly disabled with few elements and structure by disengaging the lower control element 653 only, rather than by disengaging both control elements 652, 653.

Following the same operational principles described above, it is possible to have more latch inputs to the latch assembly of the present invention than exist in the illustrated preferred embodiment. Three or more inputs each capable of unlatching the latch can be used, any or all of which can have their motion-transmitting paths combined to be "in series" with the element holding the latch in its latched state in a similar manner to that described above.

Although the fourth preferred embodiment of the present invention described above and illustrated in FIGS. 35–46 employs control elements 652, 653 releasably engagable with pins 666, 686 via actuators 668, 688, it should be noted that the novel arrangement of control elements just described can be employed without such engagement devices, whereby actuation of one or more control elements to unlatch the latch relies upon one or more other control elements to transfer the unlatching motive force.

It will be appreciated by one having ordinary skill in the art that the isolation element 740 need not necessarily be pivotably connected to the upper control element 652 as described above. In less preferred embodiments of the present invention, the isolation element 740 can be secured to the upper control element 652 in any conventional manner against movement relative thereto. The resulting motion of the isolation element 740 is somewhat different than that of the preferred embodiment above, but still serves to move the isolation element 740 into contact with the lower control element 653 and to transfer motive force to the lower control element 653. Therefore, the isolation element 740 can even be integral with or be an extension of the upper control element 652. Also, the isolation element 740 can instead be connected to the lower control element 653 (for pivotal movement with respect thereto or not) or can be a part thereof in any manner as described above with reference to the connection between the upper control element 652 and the isolation element 740. In such cases, the upper control element 652 is preferably spaced from the isolation element 740 a distance when the upper control element 652 is not actuated, and is brought into motive force-transmitting contact with the isolation element 740 when the upper control element 652 is actuated in its engaged state. Depending upon the arrangement of the control elements 652, 653 in the latch assembly 610, it is even possible to remove the isolation element 740 altogether. Specifically, the control elements 652, 653 can be positioned sufficiently close to one another to enable the upper control element 652 to contact and move the lower control element 653 upon actuation of the upper control element 652 in its engaged state but not in its disengaged state. However, the use of an isolation element 740 is preferred to facilitate the use of the control element arrangement illustrated in the figures.

As another feature of the present invention, a preferred mechanical actuation assembly capable of supplementing or replacing the above-described electrical actuation devices is illustrated in FIGS. 35–46. This actuation assembly 744 not only provides a novel manner in which to transfer the motion of one control element to actuation of an actuator, but also provides a manner in which to transfer motion of a linking element to actuation of an actuator. In the illustrated preferred embodiment (once again with reference to application on a vehicle door by way of example only), the actuation assembly 744 preferably has first and second actuation levers 746, 748, respectively, connected for pivotal movement about a common pivot point. The actuation assembly 744 is preferably connected to the linking element 733, which is itself connected in any conventional manner to the outside door lock cylinder or other conventional lock device. The actuation assembly 744 is also preferably connected to the isolation element 740 and is connected to and/or movable into direct or indirect engagement with the pins 666, 686 of the actuators 668, 688.

The connection with the linking element 733 functions to transfer motion of the linking element 733 to the actuator pins 666, 686 when the lock cylinder (or other such locking device) is actuated. In particular, the linking element 733 preferably has a hooked end upon which the first actuation lever 746 is slidably received in any conventional manner, such as by a hook, boss, lug, or aperture 750 on the second actuation lever 746. When the linking element 733 is pulled or pushed by its user-manipulated lock device, it pivots the first actuation lever 746 about pivot 752, thereby swinging the first actuation lever 746 to push or pull the actuator pins 666, 686. The pivot 752 can take any form desired, including without limitation a post, bar, tube, rivet, or other element about which the first actuation lever 746 can pivot. Preferably, the pivot 752 is a spindle-shaped element secured in a conventional fashion (e.g., via a bolt, rivet, or other fastener, by welding, gluing, press fitting, and the like) to the front cover 612, but can instead be secured to any portion of the latch assembly 610 capable of bearing the loads exerted upon the pivot 752 by actuation of the actuation levers 746, 748. The pivot 752 can even be part of the front cover 612 if desired. As an alternative to the pivot 752, either of the actuation levers 746, 748 can have a pivot secured thereto or extending therefrom which can be used to pivotably mount the other actuation lever 748, 746 and/or which can be pivotably received within an aperture in the front cover 612 or other portion of the latch assembly 610. Still other manners of mounting the actuation levers 746, 748 for rotation on the latch assembly 610 are well known to those skilled in the art and are not therefore described further herein.

Figure 37:
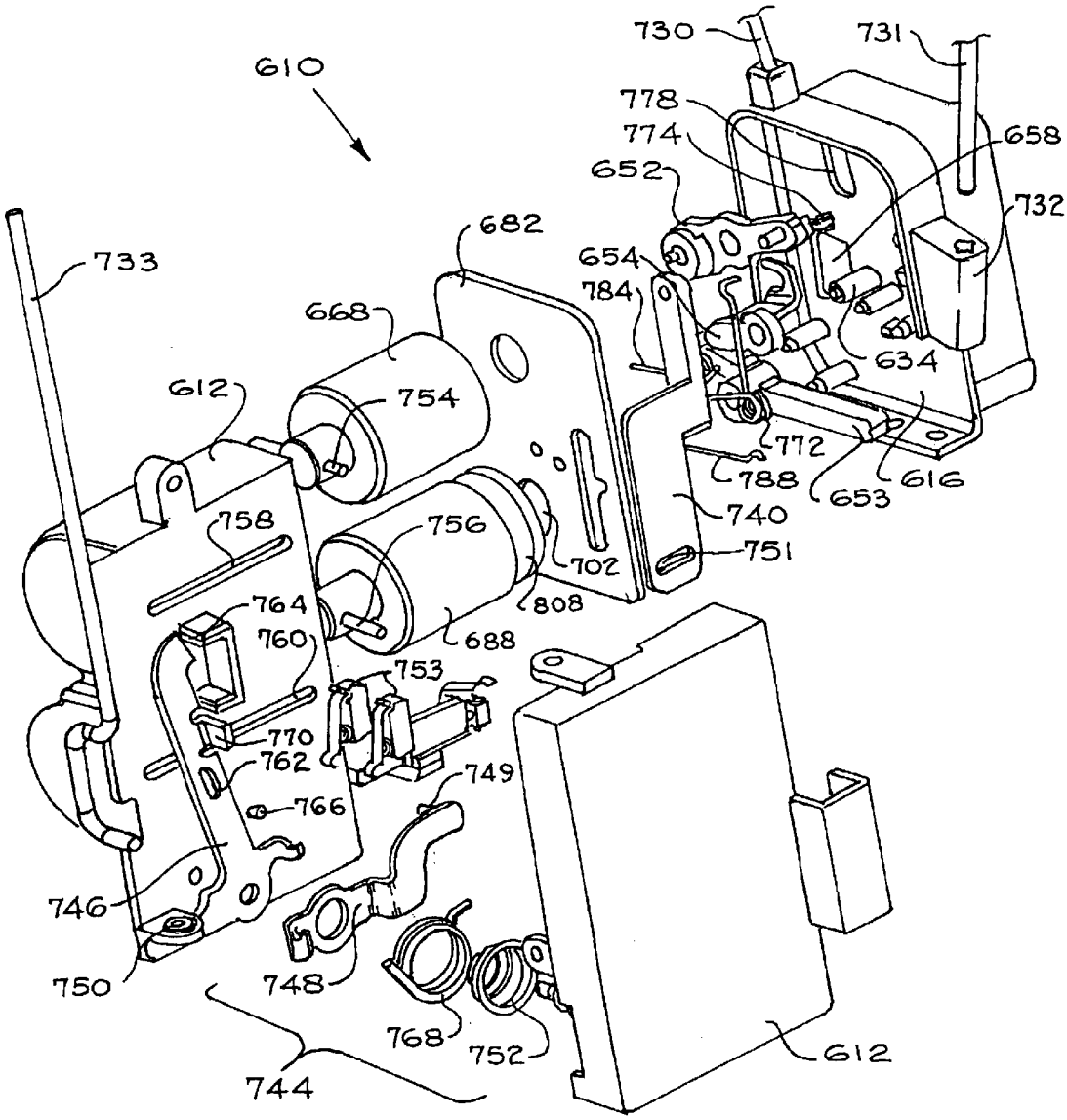
FIG. 37 is an exploded view of the latch mechanism shown in FIGS. 35 and 36, viewed from the front.

Preferably, the pins 666, 686 of the actuators 668, 688 are armatures thereof (although the pins 666, 686 can be elements fitted upon the armatures or movable by the armatures as described in more detail below). The pins 666, 686 each preferably have an extension 754, 756, respectively, extending laterally from the actuators 668, 688 to positions beside the first actuation lever 746. Depending at least in part upon the shape and style of the housing front cover 612, the extensions 754, 756 can pass through respective elongated slots 758, 760 in the front cover 612 as shown in FIG. 37. These slots 758, 760 (or other apertures as desired) permit the extensions 754, 756 to move with the pins 666, 686 in their ranges of motion between their engaged and disengaged positions.

The first actuation lever 746 illustrated in the preferred embodiment shown in the figures demonstrates two manners in which the first actuation lever 746 can interface with the pins 666, 686. Specifically, the first actuation lever 746 can be connected to a pin or can be movable to contact and move a pin without being connected thereto. The lower pin 686 corresponding to the lower control element 653 and outside door handle in the preferred illustrated embodiment is preferably connected to the first actuation lever 746 via an elongated aperture 762 in the first actuation lever 746. This connection permits the first actuation lever 746 to swing while remaining engaged with the lower pin 686 (via the extension 756 thereof). One having ordinary skill in the art will appreciate that a number of alternative connections establishing this relationship are possible and fall within the spirit and scope of the present invention. The upper pin 666 corresponding to the upper control element 652 and inside door handle in the preferred illustrated embodiment is preferably not connected to the first actuation lever 746, but is in the swing path thereof Therefore, a surface 764 of the first actuation lever 746 preferably contacts and pushes the extension 754 of the upper pin 666 when the first actuation lever 746 is actuated. Unlike the elongated aperture 762 and lower pin 686 arrangement, the upper pin 666 is not returned to its retracted position when the first actuation lever 746 is returned to its original position. It should be noted that either type of response can be selected for either or both pins 666, 686 by changing the shape of the first actuation lever 746

(e.g., one or two elongated apertures 762 or bearing surfaces 764 for the pins 666, 686).

When actuated by the linking element 733, the first actuation lever 746 rotates to push the pins 666, 686 into engagement with their respective control elements 652, 653. Both control elements 652, 653 are thereby placed into their unlocked states. In other words, both the inside and outside door handles are unlocked. Preferably, a stop 766 is attached to or integral with a portion of the latch assembly 610 (e.g., a side of the front cover 612) to limit the amount of swing motion of the first actuation lever 746. In the illustrated preferred embodiment where the lower pin 686 is connected to the first actuation lever 746 and where the upper pin 666 is not, actuation of the linking element 733 in an opposite direction pulls the lower pin 686 out of engagement with the lower control element 653 but does not pull the upper pin 666 out of engagement with the upper control element 652. Therefore, the outside door handle is locked while the inside door handle remains unlocked. In other less preferred embodiments of the present invention, the first actuation lever 746 has an elongated aperture 762 for each pin 666, 686 (in which case actuating the linking element 733 to lock the latch 610 locks both door handles), has an elongated aperture 762 only for the top pin 666 with a bearing surface 764 for the bottom pin 686 (in which case actuating the linking element 733 to lock the latch 610 locks only the inside door handle), or has only a bearing surface 764 for both pins 666, 686 (in which case neither handle could be locked via the linking element 733 once unlocked). It is also possible to adapt the first actuation lever 746 to control only one of the pins 666, 686. For example, a latch assembly having an outside door lock that does not affect the locked state of the inside door lock could employ a first actuation lever 746 that terminates at the lower pin 686. In such a case, the upper control element 652 can still preferably be manually engaged and disengaged by connecting the extension 754 of the upper actuator's pin 666 to any user-operable and accessible device, such as a lever, pin, post, and the like extending from the latch assembly 610. If desired, such a manual input can be used with any actuator in other embodiments of the latch assembly. Such a manual input can be connected in any conventional manner to a pin or other engagement device regardless of whether the engagement device is part of an actuator (such as an armature of a solenoid). In other words, such a manual input can be connected to or integral with an engagement device movable into and out of engagement with respect to its corresponding control element. As one having ordinary skill in the art will recognize, other manners exist for adapting the first actuation lever 746 to control only one of the pins 666, 686, such as by employing a curved first actuation lever 746 having no interaction with the lower pin 686 or by changing the location of the pivot 752 and the orientation of the actuation levers 746, 748 with respect to the pins 666, 686, etc.

As described above, the fourth preferred embodiment of the present invention preferably has a second lock input which can correspond to the inside lock button on a vehicle door. The actuation assembly 744 preferably provides a manner in which to transfer actuation of this input to the actuators 668, 688 for control thereof With reference to FIGS. 39 and 40, the second actuation lever 748 is preferably connected via the pivot 752 to the front cover 612 or to any other substantially rigid portion of the latch assembly 610 for pivotal movement about the pivot 752. Although the first and second actuation levers 746, 748 need not necessarily share the same pivot, this arrangement is preferred. The second actuation lever 748 is also preferably connected to the isolation element 740. This connection location can be virtually anywhere on the isolation element 740, but is most preferably on the end opposite its connection to the upper control element 652 as shown in the figures. The connection can be in any conventional manner, including without limitation via conventional fasteners such as nuts and bolts, riveting, welding, gluing, press fitting the end of the second actuation lever 748 into a mating aperture or groove in the isolation element 740, etc. Most preferably however, the end of the second actuation lever 748 has a pin 749 on the end thereof mating within an elongated aperture 751 in the isolation element 740. This connection therefore permits relative rotational and translational movement of the second actuation lever 748 with respect to the isolation element 740. Numerous other connection types permitting such relative movement are well known to those skilled in the art and can instead be used if desired. The second control element 748 is therefore preferably pivotably connected to the isolation element 740 at one end and pivotably connected to the pivot 752 at another end. It should be noted that it is possible to connect the second actuation lever 748 in any conventional manner directly to the upper control element 752 for movement therewith, if desired.

With the above-described connection between the isolation element 740, the actuation assembly 744, and the pins 666, 686 of the actuators 668, 688, it can be seen that actuation of the linking element 730 when the upper control element 652 is not engaged generates no motion of the isolation element 740, no motion of the second actuation lever 748, and therefore no motion of the pins 666, 686. The latch assembly 610 therefore stays in the same lock mode. If the linking element 730 corresponds and is attached to an inside door handle and door lock, the inside door remains locked and the latch assembly 610 is therefore either in child locked mode (lower pin 686 engaged with the lower control element 653) or in dead locked mode (lower pin 686 disengaged from the lower control element 653). On the other hand, actuation of the linking element 730 when the upper control element 652 is engaged generates motion of the isolation element 740, motion of the second actuation lever 748, motion of the first actuation lever 746, and motion of the pins 666, 686 into engagement with the control elements 652, 653 if not already engaged therewith (note that even if the upper pin 666 is not engaged with the upper control element 652, the upper control element 652 can still be held to pivot about pivot point A when certain actuators such as the magnetic holding actuator described below are employed). The linking element 733 connected to the first actuation lever 746 preferably has a hooked end creating some lost motion with respect to the first actuation lever 746. This prevents the transfer of motion from the first actuation lever 746 to the linking element 733 when the linking element 730 and engaged upper control element 652 are actuated as just described, and helps to ensure that the first actuation lever 746 is thrown only when the linking element 733 is fully (and not partially) actuated.

To transfer motion between the actuation levers 746, 748, the actuation levers 746, 748 are preferably connected to a spring 768 on the pivot 752. The spring 768 is preferably a torsion spring, although any type of conventional spring can instead be used, including without limitation a leaf spring, extension spring, compression spring, and the like The spring 768 preferably transfers force from the second actuation lever 748 to the first actuation lever 746 via its ends, each of which is attached to or seated against one of the levers 746, 748. The spring 768 preferably also permits overextension of the second actuation lever 748 with respect to the first actuation lever 746 when the first actuation lever 746 has reached the end of its travel defined by stop 766.

Therefore, actuation of the linking element 730 when the upper control element 652 is engaged causes engagement of the lower control element 653. With reference to the vehicle door application described above, the outside and inside door handles are unlocked (if not already unlocked) when a user uses the inside door lock input to unlock the door.

The overextension capability of the second actuation lever 748 with respect to the first actuation lever 746 is particularly useful for permitting movement of the second actuation lever 748 in response to full actuation of the linking element 730. As mentioned above, the linking element 730 is preferably attached to a latch locking input (e.g., a door lock button, lock lever, sill button, and the like) and a latch unlatching input (e.g., a door handle, door lever, and the like). The linking element 730 is preferably actuatable through a first range of motion shown in FIG. 42 to move the actuator pins 666, 686 into engagement with the control elements 652, 653 if not already engaged therewith. The linking element 730 can then be actuated through a second range of motion shown in FIG. 43 to move the lower control element 653 via the isolation element 740 as described above. The spring connection between the first and second actuation levers 746, 748 permits the isolation element 740 to move through its full range of motion after the pins 666, 686 have been engaged with their respective control elements 652, 653 by the first actuation lever 746.

It will be appreciated by one having ordinary skill in the art that the first and second actuation levers 746, 748 can take a number of different shapes limited primarily by the ability to connect the elements and transmit the forces as described above. Either or both of these levers 746, 748 can also be made of multiple parts if desired. Multiple-part levers can be particularly useful for latch assembly adjustment and/or to speed assembly of the latch 610.

The actuation assembly 744 enables the manual transfer of motion from a control element to one or more actuators to change the state thereof. Although this capability is shown only with reference to the transfer of one control element's motion to one or two actuator pins 666, 686 in the illustrated preferred embodiment, such motion transfer can be facilitated in a similar manner for any number of control elements and corresponding actuators. One having ordinary skill in the art will appreciate that this transfer of motion from an actuated control element to any actuator in a latch assembly is possible, even to move the actuator corresponding to the same control element into engagement with the control element (when certain actuator types are employed in the latch, such as the magnetic holding actuators described below).

It may be desirable to detect when the pins 666, 686 of the actuators 668, 688 have been moved to their engaged positions, whether by manual force from the first actuation lever 746 or by electrical actuation of the actuators 668, 688. To this end, one or more sensors can be located on the latch assembly 610 to be tripped with changes in pin location. By way of example only and with reference to the preferred embodiment of the present invention shown in FIGS. 35–46, one or more sensors 753 can be located at both ends of the first actuation lever's range of motion. The first actuation lever 746 can be provided with an extension or arm 770 to trip such sensors, if desired. Alternatively, one or more sensors (not shown) can be located beside the path followed by the extensions 754, 756 of the pins 666, 686. Other sensor locations are possible and fall within the spirit and scope of the present invention. In each case, the sensors used are preferably conventional in nature, such as motion sensors, proximity sensors, mechanical trip sensors, and the like.

Like the other embodiments of the present invention described earlier, the fourth embodiment of the present invention preferably employs one or more springs and stop elements to place the various elements in the latch assembly in desired at-rest positions. Preferably, the upper control element 652 has two at-rest positions defined by at least one spring 772 and at least one stop 774. These two at-rest positions are preferably the locked and unlocked positions of the upper control element 652 shown in FIGS. 41 and 42, respectively. The spring 772 is preferably connected to one of the guidance posts 743 in any conventional manner and extends to a position alongside the path of the upper control element lever end 664. When the upper control element 652 is fully actuated by the linking element 730 to unlock the latch assembly 610, the upper control element 652 preferably moves past an elbow 780 in the spring 772. This elbow 780 provides some degree of force upon the upper control element 652 to bias the upper control element 652 in the first range of positions (including and between the locked position shown in FIG. 41 and the unlocked position shown in FIG. 42). Because the spring force exerted by the spring 768 on the pivot 752 is preferably stronger than the spring force of the elbow 780 on the upper control element 652, the fully actuated upper control element position shown in FIG. 43 is preferably maintained only so long as pulling force is maintained on the linking element 730. The upper control element 652 can therefore be toggled to remain between its locked and unlocked positions and can be moved to an unlatched position for so long as force is applied by a user to keep the upper control element 652 in this latter position.

The lower control element 653 is preferably also maintained in an at-rest position by spring force. Specifically, at least one spring biases the lower control element 653 into the position shown in FIGS. 40–42 and 45 against at least one stop 782. In the illustrated preferred embodiment, a first spring 788 is connected to and biased by a pair of latch housing posts 786 in any conventional manner, and extends to bias the linkage end 674 of the lower control element 653 to the at-rest position of the lower control element 653. Preferably, a second spring 784 is connected to the pivot post 634, is biased against one of the guidance posts 742, and extends to bias the lever end 676 of the lower control element 653 to the at-rest position of the lower control element 653. The second spring 784 can also be connected to the pawl 654 in any conventional manner to bias the pawl 654 in its unactuated position, if desired.

One having ordinary skill in the art will appreciate that virtually any type of spring (leaf, tension, extension, compression, etc.) can be used to bias each of the control elements 652, 653 and pawl 654 into their unactuated positions as described above, and can be connected to these elements and to any stationary surface in the latch assembly 610 (a surface, post, boss, or wall of the latch housing 616, cover plate 682, front cover 612, etc.) to generate the necessary bias force. One or more springs can be associated with each of the control elements 652, 653, and pawl 654, and can be transmit bias force upon any leverage-bearing position on these elements as desired. Also, the stops used to limit motion of the elements and the posts used to mount the springs can be separate elements mounted within the latch assembly 610 in any conventional manner, or can be integral with the latch housing 616, cover plate 682, or front cover 612. These stops and posts can take any form as described in the first through third embodiments above.

As with the other preferred embodiments of the present invention, a number of the elements in the latch assembly 610 rely upon physical contact with another element to transmit force and/or to move one or more elements in the latch assembly 610. It should be noted that though such physical contact is preferred, it is not required. Force can be transmitted, for example, via magnet sets located on the elements in question, and can even be transmitted by magnetic force from latch assembly elements made of magnetic material. As such, the present invention as described herein and as claimed in the appended claims is understood to encompass transmission of force and movement with out without physical contact between elements.

Still other advantages of the present invention are provided by an improved actuator 800 which is preferably used in conjunction with the latch assembly 610 according to the fourth preferred embodiment of the present invention described above and illustrated in FIGS. 35–46, but which can be used in conjunction with any of the latch assembly embodiments of the present invention, and also in virtually any application desired (e.g., non-latch applications, non-vehicular applications, etc.). The actuator 800 is capable of engagement with any element at speeds significantly faster than conventional solenoids, and employs magnetic holding force to at least temporarily impede or restrain movement of the element. For purposes of illustration only, the preferred latch embodiment shown in FIGS. 35–46 employs this type of actuator as the lower actuator 688.

Figure 47:
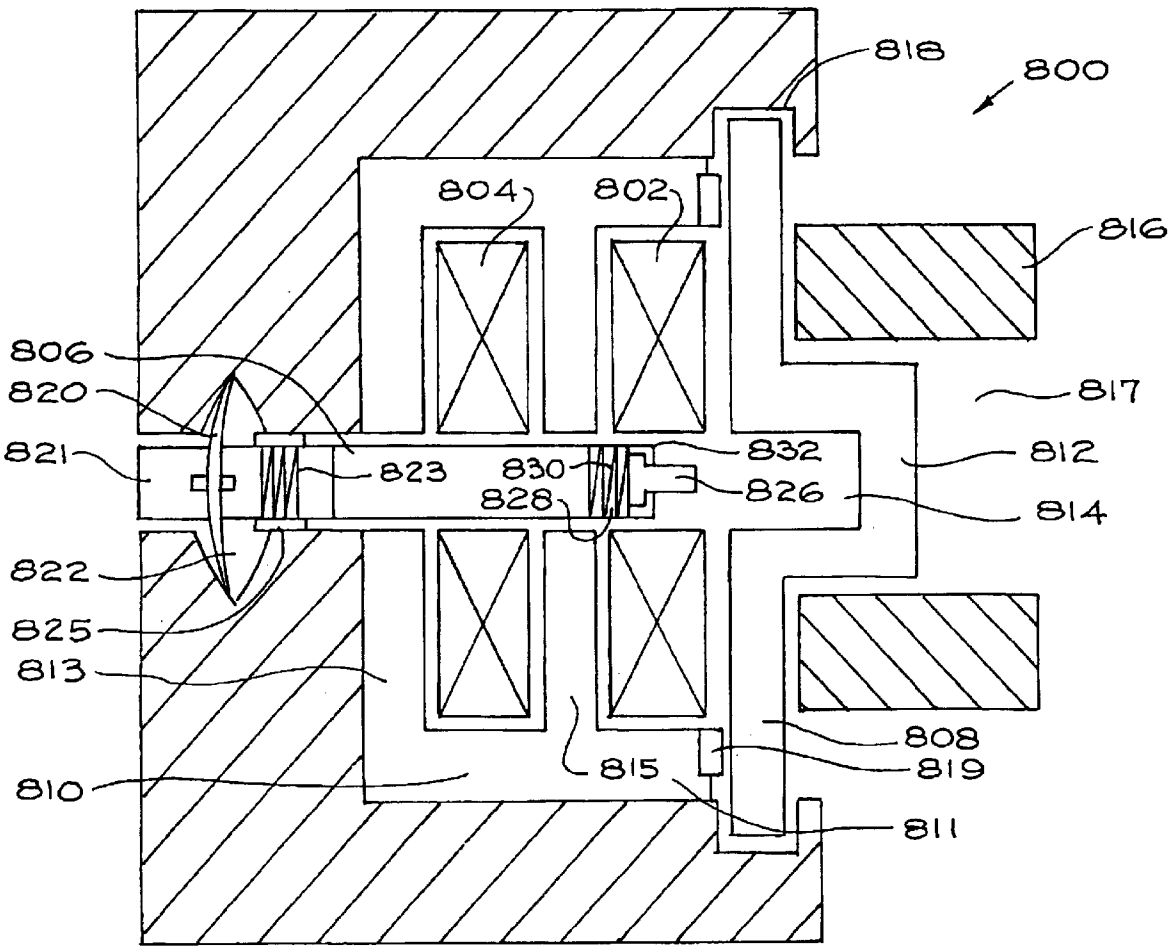
FIG. 47 is a cross-sectional view of an actuator according to a preferred embodiment of the present invention.
Figure 48:
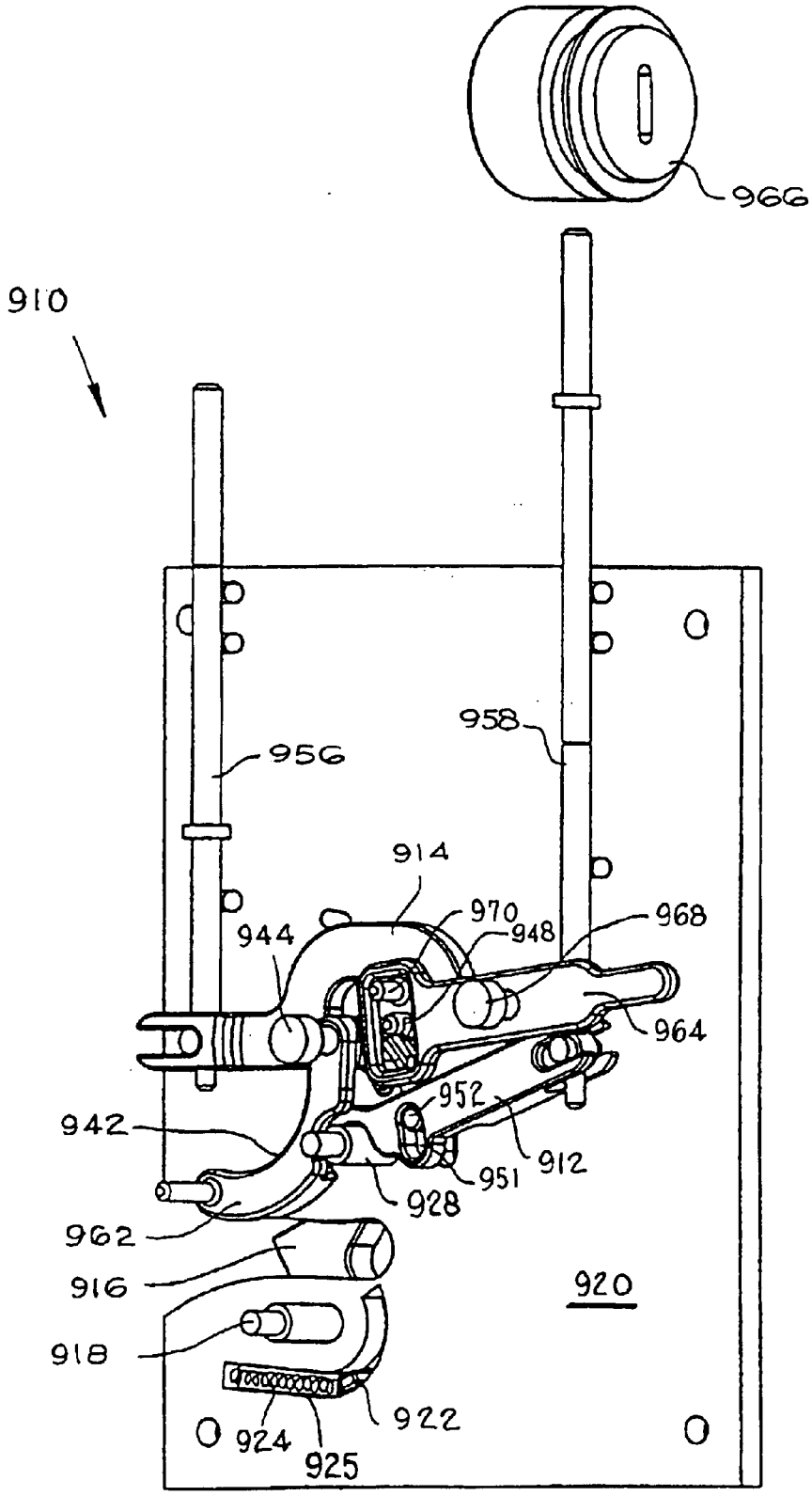
FIG. 48 is a front perspective view of a latch mechanism according to a fifth preferred embodiment of the present invention, shown with the front cover, actuators, cover plate, and rear mounting plate removed.

A highly preferred embodiment of the actuator according to the present invention is best shown in FIG. 47. Actuator 800 preferably includes first and second coils 802, 804, an armature 806 movable with respect to the coils 802, 804, and a holding element 808. The coils 802, 804 are preferably conventional and can be controllably energized to generate a magnetic force exerted upon the armature 806. In some preferred embodiments of the present invention, the solenoid coils are electrically connected by a conventional insulation displacement connector (IDC) for quick assembly and connection. However, any other conventional electrical connectors can be used as desired. Solenoid coils, their manner of connection, and their manner of operation and control are well known to those skilled in the art and are therefore not described further herein. To retain the coils 802, 804 in proper position in the actuator 800, the coils 802, 804 are preferably received within separate compartments of a conventional housing or frame 810 (both terms used synonymously herein and in the appended claims). The frame 810 can take virtually any shape for housing the coils, but most preferably substantially encloses the coils 802, 804 as shown. The frame 810 is preferably made from any magnetically conductive material to permit magnetic flux about the coil, and is more preferably made of steel. The frame 810 can be one element as shown in the figures or can be made of multiple elements assembled and connected in any conventional manner, such as a tube having an end plate closing one end of the frame 810 (preferably with the exception of an aperture to allow the armature 806 to pass therethrough) and a center disc separating the coils 802, 804. In such an embodiment, the end plate and center disc can be attached to the tube in any conventional manner, such as by gluing, welding, press fitting, fastening with conventional fasteners, and the like. Because the tube, end plate, and center disc (or the corresponding portions 811, 813, and 815 of the frame shown in FIG. 47) serve as paths for magnetic flux, the coils and armature are preferably fitted within the frame with close clearance fits to minimize flux loss through gaps in the actuator. It will be appreciated by one having ordinary skill in the art that the center disc (or its corresponding portion 815 of the frame shown in FIG. 47) acts as a common flux path for both coils 802, 804.

The armature 806 is preferably an elongated body made at least partially of material responsive to magnetic force (e.g., steel, iron, etc.) and can be made at least partially of ferromagnetic material if desired. Alternatively, one or more magnets can be located in or on the armature 806 to achieve a similar result. The armature 806 is preferably movable through the coils 802, 804 under magnetic force from the coils 802, 804 in a manner well known to those skilled in the art.

The holding element 808 is also at least partially made of a material responsive to magnetic force, and most preferably is made of a ferromagnetic material. Therefore, the holding element 808 is responsive to the energization of the first coil 802 as will be described in more detail below. Alternatively, one or more magnets can be located in or on the holding element 808 to achieve a similar result. The holding element 808 is movable with respect to the rest of by the actuator 800, and preferably is movable radially with respect to the armature 806 and the coils 802, 804. The holding element 808 is preferably a disc-shaped body as can be seen with reference to FIGS. 35–46, and preferably has an extension in the shape of a pin 812 axially extending from the body. Most preferably,the pin 812 at least partially defines a receptacle or cavity 814 on the opposite face of the holding element 808 (i.e., facing the armature 806 and coils 802, 804). When installed in an application, the pin 812 is permanently or removably connected to an element 816 whose motion is to be controlled. For example, and with reference to FIG. 47 and FIGS. 37–46 of the fourth preferred latch embodiment described above, the pin 812 is preferably removably received within the aperture 690 of the lower control element 653. Therefore, the lower control element 653 can be controlled by controlling the holding element 808 attached thereto. Such control of any element in any device is possible as a result of a similar relationship between the holding element 808 and the element attached thereto.

Preferably, the holding element 808 is connected to the controlled element 816 by a pin and receptacle connection as shown in the figures. Specifically, the pin 812 of the holding element 808 is received within an aperture, cavity, groove, slot, or other receptacle in the controlled element 816. More preferably however, the pin 812 is received within a socket 817 of the controlled element 816. Although the pin 812 can be permanently secured within the socket 817 in any conventional manner, such as by press fitting, gluing, welding, brazing, fastening with conventional fasteners, and the like, the pin 812 is more preferably removably received in the socket 817 with a clearance fit. In alternative embodiments of the present invention, the controlled element 816 (such as the lower control lever 653 in the latch assembly described above) can even be a part of or integral with the holding element 808, and can be made at least partially of same material as the holding element 808. In this regard, it should therefore be noted that the connection between the controlled element 816 and the holding element 808 need not be via a pin and receptacle arrangement as described above and illustrated in the figures. Any manner of permanent or releasable connection of the controlled element 816 and the holding element 808 is possible. By way of example only, the controlled element 816 and the holding element 808 can be welded, brazed, glued, fastened together via one or more conventional fasteners, clamps, bands, etc. Therefore, the shapes of the controlled element 816 and the holding element 808 can be quite different from that shown in the figures while still falling within the spirit and scope of the present invention.

Figure 38:
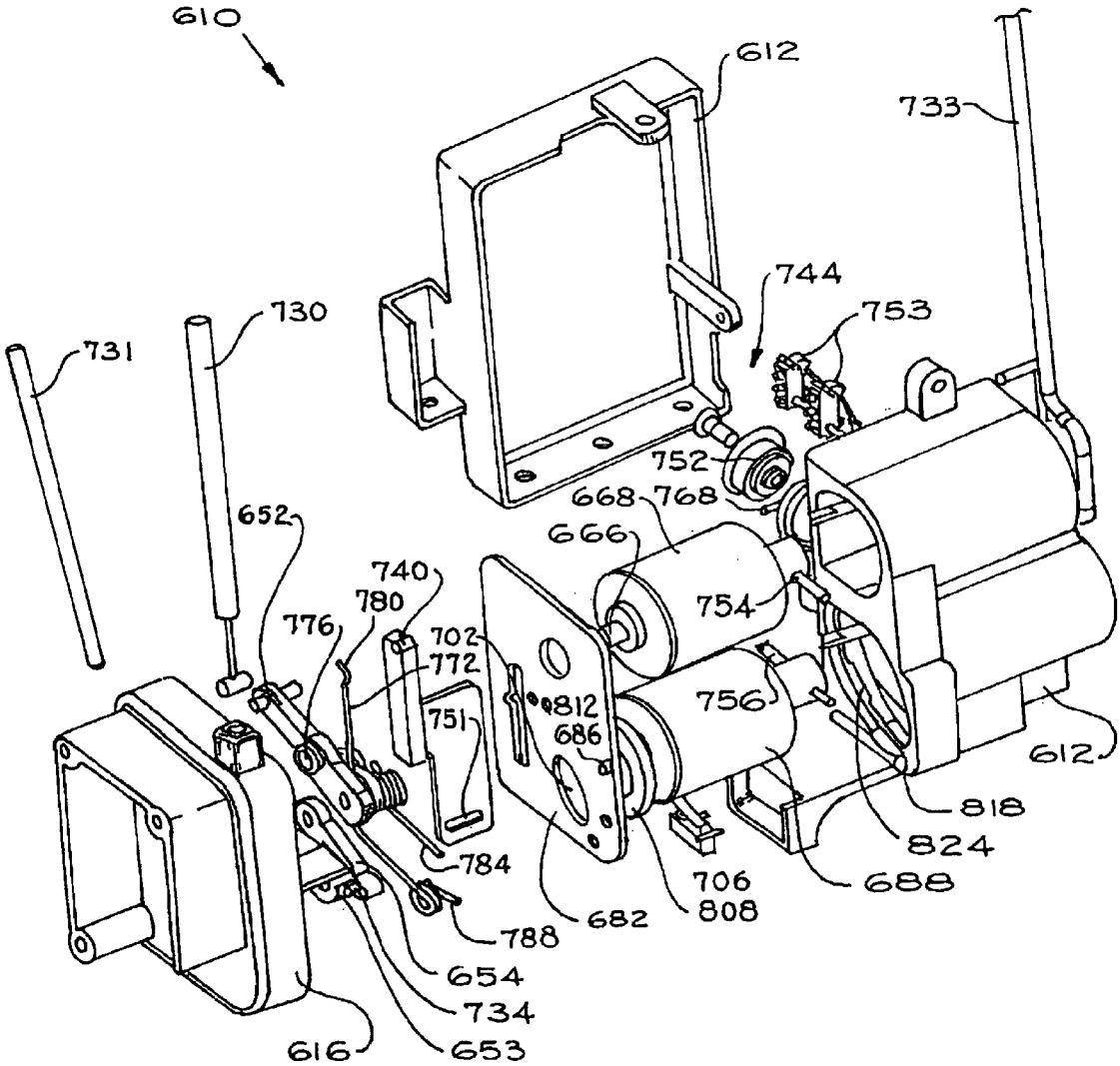
FIG. 38 is an exploded view of the latch mechanism shown in FIGS. 35–37, viewed from the rear.
Figure 39:
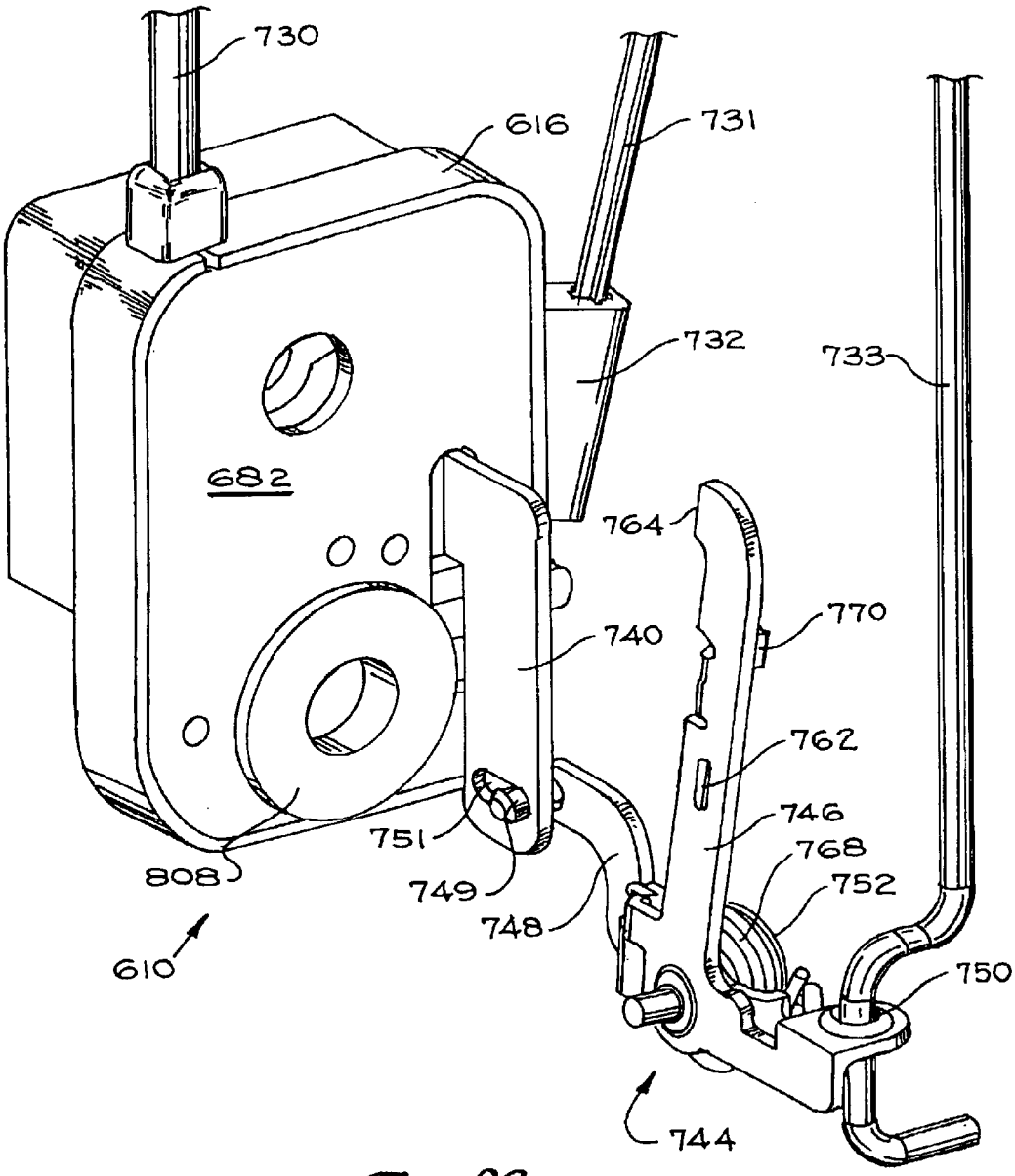
FIG. 39 is a front perspective view of the latch mechanism shown in FIGS. 35–38, with the front cover and actuators removed.
Figure 40:
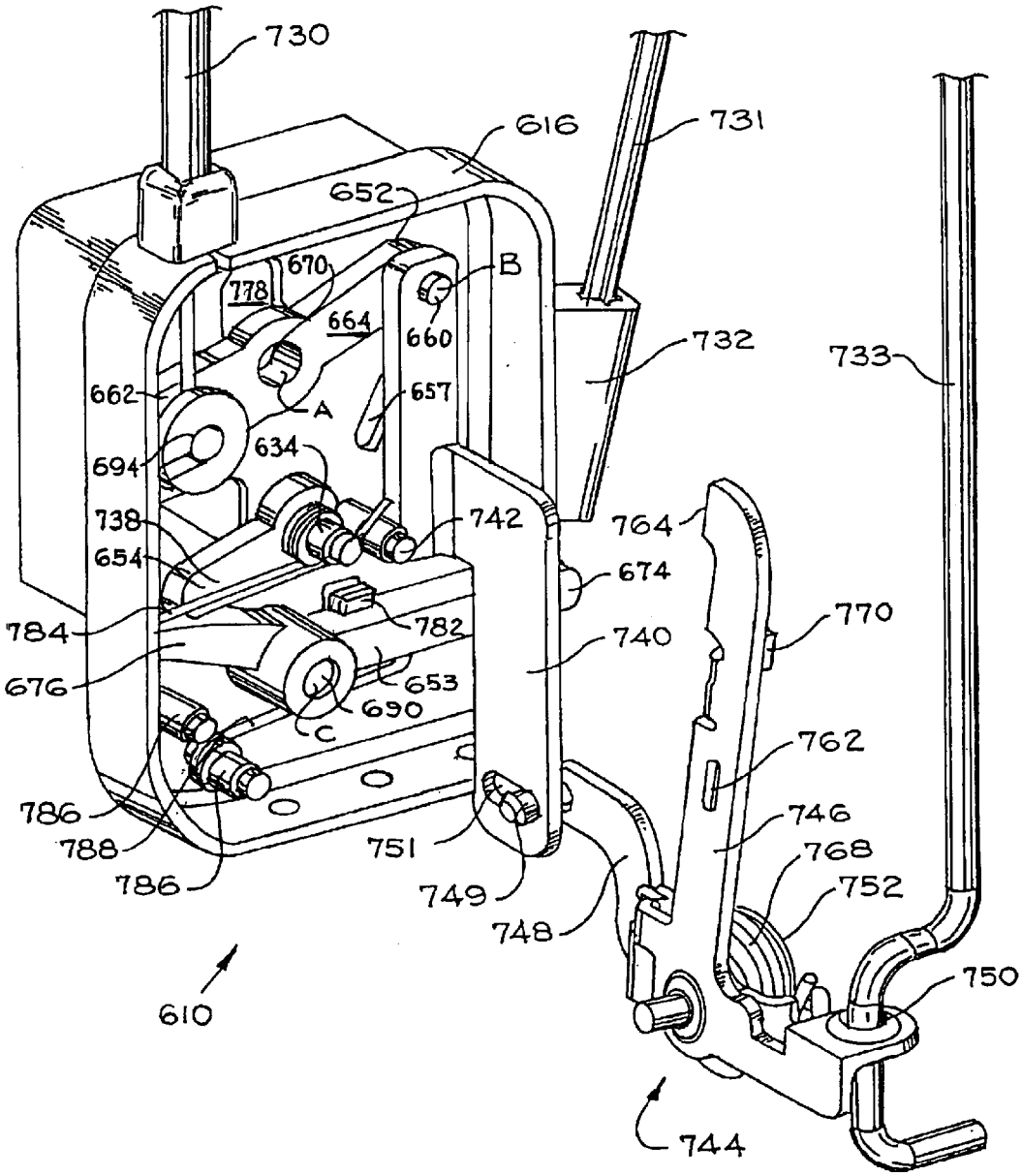
FIG. 40 is a front perspective view of the latch mechanism shown in FIGS. 35–39, with the front cover, actuators, and the cover plate removed, and showing the control elements and the pawl of the latch mechanism.
Figure 41:
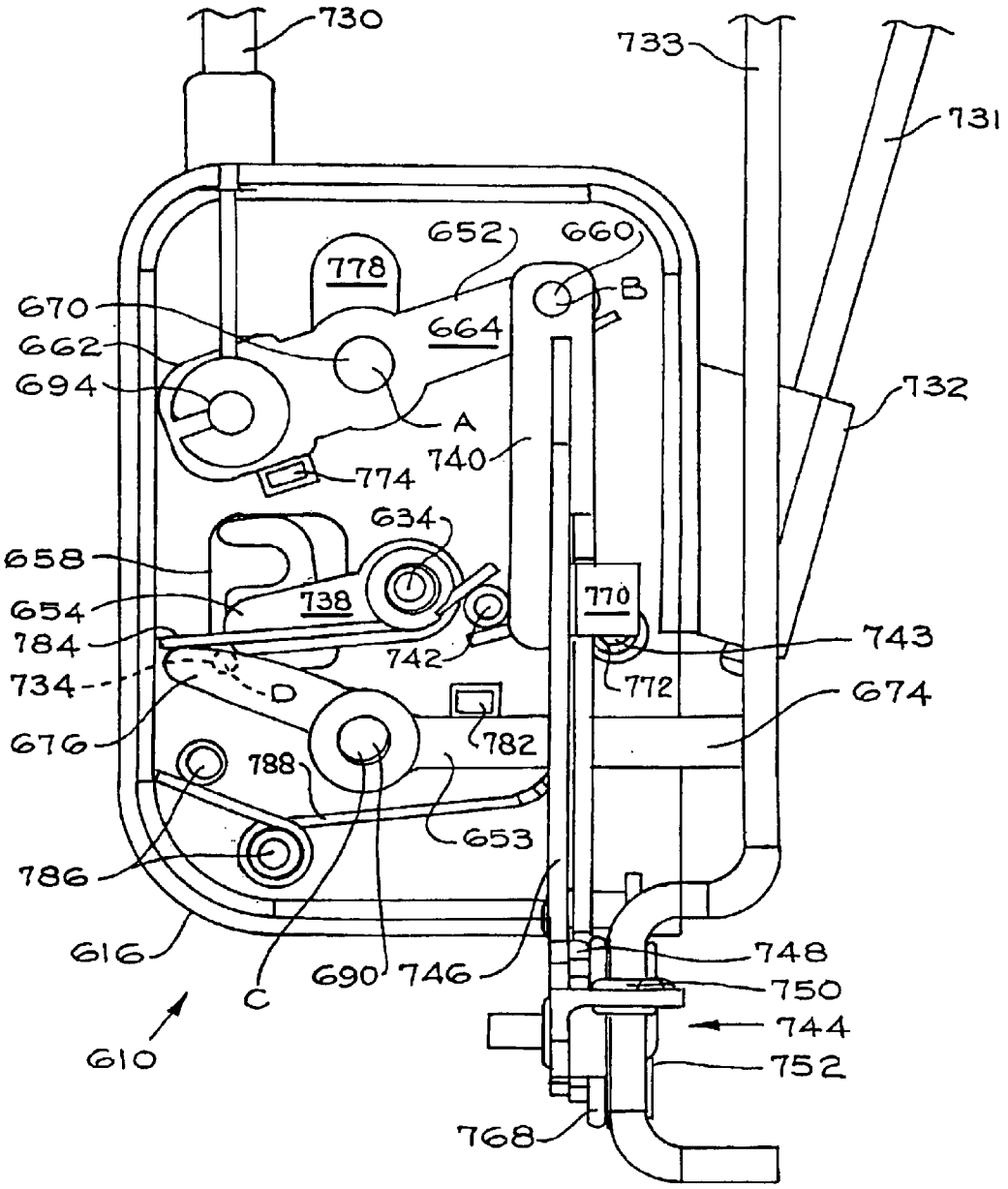
FIG. 41 is a front elevational view of the latch mechanism shown in FIGS. 35–40, with both the upper and lower control elements in their unactuated positions.

As mentioned above, the holding element 808 is movable with respect to the rest of the actuator 800. To provide a desired degree of control over this movement, the holding element 808 can be seated within a track, guide, rails, or other conventional motion-controlling and guiding elements in the environment of the actuator 800. Alternatively, such elements can be attached to, formed in, or otherwise at least partially defined by the actuator frame 810 and/or a housing of the actuator 800 (not shown). In the illustrated preferred embodiment of the present invention, the actuator 800 is shown installed in a device having a track 818. The holding device 808 is received within the track 818 and can be moved therealong (radially with respect to the coils 802, 804 and the armature 806). An example of such an installation is shown in the latch assembly of FIGS. 35–46. With particular reference to FIG. 38, the track 818 is shown as a groove in the wall of the front cover 612. It will be appreciated by one having ordinary skill in the art that numerous other conventional motion-controlling and guiding elements and assemblies can be used in place of the preferred track 818, each one of which acts to at least partially retain and guide the holding element 808 through a desired path of motion. Although not required, such elements and assemblies help to predictably and controllably position the holding element 808 in any given application.

The holding element 808 can be virtually any shape as mentioned above, and therefore can move with respect to the coils 802, 804 and armature 806 in any manner (e.g., sliding, rolling, etc.). The holding element 808 can be a plate-shaped object such as in the illustrated preferred embodiment, can be a rod, bar, or other elongated object preferably orthogonal to an axis passing through the armature 806 and coils 802, 804 and having an end or ends movable in a track or other motion guiding element as described above, etc. Virtually any holding element shape permitting movement with the attached controlled element 816 into and out of position substantially aligned with the axis of the armature 806 is possible.

In operation, the holding element 808 and the controlled element 816 attached thereto are preferably movable as described above when the first coil 802 is not energized and when the armature 806 is in its retracted position shown in FIG. 47. When it is desired to engage and limit movement of the controlled element 816, the first coil 802 is preferably energized. This causes a magnetic force to be applied to the holding element 808, which responds by being attracted or repelled with respect to the first coil 802. At least in the case of repulsive force, the holding element 808 is made at least partially of a material having a magnetic field (is a permanent magnet), or has one or more elements attached thereto or embedded therein that are at least partially made of such material. Most preferably, the coil 802 is energized and the holding element 808 is positioned with respect thereto to exert an attraction force upon the holding element 808. This attractive force holds the holding element 808 against the nearest object (to which the holding element is most preferably already in contact). In the case of the actuator 800 shown in the figures, this object is the frame 810 of the actuator 800, but can instead be the first coil 802 itself, one or more surfaces of the track or other motion-controlling and guiding element used, a braking clement mounted between the holding element 808 and the first coil 802, etc. To provide a close fit between the holding element 808 adjacent to the frame 810 (for minimizing flux loss through an air gap therebetween), the frame 810 can be fitted with a flux ring 819 that has a substantially flat and smooth surface facing the holding element 808. The flux ring 819 is preferably made of a magnetic flux-transmitting material such as steel, and can be attached to the end of the frame 808 in any conventional manner, including without limitation by conventional fasteners, welding, adhesive, cohesive, brazing, and the like. However, the flux ring 819 is most preferably press fit into a recess in the end of the frame 810 as shown in FIG. 47.

The time needed to hold the holding element 808 and controlled element 816 as just described is primarily limited only by the time necessary to energize the first coil 802, to create the magnetic field thereby, and to attract the holding element 808. This time is significantly less than the time needed to change the position of a conventional solenoid armature. Similar holding element restraint can be accomplished where the magnetic force from the first coil 802 repels the holding element 808 as described above. In this case, the repelling force also holds the holding element 808 against the nearest adjacent object (against which the holding element is preferably already in contact). This can be a wall of the track or other motion controlling and guiding element used, a braking element mounted beside the holding element 808 or even beside the controlled element 816, a wall of the device within which the actuator 800 is mounted, etc.

By energizing the first coil 802, the magnetic field created also generates motive force upon the armature 806 to move the armature 806 toward the holding element 808. Under magnetic force from the first coil 802, the armature 806 preferably engages with the holding element 808 while the holding element 808 is held in place by the magnetic force as described above. Preferably, the end of the armature 806 is suitably shaped and sized to fit within the receptacle or cavity 814 in the holding element 808. Upon entry of the armature 806 into the holding element 808, the armature 806 is engaged with the holding element 808 (and therefore with the controlled element 816) and therefore limits movement of the controlled element 816. At this time or any time thereafter, the first coil 802 is preferably de-energized. Although the holding element 808 is thereby released from being held by the first coil 802, the armature 806 is engaged with the holding element 808 and therefore prevents movement thereof (and of the controlled element 816). To retract the armature 806 from engagement with the holding element 808 and to thereby disengage the controlled element 816, the second coil 804 can be energized to exert a reverse magnetic force upon the armature 806. Because the holding element 808 is no longer held by magnetic force from the first coil 802, removal of the armature 806 disengages the actuator 800 from the controlled element 816.

Engagement of the armature 806 into the holding element 808 is preferably accomplished by insertion of the end of the armature into the cavity 814 in the holding element 808. Such engagement therefore restricts lateral movement of the holding element 808 and attached controlled element 816 with respect to the armature 806 and coils 802, 804. While this type of engagement and movement restriction is preferred in many applications, such as in the latch assembly embodiments of the present invention described above, it may not be preferred or useful in others. As such, alternative embodiments of the present invention can employ other manners of engagement for the armature 806 and the holding element 808. For example, the armature 806 can be inserted sufficiently far in the holding element 808 to prevent holding element rotation about any axis other than the axis of the armature 806. This type of engagement can be useful for engaging elements that pivot (about any axis but the axis of the armature 806) when free to move. As another example, the armature end can be forked to mate with matching apertures in the holding element 808 or can be splined to mate with a matching splined aperture in the holding element 808. These types of engagement can be useful for engaging elements that, when free to move, pivot about any axis, including an axis substantially aligned with the axis of the armature 806. As yet another example, the armature 806 can be provided with a magnet or electromagnet that can be attached to a surface of the holding element 808 for preventing axial movement of the holding element 808 away from the armature 806 and/or for preventing other holding element movement. If the magnet on the armature 806 is not controllable, the magnet preferably has a holding force that is weaker than the disengagement pulling force upon the armature 806 to permit proper disengagement of the armature 806 from the holding element 808. One having ordinary skill in the art will appreciate that still other types of armature engagement with the holding element 808 are possible and may or may not call for a pin and receptacle arrangement such as that of the preferred embodiment described above. In essence, virtually any holding element movement (not necessarily radial as in the preferred embodiment shown in FIG. 47) can be limited or restrained by the two-stage actuator engagement: magnetically restraining a holding element moving in any manner long enough for actuation and engagement of the armature to take place.

Although the armature 806 is preferably engagable with the holding element 808, this need not necessarily be the case. Because the holding element 808 functions at least to permit restraint of the controlled element 816 attached thereto, the armature 806 can engage directly with the controlled element 816 in any manner, if desired. For example, the holding element 808 shown in FIG. 47 can have an aperture passing fully therethrough. The armature 806 can therefore be extended through the holding element 808 and into a cavity, aperture, groove, recess, or other mating feature in the controlled element 816. Any manner of engagement such as those described above can be employed between the armature 806 and the controlled element 816 without any contact or with insubstantial contact of the armature 806 and the holding element 808. Therefore, engagement of the armature 806 with the controlled element 816 can be indirect (i.e., engagement of the holding element 808 which is connected to the controlled element 816) or direct.

Also, the connection between the holding element 808 and the controlled element 816 need not necessarily restrict the controlled element 816 to the same motion as the holding element 808. In other words, the amount and type of mobility of the controlled element 816 when the holding element 808 is restrained by the first coil 802 need not necessarily be the same as the holding element 808. This is the case where a clearance fit exists between the controlled element 816 and the holding element 808 (the holding element 808 is not free to move in any direction, but the controlled element 816 can be at least minimally axially movable). As another example, the controlled element 816 can still be radially movable with respect to the holding element 808 depending upon how loose the connection is between the pin 812 and the aperture 817 of the controlled element 816. As yet another example, the controlled element 816 can be rotatable about the holding element 808 if desired. One having ordinary skill in the art will appreciate that still other types of control element freedom with respect to the holding element 808 are possible.

The actuator 800 therefore employs a two-stage engagement process to result in significantly reduced engagement times. Specifically, by using a fast-acting and preferably temporary magnetic force to quickly hold a controlled element 816 in place until the slower-acting armature 806 is moved into engagement therewith (via direct or indirect engagement with the holding element 808), the time needed to engage an element is greatly reduced.

Although not required to practice the present invention, a number of features can be used to improve operation of the actuator 800. First, the armature 806 is preferably biased in extended and retracted states by an over-center spring 820 connected to the armature 806. This spring 820 is preferably a resilient and deformable plate or strip made of spring material and captured within a spring receptacle 822. The spring receptacle 822 is preferably located within the environment of the actuator 800 as shown in FIG. 47, but can instead be located on or in the actuator frame 813. The spring receptacle 822 is preferably a cavity within which the spring 820 is retained and in which the spring 820 can move between two positions in an manner well known to those skilled in the art. The spring receptacle 822 can be defined by any framework, structure, or elements capable of holding the spring 820 in a bowed position as shown in FIG. 47. Motion can be transferred from the spring 820 to the armature 806 via any suitable connection thereto, such as by being trapped between pairs of pin sets extending from the armature 806, by being attached in any conventional manner to the armature, and the like. The over-center spring 820 preferably biases the armature 806 out of engagement with the holding element 808 when the armature 806 is not engaged therewith and into engagement with the holding element 808 once the armature 806 has moved a sufficient distance toward the holding element 808.

It will be appreciated by one having ordinary skill in the art that the plate or strip-type over-center spring described above and illustrated in the figures is only one type of over-center biasing device that can be employed to bias the armature 806 into its engaged and disengaged states. For example, the armature can be provided with one or more ribs, knobs, pins, or other protrusions engaging with one or more springs or resiliently deformable elements in the aperture through which the armature 806 moves. The springs or resiliently deformable elements can be shaped to have recesses, dips, or seats therein within which the protrusions on the armature are received for holding the armature in extended and retracted positions. Numerous other over-center devices can be used to bias the armature 806 into its two at-rest positions, each of which falls within the spirit and scope of the present invention.

Especially where the armature 806 extends a distance behind the second coil 804 when in its retracted position (to the left in FIG. 47), such as to connect an over-center spring as just described, preferably only part of the armature 806 is made of magnetically responsive material. One having ordinary skill in the art will recognize that this provides a gap for flux from the second coil 804 to properly act upon the magnetic portion of the armature 806 when in its extended position. Therefore, the rear portion 821 of the armature 806 shown in FIG. 47 is preferably made of plastic or other non-magnetic material. For helping to ensure fall armature engagement, he tip of the armature is preferably also made of plastic.

Another preferred feature of the actuator 800 concerns the retention of the holding element 808 by magnetic force when the first coil 802 is energized. As described above, the magnetic force can exert an attracting or repelling force upon the holding element 808 to hold the holding element. 808 in place within the track 818 (or against an element of the actuator 800 or surrounding environment). To supplement the resistance to holding element movement provided by the magnetic force, the track 818 is preferably shaped to have a recess or seat at the holding element location substantially aligned with the armature 806 and coils 802, 804. Because the track or other motion controlling and guiding element used can be a part of the actuator itself as described above, the recess or seat can be defined in the actuator 800 or in the environment of the actuator 800. For purposes of illustration, an example of such a recess or seat is shown in the latch assembly 610 of the present invention. With reference to FIG. 38, a recess 824 preferably exists in the track 818 at a location substantially aligned with the rest of the actuator 688. When the first coil 802 is energized as described above, the holding element 808 is seated within the recess 824. By being seated in this manner, forces urging the holding element 808 away from the aligned position must move the holding element 808 axially out of the recess 824 as well as radially away from the aligned position. The holding element 808 is therefore more able to resist shifting and movement in the track 818 when magnetically held by the first coil 802.

A number of other elements and devices can be used as an alternative to a recess 824 to help resist holding element movement when held by the first coil 802. For example, the track 818 can have one or more raised portions defining a'seat in the track, bumps, pins, or springs on the edges or face of the track defining the edges of the aligned position, and the like. The track 818 can even have a portion that is magnetic or have a magnet attached thereto or embedded therein to bias the holding element 808 into aligned position with respect to the armature 806 and coils 802, 804. Each of the elements help to restrain holding element movement while the holding element 808 is restrained by the coil 802. However, each element or device preferably exerts a bias force that is sufficient to help resist holding element movement away from the position aligned with the armature 806 and coils 802, 804, but that is insufficient to significantly impede or restrain free holding element movement in the track 818 when not engaged by the actuator 800. It should also be noted that the recess, seat, or other biasing device need not necessarily be located in the track 818 or other motion controlling and guiding element used. Instead, any of these biasing elements can be defined in or located on the actuator frame 810, a wall or walls of the surrounding environment, or any other structure adjacent to the holding element 808 in its position aligned with the armature 806 and coils 802, 804.

Regardless of whether a seat or recess 824 is employed in a particular embodiment of the present invention, it is most desirable to spring-load the holding element 808 toward the first coil at all times (or away from the first coil 802 when magnetic repelling force is used to magnetically engage the holding element 808). This helps to close or narrow any air gap between the holding element 808 and whatever element the holding element is pressed against when the first coil 802 is energized. One having ordinary skill in the art will recognize that narrower air gaps (or no air gaps) preserves magnetic flux and is highly desirable. Any of the elements and devices described above for biasing the holding element 808 into a seat or recess 824 can be used to generate the force to urge the holding element against the flux ring 819, frame 810, coil 802, adjacent wall, etc. Most preferably however, one or more leaf springs (not shown) are embedded in the walls of the track 818 to bias the holding element 808 as just described.

Yet another preferred feature of the actuator 800 is related to the desirability of complete armature engagement with the holding element 808. Specifically, if the holding element 808 is not substantially aligned with the armature 806, the armature 806 may not engage with the holding element 808 as described above. In this case, when the first coil 802 is de-energized after moving the armature 806, the armature 806 can retract back to its original position (especially where a bias element such as the over-center spring 820 is used). To avoid this All condition, the armature 806 preferably has a compressible portion to permit the armature to move at least partially into its extended position. Two examples of an armature compression device are illustrated in FIG. 47 for purposes of description, although preferably only one such device would normally be used.

Highly preferred embodiments of the present invention can employ a rear armature portion 821 that is spring loaded Specifically, the rear portion 821 of the armature can be split into two sections that are connected for axial movement with respect to each other, such as by fitting a coined end of one section into the other section, via a collar 825 that is secured in any conventional fashion to one section and slidably receives the other section, and the like. Between the relatively movable section is preferably located a spring 823 or other resiliently compressible element that can be compressed via relative movement of the rear armature sections. The spring can be of any type, but most preferably is a helical compression spring, and can be attached to either, both, or neither rear armature section as desired. In operation, the armature 806 can be moved at least partially into its extended position by compression of the spring 823. Preferably, the additional armature motion permitted by this spring 823 is sufficient to move the armature 806 past the point where the over-center bias element ceases to urge the armature 806 back into its retracted position. When the holding element 808 thereafter is brought into alignment with the armature 806, the armature inserts itself into engagement with the holding element 808.

Other embodiments of the present invention can employ a compressible armature tip 826 as also shown in FIG. 47. This tip permits the armature 806 to move at least partially into its extended position. Preferably, the additional armature motion permitted by the compressible tip 826 is sufficient to move the armature 806 past the point where an over-center bias element ceases to urge the armature 806 back into its retracted position. When the holding element 808 thereafter is brought into alignment with the armature 806, the armature 806 inserts itself into engagement with the holding element 808.

The tip 826 of the armature 806 can be made compressible in any number of different manners. In a highly preferred embodiment, the tip 826 is an element received within a cavity 828 in the end of the armature 806. Preferably, the tip 826 can be pressed into the cavity against the force of a spring 830 (of a type such as described above with regard to spring 823) within the cavity 828 behind the tip 826. Also preferably, a lip 832 on the end of the armature 806 retains the tip 826 within the cavity 828. A number of other conventional compressible devices can be employed if desired, including without limitation a spring-loaded telescoping armature tip, a tip mounted upon resilient elastomeric material at the end of the armature 806 or made at least partially from resilient elastomeric material, a spring-loaded ball bearing retained in a socket in the end of the armature 806, and the like. Numerous alternative compressible devices are well known to those skilled in the art and fall within the spirit and scope of the present invention.

For purposes of illustration, operation of a preferred embodiment of the actuator 800 will now be described with reference to its application in the fourth preferred latch assembly embodiment 610. It should first be noted, however, that the latch assembly 610 described above need not employ this type of actuator. In this case, the lower actuator 688 is preferably a two-stage actuator 800 as described above (although either or both actuators 668, 688 could be such an actuator in alternative embodiments). Specifically, the lower control element 653 is the element to be controlled 816, the lower pin 686 is the pin 812 of the actuator 800, and the lower pin plate 706 is the body of the holding element 808. The track 818, within which the lower pin plate 706 is movable, is shown as a groove in the interior wall of the front cover 612, and has a width sized to slidably receive the edges of the lower pin plate 706. As such, the lower pin plate 706 is movable through the track 818 in the front cover 612. The pin 812 of the holding element 808 extends through the lower aperture 702 in the cover plate 682 and is connected in any manner described above to the lower control element 653. The lower aperture 702 in the cover plate 682 is preferably shaped (e.g., elongated) to permit movement of the holding element 808 with the lower control element 653. The coils 802, 804, over-center spring 820, and spring receptacle 822 are not visible in FIGS. 35–46.

When the lower actuator 688 is not in its engaged state (i.e., de-energized), the holding element 808 follows the movement of the lower control element 653 in its disengaged state described above. When the lower actuator 688 is engaged, the holding element 808 is magnetically restrained in a position substantially aligned with the lower actuator 688 (see FIG. 38). Where a recess 824 in the track 818 is used, the holding element 808 preferably is seated within this recess 824. While the holding element 808 is restrained by the magnetic force, the armature 806 of the lower actuator 688 is extended to engage with the holding element 808. Thereafter, the coil 802 in the lower actuator 688 is preferably de-energized. The lower control element 653 is therefore engaged by the holding element 808 and armature 806 and provides the pivot point C about which the lower control element 653 can pivot when actuated. To disengage the lower control element 653, the second coil 804 is preferably energized, thereby pulling the armature 806 from engagement with the holding element 808. In this disengaged state, the holding element 808 is once again permitted to move in its track 818 with movement of the lower control element 653.

A fifth preferred embodiment of the present invention is illustrated in FIGS. 48–58. The latch assembly 910 illustrated in FIGS. 48–58 is shown without a front cover, cover plate, actuators, or rear mounting plate for purposes of easier assembly description. These elements, their manner of attachment, and their relationship with the other elements in the latch assembly 910 preferably take any of the forms described above with reference to the first through fourth embodiments of the present invention.

Like the latch assemblies described above, the latch assembly 910 preferably has two control elements 912, 914 corresponding to respective elements or devices for actuation by a user. Although alternative embodiments of the present invention can employ only one control element 912, 914 to perform some of the functions of the fifth preferred embodiment described below, full latch functionality is possible by employing two control elements. Also, three or more control elements having respective inputs for actuation and having respective engagement elements for switching between control element states are also possible. Therefore, it should be noted that the latch assembly according to the fifth preferred embodiment of the present invention is described and illustrated herein as having two control elements by way of example only.

The latch assembly 910 further includes a ratchet 916 the same or similar to those described in the earlier embodiments of the present invention. Specifically, the ratchet 916 is preferably mounted for rotation between a latched position in which a striker (not shown) is captured by the latch assembly 910 and an unlatched position in which the striker is free to enter and exit the latch assembly 910. Preferably, the ratchet 916 is mounted for rotation about a pivot post 918 attached to or integral with the housing 920 in any manner described above with reference to ratchet pivot posts. Alternatively, the pivot post 918 can be attached to or integral with a rear mounting plate (not shown) of the latch assembly 910 or to the ratchet itself for rotation in one or more apertures or lugs in the housing 920 and/or rear mounting plate.

The ratchet 916 is preferably biased to move into its unlatched position in any of the manners described above, and most preferably is biased thereto by interaction of a ratchet pin 922 on the ratchet 922 and a ratchet spring 924. Specifically, the ratchet pin 922 is preferably received within a groove or other aperture 925 in the housing 920, and can move therein against the force of the spring 924 biasing the pin 922 and ratchet 916 to the unlatched ratchet position. As mentioned above, numerous other conventional elements and devices can be used to bias the ratchet 916 to its unlatched position, such as a torsion spring mounted upon the pivot post 918 and biasing the ratchet 916 to its unlatched position, one or more leaf springs biased against one or more surfaces of the ratchet 916 to rotate the ratchet 916 to its unlatched position, or even opposing magnets on the ratchet 916 and on the housing 920, respectively, repelling one another and thereby causing rotation of the ratchet 916. Such alternative biasing elements fall within the spirit and scope of the present invention.

Figure 49:
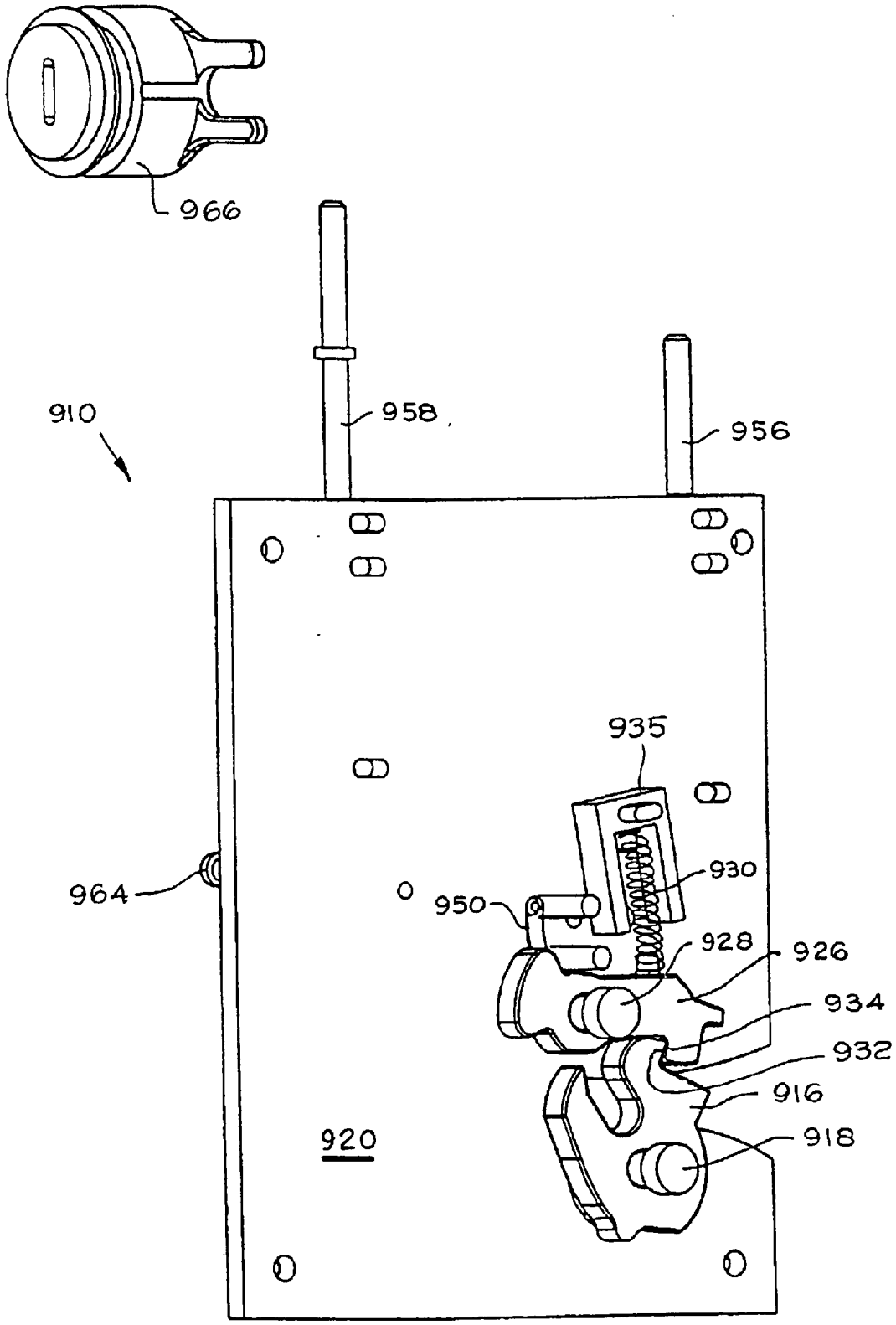
FIG. 49 is a rear perspective view of the latch mechanism shown in FIG. 48.
Figure 50:
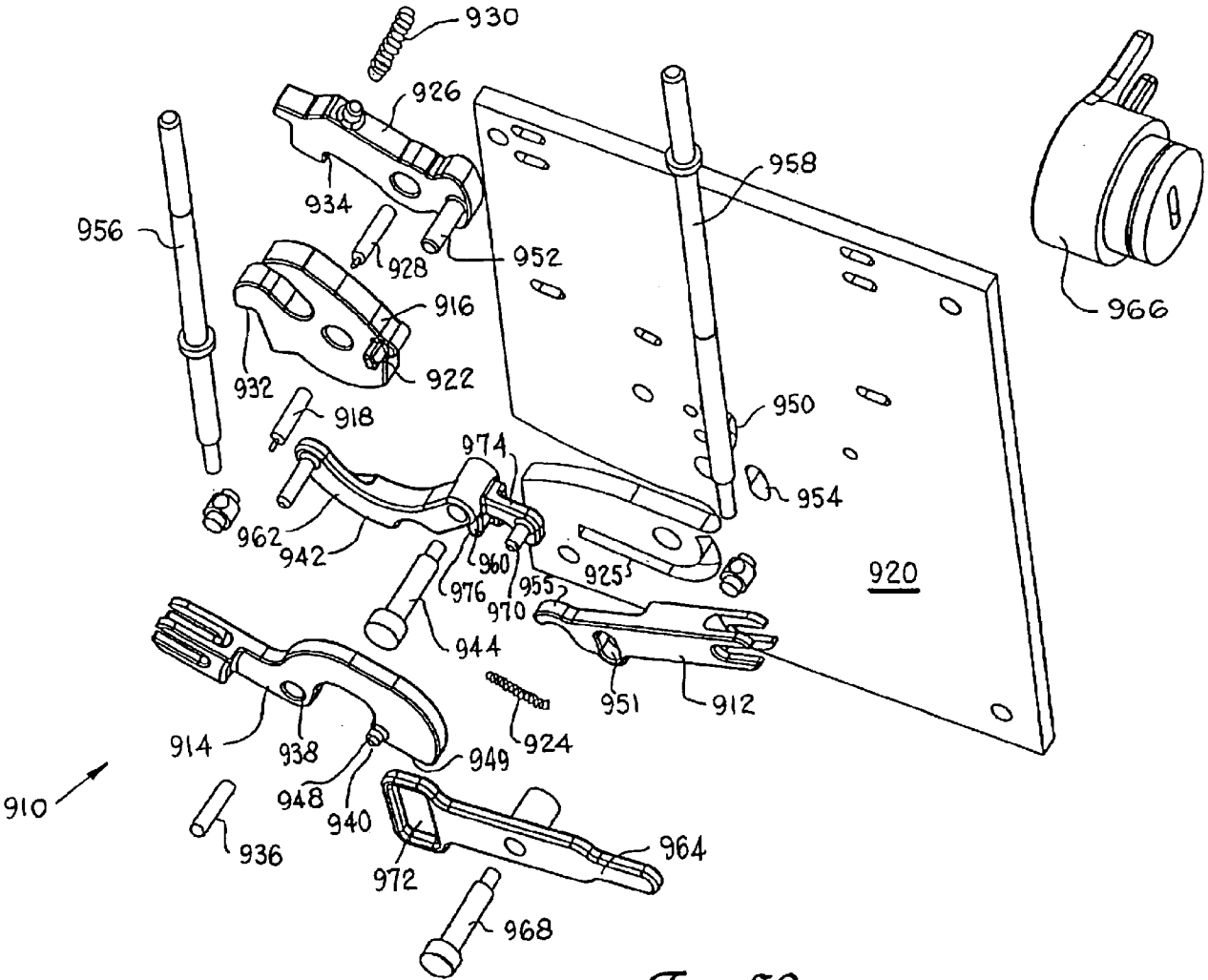
FIG. 50 is an exploded view of the latch mechanism shown in FIGS. 47 and 48, viewed from the front.
Figure 51:
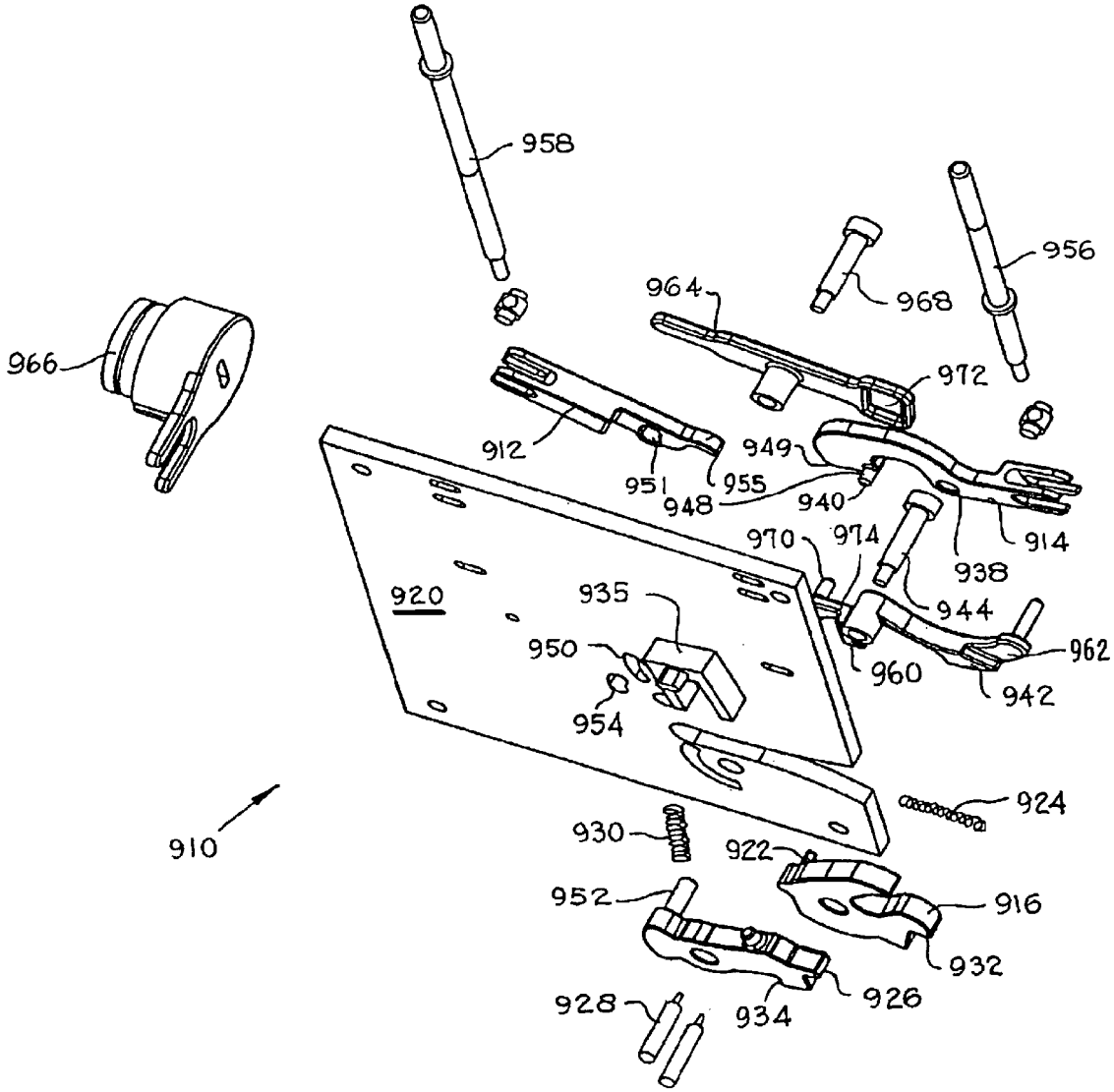
FIG. 51 is an exploded view of the latch mechanism shown in FIGS. 48–50, viewed from the rear.
Figure 52:
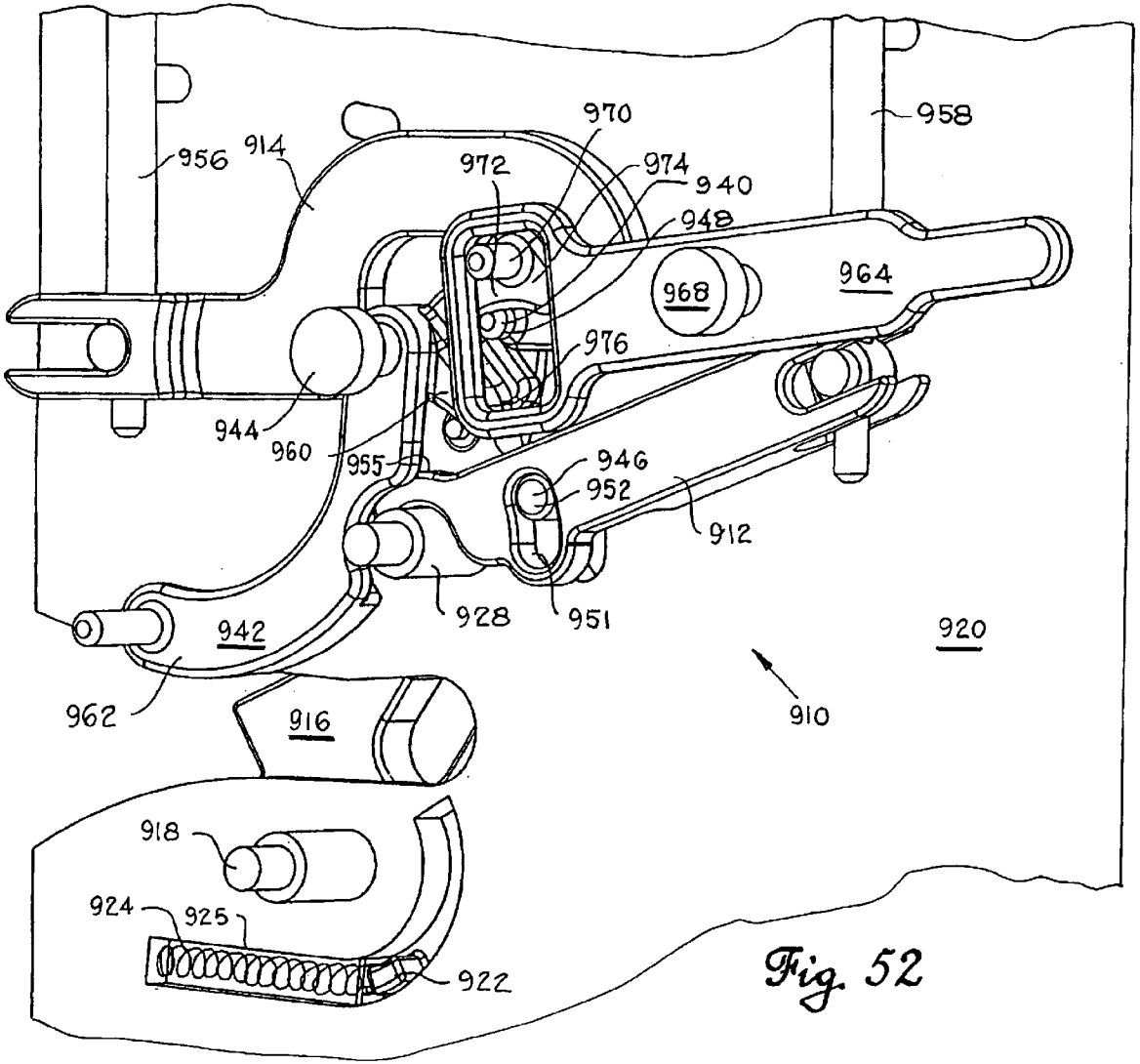
FIG. 52 is a front perspective detail view of the latch mechanism shown in FIGS. 48–51, shown with the upper engagement element removed.

As with the other embodiments of the present invention described above, the latch assembly 910 preferably has a pawl 926 releasably engagable with the ratchet 916. The pawl 926 (see FIGS. 49 and 51) is shown having a different shape from the pawls illustrated in the above embodiments, but operates in substantially the same manner as the other pawls described. Preferably, the pawl 926 is mounted for rotation about a pivot post 928 in substantially the same manner as the ratchet 916 about its pivot post 918. The pawl 926 is also preferably biased into engagement with the ratchet 916 by a pawl spring 930 as is best shown in FIG. 49. Therefore, operating on similar principles to those described above with reference to the earlier embodiments of the present invention, the pawl 926 preferably holds the ratchet 916 in its latched position when moved into engagement therewith. For this purpose, the ratchet 916 preferably has a stop surface 932 against which a lobe, tooth, hook, or other surface 934 (preferably acting as a bearing surface) of the pawl 926 contacts and engages when the ratchet 916 is rotated to its latched position shown in FIGS. 48–56. When the pawl 926 is rotated to disengage the pawl surface 934 from the stop surface 932 of the ratchet 916, the ratchet 916 is preferably free to rotate to its unlatched position as described above. Alternatively, when a striker (not shown) enters the latch assembly 910 as described above, the striker preferably rotates the ratchet 916 toward its latched position in which the pawl 926 (under spring force from the pawl spring 930) engages the ratchet 916 to hold the ratchet 916 in its latched position. The pawl spring 930 is preferably a helical compression spring attached to or mounted upon the pawl 926 and received in a seat 935 integral with or attached to the housing 920 and/or to the rear mounting plate (not shown). Other spring types can be used to bias the pawl 926 against the ratchet 916, such as those described above with reference to the ratchet spring 924. Such alternative spring types and their manner of attachment to the pawl 926 and surrounding latch structure are well known to those skilled in the art.

As with the earlier-described embodiments of the present invention, the ratchet 916 and pawl 926 can be movable in other manners to capture and release the striker and to engage and disengage the ratchet 916. For example, either or both the ratchet 916 and pawl 926 can be movable via shifting, sliding, or other translation in which the ratchet 916 does not rotate or substantially rotate. As another example, the either or both the ratchet 916 and pawl 926 can move through a combination of translation and rotation in their above-described functions. Alternative ratchet and pawl devices operating in different manners to perform these functions exist, are well known to those skilled in the art, and can be employed in the present invention if desired.

Both of the control elements 912, 914 preferably have a locked state and an unlocked state. In the locked state, control element actuation does not impart movement or imparts insufficient movement to move the pawl 926 and to thereby release the ratchet 916. In the unlocked state, control element actuation imparts sufficient movement to the pawl 926 to release the ratchet 916. Most preferably, this control element actuation brings some part of the actuated control element (or an element connected thereto) into pressing contact with a surface of the pawl 926 whereby further actuation of the control element 912, 914 causes the control element 912, 914 to move the pawl 926. Although as few as one control element 912, 914 can have locked and unlocked states, preferably each control element 912, 914 in the latch assembly 910 has both states. Control elements 912, 914 not having both states are preferably always in an unlocked state, whereby actuation of such control elements 912, 914 generates pawl movement and ratchet release.

Like the earlier embodiments of the present invention described above, the locked and unlocked states of the control elements 912, 914 are at least partially defined by one or more engagement elements that can be moved, energized, or otherwise brought into engagement with the control elements 912, 914 to change their manner of movement when actuated. As described in more detail below, the engagement elements can take a number of different forms, two of which are employed in the latch assembly 910. Specifically, the upper control element 914 is preferably releasably engagable by a pin 936 movable into and out of an aperture 938 in the upper control element 914, while the lower control element 912 is releasably engagable by a locking element 942 movable into and out of contact with a surface of the lower control element 912. The pin 936 and aperture 938 relationship of the upper control element 914 is preferably substantially the same as the pin and aperture relationship of the first preferred embodiment described above, and operates in substantially the same manner. The pin 936 is preferably axially movable by an actuator (not shown). Most preferably, the actuator is an electromagnetic solenoid, but can be any of the types of actuators described above. When the actuator is actuated to extend the pin 936 into the aperture 938 of the upper control element 914, actuation of the upper control element 914 causes the upper control element 914 to rotate about the pin 936. When actuator retracts the pin 936 from the aperture 938 of the upper control element 914, the upper control element 914 instead rotates about a pivot point 940 as described in more detail below.

The engagement element for the lower control element 912 is preferably a lever: locking element 942. The locking element 942 is preferably rotatable about a pivot 944 into and out of contact with the lower control element 912. The pivot 944 is preferably received within an aperture in the locking element 942 and is integral to the housing 920 or is attached thereto in any conventional manner, including without limitation by welding, gluing, one or more conventional fasteners, a threaded connection, press-fitting, and the like. Alternatively, the pivot 944 can extend from the cover plate or front housing (not shown) of the latch assembly 920, or can be integral to or connected for rotation with the locking element 942 itself and rotate within an aperture in the housing 920. In short, any manner in which the locking element 942 can be mounted for rotation about a pivot 944 can be employed in the present invention.

When the locking element 942 is pivoted away from interference with lower control element movement, actuation of the lower control element 912 preferably causes the lower control element 912 to rotate about a pivot point 946 as described in more detail below. However, when the locking element 942 is pivoted into engagement with the lower control element 912, actuation of the lower control element 912 preferably causes the lower control element 912 to rotate about the pawl pivot post 928 extended through the housing 920 (or about another pivot post preferably at or near this same location). Specifically, the locking element 942 in contact with the lower control element 912 preferably defines a new fulcrum location for the lower control element 912.

Although the pin 936 and locking element 942 are different types of engagement elements, they both perform the same function of changing control element mobility between the respective engaged and disengaged states. The actuated control elements 912, 914 move in one manner when engaged with their respective engagement elements and in a different manner when disengaged from their respective engagement elements. More preferably, the actuated control elements 912, 914 pivot about one point when engaged with their respective engagement elements and about a different point when disengaged from their respective engagement elements.

As is evident from the earlier-described embodiments of the present invention, engaged control element movement can trigger movement of the pawl 926 to release the ratchet 916 in a number of different manners. Preferably, movement of the pawl 926 is triggered by direct contact of an engaged and actuated control element against the pawl 926. However, actuation of the engaged and actuated control element can trigger movement of the pawl 926 through one or more other elements, if desired. In some alternative embodiments of the present invention, the pawl 926 need not be contacted at all for the control elements 912, 914 to move the pawl (e.g., by using magnetic force between a magnet on the pawl 926 and a magnet on the control element 912, 914 to attract or repel the pawl 926 and thereby to move the pawl 926 as described below).

Figure 53:
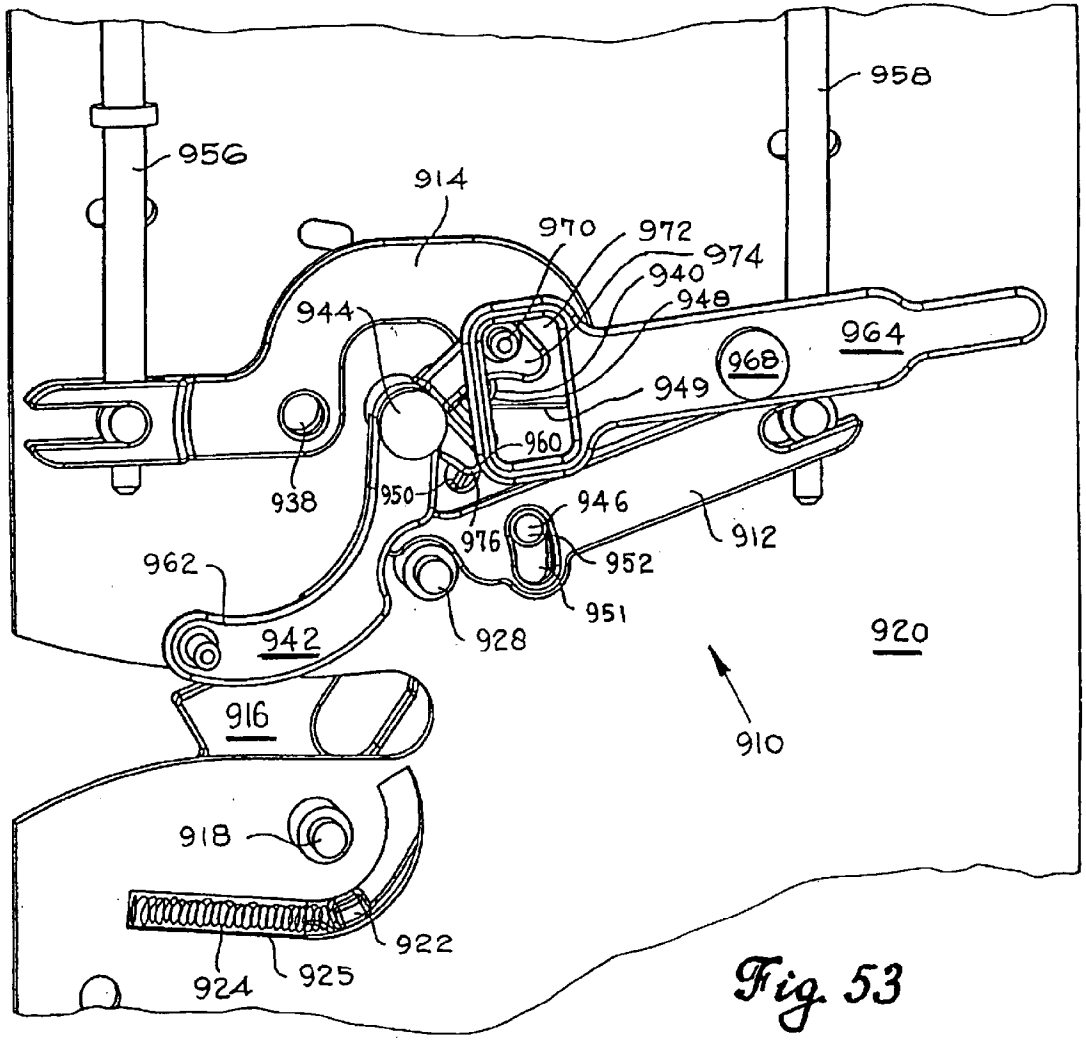
FIG. 53 is a front elevational view of the latch mechanism shown in FIGS. 48–52, with the latch mechanism fully locked and with both the upper and lower control elements in their unactuated positions.
Figure 54:
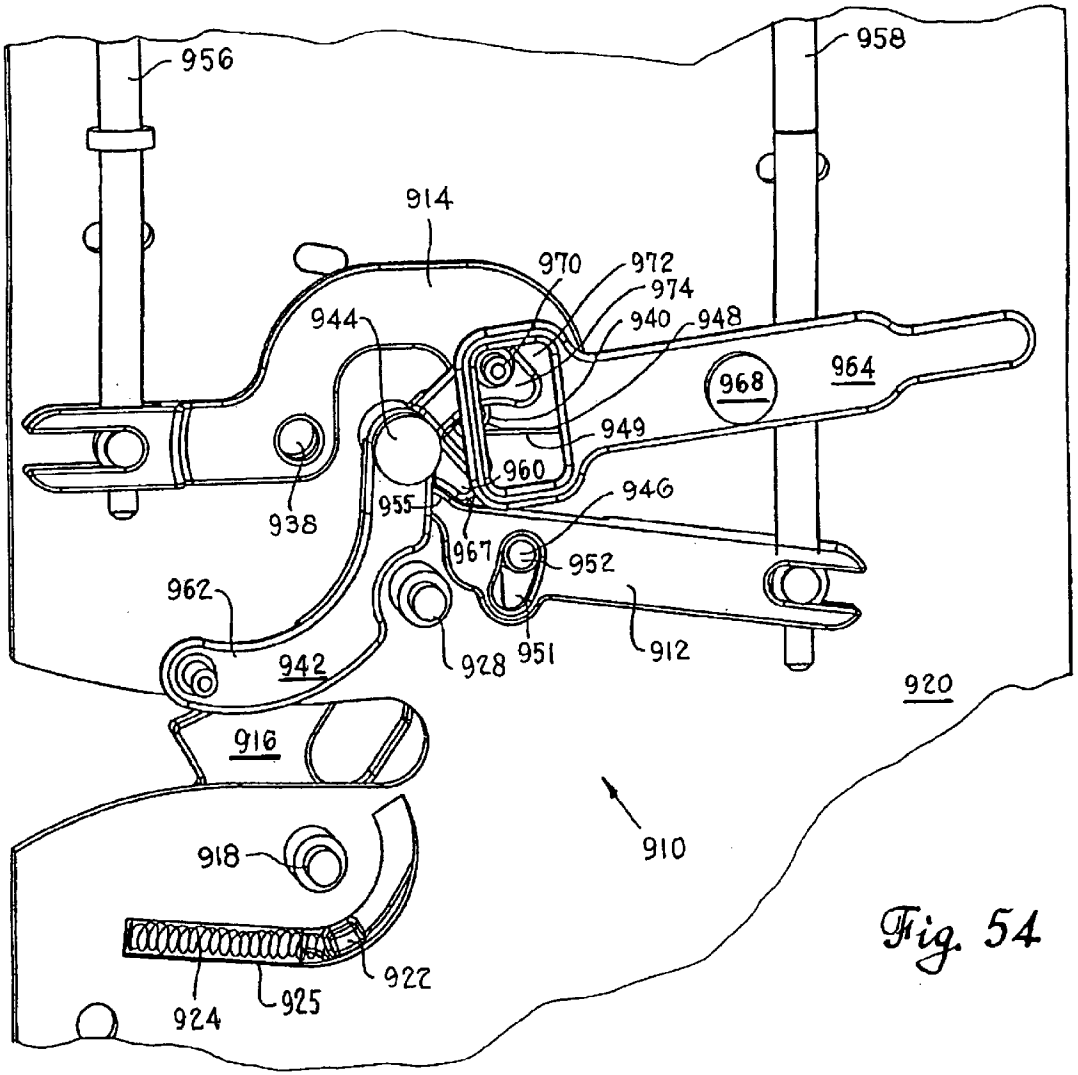
FIG. 54 is a front elevational view of the latch mechanism shown in FIGS. 48–53, with the latch mechanism fully locked and with the lower control element fully actuated.
Figure 55:
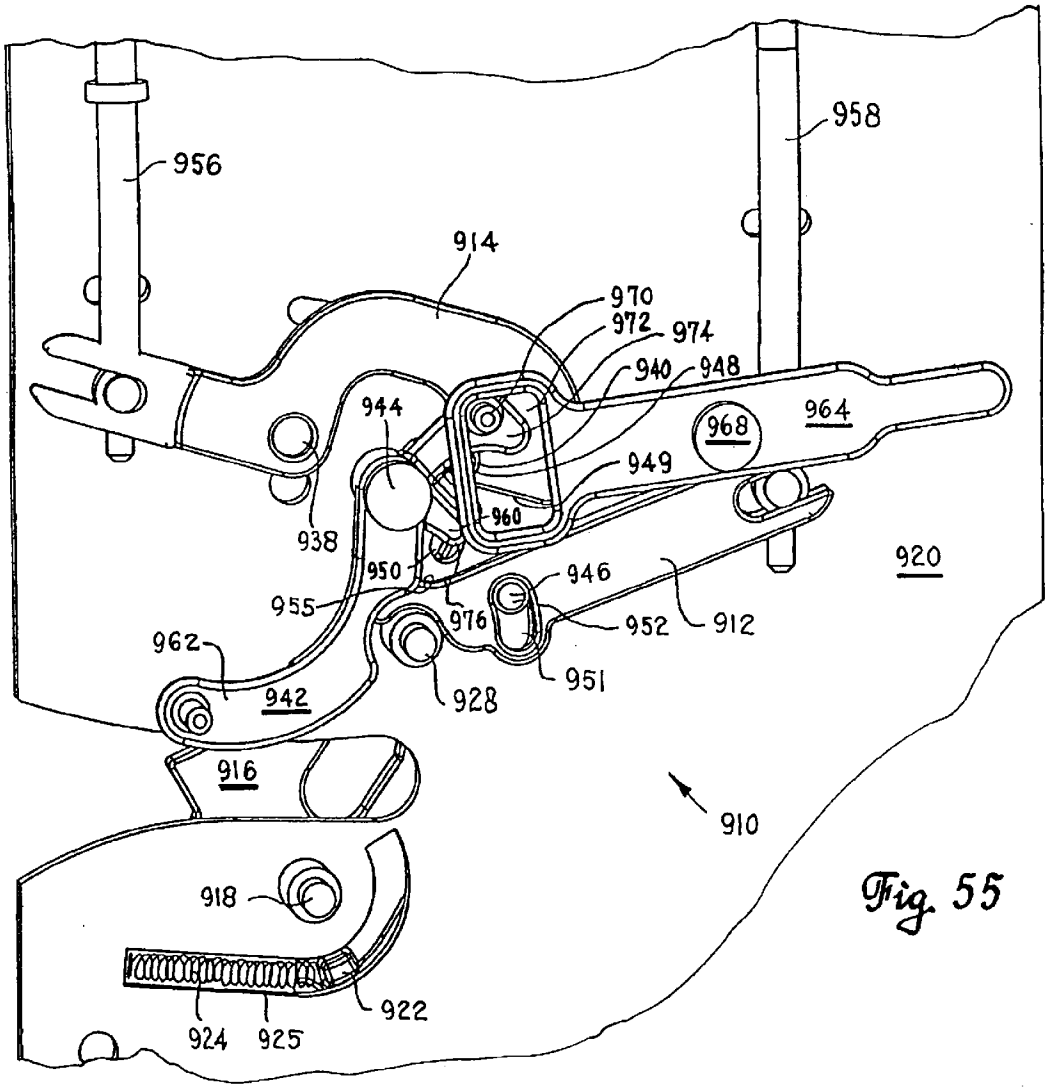
FIG. 55 is a front elevational view of the latch mechanism shown in FIGS. 48–54, with the latch mechanism fully locked and with the upper control element fully actuated.
Figure 56:
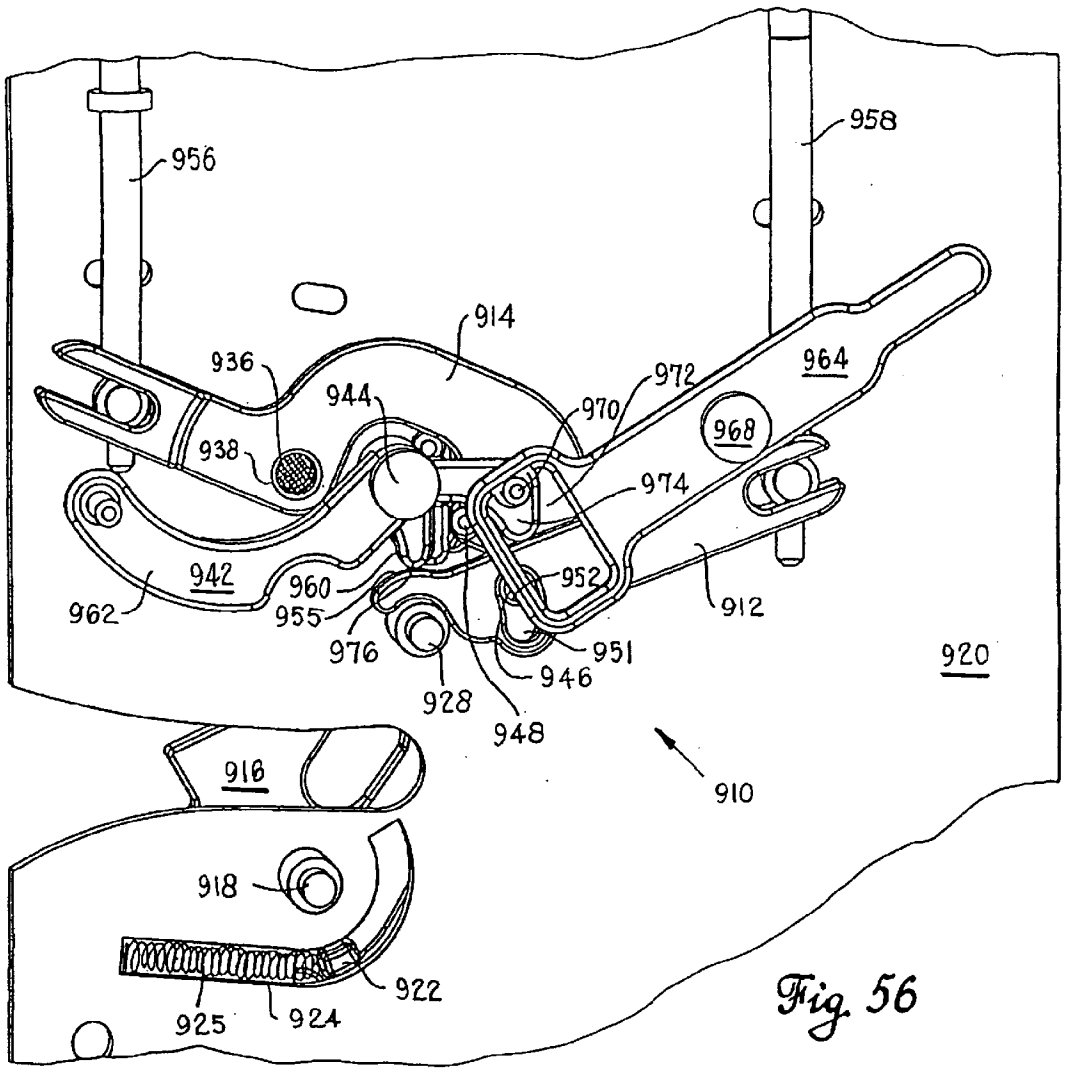
FIG. 56 is a front elevational view of the latch mechanism shown in FIGS. 48–55, with the latch mechanism fully unlocked and with the upper control element partially actuated.
Figure 57:
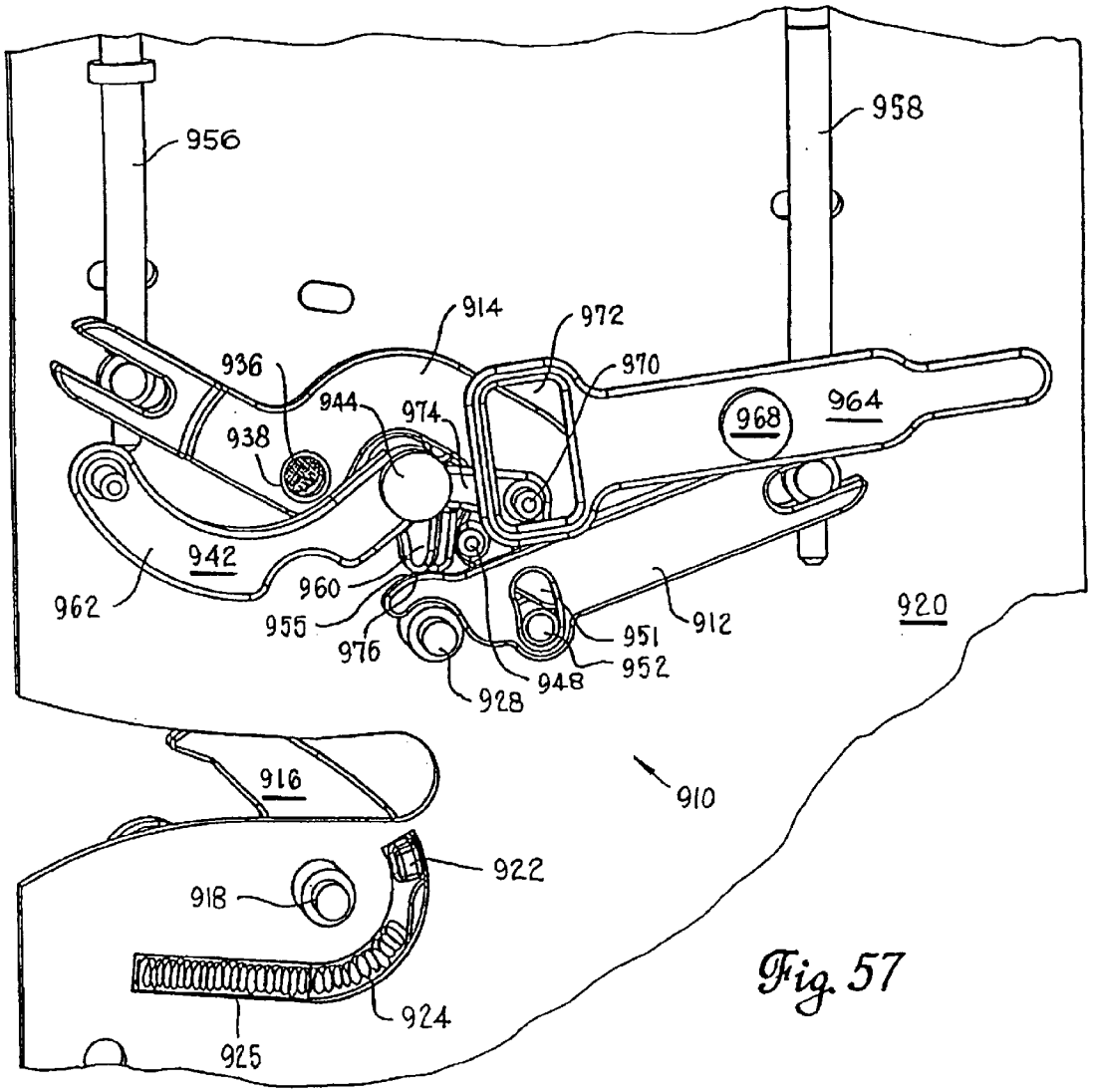
FIG. 57 is a front elevational view of the latch mechanism shown in FIGS. 48–56, with the latch mechanism fully unlocked and triggered to its unlatched state by the upper control element.

The fifth preferred embodiment of the present invention illustrated in FIGS. 48–58 illustrates two different ways in which motion can be transferred from engaged control elements 912, 914 to the pawl 926 to move the pawl 926 and release the ratchet 916. The upper control element 914 preferably has a pin 948 integral, attached thereto in any conventional manner, or otherwise extending therefrom and movable with movement of the upper control element 914 into contact with the pawl 926. As shown in FIG. 49, the pin 948 is movable through an aperture 950 into and out of contact with a surface of the pawl 926. With reference also to FIGS. 53 and 55, when the pin 936 is removed from the upper control element 914 to place the upper control element 914 in its locked state, actuation of the upper control element 914 causes the upper control element 914 to rotate about the pin 948 at the top of the aperture 950. This rotation preferably generates no transmission of motion to the pawl 926, or at least insufficient motion to all trigger release of the ratchet 916. With reference to FIGS. 53 and 57, when the pin 936 is engaged in the aperture 938 in the upper control element 914 to place the upper control element 914 in its unlocked state, actuation of the upper control element 914 causes the upper control element 914 to rotate about the pin 936. This rotation causes the pin 948 of the upper control element 914 to move with the upper control element 914, eventually contacting and pressing against the pawl 926 to pivot the pawl 926 about its pivot post 928 and to release the ratchet 916.

Figure 58:
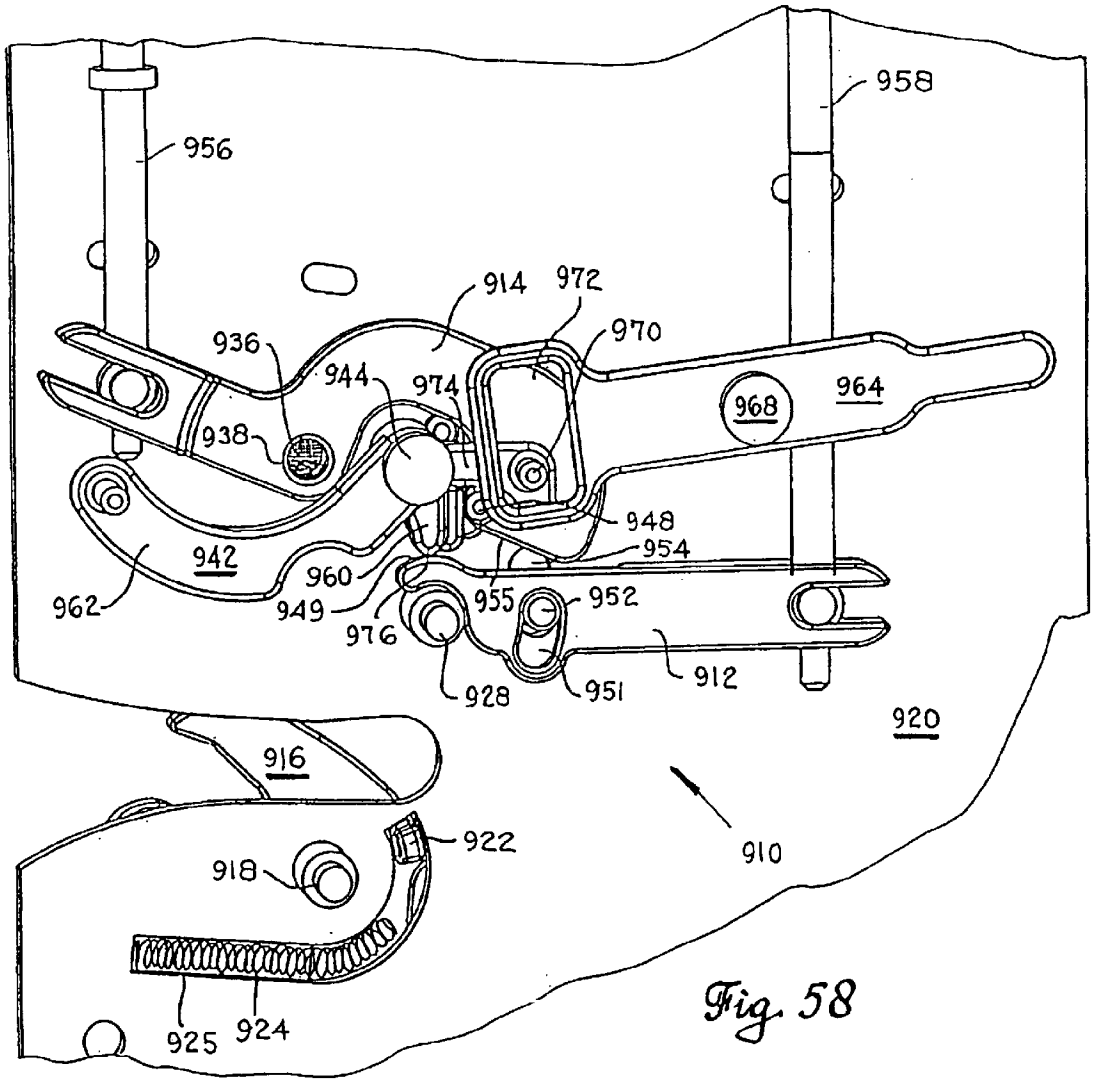
FIG. 58 is a front elevational view of the latch mechanism shown in FIGS. 48–57, with the latch mechanism fully unlocked and triggered to its unlatched state by the lower control element.

The lower control element 912 preferably has an aperture 951 therein within which is received a pin 952 attached in any conventional manner to, integral with, or otherwise extending from the pawl 926. The pin 952 of the pawl 926 preferably extends through an aperture 954 in the housing 920, and is movable in the aperture 954 as described below. With reference to FIGS. 53 and 54, when the locking element 942 is moved away from interference with lower control element motion, actuation of the lower control element 912 preferably causes the lower control element 912 to pivot about the pawl pin 952 at the top of the housing aperture 954. This rotation generates no transmission of motion to the pawl 926, or at least does not move the pawl 926 sufficiently to release the ratchet 916. With reference to FIGS. 53 and 58, when the locking element 942 is moved into engagement with the lower control element 912, actuation of the lower control element 912 causes the lower control element 912 to pivot about pivot post 928 (or preferably about a point near the pivot post 928). This rotation causes the pawl pin 952 to be moved out of its position, thereby moving the pawl 926 and releasing the ratchet 916.

Both control elements 912, 914 of the illustrated preferred embodiment are elongated in shape and function as levers to pivot about different points responsive to engagement with or disengagement from an engagement element (whether in the form of a pin 936, a lever 942, or other element). However, it will be appreciated by one having ordinary skill in the art that the control elements 912, 914 can be shaped in a number of different manners depending at least in part upon the desired location of the control elements 912, 914 in the latch assembly 910, the manner in which connections are made to the latch assembly 910, and the desired motion of the control elements 912, 914 when in their locked and unlocked states. For example, a portion of the upper control element 914 in the illustrated preferred embodiment is hook-shaped to avoid interference with the locking element pivot 944 and to permit connection to an external linking element at a desired location in the latch assembly 910. Either control element 912, 914 can be bar-shaped, curved, angled, have multiple bends,or be shaped in any other manner desired.

Also, both control elements 912, 914 in the illustrated preferred embodiment have purely rotational or substantially rotational motion when in their locked and unlocked states (i.e., fully disengaged and fully engaged with their respective engagement elements 942, 936). This type of motion is not required to practice the present invention. Instead, the motion of either control element 912, 914 in either of its locked or unlocked states can be non-rotational or can be a combination of rotation and translation while still performing the same functions as described above. For example, the upper control element 914 can be connected for substantially translational movement when not engaged by the pin 936, such as by being guided within one or more tracks, rails, or other elements when actuated. Alternatively, the upper control element 914 can both rotate and translate when disengaged from the pin 936.

Still other types of control element motion (when in a locked state or an unlocked state) are possible with the use of different engagement elements and/or different manners of control element engagement. For example, any of the above-described structures employing a pin in an aperture (including the pin and aperture engagement element arrangement for the upper control element 914) can be replaced by an aperture and a pin, respectively. Alternatively, engagement of any control element can be accomplished by one or more pins driven by one or more actuators into positions alongside the control element to limit or guide the control element in its movement when actuated, and can be retracted to establish different movement of the control element (or vice versa). As another example, the upper control element 914 could be releasably engagable by a lever to change lock states of the upper control element 914 in much the same way as the locking element 942 engages with the lower control element 912. The lower control element 912 could also pivot about or otherwise have its motion guided or limited by one or more retractable pins in much the same way as the pin 936 and aperture 938 of the upper control element 914 described above. These pin(s) could be extended within the lower control element 912 and/or into positions beside or adjacent to the lower control element 912 to control, guide, or limit motion of the lower control element 912. As will be described more fully below, other elements performing similar motion limiting or enabling functions can be employed as desired, including without limitation one or more magnet sets, walls, bumps, etc. at least partially defining a path in which a control element 912, 914 is movable when actuated. Such other engagement elements and the different types of motion they enable for the control elements 912, 914 will be appreciated by one having ordinary skill in the art and fall within the spirit and scope of the present invention.

Although the pin 948 of the upper control element 914 is preferably movable into contact with the pawl 926 when the upper control element 914 is actuated in its unlocked state, it will be appreciated that the pawl 926 can instead be provided with a pin extending through the aperture 950 in the housing 920 and received within an aperture in the upper control element 914 or positioned to be contacted by a surface of the upper control element 914 when actuated in its unlocked state. Similarly, although the pin 952 of the pawl 926 is preferably received within the aperture 951 of the lower control element 912, the lower control element 912 can be provided with a pin extending through the aperture 954 in the housing 920 and received within an aperture in the pawl 926 or positioned to contact the pawl 926 when the lower control element 912 is actuated in its unlocked state.

Alternatively, a peripheral surface of either control element 912, 914 can be used to transfer motive force from the control element 912, 914 when in its unlocked state to the pawl 926. For example, the pawl pin 952 can be pressed by a peripheral edge of the lower control element 912 when actuated in its unlocked state to move the pawl 926 out of engagement with the ratchet 916, or the upper control element 914 can be actuated in its unlocked state into contact with the pawl pin 952 to move the pawl 926 out of engagement with the ratchet 916. In the latter case, illustrated by way of example in FIG. 59, the upper control element pin 948 and housing aperture 950 can be eliminated. Specifically, when the upper control element 914 is in its unlocked state (e.g., engaged with the engagement pin 936), the upper control element 914 is actuatable to pass between the housing 920 and the lower control element 912 or to pass over the lower control element 912. As illustrated in FIGS. 48–59, the upper control element 914 preferably passes between the lower control element 912 and the housing 920 when the upper control element 914 is actuated in its unlocked state. When thus actuated, a bearing or camming surface 949 of the upper control element 914 preferably contacts and then pushes, cams, or otherwise exerts motive force upon the pawl pin 952 extending past the housing 920 and into the lower control element aperture 951. This alternative to extending the pin 948 of the upper control element 912 through an aperture 950 in the housing 920 as described above is more preferred because it eliminates the need for the aperture 950, thereby permitting that portion of the latch assembly between the housing 920 and the front cover (not shown) to be more fully enclosed. One having ordinary skill in the art will appreciate that still other elements can be used to transfer motion between a control element 912, 914 in its unlocked state and the pawl 926.

Each control element 912, 914 is preferably connected in a conventional manner to a respective linking element 958, 956 to permit external actuation of the control elements 912, 914. The linking elements 956, 958 take any form described above, such as the rods 956, 958 shown in the figures, and can be run through apertures in any location in the housing 920 as desired. The linking elements 958, 956 can be connected to the control elements 912, 914 in any conventional manner, such as by conventional fasteners, by pivotable joints, or in any manner described above.

Although the present invention can be employed in numerous applications with the linking elements 956, 958 running to and connected to any user-manipulatable device desired, the illustrated preferred embodiment is directed to application in a vehicle door in which the upper control element 914 corresponds to an inside door handle (not shown) and the lower control element 912 corresponds to an outside door handle (also not shown). Therefore, actuation of an inside door handle to actuate the upper control element 914 via the linking element 956 will generate release of the ratchet 916 if the upper control element 914 is in its unlocked state and will not generate release of the ratchet 916 if the upper control element 914 is in its locked state. The upper control element 914 preferably moves through a first path in its locked state in which ratchet release is not triggered and in a second path in its unlocked state in which ratchet release is triggered. Similarly, actuation of an outside door handle to actuate the lower control element 912 via the linking element 958 will generate release of the ratchet 916 if the lower control element 912 is in its unlocked state and will not generate release of the ratchet 916 if the lower control element 912 is in its locked state.

The fifth preferred embodiment of the present invention provides a number of advantages by virtue of its use of a member (e.g., locking element 942) movable into and out of contact against a surface of a control element (e.g., lower control element 912) to define the unlocked and locked states of the control element. In the illustrated preferred embodiment, the locking element 942 is a lever having a generally elongated shape and pivotable about the pivot 944. The locking element 942 preferably has an abutment portion 960 that contacts a bearing or camming surface 955 of the lower control element 912 when the locking element 942 is rotated to its unlocked position shown in FIGS. 56–58. This abutment portion 960 serves to limit motion of the lower control element 912 when the locking element 942 is in its unlocked position, thereby at least partially defining the manner in which the lower control element 912 can move. By moving the abutment portion 960 out of interference with the lower control element 912, the lower control element 912 is permitted to move in a different manner. Although not required, a portion of the locking element 942 extends a distance from its pivot 944 to provide a lever arm 962 that can be actuated to move the locking element 942 between its locked position shown in FIGS. 53–55 and its unlocked position shown in FIGS. 56–58. The lever arm 962 can be connected to a user-actuatable element or device (e.g., a button, lever, switch, and the like) for unlocking and locking the lower control element 912 to unlock and lock the outside door handle. Alternatively, the lever arm 962 can be connected to an actuator (not shown) internal or external to the latch assembly 910 and operable by the user or by a conventional controller to unlock and lock the lower control element 912. Regardless of the connected actuating device used, connection can be made to the lever arm 962 in any conventional manner, such as by a pin and aperture connection as employed in the illustrated preferred embodiment, by one or more conventional fasteners, and the like. The lever arm 962 can take any shape desired to permit connection of the locking element 942 to a linking element or actuator and to permit a range of motion needed for proper operation of the locking element 942. As with the shape of the entire locking element 942, the lever arm 962 can be straight, bent, angled, bowed, or take any other shape providing a connection point for actuation thereof and an abutment portion 960 for contact and engagement with the locking element 942.

The locking element 942 moves to engage the lower control element 912 to thereby place the lower control element 912 in its unlocked position (capable of triggering the pawl 926 upon its actuation). The illustrated preferred embodiment shown in FIGS. 48–58 provides one manner in which the locking element 942 can be moved to accomplish this function. Although pivotal movement in response to actuation of a lever arm 962 on the locking element 942 is one manner in which to engage the lower control element 912, one having ordinary skill in the art will appreciate that other locking element motion can perform the same function. For example, the locking element 942 can be mounted for translational or substantially translational movement in response to actuation thereof, or movement having translational and rotational components or stages. The locking element 942 can be positioned in the latch assembly 910 so that such movement brings the locking element 942 into and out of engagement with the lower control element 912. Other locking element movement (such as orbital, sliding, and the like) is possible to perform this same function.

Any of the types of locking element motion just described can be accomplished in a number of manners well known to those skilled in the art. By way of example only, the pivot 944 in the illustrated preferred embodiment can be replaced with or supplemented by one or more guidance surfaces, posts, walls, abutments, or stops (see, for example, walls 555, 559 in the third preferred embodiment of the present invention above) on the housing 920, cover plate (not shown), front cover (also not shown), or other latch assembly structure. Alternatively, the pivot 944 can be a pin, extension, elbow, or other protrusion of the locking element 942 pivotably received within an aperture in the housing 920. The locking element 942 can additionally or instead be movable through one or more tracks, rails, slides, or other elements in any conventional manner, such as via a pin and groove connection, a slidable carriage or one or more bearing sets in the track, rail, slide, or like element, etc. Such elements and devices for guiding, limiting, or otherwise controlling the path taken by the locking element 942 when actuated fall within the spirit and scope of the present invention.

Although the locking element 942 is preferably actuated by actuation of a lever arm 962 as shown in the figures, locking element actuation can be performed in a number of different manners well known to those skilled in the art. For example, where the pivot 944 is connected to the locking element 942 in any conventional manner for rotation therewith, a stepper motor or other conventional rotational positioning device can be connected to drive the pivot 944 and locking element 942 in different rotational positions. The locking element 942 can instead be driven by a rotating cam or lever brought into contact with the locking element 942 and capable of pushing the locking element 942 into its locked and unlocked positions. Alternatively, one or more electromagnet sets mounted adjacent to the locking element 942 (e.g., on the housing 920, pivot post 928, etc.) and upon the locking element 942 can be selectively energized to move the locking element 942 between its locked and unlocked positions. As another example, the locking element 942 can be provided with a set of gear teeth (e.g., on a surface thereof near the pivot 944, by a spur gear mounted on the pivot 944, etc.) meshed with a gear driven in any conventional manner to rotate the locking element 942 between its locked and unlocked positions. Still other manners of actuating the locking element 942 between these positions are possible and will be readily recognized by those skilled in the art.

Due at least in part to the different possible manners of driving the locking element 942, it should be noted that the shape and form of the locking element 942 can be significantly different from that shown in the figures. For example, certain manners of locking element actuation such as the alternative manners described above do not require a lever arm 962. As another example, the locking element 942 of the preferred embodiment shown in FIGS. 48–58 is shown adjacent to the lower and upper control elements 912, 914. In other possible arrangements of the latch assembly 910, the locking element 942 can be located a greater distance from the control elements 912, 914 and have an abutment portion 960 that is longer to interact with the control elements 912, 914. One having ordinary skill in the art will recognize that still other locking element shapes can be employed in the present invention as desired.

As described above, movement of the locking element 942 to its unlocked position shown in FIGS. 56–58 causes engagement of the locking element 942 with the lower control element 912, while movement of the locking element.942 to its locked position shown in FIGS. 53–55 causes disengagement of the locking element 942 from the lower control element 912. Therefore, the resulting unlocking and locking of the lower control element 912 and the outside door handle preferably connected thereto is determined by the position of the locking element 942. In highly preferred embodiments of the present invention, the locking element 942 is connected to an actuator in a conventional manner as described above for automatic movement of the locking element 942 responsive to latch control circuitry (e.g., passive entry electronic controls, a keypad or button and associated circuitry, and the like). However, the locking element 942 can instead or also be connected to an actuating element 964 that is manually actuatable by a user.

The actuating element 964 is preferably connected to a user-accessible device or element such as a lever, button, or handle. Where the user-accessible device or element is located on the outside of a vehicle such as in the preferred embodiment of FIGS. 48–58, the actuating element 964 is more preferably connected to a key-operated lock cylinder 966. The actuating element 964 can be connected directly to the lock cylinder 966 or can be connected to the lock cylinder 966 via a linking element (not shown) which is itself connected to the lock cylinder 966 and to the actuating element 964 in any conventional manner for transferring motion of the lock cylinder 966 to motion of the actuating element 964. Preferably, the actuating element 964 is mounted in a conventional manner for pivotal movement about a pivot 968. The pivot 968 is preferably attached to the housing 920 in any conventional manner and is received within an aperture in the actuating element 964. However, the actuating element 964 can be mounted for pivotal movement about the pivot 968 in any of the manners described above with reference to the locking element 942 mounted for pivotal movement about its pivot 944.

The actuating element 964 is connected to the locking element 942 to transmit actuation force from the user-operable actuating element 964 (e.g., the lock cylinder 966) to the locking element 942. In the preferred embodiment of the present invention shown in the figures, this connection is a pin 970 integral with or attached to the locking element 942 in any conventional manner and received within an aperture 972 in the actuating element 964. However, other connections permitting relative motion of the actuating element 964 and the locking element 942 can be used as desired. For example, a pin or other extension on the actuating element 964 can extend within an aperture in the locking element 942, one or more linking members or flexible members can be pivotably connected to the actuating element 964 at one end and to the locking element 942 at another, the pin 970 on the locking element 942 can be pushed or cammed against an exterior surface of the actuating element 964 (providing for actuation of the locking element 942 by the actuating element 964 in one direction and therefore with less functionality), and the like. Preferably, the aperture 972 in the pin and aperture connection between the locking element 942 and the actuating element 964 permits movement of the pin 970 in the aperture 972. The lost motion provided by such a connection permits movement of the locking element 942 without consequent movement of the actuating element 964. This is particularly useful in a number of applications such as in the illustrated preferred embodiment, where movement of the locking cylinder 966 in response to movement of the various elements in the latch assembly 920 is not desirable.

With reference to the illustrated preferred embodiment, when the actuating element 964 is actuated by movement of the lock cylinder 966, the actuating element 964 pivots about pivot 968. When actuated in one direction, the actuating element 964 preferably rotates the locking element 942 via the pin and aperture connection to its locked position shown in FIGS. 53–55, thereby moving the locking element 942 out of engagement with the lower control element 912 and placing the lower control element 912 in its locked state.

When actuated in an opposite direction, the actuating element 964 preferably rotates the locking element 942 via the pin and aperture connection to its unlocked position shown in FIGS. 56–58, thereby causing engagement of the locking element 942 with the lower control element 912 and placing the lower control element 912 in its unlocked state.

Like the locking element 942 described above, the actuating element 964 is preferably movable by rotation about a pivot, but can instead be moveable in a number of different manners still functioning to transfer motion from the user-operable input (e.g., locking cylinder 966) to the locking element 942 for placing the lower control element 912 in its locked and unlocked states. This motion of the actuating element 964 can be purely rotational, purely translational, or a combination thereof acting in series or concurrently or in a combination thereof. Any of the elements or structure described above with reference to locking element actuation can be used to guide, limit, or otherwise control the motion of the actuating element 964 when actuated. It should also be noted that it is even possible in some alternative embodiments of the present invention to connect the user-operable input 966 directly to the locking element 942, if desired, in which case the actuating element 964 is not needed in the latch assembly 910. Such a connection is limited at least in part by the location of the user-operable input 966 with respect to the latch assembly 910 and by the shape of the locking element 942.

In operation of the fifth preferred embodiment (described by way of example, with reference to the latch assembly 910 shown in FIGS. 48–58), the lower and upper control elements 912, 914 can be placed in their respective unlocked and locked states by engagement or disengagement with respect to the locking element 942 and engagement pin 936, respectively. In the preferred embodiment illustrated in the figures, the locked states for both control elements 912, 914 are shown in FIG. 53. Specifically, the engagement pin 936 is not engaged in the aperture 938 in the upper control element 914, and the locking element 942 is not moved to engage the abutment portion 960 with the lower control element 912. With reference to FIG. 54, actuation of the lower control element 912 (connected, for example, to an outside door handle of a vehicle) when in its locked state causes the lower control element 912 to rotate through a first path about the pin 952 of the pawl 926. This rotation preferably generates no movement of the pin 952 or pawl 926, or at least generates insufficient movement to disengage the pawl 926 from the ratchet 916 as described above. With reference to FIG. 55, actuation of the upper control element 914 (connected, for example, to an inside door handle of a vehicle) when in its locked state causes the upper control element 914 to rotate through a second path about the pin 948 of the upper control element 914. This rotation also preferably generates no movement of the pawl 926, or at least generates insufficient movement to disengage the pawl 926 from the ratchet 916 as described above. Specifically, the pin 948 extending from the upper control element 914 either pivots in place in the aperture 956 or travels therein without contacting the pawl 926 or without exerting sufficient force against the pawl 926 to trigger disengagement of the ratchet 916.

When the locking element 942 is moved through a path (preferably a rotational path) to engage the abutment portion 960 thereof with the lower control element 912 as shown in FIG. 56, the lower control element 912 is in its unlocked state. Actuation of the lower control element 912 when in this unlocked state causes the lower control element 912 to rotate through a third path about the pivot post 928 as discussed above. In particular, the abutment portion 960 of the locking element 942 preferably holds a portion of the lower control element 912 (e.g., an end as shown in the figures) in place so that the lower control element 912 pivots about the pivot post 928 rather than the pawl pin 952. As shown in FIG. 58, rotation of the lower control element 912 about the pivot post 928 moves the pawl pin 952 received in the aperture 951 of the lower control element 912, thereby moving the pawl 926 out of engagement with the ratchet 916 to release the ratchet 916.

When the engagement pin 936 is moved into the aperture 938 of the upper control element 914, the upper control element 914 is in its unlocked state. Actuation of the upper control element 914 when in this unlocked state causes the upper control element 914 to rotate through a fourth path about the engagement pin 936 as discussed above. As shown in FIG. 57, rotation of the upper control element 914 eventually brings the pin 948 on the upper control element 914 into pressing contact with the pawl 926 to move the pawl 926 and thereby to release the ratchet 916.

The control elements 912, 914 are preferably rotatable about different points when engaged with and disengaged from their respective control elements 942, 936. Preferably, these points at least partly define (and more preferably, substantially fully define) the paths taken by in the control elements 912, 914 in their engaged and disengaged states. Other control element motion is possible in various embodiments of the present invention, but the control elements 912, 914 preferably still pivot to some degree about pivot points 928, 936, 952, 970 as described above. In less preferred embodiments, the control elements 912, 914 do not pivot when actuated in their engaged and/or disengaged states, but instead move by orbiting, translating, or other motion. Regardless of the manner in which the control elements 912, 914 move when engaged with or disengaged from their respective engagement elements 942, 936 (such motion possibly being purely rotational, purely translational, or any combination of these types of motion), the engagement elements of the present invention at least partially define the manner in which the control elements move when engaged therewith. When the control elements 912, 914 are actuated, the paths taken by the control elements 912, 914 need not necessarily be defined solely by the engagement elements 942, 936, but can be the result of one or more other elements (e.g., latch assembly walls, surfaces, and the like) affecting the manner in which the control elements 912, 914 react to actuation forces.

As described above, the lower control element 912 is connected to an outside vehicle door handle in highly preferred embodiments of the present invention, and can be placed in its locked and unlocked positions by actuation of a manually-actuated user operable device (such as a lock cylinder 966 accessible from outside of the vehicle) coupled to the locking element 942 and by actuation of an actuator also coupled to the locking element 942 and preferably responsive to electrical controls as described above. Also in highly preferred embodiments, the upper control element 914 is connected to an inside vehicle door handle and can be placed in its locked and unlocked positions by actuation of a manually-actuated user operable device (such as a lever, switch, button, and the like) coupled to the engagement pin 936. As with earlier embodiments of the present invention, the locked and unlocked states of the two control elements 912, 914 define four states of the latch assembly 910. When the lower and upper control elements 912, 914 are in their engaged states with the locking element 942 and the engagement pin 936, respectively as shown in FIG. 56, the latch assembly 910 is in a fully unlocked mode. When the lower control element 912 is engaged with the locking element 942 as shown in FIG. 56 but the upper control element 914 is disengaged from the engagement pin 936, the latch assembly 910 is in a child locked mode. When the lower control element 912 is disengaged from the locking element 942 as shown in FIG. 53–55 but the upper control element 914 is engaged with the engagement pin 936, the latch assembly 910 is in a locked mode (openable by a user inside the vehicle but not by a user outside the vehicle). When both the lower and upper control elements 912, 914 are disengaged from the locking element 942 and engagement pin 936, respectively as shown in FIG. 53, the latch assembly 910 is in a deadlocked mode.

Although the engagement elements 942, 936 for the control elements 912, 914 are preferably driven manually or by an actuator as described above, it should be noted that either control element 912, 914 can be actuated manually or by an actuator, and can include any number of actuators and/or manual user-manipulatable devices, each of which can be located as desired with respect to the latch assembly 910. For example, both engagement elements 936, 942 can be connected exclusively to user-operable handles, levers, buttons, and other manual devices for changing the lock states of the control elements 912, 914. Alternatively, both engagement elements 936, 942 can be connected to respective actuators responsive to electrical controls or other actuation devices (including without limitation hydraulic, pneumatic, electromagnetic, and other devices as described above with reference to the other preferred embodiments of the present invention) for the same purpose.

As with earlier-described embodiments of the present invention, it may be desirable to change the locked state of one control element 912, 914 in response to actuation of another control element 914, 912. This operation can be performed in any of the manners described above. Another manner in which to perform this operation is provided by the fifth preferred embodiment of the present invention. Specifically, the locking element 942 can preferably be placed in its locked and unlocked positions with respect to the lower control element 912 by movement of the upper control element 914. Although this feature is not required to practice the present invention, it is particularly desirable in applications such as the vehicle door application described above. Where the upper control element 914 is in its unlocked state (pin 936 engaged therewith) and the lower control element 912 is in its locked state (disengaged from the locking element 942), actuation of the upper control element 914 by an inside door handle or other device preferably causes the locking element 942 to move to its unlocked position in engagement with the lower control element 912. Therefore, the outside door handle or other input to the lower control element 912 is unlocked by actuation of the inside door handle or other input to the upper control element 914.

To transfer movement of the upper control element 914 to the locking element 942, the pin 948 of the upper control element 914 preferably extends to a position in the path traveled by the locking element 942 when actuated. Movement of the upper control element 914 therefore causes the pin 948 to contact a surface of the locking element 942 and to move the locking element 942. Most preferably, movement of the upper control element 914 in one direction causes the pin 948 to move the locking element 942 to its locked position while movement of the upper control element 914 in an opposite direction causes the pin 948 to move the locking element 942 to its unlocked position. However, in less preferred embodiments, the pin 948 only contacts and moves the locking element 942 in one direction of upper control element movement (actuation of the upper control element 914 thereby only capable of moving the lower control element 912 to its locked state but not to its unlocked state or only capable of moving the lower control element 912 to its unlocked state but not to its locked state).

With reference again to the illustrated preferred embodiment, the pin 948 is preferably located between the abutment portion 960 and an extension 974 of the locking element 942, thereby transmitting motive force from the upper control element 914 to the locking element 942 in both rotational directions of the upper control element 914. Although the pin 948 can be received between two portions of the locking element 942 (as shown in the figures) for this purpose, it should be noted that many alternative connections between the pin 948 and the locking element 942 are possible. For example, the pin 948 can be received within an aperture in the locking element 942, can cam along one or more surfaces of the locking element 942 to transfer motive force thereto, and the like. Also, the pin 948 can be replaced by a number of other elements and structure for transmitting motive force to the locking element 942, including without imitation an extension, leg, boss, or other element on the upper control element 914 movable into contact with a surface on the locking element 942, or an aperture within which is received a pin, extension, leg, boss, or other element on the locking element 942. Alternatively, the upper control element 914 and the locking element 942 can be arranged in the latch assembly 910 so that an edge of the upper control element 914 contacts and cams, pushes, or rides against an edge of the locking element 942 to transmit motive force to the locking element 942. Still other structure and elements for transferring motive force between the upper control element 914 and the locking element 942 are possible and would be recognized by one skilled in the art. Any alternative embodiment can permit the transmission of motive force to the locking element 942 in only one direction of motion of the upper control element 914. More preferably however, motive force can be transmitted to the locking element 942 in both directions of motion of the upper control element 914 as described above.

Where a connection between the upper control element 914 and the locking element 942 is employed for transmitting motive force from the upper control element 914 to the locking element 942, force can also preferably be transmitted from the locking element 942 to the upper control element 914 to move the upper control element 914 into different positions corresponding to the locked and unlocked positions of the locking element 942. While such a relationship between the positions of the locking element 942 and the upper control element 914 is not required to practice the present invention, it is nevertheless preferred.

In the illustrated preferred embodiment of the latch assembly 910, actuation of the upper control element 914 preferably changes the position of the locking element 942 and its engaged state with respect to the lower control element 912. Elements and structure similar to that described above can instead or in addition be included in the latch assembly 910 to transfer actuation motion of the lower control element 912 to another locking element in order to engage or disengage the upper control element 914. Employing similar elements and structure, it is even possible to employ control elements each capable (when actuated) of generating engagement or disengagement of the another control element. In short, a connection between a control element and a locking element similar to that described above and illustrated in the figures can be employed for similar purposes with any control element in the latch assembly 910.

Although not required to practice the present invention, the use of the locking element 942 and the force-transmitting relationship between the upper control element 914 and the locking element 942 (e.g., via the upper control element pin 948 and the locking element 942 in the illustrated preferred embodiment) described above offers still other advantages over conventional latches. Unlike several other types of engagement elements, the locking element 942 is capable of engagement with its associated control element 912 in a range of control element positions. This capability is valuable regardless of which control element is engaged by the locking element 942, but is described herein and illustrated in the accompanying figures as being used to permit engagement of a control element 912 connected to an outside vehicle door handle.

In operation, when the locking element 942 is engaged with the lower control element 912 as shown in FIG. 56, the lower control element 912 is in its unlocked position. However, when the lower control element 912 has already been partially or fully actuated prior to actuation of the locking element 942, the locking element 942 is still capable of placing the lower control element 912 in its unlocked (engaged) state. The path of motion traveled by the locking element 942 when actuated to its unlocked state preferably brings the locking element 942 into contact with the lower control element 912 regardless of the position of the lower control element 912. Specifically, the abutment portion 960 of the locking element 942 can preferably be brought into contact with the lower control element 912 not just when the lower control element 912 is in its at rest or non-actuated position shown in FIG. 53, but also in at least one actuated position of the lower control element 912.

Preferably, the abutment portion 960 is brought into contact with the lower control element 912 in a range of lower control element positions when actuated in its locked state. More preferably, the abutment portion 960 is brought into contact with the lower control element 912 in any position of the lower control element 912 when actuated in its locked state. Upon contact with the lower control element 912 after partial or fully actuation in its locked state, further actuation of the locking element 942 preferably moves the lower control element 912 into an engaged position where the locking element 942 is engaged with the lower control element 912 (see FIGS. 56–58).

In other words, the lower control element 912 has an engaged state shown in FIGS. 56–58 in which the lower control element 912 moves through a first path when actuated. The first path is defined by rotation of the lower control element 912 about or substantially about the pivot post 928. In the engaged state, the lower control element 912 is pressed against the pivot post 928 by the abutment portion 960 of the locking element 942 in its unlocked position. The abutment portion 960 pressed against the lower control element 912 preferably defines a pivot axis of the lower control element 912 that is the same as the pivot axis of the pawl 926 (i.e., the pawl pivot 928) or that is near the pivot axis of the pawl 926. However, the lower control element 912 in less preferred embodiments can be pivotable about an axis disposed from the pawl pivot 928 when engaged by the abutment portion 960 of the locking element 942 while still permitting the transmission of force against the pawl pivot 952 by the lower control element 912 when thus engaged. Also, the control element 912 need not be pressed against the pawl pivot 928 when engaged, and can instead be pressed against a post, pin, wall, protrusion, or other latch structure adjacent to or disposed from the pawl pivot 928. When the locking element 942 is moved sufficiently from its unlocked position, the lower control element 912 moves through a second path when actuated. The second path is defined by rotation of the lower control element 912 about the pawl pin 952. In this disengaged state, the lower control element 912 may contact the locking element 942, but is incapable of transferring motive force or sufficient motive force to the pawl pin 952 to release the ratchet 916.

When the locking element 942 is actuated to its unlocked state, the lower control element 912 preferably can be in its rest or unactuated position shown in FIG. 53 or can be in at least one position in its second path of motion (partially or fully actuated). When partially or fully actuated in its second path of motion, the lower control element 912 is preferably contacted by the locking element 942 and is moved thereby to the lower control element's first path of motion. Preferably, the position to which the lower control element 912 is moved in its first path of motion is dependent upon the extent to which the lower control element 912 has already been actuated. For example, if only slightly actuated, the lower control element 912 is preferably moved to a position in the first path of motion in which the lower control element 912 must be further actuated to trigger disengagement of the pawl 926. If already fully actuated, the lower control element 912 is preferably moved to a position in the first path of motion in which the lower control element 912 triggers disengagement of the ratchet 916. One having ordinary skill in the art will appreciate that different arrangements and shapes of the lower control element 912 and locking element 942 can be employed to generate disengagement of the ratchet 916 when the lower control element 912 is moved from any actuated position (partially or fully) in the second path of motion, from only a fully actuated position in the second path of motion, or from only a desired range or number of partially actuated positions in the second path of motion.

When the locking element 942 is employed as just described on the preferred vehicle door application described above, the outside vehicle door handle can be partially or fully actuated by a user prior to actuation of the locking element 942 to its unlocked position (e.g., by an actuator connected to the lever arm 962 and triggered by remote keyless entry controls, by a key turned in the lock cylinder 966, and the like) without requiring the user to release and re-actuate the outside door handle. Preferably, if the outside door handle has already been partially actuated, the locking element 942 contacts and moves the lower control element 912 to its first path so that further actuation of the outside door handle generates release of the ratchet 916. Also preferably, if the outside door handle has already been fully actuated, the locking element 942 contacts and moves the lower control element 912 to a position; in its first path in which the pawl 926 is triggered to release the ratchet 916.

In the preferred embodiment of the latch assembly 910 described above and illustrated in FIGS. 48–58, the locking element 942 is movable into contact with the lower control element 912 and can thereby move the lower control element 912 into an engaged position in the lower control element's first path of motion. Preferably, this contact is a camming contact in which a cam or bearing surface 976 of the locking element 942 contacts and then pushes against a surface of the lower control element 912. However, many other types of force-transmitting contact between the locking element 942 and the lower control element 912 can be employed to achieve this same result, including without limitation rolling, sliding, pushing, pulling, camming, pressing, and other contact of the locking element 942 against the lower control element 912. The type of contact between the locking element 942 and the lower control element 912 can be against peripheral surfaces of the locking element 942 and the lower control element 912 (as shown in the figures) or can be between any other surfaces of these elements desired, such as between a pin on the locking element 942 contacting a peripheral surface of the lower control element 912, an interior surface of an elongated aperture in the locking element 942 within which is received a post or block on the lower control element 912 (preferably providing for lost motion of the lower control element 912 in the elongated aperture), and the like. Contact between these elements does not even have to exist to achieve the above-described results, such as where one or more magnet sets on the locking element 942 and the lower control element 912 are used to generate repelling magnetic force between these elements, where one or more elements are located between the locking element 942 and the lower control element 912 (and no direct physical contact exists between the locking element 942 and the lower control element 912), etc.

Figure 59:
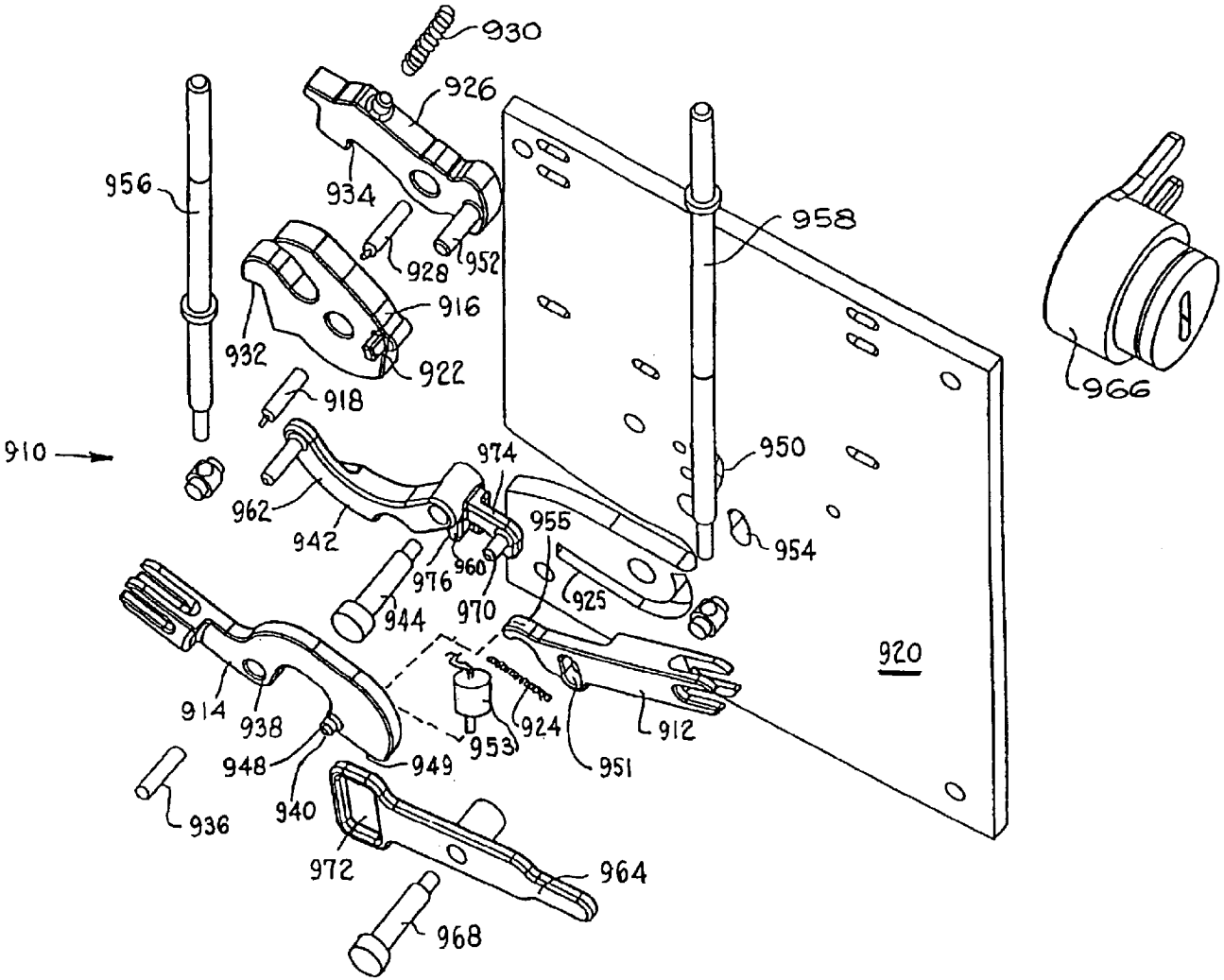
FIG. 59 is an exploded view of a latch mechanism according to a sixth preferred embodiment of the present invention, viewed from the front.

It may be desirable in certain applications to permit engagement of the lower control element 912 without employing the locking element 942. For example, engagement of the lower control element 912 without resulting actuation of the upper control element 914 and/or without actuation of the locking element 942 can be preferred in some applications. In the preferred embodiment of the present invention illustrated in FIGS. 48–58, actuation of the locking element 942 between its locked and unlocked states preferably generates movement of the upper control element 914 between its unactuated and partially actuated states, respectively, as described above. This relationship between the locking element 942 and the upper control element 914 can be severed by eliminating the pin 948 from the upper control element 914. However, some highly preferred embodiments of the present invention can retain this relationship while permitting engagement of the lower control element 912 in another manner. For example, FIG. 59 illustrates a latch assembly 910 substantially the same as the latch assembly shown in FIGS. 48–58 (with the exception of the camming surface 949 of the upper control element 914 triggering the pawl 926 rather than the pin 948 as described above), but which employs a second engagement element 953 for the lower control element 912. The second engagement element 953 is releasably engagable with the lower control element 912. This second engagement element can take a number of forms, but most preferably is an actuator 953 mounted in the latch assembly 910 to extend to and retract from the lower control element 912. Preferably, the actuator 953 is an electromagnetic actuator, but can take any of the forms described above with reference to the actuators of the earlier-described preferred embodiments, can be a lever movable (e.g., pivotable or slidable) into and out of engagement with the lower control element 912 in a manner similar to the locking element 942, etc. The actuator 953 can be connected in a conventional manner to a latch controller or to a user-manipulatable device such as a button, lever, handle, and the like.

Upon actuation, the actuator 953 preferably moves into contact with the bearing surface 955 of the lower control element 912 and thereby exerts force against the lower control element 912 to either hold the lower control element 912 in its unlocked state (as described above with reference to the abutment portion 960 of the locking element 942) or to move the lower control element 912 into its first path of motion if not already there. As with the relationship between the locking element 942 and the lower control element 912 described above, the actuator 953 is preferably positioned to push the lower control element 912, but can be positioned in the latch assembly 910 and/or can be connected to the locking element 942 to move the locking element 942 in any of the alternative manners also described above. Also preferably, the actuator 953 is preferably positioned with respect to the lower control element 912 so that the actuator 953 can contact and exert motive force to push the lower control element 912 into the first path from at least one position in the second path, and most preferably from any position in the second path.

Although not preferred, it should be noted that the actuator 953 can replace the locking element 942. In such a case, the actuator 953 is preferably connected to one or more inputs for actuation in a similar manner to actuation of the locking element 942. Without a connection between the actuator 953 and the upper control element 914 however, the above-described relationship between the upper control element 914 and the lower control element 914 (e.g., actuation of the upper control element 914 generating engagement of the lower control element 912) is lost. If this relationship is still desired, however, one or more motion or proximity sensors, mechanical trips, buttons, and the like can be directly or indirectly connected to the actuator 953 and positioned within the latch assembly 910 to detect actuation of the upper control element 914 and to trip the actuator 953 in response thereto. Such sensors and devices and their connection and operation are well known to those skilled in the art and are not therefore described further herein. If desired, the actuator 953 can also or instead be connected to the actuating element 964 in a similar manner to provide the ability of a user to change the state of the actuator 953 (and therefore of the lower control element 912). More preferably however, the actuator 953 is employed in conjunction with the locking element 942 described above.

By employing the actuator 953 for releasable engagement with the lower control element 912, the lower control element 912 can be moved to its first path (or held therein if already in its first path) without changing the state of the locking element 942 and without moving the upper control element 912 or the actuating element 964. In an alternative embodiment of the present invention, the locking element 942 is moved to its unlocked position only for a period of time to permit actuation of the lower control element 912 in its unlocked state (in the first path), after which time the locking element 942 is automatically returned to its locked state. As a result, the locking element 942 of the preferred embodiment illustrated in FIGS. 48–58 would preferably return the upper control element 914 and the actuating element 964 to their unactuated positions. Where a locking element actuator (not shown) is coupled to a latch controller for moving the locking element 942 between its unlocked and locked states as described above, the latch controller (conventional in fashion) can be programmed or otherwise configured to trigger the actuator to its unlocked position for a period of time after which the actuator returns the locking element 942 to its locked position. The amount of time the locking element 942 is in its unlocked position can be selected as desired. Still other manners of moving the locking element 942 briefly to its unlocked position are possible and would be recognized by one having ordinary skill in the art.

As mentioned above, any number of manual or actuator-driven inputs can be connected to the control elements 912, 914 and the locking element 942 to drive these elements into their respective positions. If desired, it is even possible to combine different input types into one latch input. For example, rather than have one input to the upper control element 914 for actuation thereof in its locked and unlocked states, this input can also be used to change the state of the lower control element 912 as discussed above. Therefore, the input is not only used for actuating the upper control element 914, but also for engaging and/or disengaging the lower control element 912 (i.e., changing the state of the lower control element 912). If actuated when disengaged from the pin 936, the upper control element 914 moves through a first path in which it is incapable of moving or sufficiently moving the pawl 926 to release the ratchet 916, while if actuated when engaged with the pin 936, the upper control element 914 preferably moves through a two-stage second path causing release of the ratchet 916. In the second path, a first stage of upper control element movement engages the locking element 942 with the lower control element 912 as described above. A second stage of upper control element movement (i.e., further actuation of the upper control element 914) in the second path preferably causes the upper control element 914 to move the pawl 926 and to release the ratchet 916. Therefore, one having ordinary skill in the art will appreciate that two functions can be performed by the same latch assembly input, if desired. As an alternative to a single upper control element input functioning as just described, the extension 974 and pin 948 connection between the upper control element 914 and the locking element 942 can be eliminated so that the only inputs capable of changing the state of the lower control element 912 are a linking element (not shown) connected to the lever arm 962 of the locking element 942 and the actuating element 964 connected to the lock cylinder 966.

To prevent undesirable motion of one control element 912, 914 as a result of actuation of another control element 914, 912 (such as during actuation of one control element 912, 914 in its unlocked state to generate release of the pawl 926), the control elements 912, 914 are preferably mounted in the latch assembly 910 having lost motion at least with respect to the pawl 926. For example, the pin 952 of the pawl 926 is preferably received within the elongated aperture 951 of the lower control element 912 so that motion of the pawl 926 by actuation of the upper control element 914 does not generate actuation of the lower control element 912. As another example, the pin 952 of the pawl 926 is preferably located a sufficient distance from the upper control element 914 so that motion of the pawl 926 by actuation of the lower control element 912 does not generate actuation of the upper control element 914. Still other conventional manners of providing lost motion for the lower and upper control elements 912, 914 are possible and fall within the spirit and scope of the present invention.

It should be noted that like the other embodiments of the present invention, the ratchet 916 need not be releasably engagable with a pawl 926 for the latch assembly 910 to function as described. Specifically, the control elements 912, 914 can releasably engage the ratchet 916 directly, such as by a surface, aperture, notch, or other portion of the ratchet 916. Employing operational principles similar to those described above, the control elements 912, 914 would preferably move in one manner when engaged with their respective engagement elements 942, 936 (in which control element engagement with the ratchet 916 is released) and in another manner when not thus engaged (in which control element engagement with the ratchet 916 is maintained).

Also, the engaged states of the control elements 912, 914 need not necessarily correspond to the pawl-releasing paths of the control elements 912, 914 when actuated as described above and illustrated in the figures. One having ordinary skill in the art will recognize that the control elements 912, 914 can be shaped and/or arranged in the latch assembly 910 so that movement of either or both control elements 912, 914 when engaged with their respective engagement elements 942, 936 triggers release of the ratchet 916 while movement of either or both control elements 912, 914 when disengaged therefrom does not trigger such release. As with the other embodiments of the present invention, the control elements 912, 914 move through a first path when engaged with their engagement elements 942, 936 and through a different path when not so engaged. The path generating ratchet release can be selected as desired.

The fifth preferred embodiment of the present invention offers the same advantages described above with reference to the other preferred embodiments, including without limitation the advantages of arranging the latch assembly 910 in layers (the ratchet 916 and pawl 926 in one layer, the control elements 912, 914 and linking elements 958, 956 in another layer, and engagement elements 936, 942 at least partially located in yet another layer), latch modularity and ease of adaptation to different applications, latch speed, weight, and complexity, and the like.

As used herein and in the appended claims, movement of an element in or through a "path" does not necessarily mean that the element is moved completely through the entire path available to it, but just that the element is moved some distance along the path available to it.

The preferred embodiments of the latch assembly according to the present invention demonstrate the application flexibility of the present invention. For example, the latch assemblies described above and illustrated in the figures can be quickly adapted for use in a number of different applications. For a more universal latch assembly, multiple ports can be located in different locations around the sides of the housing and/or front cover. An installer can therefore run any desired linking element (preferably bowden cables or rods) from outside the latch assembly to the control elements inside from a number of different angles with respect to the latch assembly. Such a latch assembly can be immediately installed into a large number of applications in which linking elements are run from different locations with limited space for re-routing such linking elements.

Similarly, either or both control elements can be modified to extend past the housing or front cover out of a suitably sized aperture. For example, although both control elements 252, 253 in the second preferred embodiment described above and illustrated in the drawings are located inside the housing 216 and are connected internally to cables running inside the housing 216, the ends 262, 274, 264, 276 of either or both of these control elements 252, 253 can be lengthened to extend outside of the housing 216 via housing apertures in the side of the housing 216 (much in the same way as the right control element 52 extends outside of the housing 16 in the first preferred embodiment) for connecting linking elements thereto. For this purpose, alternative embodiments of the present invention can have housing apertures in a number of locations around the housing to permit a user to use exteriorly-connected control elements when desired.

It may also be desirable to connect the cables in the second preferred embodiment of the present invention to the opposite ends of the control elements, either inside or outside of the housing 216. Alternative embodiments of the present invention provide for ports and housing slots on both sides of the housing so that control elements can be selected for linkage on either side of the housing—externally or internally. It is even possible to employ control elements which can be installed in one fashion (e.g., face up in the housing) to extend the ends out of one side of the latch assembly or adjacent ports on one side of the latch assembly, and in another on fashion (e.g., face down in the housing) to extend the ends out of an opposite side of the latch assembly or adjacent ports on the opposite side of the latch assembly for connecting linking elements thereto. In short, the present invention can be applied to create a universal latch assembly having multiple ports and multiple housing apertures so that different control elements having different lengths can be installed in a number of different orientations for connection either inside or outside the latch assembly. This flexibility also permits connection to a wide variety of linking elements, such as cables, rods, chain, and the like connecting the control elements with user-operable devices to actuate the control elements. Although in some embodiments multiple control elements types (i.e., having different shapes and lengths) would be needed to enable latch installation in a wide range of applications, other elements of the latch assembly require no modification. As such, only different control elements are needed rather than different latch assemblies.

Another important advantage of the present invention is the modularity of the latch assemblies disclosed. A latch assembly according to the present invention can be manufactured to house a number of control elements in a number of different control element positions, as well as the actuators, pins, and other elements associated with each control element. The control element positions can be, for example, right and left positions for right and left control elements as in the first preferred embodiment described above, upper and lower positions for upper and lower control elements as also described above, etc. Therefore, an assembler can include any desired number of control elements placed in any of the locations in the latch assembly to define a number of different latch assembly configurations. The linking elements (i.e., the cables, rods, and the like) can be connected to the control elements in the positions for actuation thereof as needed. For example, in the second preferred embodiment of the present invention described above, both cables running through ports can be connected to the upper control element 252 for actuation thereof Actuation of the upper pin 266 by the actuator 268 would therefore lock and unlock the inside and outside door handles in the preferred car door application. In this example, the lower control element 253 and associated hardware would not be needed and would not be installed. If,however, full functionality of the door were desired in another application, the assembler would install and connect the lower control element 252.

The latch assembly of the present invention therefore has multiple operational modes which are determined at least in part by the number of control elements installed in positions in the latch assembly and the manner in which the control elements are connected for actuation to external inputs (such as handles) by linking or "input" elements (such as bowden cables or connecting rods). The latch assembly can be quickly and easily built for a number of different applications by installing and connecting only the elements required for the latch functionality desired. The same general latch structure can preferably be used regardless of the degree of functionality in any particular application (e.g., one mode in which two handles are locked or unlocked together via connection to one control element, another mode in which the two handles can be locked independently of one another by being connected to respective control elements, yet another mode in which two handles connected to the same control element are locked and unlocked together while a third handle connected to another control element is locked or unlocked independently, etc.). The number of control element positions, ports, and housing apertures are preferably selected to facilitate latch installation in an optimal number of different applications.

To further increase the installation flexibility of the present invention, highly preferred embodiments permit connection of linking elements such as bowden cables, rods, and the like directly to the pawl. With reference to FIGS. 24–29 of the second preferred embodiment for example, the pawl 254 can have a pawl groove, slot, aperture, or other aperture for connection of a linking element thereto in much the same manner as the linkage ends 262, 274 of the control elements 252, 253 are connectable to linking elements. Like the control elements 252, 253, other connection manners for connecting the pawl 254 to a linking element are well-known to those skilled in the art and are therefore not described further herein. Most preferably, the linking elements connected to the control elements 252, 253 are interchangeably connectable to the pawl 254. By enabling linking element connection directly to the pawl 254 and by permitting fully interchangeable connection between the pawl 254 the upper control elements 252, and the lower control element 253, the user can install the latch assembly 210 in any number of different ways. For example, the user can connect both bowden cables from the ports 98, 99 to respective upper and lower control elements 252, 253 as described above, both bowden cables in a reversed manner to the lower and upper control elements 253, 252, both bowden cables to the upper control element 252 alone, both to the lower control element 253 alone, one to the upper control element 252 and one to the pawl 254, one to the lower control element 253 and one to the pawl 254, both directly to the pawl 254, etc. Each such connection results in a differently functioning latch assembly, any one of which may be desired in a particular application. Where more than two control elements exist in a latch assembly, still further connection possibilities and latch functionality results. The universal nature of connection to the control elements and the pawl of the present invention creates a latch assembly which is highly flexible and adaptable to a large number of applications without significant latch assembly change.

The latch assemblies of the present invention also provide an important advantage over conventional latch assemblies insofar as assembly speed and ease is concerned. Unlike conventional latch assemblies which require a user to flip and rotate the latch assembly in a number of different orientations during the assembly process, the latch assemblies of the present invention are designed to avoid the need for latch movement during assembly. The latch assembly of the present invention has a layered assembly structure in which elements are placed and installed in the latch assembly in layers. In other words, elements of the latch assembly are substantially located in the latch assembly in a number of planes passing through the latch assembly. With reference to the first and second preferred embodiments of the present invention, for example, each latch assembly disclosed has a layer in which the pawl 54, 254, ratchet 22, 222, lower pivot post 30, 230, and upper pivot post 34, 234 are installed and located on rear mounting plate 14, 214. After the installation of the pawl 54, 254 and ratchet 22, 222, the remaining assembly of the latch assembly can be performed from one side of the latch assembly 10, 210 (thereby avoiding the need to repeatedly turn over the latch assembly when installing elements). The assembler can install the control elements 52, 53, 252, 253 by placing them in their desired locations (via the torsion springs 308, 309, 310, 311 in the case of the second preferred embodiment), and connecting them by a control element spring 92 if needed. In this same second layer of elements, the assembler can connect the linking elements to the control elements 52, 53, 252, 253 and/or to the pawl 54, 254 which straddles the first and second layers of elements. In a third layer of elements, the assembler can install the control plate 82, 282, pin plates 104, 106, pins 66, 86, 266, 286 (which are extendable into the second layer of elements), actuators 68, 88, 268, 288, and front cover 12, 212. The ability of an assembler to position and install the large number of elements in the second and third layers mentioned above without access from behind the housing 216 results in a much faster assembly time and a much more easily assembled latch. The overall cost of the latch assembly 10, 210 and of latch maintenance and repair is therefore lowered significantly. Of course, changes to the exact locations of one or more elements in the latch assembly are possible without departing from the advantages of the layered assembly in the present invention.

Another preferred feature of the present invention relates to smooth operation of the latch assembly. Specifically, a number of embodiments described above enable more than one cable, rod, or other such linking device to be coupled to the same element for independent actuation thereof. For example, cables run through both ports 98, 99 in the second preferred embodiment can be attached to the same control element 252, 253 or even to the pawl 254. To prevent reaction of one cable (or rod or other such device employed) from reacting to the actuation of the other cable in such cases, the grooves 294, 296, 354 are preferably sufficiently wide to permit the non-actuated cable to remain substantially stationary. In other words, the connected element preferably provides for an amount of lost motion between the cables, rods, or other such devices connected thereto. With reference to the second preferred embodiment of the present invention described above, it should also be noted that the cable 326 (or rod or other such device employed) connected to the bell crank 324 is preferably received in an aperture 336 that is elongated to provide an amount of lost motion for the cable 326. Therefore, when the bell crank 324 is moved by camming action between a ramped portion of a control element 252, 253 or pawl 254 and the bell crank 324 as described above, the bell crank 324 does not actuate the cable 326 or any user-operable device such as a handle connected thereto.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, although the present invention can be employed with excellent results in vehicle doors, the present invention can be used in any application where one body is releasably latched to another body via a movable element (e.g., a ratchet) having a latched state and an unlatched state controlled by interference caused directly or indirectly by one or more control elements. Such applications can be in non-vehicle environments and can be virtually any size (e.g., from large canal door latches to miniature device latches). The moveable element need not necessarily be a ratchet or even rotate about a pivot point, but at least is selectively held in latched and unlatched states by either a pawl or like device or directly by a control element.

In light of the above, it should be noted that the particular device used to capture the striker 20, 220 or other element captured by the latch assembly 10, 210 can be significantly different than that described above and illustrated in the drawings. Though important to operation of the latch assembly, other elements and mechanisms beside a pivotable ratchet and spring arrangement can be used to interact either with the pawl or directly with the control element(s) if a pawl is not used. One skilled in the art will recognize that it is possible to eliminate the pawl in alternative embodiments of the present invention and to design the control element(s) to ride upon and limit the rotation of the ratchet in much the same way as the pawl. In such alternative embodiments, the inventive principles herein are still employed: moving a control element in one manner when engaged by an engagement element (e.g., a pin controlled by a solenoid) and in another manner when disengaged. In one manner, the control element moves to directly or indirectly release the ratchet and in another manner, movement of the control element does not directly or indirectly release the ratchet. Where a pawl is employed, sole rotational movement of the pawl is not a requirement. For example, the pawl can be shifted or translated against spring force in one direction when the control elements act upon the pawl in their unlocked states and be unaffected when the control elements are in their locked states. Even a combined translation and rotation of the pawl is possible when actuated by the control elements. Also, it should be noted that multiple pawls can be used, if desired, to interact with different stop surfaces of the ratchet in more complex latch assemblies.

In addition to the variations and alternatives just discussed, the control elements can also be significantly different than described above and illustrated in the figures. For example, the right and left control elements 52, 53 of the first preferred embodiment are disclosed herein as being generally straight and generally L-shaped, respectively. However, it is possible that both elements can be made identical (and placed on top of one another with their linkage ends 62, 74 adjacent to one another, placed in a similar orientation to that shown in the figures, etc.). Also, the control elements can be virtually any shape, as long as the control elements move in a first manner to directly or indirectly release the ratchet as described above and to not do so when moving in a second manner, the manners of movement being controlled by engagement with the pins.

As described above and illustrated in the figures, the control elements are preferably selectively engaged for rotation about pivot points A and B, respectively, by pins. The pins are controlled by the actuators to be inserted into and retracted from the apertures in the control elements. This relationship is only one of a number of different engagement relationships possible in the present invention. Specifically, the pins are only one type of engagement element performing the function of controlling the movement of the control elements in a particular manner when engaged (e.g., by allowing only rotation of the control elements about pivot points A and B). The present invention resides not in the particular type or shape of engagement element, but in the control of the control elements when the pins are in their engaged states. Therefore, one having ordinary skill in the art will recognize that the location of the pins and the apertures can be reversed, with pins in the control elements fitting into apertures in the plates or actuators.

Engagement of the control elements by the actuators can also be performed for example, by bumps in the control elements fitting into dimples in the pin plates or actuators (or vice versa), by one or more teeth in the control elements and in the pin plates or actuators meshing together when engaged, by a magnetic or electromagnetic connection established between the pin plates or actuators and the control elements, etc.

An example of using magnetic force to hold a control element in place has been described above with reference to the actuator 800 and the fourth preferred latch assembly 610 of the present invention. In that example, magnetic force is exerted upon an element (holding element 808) connected to the element to be controlled (e.g., a control element). This magnetic force restrains the holding element 808 from moving until the armature 806 of the actuator 800 is engaged with the holding element 808 or element to be controlled. The magnetic force can be maintained after such engagement, but is more preferably only maintained until the armature 806 is engaged. One having ordinary skill in the art will appreciate that magnetic force can be used in other manners to engage and disengage the control elements for a first type of movement when engaged and a second type of movement (or no movement) when disengaged. For example, any or all of the actuators of the preferred latch embodiments can be replaced by electromagnets, coils, or other conventional elements capable of producing a magnetic force. To be responsive to such magnetic force, the control elements can have one or more magnets directly or indirectly connected thereto or embedded therein. Therefore, by controlling the electromagnets, coils, or like device, the control elements can respond to move in one manner when "engaged" by the magnetic force and in another manner when not so "engaged", or vice versa. Alternatively, the control elements can respond via a first magnet thereon or therein to move in one manner when one electromagnet, coil, or like device is energized and can respond via another magnet thereon or therein to move in another manner when another electromagnet, coil, or like device is instead or additionally energized.

The controllable magnetic force used to engage and disengage a control element can do so in many different manners, many of which do not require a pin or armature to generate engagement or, more generally, any engagement via physical contact between the engaging and engaged elements. Examples include without limitation attracting or repelling the control element into different tracks, rails, or other guidance surfaces, permitting rotation about a magnetically engaged portion of the control element and permitting other movement when disengaged, magnetically defining magnetic "walls" of repelling force that guide the magnetically-responsive control element in a path of motion that is different from the control element path taken when the magnets are de-energized, and the like.

In light of the above, it should be noted that the engagement element of the present invention described herein and claimed in the appended claims need not necessarily be an armature of a solenoid, but can be any part of an element used to engage and disengage the control elements for changing their states of movement, such as a holding element or a magnet as described above.

All such alternatives to the pin and aperture arrangement in the preferred embodiment of the present invention share the inventive principle of using an actuator to engage the control elements for controlling their movement as described above. It should be noted that the particular location of the pins, teeth, bumps, or other engagement elements need not necessarily be between the actuators and the control elements. Instead, the engagement elements can be located between the control elements and the housing, if desired. For example, the pins, teeth, bumps, or magnets can be located on the housing normally disengaged from the control elements when the actuators are in their retracted positions. When the actuators are extended, they can push the control elements into engagement with the pins, teeth, bumps, or magnets on the housing to thereby engage the control elements for a particular motion (as the pins in the preferred embodiments described above do).

The latch assembly of the present invention as disclosed herein employs an engagement element or elements such as pins, teeth, bumps, or magnets engaging with an element or elements such as apertures, teeth, dimples or magnets in the control elements (or vice versa). However, one having ordinary skill in the art will recognize that the engagement elements need not interact by inserting one engagement element into another (such as a pin into an aperture in the control elements). Instead, the engagement elements can simply be actuated to provide guidance surfaces to control the movement of the control elements when actuated. Therefore, one element brought into "engagement" or taken out of "engagement" with another element is not limited to one element being inserted into and released from another, but instead indicates that movement of the element being engaged is at least partially changed due to the change in state of the engagement element (e.g., between extended and retracted states, energized or de-energized states, and the like). For example, in the case of the pin and aperture arrangement of the preferred embodiments, the pins need not be inserted into apertures in the control elements. Instead, the pins can be inserted alongside the control elements so that when the control elements are actuated by a user, the pins guide the control elements along a particular path that is different than that taken by the control elements when the pins are retracted.

The control elements need not therefore be limited for solely rotational movement (such as in the preferred embodiments of the present invention) in either state. In fact, movement of the control elements in the extended and retracted states of the pins can be purely translational or be a combination of rotation and translation. A broad aspect of the present invention resides not necessarily in the specific rotation, translation, or combined rotation and translation of the control elements in either their locked or unlocked states, but rather in a path of control element motion imparting movement to the pawl (if used) in one actuator state and a path of control element motion not imparting such movement in a second actuator state. Because the two paths of motion are determined by the placement of the pins and the shape of the control elements, the path imparting motion and the path not imparting motion need not correspond to the extended and retracted positions of the pins. The path imparting motion and the path not imparting motion can correspond instead to the retracted and extended positions of the pins as desired.

In addition to the manual override device embodiments described above with regard to the second preferred embodiment of the present invention, still other manual override devices can be used. The manual override device can be coupled to at least one of the control element, the pawl, and the actuator. As described above, the manual override operates to change the states or modes of the latch assembly in a supplemental manner to the manners previously described. The manual override can include a wide variety of manually actuated mechanical or electronic devices, but preferably includes a lock or a lock plunger. It will be apparent to one of ordinary skill in the art that the coupling of the manual override to the latch assembly will vary depending upon the particular manual override selected. For example, where the manual override comprises a cylinder lock, any of the previously described linking elements can be used satisfactorily to couple the manual override to the latch assembly. In one highly preferred embodiment, the cylinder lock includes a projection for driving a mechanical linkage that is connected directly to the engagement elements of the latch assembly, such as to the linkage end of the right control element or upper control element. Alternatively, an electronic manual override such as an electronic lock can be electronically coupled to an electronic actuator, or can be used to actuate a mechanical element or linkage.

Figure 16:
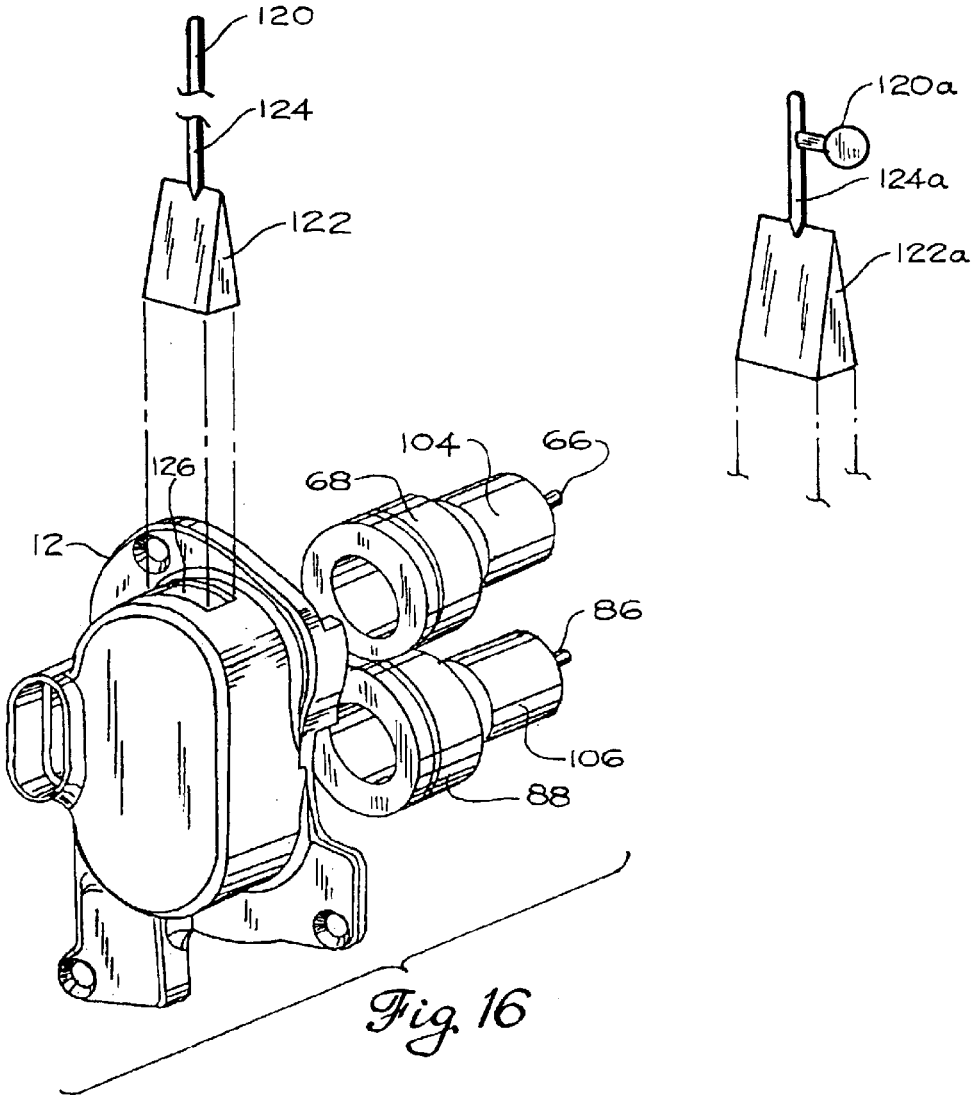
FIG. 16 is a exploded perspective view of a portion of the latch assembly with a manual override according to a preferred embodiment of the present invention.

Two manual override assemblies are illustrated by way of example in FIG. 16, and are shown installed on a latch assembly according to the first preferred embodiment of the present invention. However, it should be noted that the same manual override assemblies can be installed and employed on any of the latch assembly embodiments described above and illustrated in the figures. On the left in FIG. 16 is a conventional user-activated lock pin 120 accessible from within the vehicle and used to manually override the latch assembly 10. The lock pin 120 can be connected to a wedge shaped element 122 inserted within the latch assembly 10 as shown by the dashed lines. Specifically, a rod 124 or other conventional linking member can extend from the lock pin 120, into an aperture 126 in the cover 12, and to the wedge shaped element 122. As such, lifting the lock pin 120 will move the wedge shaped element 122 in an upward direction as viewed in FIG. 16, thereby causing the wedge shaped element 122 to act upon the pin 66 to push it into its unlocked state (note that the rear end of the pin 66 preferably extends through and past the actuator 68 when in its fully retracted position). Depressing the lock pin 120 will permit the pin 66 to retract, when actuated, to place the pin 66 in its locked state again.

Another type of manual override is also shown by way of example in FIG. 16. Where, as preferred, the manual override is operated by a cylinder lock 120*a*, the cylinder lock 120*a* can be connected to a wedge shaped element 122*a* inserted in the latch assembly 10. Like the manual override 120, 122, 124 described above, a rod 124*a* or other conventional linking member can a extend from the cylinder lock 120*a* into the aperture 126 in the cover 12, and to the wedge shaped element 122*a*. When the cylinder lock 120*a* is turned by an authorized user, the rod 124*a* and the wedge shaped element 122*a* act in a similar manner as described above to place the pin 66 in its locked and unlocked states. The manual overrides illustrated in FIG. 16 are shown only by way of example. One skilled in the art will recognize that many other manual override devices and systems can instead be used to achieve the same result. Also, a manual override can be coupled to both pins 66, 86, 266, 286 or just to the lower pin 86, 286. Multiple manual override devices can also be used, if desired, to operate the same pin. It will be apparent to one of ordinary skill in the art that still other manual overrides can be used without departing from the present invention.

We claim:

1. A latch assembly, comprising:

a ratchet having a latched position and an unlatched position;

a control element pivotable about a first point to at least partially define a first path of motion generating release of the ratchet to the unlatched position and pivotable about a second point to at least partially define a second path of motion between an unactuated at rest position and an actuated position not generating release of the ratchet to the unlatched position;

a locking element having a locked position and an unlocked position; and an actuator coupled to the locking element, actuation of the locking element to its unlocked position when the control element is actuated from the unactuated at rest position in its second path generating movement of the control element from its second path to its first path, the ratchet releasable from the latched position to the unlatched position responsive to actuation of the locking element to its unlocked position during at least partial actuation of the control element from the unactuated at rest position.

2. The latch assembly as claimed in claim 1, further comprising a pawl releasably engagable with the ratchet, the pawl releasable by the control element in its first path of motion.

3. The latch assembly as claimed in claim 2, wherein the control element is pivotable about a pivot point in its first path of motion to trigger release of the pawl.

4. The latch assembly as claimed in claim 1, wherein the control element is pivotable about a first point at least partially defining the first path and about a second point at least partially defining the second path.

5. The latch assembly as claimed in claim 1, wherein the locking element is mounted for pivotal movement between the locked and unlocked positions.

6. The latch assembly as claimed in claim 5, wherein the locking element is in contact with the control element in the unlocked position to at least partially limit the control element to its first path, and wherein the locking element is substantially free from contact with the control element in the locked position to permit control element movement in the second path.

7. The latch assembly as claimed in claim 5, wherein the control element has a surface against which the locking element is pressed when in the unlocked position.

8. The latch assembly as claimed in claim 1, further comprising a user-manipulatable actuating element coupled to the locking element for user control of locking element position.

9. The latch assembly as claimed in claim 8, wherein the user-manipulatable actuating element is a lock cylinder.

10. The latch assembly as claimed in claim 1, wherein the control element is a first control element, the latch assembly further comprising a second control element movable through a third path, the locking element movable to at least one of the locked and unlocked positions by the second control element in the third path.

11. The latch assembly as claimed in claim 10, further comprising a pawl releasably engagable with the ratchet, the second control element movable through the third path to trigger ratchet release via movement of the pawl.

12. The latch assembly as claimed in claim 1, wherein the control element is a first control element, the latch assembly further comprising:

a pawl releasably engagable with the ratchet; and a second control element pivotably mounted for movement through a third path, the second control element movable against the pawl in the third path to move the pawl and disengage the ratchet.

13. The latch assembly as claimed in claim 12, wherein the second control element is also movable against the locking element in the third path to change the position of the locking element.

14. The latch assembly as claimed in claim 1, further comprising a linking element coupled to the control element for user manipulation of the control element.

* * * * *